US009404346B2

(12) United States Patent
Gray et al.

(10) Patent No.: US 9,404,346 B2
(45) **Date of Patent: *Aug. 2, 2016**

(54) LATCH POSITION INDICATOR SYSTEM AND METHOD

(71) Applicant: Weatherford Technology Holdings, LLC, Houston, TX (US)

(72) Inventors: Kevin L. Gray, Houston, TX (US); Thomas F. Bailey, Abilene, TX (US); James W. Chambers, Hackett, AR (US); Jonathan P. Sokol, Houston, TX (US); Nicky A. White, Poteau, OK (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/477,515

(22) Filed: Sep. 4, 2014

(65) Prior Publication Data

US 2014/0367114 A1 Dec. 18, 2014

Related U.S. Application Data

(63) Continuation of application No. 12/322,860, filed on Feb. 6, 2009, now Pat. No. 8,826,988, which is a continuation-in-part of application No. 10/995,980, filed on Nov. 23, 2004, now Pat. No. 7,487,837, and a (Continued)

(51) Int. Cl.

| | |
|---|---|
| ***E21B 43/013*** | (2006.01) |
| ***E21B 47/00*** | (2012.01) |
| ***E21B 23/04*** | (2006.01) |

(Continued)

(52) U.S. Cl.

CPC ..... *E21B 43/013* (2013.01); *E21B 23/04* (2013.01); *E21B 33/085* (2013.01); *E21B 34/045* (2013.01); *E21B 47/0001* (2013.01); *E21B 47/09* (2013.01)

(58) Field of Classification Search

CPC ..... E21B 23/04; E21B 33/085; E21B 34/045; E21B 43/013; E21B 47/0001; E21B 47/09

See application file for complete search history.

(56) References Cited

U.S. PATENT DOCUMENTS

| | | | |
|---|---|---|---|
| 517,509 | A | 4/1894 | Williams |
| 1,157,644 | A | 10/1915 | London |

(Continued)

FOREIGN PATENT DOCUMENTS

| | | | |
|---|---|---|---|
| AU | 199927822 | B2 | 9/1999 |
| AU | 200028183 | A1 | 9/2000 |

(Continued)

OTHER PUBLICATIONS

US 6,708,780, 3/2004, Bourgoyne et al. (withdrawn).

(Continued)

*Primary Examiner* — James G Sayre

(74) *Attorney, Agent, or Firm* — Smith IP Services, P.C.

(57) ABSTRACT

Latch position indicator systems remotely determine whether a latch assembly is latched or unlatched. The latch assembly may be a single latch assembly or a dual latch assembly. An oilfield device may be positioned with the latch assembly. Non-contact (position), contact (on/off and/or position) and hydraulic (flowmeter), both direct and indirect, embodiments include fluid measurement systems, an electrical switch system, a mechanical valve system, and proximity sensor systems.

30 Claims, 64 Drawing Sheets

Related U.S. Application Data continuation-in-part of application No. 11/366,078, filed on Mar. 2, 2006, now Pat. No. 7,836,946, which is a continuation-in-part of application No. 10/995,980, filed on Nov. 23, 2004, now Pat. No. 7,487,837.

(51) Int. Cl.

| | |
|---|---|
| ***E21B 33/08*** | (2006.01) |
| ***E21B 34/04*** | (2006.01) |
| ***E21B 47/09*** | (2012.01) |

(56) References Cited

U.S. PATENT DOCUMENTS

| | | | | |
|---|---|---|---|---|
| 1,472,952 | A | | 11/1923 | Anderson |
| 1,503,476 | A | | 8/1924 | Childs et al. |
| 1,528,560 | A | | 3/1925 | Myers et al. |
| 1,546,467 | A | | 7/1925 | Bennett |
| 1,560,763 | A | | 11/1925 | Collins |
| 1,700,894 | A | | 2/1929 | Joyce et al. |
| 1,708,316 | A | | 4/1929 | MacClatchie |
| 1,769,921 | A | | 7/1930 | Hansen |
| 1,776,797 | A | | 9/1930 | Sheldon |
| 1,813,402 | A | | 7/1931 | Hewitt |
| 1,831,956 | A | | 11/1931 | Harrington |
| 1,836,470 | A | | 12/1931 | Humason et al. |
| 1,902,906 | A | | 3/1933 | Seamark |
| 1,942,366 | A | | 1/1934 | Seamark |
| 2,036,537 | A | | 4/1936 | Otis |
| 2,038,140 | A | | 4/1936 | Stone |
| 2,071,197 | A | | 2/1937 | Burns et al. |
| 2,124,015 | A | | 7/1938 | Stone et al. |
| 2,126,007 | A | | 8/1938 | Gulberson et al. |
| 2,144,682 | A | | 1/1939 | MacClatchie |
| 2,148,844 | A | | 2/1939 | Stone et al. |
| 2,163,813 | A | | 6/1939 | Stone et al. |
| 2,165,410 | A | | 7/1939 | Penick et al. |
| 2,170,915 | A | | 8/1939 | Schweitzer |
| 2,170,916 | A | | 8/1939 | Schweitzer et al. |
| 2,175,648 | A | | 10/1939 | Roach |
| 2,176,355 | A | | 10/1939 | Otis |
| 2,222,082 | A | | 1/1940 | Young |
| 2,199,735 | A | | 5/1940 | Beckman |
| 2,211,122 | A | | 8/1940 | Howard |
| 2,233,041 | A | | 2/1941 | Alley |
| 2,243,340 | A | | 5/1941 | Hild |
| 2,243,439 | A | | 5/1941 | Pranger et al. |
| 2,287,205 | A | | 6/1942 | Stone |
| 2,303,090 | A | | 11/1942 | Pranger et al. |
| 2,313,169 | A | | 3/1943 | Penick et al. |
| 2,325,556 | A | | 7/1943 | Taylor, Jr. et al. |
| 2,338,093 | A | | 1/1944 | Caldwell |
| 2,480,955 | A | | 9/1949 | Penick |
| 2,506,538 | A | | 5/1950 | Bennett |
| 2,529,744 | A | | 11/1950 | Schweitzer, Jr. |
| 2,609,836 | A | | 9/1952 | Knox |
| 2,628,852 | A | | 2/1953 | Voytech |
| 2,646,999 | A | | 7/1953 | Barske |
| 2,649,318 | A | | 8/1953 | Skillman |
| 2,731,281 | A | | 1/1956 | Knox |
| 2,746,781 | A | | 5/1956 | Jones |
| 2,760,750 | A | | 8/1956 | Schweitzer, Jr. et al. |
| 2,760,795 | A | | 8/1956 | Vertson |
| 2,764,999 | A | | 10/1956 | Stanbury |
| 2,808,229 | A | | 10/1957 | Bauer et al. |
| 2,808,230 | A | | 10/1957 | McNeill et al. |
| 2,846,178 | A | | 8/1958 | Minor |
| 2,846,247 | A | | 8/1958 | Davis |
| 2,853,274 | A | | 9/1958 | Collins |
| 2,862,735 | A | | 12/1958 | Knox |
| 2,886,350 | A | | 5/1959 | Horne |
| 2,904,357 | A | | 9/1959 | Knox |
| 2,927,774 | A | | 3/1960 | Ormsby |
| 2,929,610 | A | | 3/1960 | Stratton |
| 2,962,096 | A | | 11/1960 | Knox |
| 2,995,196 | A | | 8/1961 | Gibson et al. |
| 3,023,012 | A | | 2/1962 | Wilde |
| 3,029,083 | A | | 4/1962 | Wilde |
| 3,032,125 | A | | 5/1962 | Hiser et al. |
| 3,033,011 | A | | 5/1962 | Garrett |
| 3,052,300 | A | | 9/1962 | Hampton |
| 3,096,999 | A | | 7/1963 | Ahlstone et al. |
| 3,100,015 | A | | 8/1963 | Regan |
| 3,128,614 | A | | 4/1964 | Auer |
| 3,134,613 | A | | 5/1964 | Regan |
| 3,176,996 | A | | 4/1965 | Barnett |
| 3,203,358 | A | | 8/1965 | Regan et al. |
| 3,209,829 | A | | 10/1965 | Haeber |
| 3,216,731 | A | | 11/1965 | Dollison |
| 3,225,831 | A | | 12/1965 | Knox |
| 3,259,198 | A | | 7/1966 | Montgomery et al. |
| 3,268,233 | A | | 8/1966 | Brown |
| 3,285,352 | A | | 11/1966 | Hunter |
| 3,288,472 | A | | 11/1966 | Watkins |
| 3,289,761 | A | | 12/1966 | Smith et al. |
| 3,294,112 | A | | 12/1966 | Watkins |
| 3,302,048 | A | | 1/1967 | Gray |
| 3,313,345 | A | | 4/1967 | Fischer |
| 3,313,358 | A | | 4/1967 | Postlewaite et al. |
| 3,323,773 | A | | 6/1967 | Walker |
| 3,333,870 | A | * | 8/1967 | Watkins ..... E21B 33/038 248/909 |
| 3,347,567 | A | | 10/1967 | Watkins |
| 3,360,048 | A | | 12/1967 | Watkins |
| 3,372,761 | A | | 3/1968 | van Gils |
| 3,387,851 | A | | 6/1968 | Cugini |
| 3,397,928 | A | | 8/1968 | Galle |
| 3,400,938 | A | | 9/1968 | Williams |
| 3,401,600 | A | | 9/1968 | Wood |
| 3,405,763 | A | | 10/1968 | Pitts et al. |
| 3,421,580 | A | | 1/1969 | Fowler et al. |
| 3,424,197 | A | | 1/1969 | Yanaigisawa |
| 3,443,643 | A | | 5/1969 | Jones |
| 3,445,126 | A | | 5/1969 | Watkins |
| 3,452,815 | A | | 7/1969 | Watkins |
| 3,472,518 | A | | 10/1969 | Harlan |
| 3,476,195 | A | | 11/1969 | Galle |
| 3,481,610 | A | | 12/1969 | Slator et al. |
| 3,485,051 | A | | 12/1969 | Watkins |
| 3,492,007 | A | | 1/1970 | Jones |
| 3,493,043 | A | | 2/1970 | Watkins |
| 3,503,460 | A | | 3/1970 | Gadbois |
| 3,522,709 | A | | 8/1970 | Vilain |
| 3,529,835 | A | | 9/1970 | Lewis |
| 3,561,723 | A | | 2/1971 | Cugini |
| 3,583,480 | A | | 6/1971 | Regan |
| 3,587,734 | A | | 6/1971 | Shaffer |
| 3,603,409 | A | | 9/1971 | Watkins |
| 3,621,912 | A | * | 11/1971 | Wooddy, Jr. ..... E21B 33/085 166/340 |
| 3,631,834 | A | | 1/1972 | Gardner et al. |
| 3,638,721 | A | | 2/1972 | Harrison |
| 3,638,742 | A | | 2/1972 | Wallace |
| 3,653,350 | A | | 4/1972 | Koons et al. |
| 3,661,409 | A | | 5/1972 | Brown et al. |
| 3,664,376 | A | | 5/1972 | Watkins |
| 3,667,721 | A | | 6/1972 | Vulasinovic |
| 3,677,353 | A | | 7/1972 | Baker |
| 3,724,862 | A | | 4/1973 | Biffle |
| 3,741,296 | A | | 6/1973 | Murman et al. |
| 3,779,313 | A | | 12/1973 | Regan |
| 3,815,673 | A | | 6/1974 | Bruce et al. |
| 3,827,511 | A | | 8/1974 | Jones |
| 3,847,215 | A | | 11/1974 | Herd |
| 3,868,832 | A | | 3/1975 | Biffle |
| 3,872,717 | A | | 3/1975 | Fox |
| 3,924,678 | A | | 12/1975 | Ahlstone |
| 3,934,887 | A | | 1/1976 | Biffle |
| 3,952,526 | A | | 4/1976 | Watkins et al. |
| 3,955,622 | A | | 5/1976 | Jones |
| 3,965,987 | A | | 6/1976 | Biffle |
| 3,976,148 | A | | 8/1976 | Maus et al. |
| 3,984,990 | A | | 10/1976 | Jones |
| 3,987,662 | A | | 10/1976 | Hara et al. |

(56) References Cited

U.S. PATENT DOCUMENTS 3,992,889 A 11/1976 Watkins et al.
3,999,766 A 12/1976 Barton
4,037,890 A 7/1977 Kurita et al.
4,046,191 A 9/1977 Neath
4,052,703 A 10/1977 Collins, Sr. et al.
4,053,023 A 10/1977 Herd et al.
4,063,602 A 12/1977 Howell et al.
4,087,097 A 5/1978 Bossens et al.
4,091,881 A 5/1978 Maus
4,098,341 A 7/1978 Lewis
4,099,583 A 7/1978 Maus
4,109,712 A 8/1978 Regan
4,143,880 A 3/1979 Bunting et al.
4,143,881 A 3/1979 Bunting
4,149,603 A 4/1979 Arnold
4,154,448 A 5/1979 Biffle
4,157,186 A 6/1979 Murray et al.
4,183,562 A 1/1980 Watkins et al.
4,200,312 A 4/1980 Watkins
4,208,056 A 6/1980 Biffle
4,216,835 A 8/1980 Nelson
4,222,590 A 9/1980 Regan
4,249,600 A 2/1981 Bailey
4,281,724 A 8/1981 Garrett
4,282,939 A 8/1981 Maus et al.
4,285,406 A 8/1981 Garrett et al.
4,291,772 A 9/1981 Beynet
4,293,047 A 10/1981 Young
4,304,310 A 12/1981 Garrett
4,310,058 A 1/1982 Bourgoyne, Jr.
4,312,404 A 1/1982 Morrow
4,313,054 A 1/1982 Martini
4,326,584 A 4/1982 Watkins
4,335,791 A 6/1982 Evans
4,336,840 A 6/1982 Bailey
4,337,653 A 7/1982 Chauffe
4,345,769 A 8/1982 Johnston
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,378,849 A 4/1983 Wilks
4,383,577 A 5/1983 Pruitt
4,384,724 A 5/1983 Derman
4,386,667 A 6/1983 Millsapps, Jr.
4,387,771 A 6/1983 Jones
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,427,072 A 1/1984 Lawson
4,439,068 A 3/1984 Pokladnik
4,440,232 A 4/1984 LeMoine
4,440,239 A 4/1984 Evans
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,457,489 A 7/1984 Gilmore
4,478,287 A 10/1984 Hynes et al.
4,480,703 A 11/1984 Garrett
4,484,753 A 11/1984 Kalsi
4,486,025 A 12/1984 Johnston
4,497,592 A 2/1985 Lawson
4,500,094 A 2/1985 Biffle
4,502,534 A 3/1985 Roche et al.
4,509,405 A 4/1985 Bates
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,591 A 7/1985 Johnston
4,531,593 A 7/1985 Elliott et al.
4,531,951 A 7/1985 Burt et al.
4,533,003 A 8/1985 Bailey
4,540,053 A 9/1985 Baugh et al.
4,546,828 A 10/1985 Roche
4,553,429 A 11/1985 Evans et al.
4,553,591 A 11/1985 Mitchell
D282,073 S 1/1986 Bearden et al.
4,566,494 A 1/1986 Roche
4,575,426 A 3/1986 Bailey
4,595,343 A 6/1986 Thompson et al.
4,597,447 A 7/1986 Roche et al.
4,597,448 A 7/1986 Baugh
4,610,319 A 9/1986 Kalsi
4,611,661 A 9/1986 Hed et al.
4,615,544 A 10/1986 Baugh
4,618,314 A 10/1986 Hailey
4,621,655 A 11/1986 Roche
4,623,020 A 11/1986 Nichols
4,626,135 A 12/1986 Roche
4,630,680 A 12/1986 Elkins
4,632,188 A 12/1986 Schuh et al.
4,646,826 A 3/1987 Bailey et al.
4,646,844 A 3/1987 Roche et al.
4,651,830 A 3/1987 Crotwell
4,660,863 A 4/1987 Bailey et al.
4,688,633 A 8/1987 Barkley
4,690,220 A 9/1987 Braddick
4,697,484 A 10/1987 Klee et al.
4,709,900 A 12/1987 Dyhr
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,757,584 A 7/1988 Pav et al.
4,759,413 A 7/1988 Bailey et al.
4,765,404 A 8/1988 Bailey et al.
4,783,084 A 11/1988 Biffle
4,807,705 A 2/1989 Henderson et al.
4,813,495 A 3/1989 Leach
4,817,724 A 4/1989 Funderburg, Jr. et al.
4,822,212 A 4/1989 Hall et al.
4,825,938 A 5/1989 Davis
4,828,024 A 5/1989 Roche
4,832,126 A 5/1989 Roche
4,836,289 A 6/1989 Young
4,844,406 A 7/1989 Wilson
4,848,472 A * 7/1989 Hopper ..... E21B 33/0355 166/339
4,865,137 A 9/1989 Bailey et al.
4,882,830 A 11/1989 Cartensen
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,035,292 A 7/1991 Bailey et al.
5,040,600 A 8/1991 Bailey et al.
5,048,621 A 9/1991 Bailey et al.
5,062,450 A 11/1991 Bailey et al.
5,062,479 A 11/1991 Bailey et al.
5,072,795 A 12/1991 Delgado et al.
5,076,364 A 12/1991 Hale et al.
5,082,020 A 1/1992 Bailey et al.

(56) References Cited

U.S. PATENT DOCUMENTS 5,085,277 A 2/1992 Hopper
5,101,897 A 4/1992 Leismer et al.
5,137,084 A 8/1992 Gonzales et al.
5,145,006 A 9/1992 June
5,147,559 A 9/1992 Brophey et al.
5,154,231 A 10/1992 Bailey et al.
5,163,514 A 11/1992 Jennings
5,165,480 A 11/1992 Wagoner et al.
5,178,215 A 1/1993 Yenulis et al.
5,182,979 A 2/1993 Morgan
5,184,686 A 2/1993 Gonzalez
5,195,754 A 3/1993 Dietle
5,213,158 A 5/1993 Bailey et al.
5,215,151 A 6/1993 Smith et al.
5,224,557 A 7/1993 Yenulis et al.
5,230,520 A 7/1993 Dietle et al.
5,243,187 A 9/1993 Hettlage
5,251,869 A 10/1993 Mason
5,255,745 A 10/1993 Czyrek
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,375,476 A 12/1994 Gray
5,427,179 A 6/1995 Bailey et al.
5,431,220 A 7/1995 Bailey
5,443,129 A 8/1995 Bailey et al.
5,492,017 A * 2/1996 Jennings ..... E21B 33/035 73/722
5,495,872 A 3/1996 Gallagher et al.
5,529,093 A 6/1996 Gallagher et al.
5,588,491 A 12/1996 Tasson et al.
5,607,019 A 3/1997 Kent
5,647,444 A 7/1997 Williams
5,657,820 A 8/1997 Bailey
5,662,171 A 9/1997 Brugman et al.
5,662,181 A 9/1997 Williams et al.
5,671,812 A 9/1997 Bridges
5,678,829 A 10/1997 Kalsi et al.
5,735,502 A 4/1998 Levett et al.
5,738,358 A 4/1998 Kalsi et al.
5,755,372 A 5/1998 Cimbura
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
6,007,105 A 12/1999 Dietle et al.
6,016,880 A 1/2000 Hall et al.
6,017,168 A 1/2000 Fraser, Jr.
6,036,192 A 3/2000 Dietle et al.
6,050,348 A 4/2000 Richarson et al.
6,076,606 A 6/2000 Bailey
6,102,123 A 8/2000 Bailey et al.
6,102,673 A 8/2000 Mott et al.
6,109,348 A 8/2000 Caraway
6,109,618 A 8/2000 Dietle
6,112,810 A 9/2000 Bailey
6,120,036 A 9/2000 Kalsi et al.
6,129,152 A 10/2000 Hosie et al.
6,138,774 A 10/2000 Bourgoyne, Jr. et al.
6,170,576 B1 1/2001 Bailey
6,202,745 B1 3/2001 Reimert et al.
6,209,663 B1 4/2001 Hosie
6,213,228 B1 4/2001 Saxman
6,227,547 B1 5/2001 Dietle et al.
6,230,824 B1 5/2001 Peterman et al.
6,244,359 B1 6/2001 Bridges et al.
6,263,982 B1 7/2001 Hannegan et al.
6,273,193 B1 8/2001 Hermann et al.
6,315,302 B1 11/2001 Conroy et al.
6,315,813 B1 11/2001 Morgan et al.
6,325,159 B1 12/2001 Peterman et al.
6,334,619 B1 1/2002 Dietle et al.
6,343,654 B1 2/2002 Brammer
6,352,129 B1 3/2002 Best
6,354,385 B1 3/2002 Ford et al.
6,361,830 B1 3/2002 Schenk
6,375,895 B1 4/2002 Daemen
6,382,634 B1 5/2002 Dietle et al.
6,386,291 B1 5/2002 Short et al.
6,413,297 B1 7/2002 Morgan et al.
6,450,262 B1 9/2002 Regan
6,454,007 B1 9/2002 Bailey
6,457,529 B2 10/2002 Calder et al.
6,470,975 B1 10/2002 Bourgoyne et al.
6,478,303 B1 11/2002 Radcliffe
6,494,462 B2 12/2002 Dietle
6,504,982 B1 1/2003 Greer, IV
6,505,691 B2 1/2003 Judge
6,520,253 B2 2/2003 Calder
6,536,520 B1 3/2003 Snider et al.
6,536,525 B1 3/2003 Haugen et al.
6,547,002 B1 4/2003 Bailey et al.
6,554,016 B2 4/2003 Kinder
6,561,520 B2 5/2003 Kalsi et al.
6,581,681 B1 6/2003 Zimmerman et al.
6,607,042 B2 8/2003 Hoyer et al.
RE38,249 E 9/2003 Tasson et al.
6,655,460 B2 12/2003 Bailey et al.
6,685,194 B2 2/2004 Dietle et al.
6,702,012 B2 3/2004 Bailey et al.
6,708,762 B2 3/2004 Haugen et al.
6,720,764 B2 4/2004 Relton et al.
6,725,924 B2 4/2004 Davidson et al.
6,725,951 B2 4/2004 Looper
6,732,804 B2 5/2004 Hosie et al.
6,749,172 B2 6/2004 Kinder
6,767,016 B2 7/2004 Gobeli et al.
6,843,313 B2 1/2005 Hult
6,851,476 B2 2/2005 Gray et al.
6,877,565 B2 4/2005 Edvardsen
6,886,631 B2 5/2005 Wilson et al.
6,896,048 B2 5/2005 Mason et al.
6,896,076 B2 5/2005 Nelson et al.
6,904,981 B2 6/2005 van Riet
6,913,092 B2 7/2005 Bourgoyne
6,945,330 B2 9/2005 Wilson et al.
6,968,895 B2 11/2005 Mosing et al.
7,004,444 B2 2/2006 Kinder
7,007,913 B2 3/2006 Kinder
7,011,167 B2 3/2006 Ebner et al.
7,025,130 B2 4/2006 Bailey et al.
7,028,777 B2 4/2006 Wade et al.
7,032,691 B2 4/2006 Humphreys
7,040,394 B2 5/2006 Bailey et al.
7,044,237 B2 5/2006 Leuchtenberg
7,073,580 B2 7/2006 Wilson et al.
7,077,212 B2 7/2006 Roesner et al.
7,080,685 B2 7/2006 Bailey et al.
7,086,481 B2 8/2006 Hosie et al.
7,152,680 B2 12/2006 Wilson et al.
7,159,669 B2 1/2007 Bourgoyne et al.
7,165,610 B2 1/2007 Hopper
7,174,956 B2 2/2007 Williams et al.
7,178,600 B2 2/2007 Luke et al.
7,191,840 B2 3/2007 Pietras et al.
7,198,098 B2 4/2007 Williams
7,204,315 B2 4/2007 Pia
7,219,729 B2 5/2007 Bostick et al.
7,237,618 B2 7/2007 Williams
7,237,623 B2 7/2007 Hannegan
7,240,727 B2 7/2007 Williams
7,243,958 B2 7/2007 Williams
7,255,173 B2 8/2007 Hosie et al.
7,258,171 B2 8/2007 Bourgoyne et al.
7,278,494 B2 10/2007 Williams
7,278,496 B2 10/2007 Leuchtenberg
7,296,628 B2 11/2007 Robichaux et al.

(56) References Cited

U.S. PATENT DOCUMENTS

| | | | |
|---|---|---|---|
| 7,308,954 | B2 | 12/2007 | Martin-Marshall |
| 7,325,610 | B2 | 2/2008 | Giroux et al. |
| 7,334,633 | B2 | 2/2008 | Williams et al. |
| 7,347,261 | B2 | 3/2008 | Markel et al. |
| 7,350,590 | B2 | 4/2008 | Hosie et al. |
| 7,363,860 | B2 | 4/2008 | Wilson et al. |
| 7,367,411 | B2 | 5/2008 | Leuchtenberg |
| 7,380,590 | B2 | 6/2008 | Hughes |
| 7,380,591 | B2 | 6/2008 | Williams |
| 7,380,610 | B2 | 6/2008 | Williams |
| 7,383,876 | B2 | 6/2008 | Gray et al. |
| 7,389,183 | B2 | 6/2008 | Gray |
| 7,392,860 | B2 | 7/2008 | Johnston |
| 7,413,018 | B2 | 8/2008 | Hosie et al. |
| 7,416,021 | B2 | 8/2008 | Williams |
| 7,416,226 | B2 | 8/2008 | Williams |
| 7,448,454 | B2 | 11/2008 | Bourgoyne et al. |
| 7,451,809 | B2 | 11/2008 | Noske et al. |
| 7,475,732 | B2 | 1/2009 | Hosie et al. |
| 7,487,837 | B2 | 2/2009 | Bailey et al. |
| 7,513,300 | B2 | 4/2009 | Pietras et al. |
| 7,559,359 | B2 | 7/2009 | Williams |
| 7,635,034 | B2 | 12/2009 | Williams |
| 7,650,950 | B2 | 1/2010 | Leuchtenberg |
| 7,654,325 | B2 | 2/2010 | Giroux et al. |
| 7,669,649 | B2 | 3/2010 | Williams |
| 7,699,109 | B2 | 4/2010 | May et al. |
| 7,708,089 | B2 | 5/2010 | Williams |
| 7,712,523 | B2 | 5/2010 | Snider et al. |
| 7,717,169 | B2 | 5/2010 | Williams |
| 7,717,170 | B2 | 5/2010 | Williams |
| 7,726,416 | B2 | 6/2010 | Williams |
| 7,743,823 | B2 | 6/2010 | Hughes et al. |
| 7,762,320 | B2 | 7/2010 | Williams |
| 7,766,100 | B2 | 8/2010 | Williams |
| 7,779,903 | B2 | 8/2010 | Bailey et al. |
| 7,789,132 | B2 | 9/2010 | Williams |
| 7,789,172 | B2 | 9/2010 | Williams |
| 7,793,719 | B2 | 9/2010 | Snider et al. |
| 7,798,250 | B2 | 9/2010 | Williams |
| 7,802,635 | B2 | 9/2010 | Leduc et al. |
| 7,823,665 | B2 | 11/2010 | Sullivan |
| 7,836,946 | B2 | 11/2010 | Bailey et al. |
| 7,836,973 | B2 | 11/2010 | Belcher et al. |
| 7,926,593 | B2 | 4/2011 | Bailey et al. |
| 8,408,297 | B2 | 4/2013 | Bailey et al. |
| 8,826,988 | B2 * | 9/2014 | Gray ..... E21B 23/04 166/338 |
| 2001/0050185 | A1 | 12/2001 | Calder et al. |
| 2002/0070014 | A1 | 6/2002 | Kinder |
| 2003/0106712 | A1 | 6/2003 | Bourgoyne et al. |
| 2003/0164276 | A1 | 9/2003 | Snider et al. |
| 2004/0017190 | A1 | 1/2004 | McDearmon et al. |
| 2004/0084220 | A1 | 5/2004 | Bailey et al. |
| 2005/0000698 | A1 | 1/2005 | Bailey et al. |
| 2005/0051324 | A1 | 3/2005 | Mosing et al. |
| 2005/0151107 | A1 | 7/2005 | Shu |
| 2005/0161228 | A1 | 7/2005 | Cook et al. |
| 2006/0037782 | A1 | 2/2006 | Martin-Marshall |
| 2006/0108119 | A1 | 5/2006 | Bailey et al. |
| 2006/0144622 | A1 | 7/2006 | Bailey et al. |
| 2006/0157282 | A1 | 7/2006 | Tilton et al. |
| 2006/0191716 | A1 | 8/2006 | Humphreys |
| 2007/0051512 | A1 | 3/2007 | Markel et al. |
| 2007/0095540 | A1 | 5/2007 | Kozicz et al. |
| 2007/0163784 | A1 | 7/2007 | Bailey et al. |
| 2008/0169107 | A1 | 7/2008 | Redlinger et al. |
| 2008/0210471 | A1 | 9/2008 | Bailey et al. |
| 2008/0236819 | A1 | 10/2008 | Foster et al. |
| 2008/0245531 | A1 | 10/2008 | Noske et al. |
| 2009/0025930 | A1 | 1/2009 | Iblings et al. |
| 2009/0101351 | A1 | 4/2009 | Hannegan et al. |
| 2009/0101411 | A1 | 4/2009 | Hannegan et al. |
| 2009/0139724 | A1 | 6/2009 | Gray et al. |
| 2009/0152006 | A1 | 6/2009 | Leduc et al. |
| 2009/0166046 | A1 | 7/2009 | Edvardson et al. |
| 2009/0200747 | A1 | 8/2009 | Williams |
| 2009/0211239 | A1 | 8/2009 | Askeland |
| 2009/0236144 | A1 | 9/2009 | Todd et al. |
| 2009/0301723 | A1 | 12/2009 | Gray |
| 2010/0008190 | A1 | 1/2010 | Gray et al. |
| 2010/0025047 | A1 | 2/2010 | Sokol |
| 2010/0175882 | A1 | 7/2010 | Bailey et al. |
| 2011/0024195 | A1 | 2/2011 | Hoyer |
| 2011/0036638 | A1 | 2/2011 | Sokol |

FOREIGN PATENT DOCUMENTS

| | | | |
|---|---|---|---|
| AU | 200028183 | B2 | 9/2000 |
| CA | 2363132 | A1 | 9/2000 |
| CA | 2447196 | A1 | 4/2004 |
| CA | 2 527 395 | A1 | 5/2006 |
| CA | 2527395 | A1 | 5/2006 |
| CA | 2 692 209 | A1 | 8/2010 |
| EP | 0290250 | A2 | 11/1988 |
| EP | 0290250 | A3 | 11/1988 |
| EP | 267140 | B1 | 3/1993 |
| EP | 1375817 | A1 | 1/2004 |
| EP | 1519003 | A1 | 3/2005 |
| EP | 1659260 | A2 | 5/2006 |
| EP | 1 830 034 | A2 | 9/2007 |
| EP | 2 216 498 | A2 | 8/2010 |
| EP | 2 636 841 | A1 | 9/2013 |
| GB | 1161299 | | 8/1969 |
| GB | 2 019 921 | A | 11/1979 |
| GB | 2019921 | A | 11/1979 |
| GB | 2067235 | A | 7/1981 |
| GB | 2106961 | | 4/1983 |
| GB | 2362668 | A | 11/2001 |
| GB | 2 394 741 | A | 5/2004 |
| GB | 2394741 | A | 5/2004 |
| GB | 2449010 | A | 8/2007 |
| NO | 20055480 | | 11/2005 |
| WO | WO 99/45228 | A1 | 9/1999 |
| WO | WO 99/50524 | A2 | 10/1999 |
| WO | WO 99/51852 | A1 | 10/1999 |
| WO | WO 99/50524 | A3 | 12/1999 |
| WO | WO 00/52299 | A1 | 9/2000 |
| WO | WO 00/52300 | A1 | 9/2000 |
| WO | WO 02/50398 | A1 | 6/2002 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |

OTHER PUBLICATIONS

The Modular T BOP Stack System, Cameron Iron Works© 1985 (4 pages).

Cameron HC Collet Connector, © 1996 Cooper Cameron Corporation, Cameron Division (14 pages).

Riserless drilling: circumventing the size/cost cycle in deep-water—Conoco, Hydril project seek enabling technologies to drill in deepest water depths economically, May 1986 Offshore Drilling Technology (6 pages).

Williams Tool Company—Home Page—Under Construction Williams Rotating Control Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where Using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact US (2 pages), 16 pages (total).

Offshore—World Trends and Technology for Offshore Oil and Gas Operations, Mar. 1998, Seismic: Article entitled, "Shallow Flow Diverter JIP Spurred by Deepwater Washouts" (3 pages including cover page, table of contents and p. 90).

(56) References Cited

OTHER PUBLICATIONS

Williams Tool Co., Inc. Rotating Control Heads and Strippers for Air, Gas, Mud, and Geothermal Drilling Worldwide—Sales Rental Service, © 1988 (19 pages).
Williams Tool Co., Inc. 19 page brochure © 1991 Williams Tool Co., Inc. (19 pages).
FIG. 19 Floating Piston Drilling Choke Design: May of 1997 (1 page).
Blowout Preventer Testing for Underbalanced Drilling by Charles R. "Rick" Stone and Larry A. Cress, Signa Engineering Corp., Houston, Texas (24 pages) Sep. 1997.
Williams Tool Co., Inc. Instructions, Assemble & Disassemble Model 9000 Bearing Assembly (28 pages including cover page).
Williams Tool Co., Inc. Rotating Control Heads Making Drilling Safer While Reducing Costs Since 1968, © 1989 (4 pages).
Williams Tool Company, Inc. International Model 7000 Rotating Control Head, 1991 (4 pages).
Williams Rotating Control Heads, Reduce Costs Increase Safety Reduce Environmental Impact, 4 pages, ( © 1995).
Williams Tool Co., Inc. Sales-Rental-Service, Williams Rotating Control Heads and Strippers for Air, Gas, Mud, and Geothermal Drilling, © 1982 (7 pages).
U.S. Appl. No. 60/079,641, Abandoned, but Priority Claimed in above U.S. Pat. Nos. 6,230,824B1 and 6,102,673 and PCT WO 99/50524, Mar. 27, 1998.
U.S. Appl. No. 60/122,530, Abandoned, but Priority Claimed in U.S. Pat. No. 6,470,975B1, Mar. 2, 1999.
Williams Tool Co., Inc., Rotating Control Heads and Strippers for Air, Gas, Mud, Geothermal and Pressure Drilling, © 1991 (19 pages).
An article—The Brief Jan. '96, The Brief's Guest Columnists, Williams Tool Co., Inc., Communicating Dec. 13, 1995 (Fort Smith, Arkansas), The When? and Why? of Rotating Control Head Usage, Copyright © Murphy Publishing, Inc. 1996 (2 pages).
A reprint from the Oct. 9, 1995 edition of Oil & Gas Journal, "Rotating control head applications increasing," by Adam T. Bourgoyne, Jr., Copyright 1995 by PennWell Publishing Company (4 pages).
1966-1967 Composite Catalog-Grant Rotating Drilling Head for Air Gas or Mud Drilling (1 page).
1976-1977 Composite Catalog Grant Oil Tool Company Rotating Drilling Head Models 7068, 7368, 8068 (Patented), Equally Effective with Air, Gas, or Mud Circulation Media (3 pages).
A Subsea Rotating Control Head for Riserless Drilling Applications; Daryl A. Bourgoyne, Adam T. Bourgoyne, and Don Hannegan—1998 (International Association of Drilling Contractors International Deep Water Well Control Conference held in Houston, Texas, Aug. 26-27, 1998) (14 pages).
Hannegan, "Applications Widening for Rotating Control Heads," Drilling Contractor, cover page, table of contents and pp. 17 and 19, Drilling Contractor Publications Inc., Houston, Texas, Jul. 1996 (4 pages).
Composite Catalog, Hughes Offshore 1986-87 Subsea Systems and Equipment, Hughes Drilling Equipment Composite Catalog (pp. 2986-3004) (19 pages).
Williams Tool Co., Inc. Technical Specifications Model for the Model 7100, (3 pages).
Williams Tool Co., Inc. Website, Underbalanced Drilling (UBD), The Attraction of UBD (2 pages).
Williams Tool Co., Inc. Website, "Applications, Where Using a Williams Rotating Control Head While Drilling is a Plus" (2 pages).
Williams Tool Co., Inc. Website, "Model 7100," (3 pages).
Composite Catalog, Hughes Offshore 1982/1983, Regan Products, © Copyright 1982 (Two cover sheets and 4308-27 thru 4308-43, and end sheet). See p. 4308-36 Type KFD Diverter (20 pages).
Coflexip Brochure; 1—Coflexip Sales Offices, 2—the Flexible Steel Pipe for Drilling and Service Applications, 3—New 5"I.D. General Drilling Flexible, 4—Applications, and 5—Illustration (5 unnumbered pages).
Baker, Ron, "A Primer of Oilwell Drilling," Fourth Edition, Published Petroleum Extension Service, The University of Texas at Austin, Austin, Texas, in cooperation with International Association of Drilling Contractors Houston, Texas © 1979 (3 cover pages and pp. 42-49 re Circulation System) (11 pages).
Brochure, Lock down Lubricator System, Dutch Enterprises, Inc., "Safety with Savings" (cover sheet and 16 unnumbered pages); see above U.S. Pat. No. 4,836,289 referred to therein (16 pages).
Hydril GL series Annual Blowout Preventers (Patented—see Roche patents above), (cover sheet and 2 pages).
Other Hydril Product Information (The GH Gas Handler Series Product is Listed), © 1996, Hydril Company (Cover sheet and 19 pages).
Brochure, Shaffer Type 79 Rotating Blowout Preventer, NL Rig Equipment/NL Industries, Inc., (6 unnumbered pages).
Shaffer, A Varco Company, (Cover page and pp. 1562-1568) (8 pages).
Avoiding Explosive Unloading of Gas in a Deep Water Riser When SOBM in Use; Colin P. Leach & Joseph R. Roche—1998 (The Paper Describes an Application for the Hydril Gas Handler, The Hydril GH 211-2000 Gas Handler is Depicted in Figure 1 of the Paper) (9 unnumbered pages).
Feasibility Study of Dual Density Mud System for Deepwater Drilling Operations; Clovis A. Lopes & A.T. Bourgoyne, Jr.—1997 (Offshore Technology Conference Paper No. 8465); (pp. 257-266) (10 pages).
Apr. 1998 Offshore Drilling with Light Weight Fluids Joint Industry Project Presentation (9 unnumbered pages).
Nakagawa, Edson Y., Santos, Helio and Cunha, J.C., "Application of Aerated-Fluid Drilling in Deepwater," SPE/IACDC 52787 Presented by Don Hannegan, P.E., SPE © 1999 SPE/IADC Drilling Conference, Amsterdam, Holland, Mar. 9-11, 1999 (5 unnumbered pages).
Brochure: "Inter-Tech Drilling Solutions, Ltd.'s RBOP™ Means Safety and Experience for Underbalanced Drilling," Inter-Tech Drilling Solutions Ltd./Big D Rentals & Sales (1981) Ltd. And Color "Rotating BOP" (2 unnumbered pages).
"Pressure Control While Drilling," Shaffer® A Varco Company, Rev. A (2 unnumbered pages).
Field Exposure (As of Aug. 1998), Shaffer® A Varco Company (1 unnumbered page).
Graphic: "Rotating Spherical BOP" (1 unnumbered page).
"JIP's Worl Brightens Outlook for UBD in Deep Waters" by Edson Yoshihito Nakagawa, Helio Santos and Jose Carlos Cunha, American Oil & Gas Reporter, Apr. 1999, pp. 53, 56, 58-60 and 63 (8 pages).
"Seal-Tech 1500 PSI Rotating Blowout Preventer," Undated, 3 pages.
"RPM System 3000™ Rotating Blowout Preventer, Setting a new standard in Well Control," by Techcorp Industries, Undated, 4 pages.
"RiserCap™ Materials Presented at the 1999 LSU/MMS/IADC Well Control Workshop", by Williams to Company, Inc., Mar. 24-25, pp. 1-14 (14 pages).
"The 1999 LSU/MMS Well Control Workshop: An overview," by John Rogers Smith. World Oil, Jun. 1999. Cover page and pp. 4, 41-42, and 44-45 (6 pages).
DAG OLUF NESSA, "Offshore underbalanced drilling system could revive field developments," World Oil, vol. 218, No. 10, Oct. 1997, 1 unnumbered page and pp. 83-84, 86, and 88 (6 pages)
D.O. Nessa, "Offshore underbalanced drilling system could revive field developments," World Oil Exploration Drilling Production, vol. 218, No. 7, Color pages Of Cover Page and pp. 3, 61-64, and 66, Jul. 1997 (7 pages).
PCT Search Report, International Application No. PCT/US99/06695, 4 pages (Date of Completion May 27, 1999).
PCT Search Report, International Application No. PCT/GB00/00731, 3 pages (Date of Completion Jun. 16, 2000).
National Academy of Sciences—National Research Council, "Design of a Deep Ocean Drilling Ship," Cover Page and pp. 114-121. (9 pages).
"History and Development of a Rotating Preventer," by A. Cress, Rick Stone, and Mike Tangedahl, IADC/SPE 23931, 1992 IADC/SPE Drilling Conference, Feb. 1992, pp. 757-773 (17 pages).
Helio Santos, Email message to Don Hannegan, et al., 1 page (Aug. 20, 2001).
Rehm, Bill, "Practical Underbalanced Drilling and Workover," Petroleum Extension Service, The University of Texas at Austin Continuing & Extended Education, Cover page, title page, copyright page, and pp. 6-6, 11-2, 11-3, G-9, and G-10 (2002) (8 pages).

(56) References Cited

OTHER PUBLICATIONS

Williams Tool Company Inc., "RISERCAP™: Rotating Control Head System for Floating Drilling Rig Applications," 4 unnumbered pages, ( © 1999 Williams Tool Company, Inc.) (4 pages).
Antonio C.V.M. Lage, Helio, Santos and Paulo R.C. Silva, Drilling With Aerated Drilling Fluid From a Floating Unit Part 2: Drilling the Well, SPE 71361, 11 pages ( © 2001, Society of Petroleum Engineers, Inc.) (11 pages).
Helio Santos, Fabio Rosa, and Christian Leuchtenberg, Drilling and Aerated Fluid from a Floating Unit, Part 1: Planning, Equipment, Tests, and Rig Modifications, SPE/ADC 67748, 8 pages ( © 2001 SPE/IADC Drilling Conference).
E.Y. Nakagawa, H. Santos, J.C. Cunha and S. Shayegi, Planning of Deepwater Drilling Operations with Aerated Fluids, SPE 54283, 7 pages, ( © 1999, Society of Petroleum Engineers).
E.Y. Nakagawa, H.M.R. Santos and J.C. Cunha, Implementing the Light-Weight Fluids Drilling Technology in Deepwater Scenarios, 1999 LSU/MMS Well Control Workshop Mar. 24-25, 1999, 12 pages (1999).
Press Release, "Stewart & Stevenson Introduces First Dual Gradient Riser," Stewart & Stevenson, http:/www.ssss/com/ssss/20000831.asp, 2 pages (Aug. 31, 2000).
Press Release: "Stewart & Stevenson introduces First Dual Gradient Riser," Stewart & Stevenson, http:www/ssss/com/ssss/20000831.asp, 2 pages (Aug. 31, 2000).
Williams Tool Company Inc., "Williams Tool Company Introduces the . . . Virtual Riser™," 4 unnumbered pages, ( © 1998 Williams Tool Company, Inc.).
"PETEX Publications," Petroleum Extension Service, University of Texas at Austin, 12 pages, (last modified Dec. 6, 2002).
"BG in the Caspian region," SPE Review, Issue 164, 3 unnumbered pages (May 2003).
"Field Cases as of Mar. 3, 2003," Impact Fluid Solutions, 6 pages (Mar. 3, 2003).
"Determine in the Safe Application of Underbalanced Drilling Technologies in Marine Environments—Technical Proposal," Maurer Technology, Inc., Cover Page and pp. 2-13 (Jun. 17, 2002) (13 pages).
Colbert, John W., "John W. Colbert, P.E. Vice President Engineering Biographical Data," Signa Engineering Corp., 2 unnumbered pages (undated).
"Technical Training Courses," Parker Drilling Co., http:/www.parkerdrilling.com/news/tech.html, 5 pages (last visited, Sep. 5, 2003).
"Drilling equipment: Improvements from data recording to slim hole," Drilling Contractor, pp. 30-32, Mar./Apr. 2000) (3 pages).
"Drilling conference promises to be informative," Drilling Contractor, p. 10 (Jan./Feb. 2002) (1 page).
"Underbalanced and Air Drilling," OGCI, Inc., http:/www.ogci.com/course_info.asp?counselD=410, 2 pages, (2003).
"2003 SPE Calendar," Society of Petroleum Engineers, Google cache of http:/www.spe.org/spe/cda/views/events/eventMaster/0,1470,1648_2194_632303.00.html; for "mud cap drilling", 2 pages (2001).
"Oilfield Glossary: reverse-circulating valve," Schlumberger Limited, 1 page (2003).
Murphy, Ross D. and Thompson, Paul B., "A drilling contractor's view of underbalanced drilling," World Oil Magazine, vol. 223, No. 5, 9 pages (May 2002) (9 pages).
"Weatherford UnderBalanced Services: General Underbalance Presentation to the DTI," 71 unnumbered pages, © 2002.
Rach, Nina M., "Underbalanced near-balanced drilling are possible offshore," Oil & Gas Journal, Color Copies, pp. 39-44, (Dec. 1, 2003) (6 pages).
Forrest, Neil et al., Subsea Equipment for Deep Water Drilling Using Dual Gradient Mud System, SPE/IADC Drilling Conference held in Amsterdam, The Netherlands, Feb. 27, 2001 to Mar. 1, 2001, Paper SPE/IADC 67707, © 2001 SPE/IADC Drilling Conference (8 pages); particularly see p. 3, col. 1, ¶ 4 and col. 2, ¶ 5 and Figs. 4-6; cited in 7V below where indicated as "technical background" (8 pages).
Hannegan, D.M.; Bourgoyne, Jr., A.T.: "Deepwater Drilling with Lightweight Fluids—Essential Equipment Required," SPE/IADC 67708,pp. 1-6 ( © 2001, SPE/IADC Drilling Conference) (6 pages).
Hannegan, Don M., "Underbalanced Operations Continue Offshore Movement," SPE 68491, pp. 1-3, ( © 2001, Societof Petroleum Engineers, Inc.) (3 pages).
Hannegan, D. and Divine, R., "Underbalanced Drilling—Perceptions and Realities of Today's Technology in Offshore Applications," IADC/SPE 74448, p. 1-9, ( © 2002, IADC/SPE Drilling Conference) (9 pages).
Hannegan, Don M. and Wanzer, Glen: "Well Control Considerations—Offshore Applications of Underbalanced Drilling Technology," SPE/IADC 79854, pp. 1-14, ( © 2003, SPE/IADC Drilling Conference) (14 pages).
Bybee, Karen, "Offshore Applications of Underbalanced—Drilling Technology," Journal of Petroleum Technology, Cover Page and pp. 51-52, (Jan. 2004) (3 pages).
Bourgoyne, Darryl A.; Bourgoyne, Adam T.; Hannegan, Don; "A Subsea Rotating Control Head for Riserless Drilling Applications," IADC International Deep Water Well Control Conference, pp. 1-14, (Aug. 26-27, 1998) (see document T) (14 pages).
Lage, Antonio C.V.M.; Santos, Helio; Silva, Paulo R.C.; "Drilling With Aerated Drilling Fluid From a Floating Unit Part 2: Drilling the Well," Society of Petroleum Engineers, SPE 71361, pp. 1-11 (Sep. 30-Oct. 3, 2001)(see document BBB) (11 pages).
Furlow, William; "Shell's seafloor pump, solids removal key to ultra-deep, dual-gradient drilling (Skid ready for commercialization), "Offshore World Trends and Technology for Offshore Oil and Gas Operations, Cover page, table of contents, pp. 54, 2 unnumbered pages, and 106 (Jun. 2001) (6 pages).
Rowden, Michael V.: "Advances in riserless drilling pushing the deepwater surface string envelope (Alternative to seawater, CaCl2 sweeps); "Offshore World Trends and Technology for Offshore Oil and Gas Operations, Cover page, table of contents, pp. 56, 58, and 106 (Jun. 2001) (5 pages).
Boye, John: "Multi-Purpose Intervention Vessel Presentation," M.O.S.T. Multi Operational Service Tankers, Weatherford International, Jan. 2004, 43 pages ( © 2003).
GB Search Report, International Application No. GB 0324939.8, 1 page (Jan. 21, 2004).
MicroPatent® list of patents citing U.S. Pat. No. 3,476,195, printed on Jan. 24, 2003.
PCT Search Report, International Application No. PCT/EP2004/052167, 4 pages (Date of Completion Nov. 25, 2004).
PCT Written Opinion of the International Searching Authority, International Application No. PCT/EP2004/052167, 6 pages.
Supplementary European Search Report No. EP 99908371, 3 pages (Date of Completion Oct. 22, 2004).
General Catalog, 1970-1971, Vetco Offshore, Inc., Subsea Systems; cover page, company page and numbered pp. 4800, 4816-4818; 6 pages total, in particular see numbered p. 4816 for "patented" Vetco H-4 connectors (6 pages).
General Catalog, 1972-73, Vetco Offshore, Inc., Subsea Systems; cover page; company page and numbered pp. 4498, 4509-4510; 5 pages total.
General Catalog, 1974-75, Vetco Offshore, Inc.; cover page, company page and numbered pp. 5160, 5178-5179; 5 pages total.
General Catalog, 1976-1977, Vetco Offshore, Inc., Subsea Drilling and Completion Systems; cover page and numbered pp. 5862-5863; 4 pages total.
General Catalog, 1982-1983, Vetco; cover page and numbered pp. 8454-8455, 8479; 4 pages total.
Shaffer, A Varco Company: Pressure Control While Drilling System, http:/www.tulsaequipm.com; printed Jun. 21, 2004; 2 pages.
Performance Drilling by Precision Drilling. A Smart Equation, Precision Drilling, © 2002 Precision Drilling Corporation; 12 pages, in particular see 9th page for "Northland's patented RBOP . . . ".
RPM System, 3000™ Rotating Blowout Preventer: Setting a New Standard in Well Control, Weatherford, Underbalanced Systems: © 2002-2005 Weatherford; Brochure #333.01, 4 pages.
Managed Pressure Drilling in Marine Environments, Don Hannegan, P.E.; Drilling Engineering Association Workshop, Moody Gardens, Galveston, Jun. 22-23, 2004; © 2004 Weatherford, 28 pages.

(56) References Cited

OTHER PUBLICATIONS

Hold™ 2500 RCD Rotating Control Device web page and brochure, http://www.smith.com/hold2500; printed Oct. 27, 2004, 5 pages.
Rehm, Bill, "Practical Underbalanced Drilling and Workover," Petroleum Extension Service, The University of Texas at Austin Continuing & Extended Education, cover page, title page, copyright page and pp. 6-1 to 6-9, 7-1 to 7-9 (2002) (21 pages).
"Pressured Mud Cap Drilling from a Semi-Submersible Drilling Rig," J.H. Terwogt, SPE, L.B. Makiaho and N. van Beelen, SPE, Shell Malaysia Exploration and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005) (5 pages).
Tangedahl, M.J., et al., "Rotating Preventers: Technology for Better Well Control," World Oil, Gulf Publishing Company, Houston, TX, US, vol. 213, No. 10, Oct. 1992, numbered pp. 63-64 and 66 (3 pages).
European Search Report for EP 05 27 0083, Application No. 05270083.8-2315, European Patent Office, Mar. 2, 2006, corresponding to U.S. Appl. No. 10/995,980, published as US2006/0108119 A1 (now U.S. Pat. No. 7,487,837 B2) (5 pages).
Netherlands Search Report for NL No. 1026044, dated Dec. 14, 2005 (3 pages).
Int'l. Search Report for PCT/GB 00/00731 corresponding to U.S. Pat. No. 6,470,975 (Jun. 16, 2000) (2 pages).
GB0324939.8 Examination Report corresponding to U.S. Pat. No. 6,470,975 (Mar. 21, 2006) (6 pages).
GB0324939.8 Examination Report corresponding to U.S. Pat. No. 6,470,975 Jan. 22, 2004) (3 pages).
2003/0106712 Family Lookup Report (Jun. 15, 2006) (5 pages).
6,470,975 Family Lookup Report (Jun. 15, 2006) (5 pages).
AU S/N 28183/00 Examination Report corresponding to U.S. Pat. No. 6,470,975 (1 page) (Sep. 9, 2002).
NO S/N 20013953 Examination Report corresponding to U.S. Pat. No. 6,470,975 w/one page of English translation (3 pages) (Apr. 29, 2003).
Nessa, D.O. & Tangedahl, M.L. & Saponia, J: Part 1: "Offshore underbalanced drilling system could revive field developments," World Oil, vol. 218, No. 7, Cover Page, 3, 61-64 and 66 (Jul. 1997); and Part 2: "Making this valuable reservoir drilling/completion technique work on a conventional offshore drilling platform." World Oil, vol. 218 No. 10, Cover Page, 3, 83, 84, 86 and 88 (Oct. 1997) (see 5A, 5G above and 5I below) (7 pages).
Int'l. Search Report for PCT/GB 00/00731 corresponding to U.S. Pat. No. 6, 470,975 (4 pages) (Jun. 27, 2000).
Int'l. Preliminary Examination Report for PCT/GB 00/00731 corresponding to U.S. Pat. No. 6,470,975 (7 pages) (Dec. 14, 2000).
NL Examination Report for WO 00/52299 corresponding to this U.S. Appl. No. 10/281,534 (3 pages) (Dec. 19, 2003).
AU S/N 28181/00 Examination Report corresponding to U.S. Pat. No. 6,263,982 (1 page) (Sep. 6, 2002).
EU Examination Report for WO 00/906522.8-2315 corresponding to U.S. Pat. No. 6,263,982 (4 pages) (Nov. 29, 2004).
NO S/N 20013952 Examination Report w/two pages of English translation corresponding to U.S. Pat. No. 6,263,982 (4 pages) (Jul. 2, 2005).
PCT/GB00/00726 Int'l. Preliminary Examination Report corresponding to U.S. Pat. No. 6,263,982 (10 pages) (Jun. 26, 2001).
PCT/GB00/00726 Written Opinion corresponding to U.S. Pat. No. 6,263,982 (7 pages) (Dec. 18, 2000).
PCT/GB00/00726 International Search Report corresponding to U.S. Pat. No. 6,263,982 (3 pages (Mar. 2, 1999) (4 pages).
AU S/N 27822/99 Examination Report corresponding to U.S. Pat. No. 6,138,774 (1 page) (Oct. 15, 2001).
EU 99908371.0-1266-US99/03888 European Search Report corresponding to U.S. Pat. No. 6,138,774 (3 pages) (Nov. 2, 2004).
NO S/N 20003950 Examination Report w/one page of English translation corresponding to U.S. Pat. No. 6,138,774 (3 pages) (Nov. 1, 2004).
PCT/US990/03888 Notice of Transmittal of International Search Report corresponding to U.S. Pat. No. 6,138,774 (6 pages) (Aug. 4, 1999).
PCT/US99/03888 Written Opinion corresponding to U.S. Pat. No. 6,138,744 (5 pages) (Dec. 21, 1999).
PCT/US99/03888 Notice of Transmittal of International Preliminary Examination Report corresponding to U.S. Pat. No. 6,138,774 (15 pages) (Jun. 12, 2000).
EU Examination Report for 05270083.8-2315 corresponding to U.S. Appl. No. 10/995,980, published as US 2006/0108119 A1 (now U.S. Pat. No. 7,487,837 B2) (11 pages) (May 10, 2006).
Tangedahl, M.J., et al. "Rotating Preventers: Technology for Better Well Control," World Oil, Gulf Publishing Company, Houston, TX, US, vol. 213, 10/1992, (Oct. 1, 1992) numbered pp. 63-64 and 66 (3 pages) XP 000288328 ISSN: 0043-8790 (see YYYY, 5X above).
UK Search Report for Application No. GB 0325423.2, searched Jan. 30, 2004 corresponding to above U.S. Pat. No. 7,040,394 (one page).
UK Examination Report for Application No. GB 0325423.2 (corresponding to above 5Z) dated Jun. 30, 2005 (4 pages).
Dietle, Lannie L., et al., Kalsi Seals Handbook, Document. 2137 Revision 1, © 1992-2005 Kalsi Engineering, Inc. of Sugar Land, Texas USA; front and back covers and 164 total pages; in particular forward page ii for "Patent Rights"; Appendix A-6 for Kalsi seal part No. 381-6- and A-10 for Kalsi seal part No. 432-32-. as discussed in U.S. Appl. No. 11/366,078 (now U.S. Pat. No. 7,836,946 B2) at number paragraph 70 and 71. (194 pages).
Fig. 10 and discussion in U.S. Appl. No. 11/366,078, published as US2006/0144622 A1 (now U.S. Pat. No. 7,836,946 B2) of Background of Invention (2 pages).
Partial European search report R.46 EPC dated Jun. 27, 2007 for European Patent Application EP07103416.9-2315 corresponding to U.S. Appl. No. 11/366,078, published as US 2006/0144622 A1, now U.S. Pat. No. 7,836,946 (5 pages).
Extended European search report R.44 EPC dated Oct. 9, 2007 for European Patent Application 07103416.9-2315 corresponding to U.S. Appl. No. 11/366,078, published as US-2006/0144622 A1, now U.S. Pat. No. 7,836,946 (8 pages).
U.S. Appl. No. 60/079,641, Mudlift System for Deep Water Drilling, filed Mar. 27, 1998, abandoned, but priority claimed in above U.S. Pat. No. 6,230,824 B1 and 6,102,673 and PCT WO-99/50524 (107 pages).
U.S. Appl. No. 60/122,530, Concepts for the Application of Rotating Control Head Technology to Deepwater Drilling Operations, filed Mar. 2, 1999, abandoned, but priority claimed in above U.S. Pat. No. 6,470,975 B1 (54 pages).
PCT/GB2008/050239 (corresponding to US2008/0210471 A1; now issued as U.S. Pat. No. 7,926,593) Annex to Form PCT/ISA/206 Communication Relating to the Results of the Partial International Search dated Aug. 26, 2008 (4 pages).
PCT/GB2008/050239 (corresponding to US2008/0210471 A1; now issued as U.S. Pat. No. 7,926,593) International Search Report and Written Opinion of the International Searching Authority (16 pages).
Vetco Gray Product Information CDE-PI-0007 dated Mar. 1999 for 59.0 Standard Bore CSO Diverter (2 pages) © 1999 by Vetco Gray Inc.
Vetco Gray Capital Drilling Equipment KFDJ and KFDJ Model "J" Diverters (1 page) (no date).
Hydril Blowout Preventers Catalog M-9402 D (44 pages) © 2004 Hydril Company LP; see annular and ram BOP seals on p. 41.
Hydril Compact GK® 7 1/16—3000 & 5000 psi Annular Blowout Preventers, Catalog 9503B © 1999 Hydril Company (4 pages).
Weatherford Controlled Pressure Drilling Williams® Rotating Marine Diverter Insert (2 pages).
Weatherford Controlled Pressure Drilling Model 7800 Rotating Control Device © 2007 Weatherford(5 pages).
Weatherford Controlled Pressure Drilling® and Testing Services Williams® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" ©2007 Weatherford and "Rotating Control Device Ensures Safety of Crew Drilling Surface-Hole Section" © 2008 Weatherford (2 pages).

(56) References Cited

OTHER PUBLICATIONS

Washington Rotating Control Heads, Inc. Series 1400 Rotating Control Heads ("Shorty") printed Nov. 21, 2008 (2 pages).
Smith Services product details for Rotating Control Device—RDH 500® printed Nov. 24, 2008 (4 pages).
American Petroleum Institute Specification for Drill Through Equipment—Rotating Control Devices, API Specification 16RCD, First Edition, Feb. 2005 (84 pages).
Weatherford Drilling & Intervention Services Underbalanced Systems RPM System 3000™ Rotating Blowout Preventer, Setting a New Standard in Well Control, An Advanced Well Control System for Underbalanced Drilling Operations, Brochure #333.00, © 2002 Weatherford (4 pages).
Medley, George; Moore, Dennis; Nauduri, Sagar; Signa Engineering Corp.; SPE/IADC Managed Pressure Drilling & Underbalanced Operations (PowerPoint presentation; 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Applications (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexico OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages); see all but particularly see FIGS. 14-20; cited in 7V below where indicated as "document cited for other reasons".
Turck Works Industrial Automation; Factor 1 Sensing for Metal Detection, cover page, first page and numbered pages 1.157 to 1.170 (16 pages) (printed in Jan. 2009).
Balluff Sensors Worldwide; Object Detection Catalog 08/09—Industrial Proximity Sensors for Non-Contact Detection of Metallic Targets at Ranges Generally under 50 mm (2 inches); Linear Position and Measurement; Linear Position Transducers; Inductive Distance Sensors; Photoelectric Distance Sensors; Magneto-Inductive Linear Position Sensors; Magnetic Linear/Rotary Encoder System; printed Dec. 23, 2008 (8 pages).
Inductive Sensors AC 2-Wire Tubular Sensors, Balluff product catalog pp. 1.109-1.120 (12 pages) (no date).
Inductive Sensors DC 2-Wire Tubular Sensors, Balluff product catalog pp. 1.125-1.136 (12 pages) (no date).
Inductive Sensors Analog Inductive Sensors, Balluff product catalog pp. 1.157-1.170 (14 pages) (no date).
Inductive Sensors DC 3-/4-Wire Inductive Sensors, Balluff product catalog pp. 1.72-1.92 (21 pages).
Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 1996-2010, Space Age Control, Inc., printed Jan. 11, 2009 (7 pages) (www.. spaceagecontrol.com/selpt.htm).
Liquid Flowmeters, Omega.com website; printed Jan. 26, 2009 (13 pages).
Super Autochoke—Automatic Pressure Regulation Under All Conditions © 2009 M-I, LLC; MI Swaco website; printed Apr. 2, 2009 (1 page).
Extended European Search Report R.61 EPC dated Sep. 16, 2010 for European Patent Application 08166660.4-1266/2050924 corresponding to U.S. Appl. No. 11/975,554, now US 2009/0101351 A1 (7 pages).
Office Action from the Canadian Intellectual Property Office dated Nov. 13, 2008 for Canadian Application No. 2,580,177 corresponding to U.S. Appl. No. 11/366,078, published as US-2006/0144622 A1, now U.S. Pat. No. 7,836,946 B2 (3 pages).
Response to European Patent Application No. 08719084.9 (corresponding to the present published application US2008/0210471 A1, now issued as U.S. Pat. No. 7,926,593) dated Nov. 16, 2010 (4 pages).
Office Action from the Canadian Intellectual Property Office dated Apr. 15, 2008 for Canadian Application No. 2,527,395 corresponding to U.S. Appl. No. 10/995,980, published as US-2006/0108119 A1, now U.S. Pat. No. 7,487,837 B2 (3 pages).
Office Action from the Canadian Intellectual Property Office dated Apr. 9, 2009 for Canadian Application No. 2,527,395 corresponding to U.S. Appl. No. 10/995,980, published as US-2006/0108119 A1, now U.S. Pat. No. 7,487,837 B2 (2 pages).
Office Action from the Canadian Intellectual Property Office dated Dec. 15, 2009 for Canadian Application No. 2,681,868 corresponding to U.S. Appl. No. 10/995,980, published as US-2006/0108119 A1, now U.S. Pat. No. 7,487,837 B2 (2 pages).
Examiner's First Report on Australian Patent Application No. 2005234651 from the Australian Patent Office dated Jul. 22, 2010 corresponding to U.S. Appl. No. 10/995,980, published as US-2006/0108119 A1, now U.S. Pat. No. 7,487,837 B2 (2 pages).
Office Action from the Canadian Intellectual Property Office dated Sep. 9, 2010 for Canadian Application No. 2,707,738 corresponding to U.S. Appl. No. 10/995,980, published as US-2006/0108119 A1, now U.S. Pat. No. 7,487,837 B2 (2 pages).
Web page of Ace Wire Spring & Form Company, Inc. printed Dec. 8, 2009 for "Garter Springs—Helical Extension & Compression" www.acewirespring.com/garter-springs.html (1 page).
Extended European Search Report (R 61 EPC) dated Mar. 4, 2011 for European Application No. 08166658.8-1266/2053197 corresponding to U.S. Appl. No. 11/975,946, published as US 2009-0101411 A1 (13 pages).
Canadian Intellectual Property Office Office Action dated Dec. 7, 2010, Application No. 2,641,238 entitled "Fluid Drilling Equipment" for Canadian Application corresponding to U.S. Appl. No. 11/975,946, published as US 2009-0101411 A1 (4 pages).
Grosso, J.A., "An Analysis of Well Kicks on Offshore Floating Drilling Vessels," SPE 4134, Oct. 1972, pp. 1-20, © 1972 Society of Petroleum Engineers (20 pages).
Bourgoyne, Jr., Adam T., et al., "Applied Drilling Engineering," pp. 168-171, © 1991 Society of Petroleum Engineers (6 pages).
Wagner, R.R., et al., "Surge Field Tests Highlight Dynamic Fluid Response," SPE/IADC 25771, Feb. 1993, pp. 883-892, © 1993 SPE/IADC Drilling Conference (10 pages).
Solvang, S.A., et al., "Managed Pressure Drilling Resolves Pressure Depletion Related Problems in the Development of the HPHT Kristin Field," SPE/IADC 113672, Jan. 2008, pp. 1-9, © 2008 IADC/SPE Managed Pressure Drilling and Underbalanced Operations Conference and Exhibition (9 pages).
Rasmussen, Ovle Sunde, et al., "Evaluation of MPD Methods for Compensation of Surge-and-Swab Pressures in Floating Drilling Operations," IADC/SPE 108346, Mar. 2007, pp. 1-11, © 2007 IADC/SPE Managed Pressure Drilling and Underbalanced Operations Conference and Exhibition (11 pages).
Shaffer Drill String Compensator available from National Oilwell Varco of Houston, Texas, printed Mar. 23, 2010 from http://www.nov.com/ProductDisplay.aspx?ID=4954&taxID=121 &terms=drill+string+compensators (1 page).
Shaffer Crown Mounted Compensator available from National Oilwell Varco of Houston, Texas, printed Mar. 23, 2010 from http://www.nov.com/ProductDisplay.aspx?ID=4949&taxID=121 &terms=active+drill+string+compensator (3 pages).
Active heave compensator available from National Oilwell Varco of Houston, Texas, printed Mar. 23, 2010 from http://www.nov.com/ProductDisplay.aspx?ID=3677&taxID=740 &terms=active+heave+compensator (3 pages).

(56) References Cited

OTHER PUBLICATIONS

Durst, Doug, et al., "Subsea Downhole Motion Compensator (SDMC): Field History, Enhancements, and the Next Generation," IADC/SPE 59152, Feb. 2000, pp. 1-12, © 2000 Society of Petroleum Engineers, Inc. (12 pages).
Sensoy, Taner, et al., Weatherford Secure Drilling Well Controlled Report "Surge and Swab effects due to the Heave motion of floating rigs", Nov. 10, 2009 (7 pages).
Hargreaves, David, et al., "Early Kick Detection for Deepwater Drilling: New Probabilistic Methods Applied in the Field", SPE 71369, © 2001, Society of Petroleum Engineers, Inc. (11 pages).
HH Heavy-Duty Hydraulic Cylinders catalog, The Sheffer Corporation, printed Mar. 5, 2010 from http://www.sheffercorp.com/layout_contact.shtm (27 pages).
Unocal Baroness Surface Stack Upgrade Modifications (5 pages).
Thomson, William T., Professor of Engineering, University of California, "Vibration Theory and Applications", © 1848, 1953, 1965 by Prentice-Hall, Inc. title page, copyright page, contents page and numbered pp. 3-9 (10 pages).
Active Heave Compensator, Ocean Drilling Program, www.oceandrilling.org (3 pages).
3.3 Floating Offshore Drilling Rigs (Floaters); 3.3.1. Technologies Required by Floaters; 3.3.2. Drillships; 3.3.3. Semisubmersible Drilling Rig; 4.3.4. Subsea Control System; 4.4. Prospect of Offshore Production System (5 pages).
Weatherford® Real Results First Rig Systems Solutions for Thailand Provides Safer, More Efficient Operations with Stabmaster® and Automated Side Doors, © 2009 Weatherford document No. 6909.00 discussing Weatherford's Integrated Safety Interlock System (ISIS) (1 page).
U.S. Appl. No. 61/205,209, filed Jan. 15, 2009; Abandoned, but priority claimed in US2010/0175882A1 (24 pages).
Smalley® Steel Ring Company, Spirolox®; pages from website http://www.spirolox.com/what_happened.php printed Apr. 27, 2010 (5 pages).
Extended European Search Report (R 61 EPC) dated Aug. 25, 2011 for European Application No. 11170537.2-2315 (see NPL "6L" above) corresponding to U.S. Appl. No. 13/048,497 published as US2011/0168932 A1 on Jul. 14, 2011 and its divisional of U.S. Appl. No. 12/080,170, filed Mar. 31, 2008, now U.S. Pat. No. 7,926,593 (5 pages).
Canadian Intellectual Property Office Action date May 16, 2011, Application No. 2,692,209 entitled "Latch Position Indicator System and Method" for Canadian Application corresponding to U.S. Appl. No. 12/322,860, now US Patent Publication US-2009-0139724-A1 (2 pages).
Extended European Search Report ( R 61 EPC) dated Feb. 22, 2012 for European Application No. 10152946.9-2315/2216498 corresponding to U.S. Appl. No. 12/322,860, published as US2009-0139724 A1 on Jun. 4, 2009 (our matter 63) (7 pages).
Extended European Search Report ( R 61 EPC) dated Feb. 28, 2012 for European Application No. 10150906.5-2315/2208855 corresponding to U.S. Appl. No. 12/643,093, published as US2010-0175882 A1 on Jul. 15, 2010 (our matter 64) (8 pages).
European Patent Office, Communication pursuant to Article 94(3) EPC, Application No. 10 152 946.9-2315, Weatherford/Lamb Inc. dated Mar. 12, 2012 (our matter 63EP) (6 pages).
Extended European Search Report R.61 EPC dated Jul. 8, 2013 for European Patent Application 13169036.4-1610 corresponding to U.S. Appl. No. 11/366,078, now U.S. Pat. No. 7,836,946 B2 (our matter 53) (9 pages).
Extended European Search Report R.61 EPC dated Aug. 12, 2013 for European Patent Application 13169038.0-1610 corresponding to U.S. Appl. No. 11/366,078, now U.S. Pat. No. 7,836,946 B2 (our matter 53) (4 pages).
Extended European Search Report R.61 EPC dated Aug. 16, 2013 for European Patent Application 08166660.13169036.4-1610 corresponding to U.S. Appl. No. 11/366,078, now U.S. Pat. No. 7,836,946 B2 (our matter 53) (6 pages).
Examiner's First Report on Australian Patent Application No. 2012202558 from the Australian Patent Office dated Nov. 28, 2012 corresponding to U.S. Appl. No. 10/995,980, now U.S. Pat. No. 7,487,837 B2 (our matter 51) (3 pages).
Canadian Office Action from the Canadian Intellectual Property Office in Canadian Application 2,527,395 dated Jan. 25, 2013 corresponding to U.S. Appl. No. 10/995,980, now U.S. Pat. No. 7,487,837 B2 (our matter 51) (3 pages).
Norwegian Office Action and Search Report dated Sep. 21, 2014, Application No. 20055480 entitled "Riser Rotating Control Device" for Norwegian Application corresponding U.S. Pat. No. 7,487,837 B2 (our matter 51) from which the present application claims priority (5 pages).
European Office Action dated May 11, 2015, Application No. 07103416.9 entitled "Rotating Control Head Radial Seal Protection and Leak Detection Systems" for European Application corresponding to U.S. Pat. No. 7,836,946 B2 (our matter 53) from which the present application claims priority (4 pages).
Canadian Office Action dated Jul. 6, 2015 (including an Examination Search Report dated Jun. 11, 2015) for Application No. 2,692,209 entitled "Latch Position Indicator System and Method", corresponding to U.S. Pat. No. 8,826,988 B2 (our matter 63) from which the present application claims priority (3 pages).
European Office Action dated Dec. 4, 2015 for European Application No. 10152946.9 entitled "Latch Position Indicator System and Method", corresponding to U.S. Pat. No. 8,826,988 B2 (our matter 63) from which the present application (our matter 83) claims priority (5 pages).

* cited by examiner

TO FIG. 21B
G3
V120
250 PSI
M2
V70
V60
T
P
A
B
MANIFOLD STACK
V150
634
V110
V100
3/32
1/8
900 PSI
V160
V140
FM40
CP
PLC
FM30
FM50
FM20
FM10
2000 PSI
800 PSI
PT70
PT
FM50L
V130
FM40L
FM30L
FM20L
FM10L
SP
P
B

START

PRESSURE >TARGET PRESSURE +100 OR PRESSURE<TARGET PRESSURE -100
YES
ADDVALUE = 100
NO
TARGET+10< PRESSURE<TARGET +100 OR TARGET-100<PRESSURE <TARGET-10
YES
ADD VALUE = 10
NO
TARGET+ TOLERANCE<PRESSURE< TARGET+10 OR TARGET-10<PRESSURE< TARGET-TOLERANCE
YES
ADDVALUE = 1
NO
G (CONTINUATION)

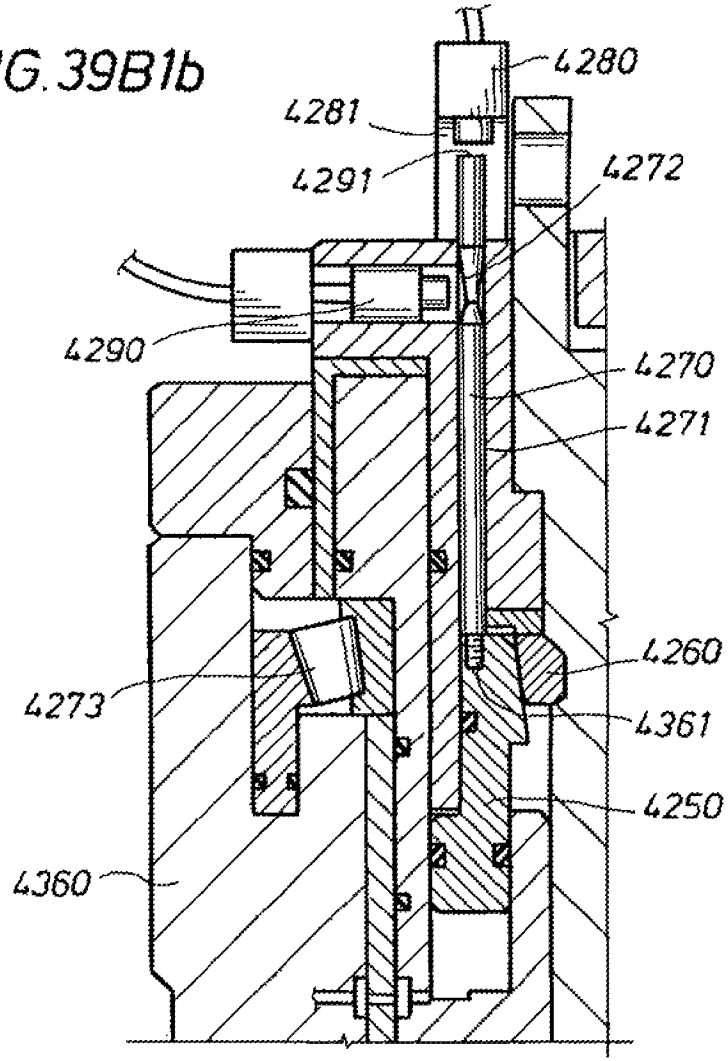
FIG. 39B1b
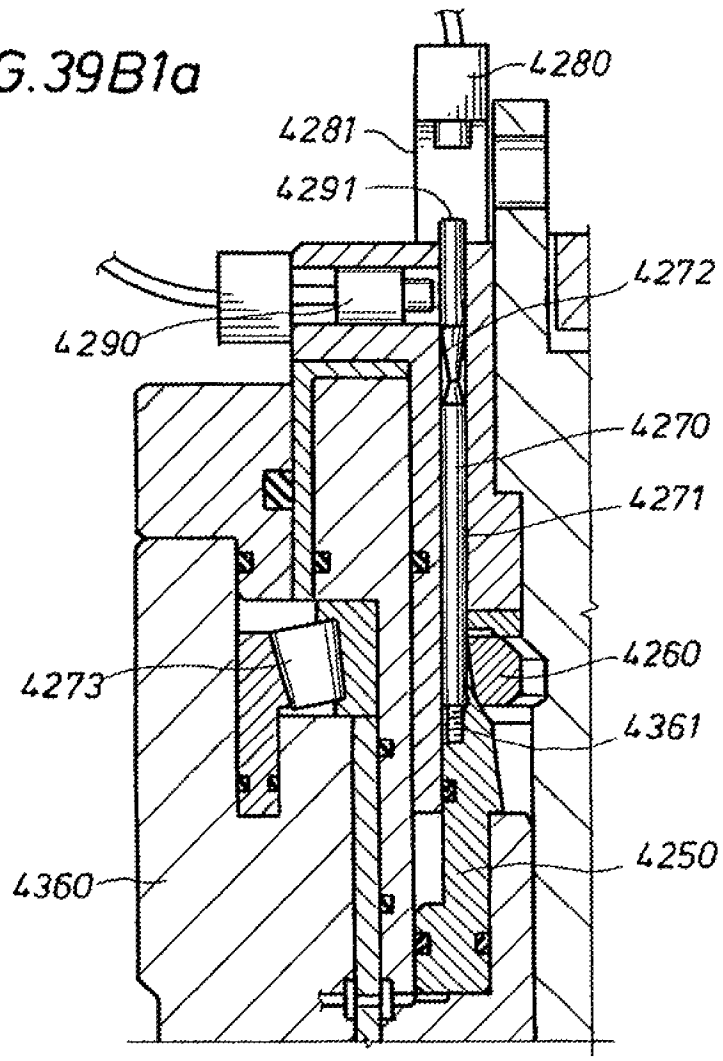
FIG. 39B1a

FIG. 39B2b
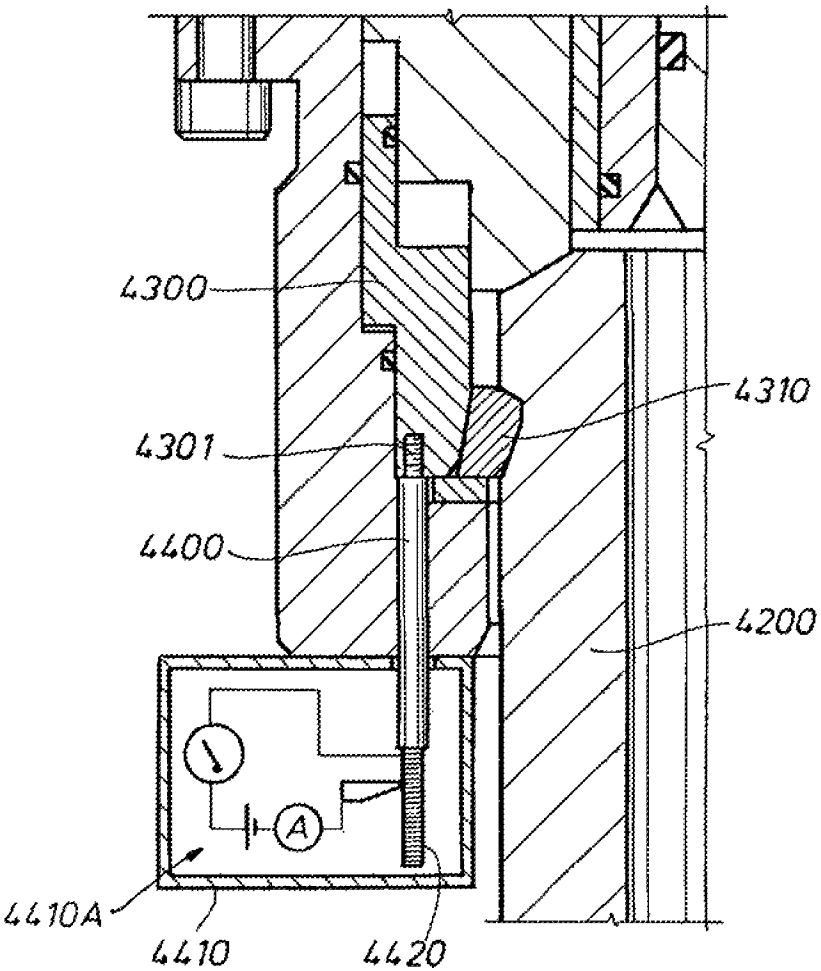
FIG. 39B2a
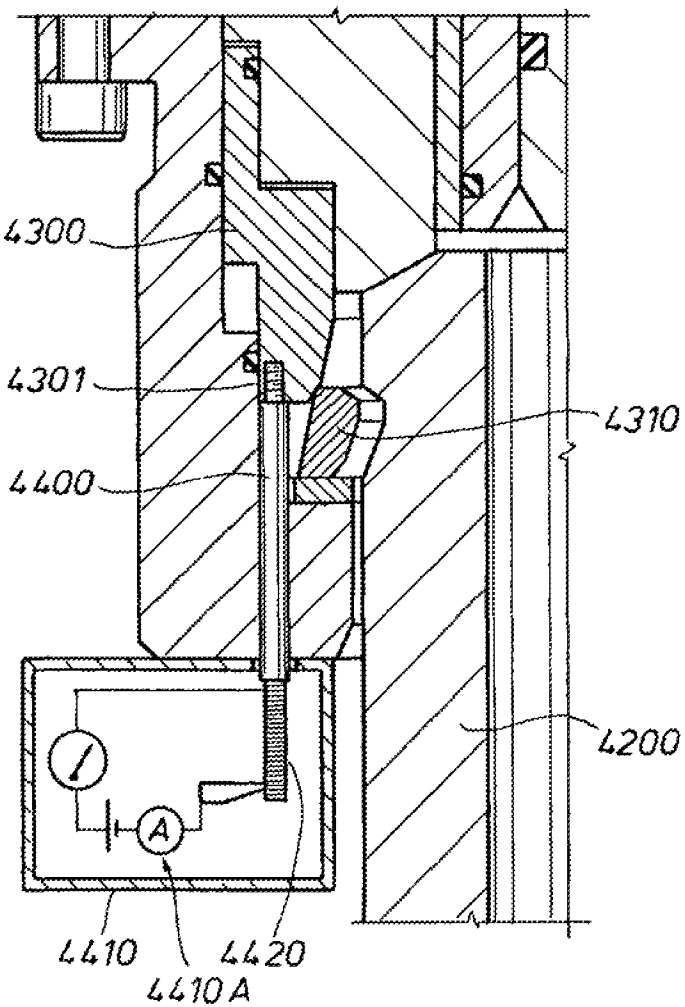

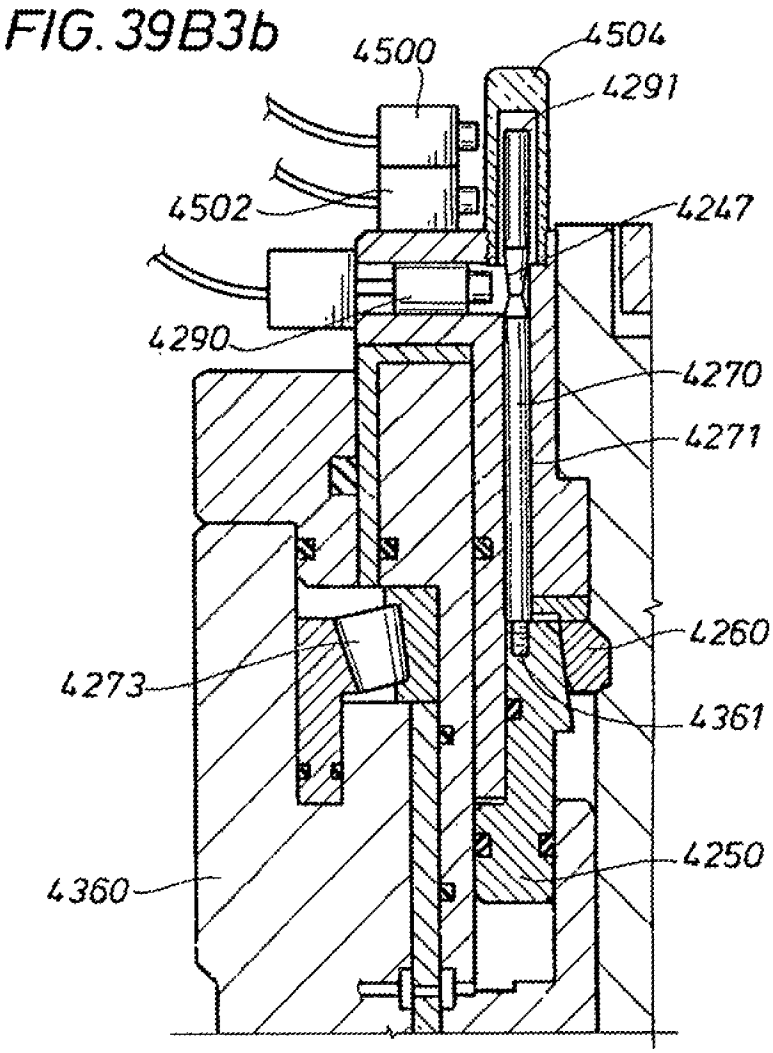
FIG. 39B3b
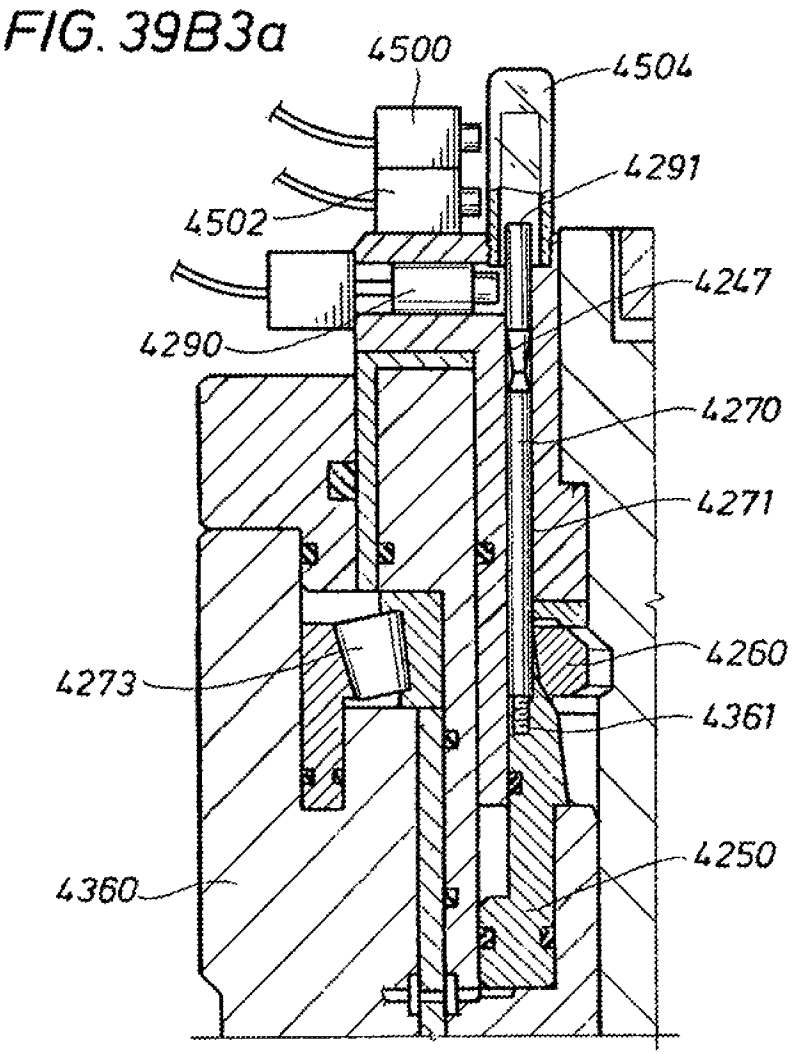
FIG. 39B3a

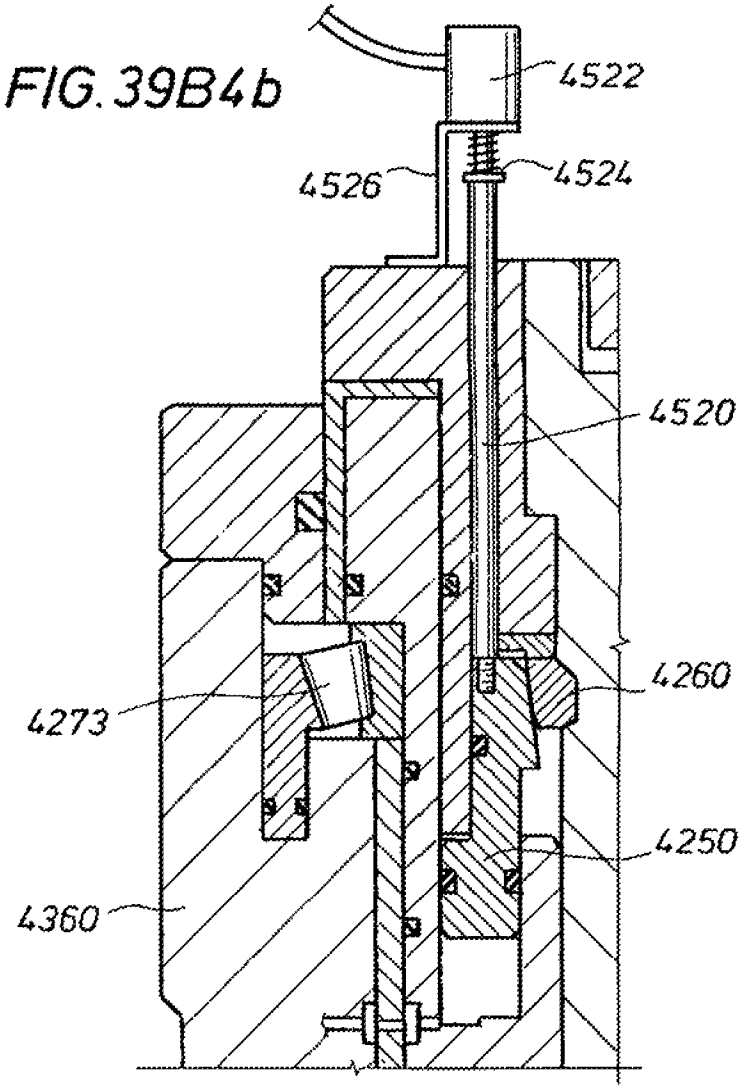
FIG. 39B4b
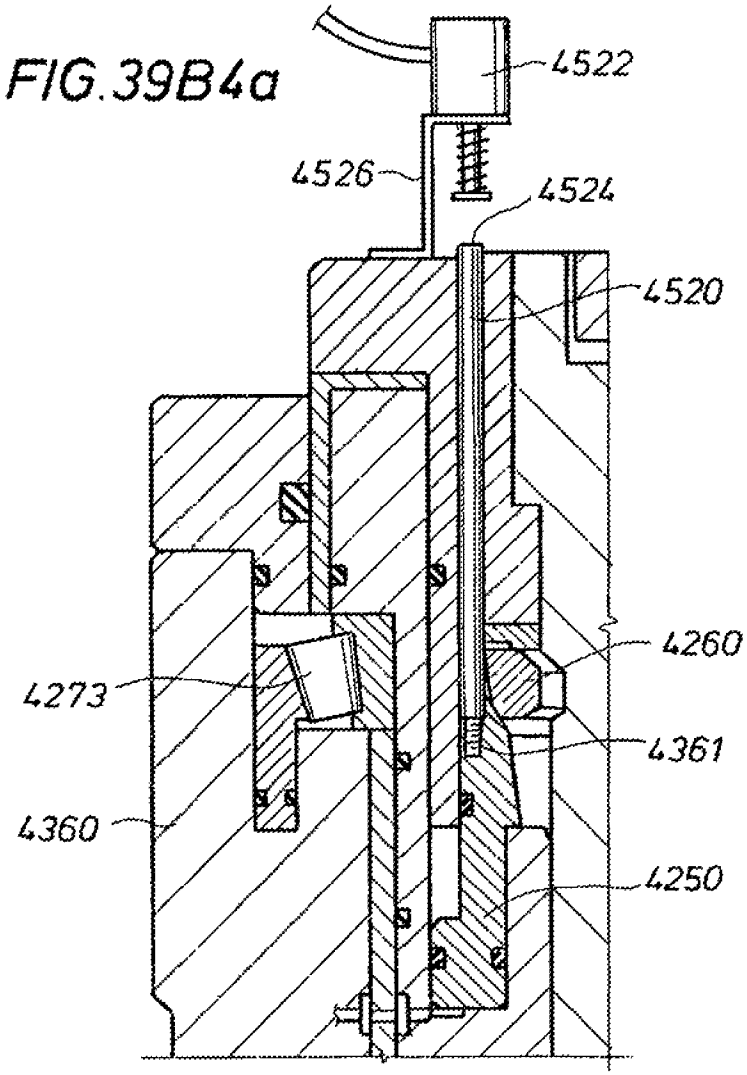
FIG. 39B4a

LATCH POSITION INDICATOR SYSTEM AND METHOD

CROSS-REFERENCE TO RELATED APPLICATIONS

This application is: (1) a continuation of U.S. application Ser. No. 12/322,860 filed on Feb. 6, 2009, now U.S. Pat. No. 8,826,988, which is a continuation-in-part of U.S. application Ser. No. 10/995,980 filed on Nov. 23, 2004, now U.S. Pat. No. 7,487,837; and this application is (2) a continuation of U.S. application Ser. No. 12/322,860 filed on Feb. 6, 2009, now U.S. Pat. No. 8,826,988, which is a continuation-in-part of U.S. application Ser. No. 11/366,078 filed on Mar. 2, 2006, now U.S. Pat. No. 7,836,946, which is a continuation-in-part of U.S. application Ser. No. 10/995,980 filed on Nov. 23, 2004, now U.S. Pat. No. 7,487,837, all of which applications are hereby incorporated by reference for all purposes in their entirety and are assigned to the assignee of the present invention.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

The present invention relates to the field of oilfield drilling equipment, and in particular to rotating control devices.

2. Description of the Related Art

Conventional offshore drilling techniques involve using hydraulic pressure generated by a preselected fluid inside the wellbore to control pressures in the formation being drilled. However, a majority of known resources, gas hydrates excluded, are considered economically undrillable with conventional techniques. Pore pressure depletion, the need to drill in deeper water, and increasing drilling costs indicate that the amount of known resources considered economically undrillable will continue to increase. Newer techniques, such as underbalanced drilling and managed pressure drilling, have been used to control pressure in the wellbore. These techniques present a need for pressure management devices, such as rotating control devices (RCDs) and diverters.

RCDs have been used in conventional offshore drilling. An RCD is a drill-through device with a rotating seal that contacts and seals against the drill string (drill pipe, casing, drill collars, kelly, etc.) for the purposes of controlling the pressure or fluid flow to the surface. Rig operators typically bolt a conventional RCD to a riser below the rotary table of a drilling rig. However, such a fixed connection has presented health, safety, and environmental (HSE) problems because retrieving the RCD has required unbolting the RCD from the riser, requiring personnel to go below the rotary table of the rig in the moon pool to disconnect the RCD. In addition to the HSE concerns, the retrieval procedure is complex and time consuming, decreasing the operational efficiency of the rig. Furthermore, space in the area above the riser typically limits the drilling rig operator's ability to install equipment on top of the riser.

U.S. Pat. No. 6,129,152 proposes a flexible rotating bladder and seal assembly that is hydraulically latchable with its rotating blow-out preventer housing. U.S. Pat. No. 6,457,529 proposes a circumferential ring that forces dogs outward to releasably attach an RCD with a manifold. U.S. Pat. No. 7,040,394 proposes inflatable bladders/seals. U.S. Pat. No. 7,080,685 proposes a rotatable packer that may be latchingly removed independently of the bearings and other non-rotating portions of the RCD. The '685 patent also proposes the use of an indicator pin urged by a piston to indicate the position of the piston. It is also known in the prior art to manually check the position of a piston in an RCD with a flashlight after removal of certain components of the RCD. However, this presents HSE problems as it requires personnel to go below the rotary table of the rig to examine the RCD, and it is time consuming.

Pub. No. US 2004/0017190 proposes a linear position sensor and a degrading surface to derive an absolute angular position of a rotating component. U.S. Pat. No. 5,243,187 proposes a body having a plurality of saw tooth-shaped regions which lie one behind the other, and two distance sensors for determining a rotational angle or displacement of the body.

The above discussed U.S. Pat. Nos. 5,243,187; 6,129,152; 6,457,529; 7,040,394; and 7,080,685; and Pub. No. US 2004/0017190 are hereby incorporated by reference for all purposes in their entirety. U.S. Pat. Nos. 6,129,152; 7,040,394 and 7,080,685 are assigned to the assignee of the present invention.

It would be desirable to retrieve an RCD or other oilfield device positioned below the rotary table of the rig without personnel having to go below the rotary table. It would also be desirable to remotely determine with confidence the position of the latch(s) relative to an RCD.

BRIEF SUMMARY OF THE INVENTION

A latch assembly may be bolted or otherwise fixedly attached to a housing section, such as a riser or bell nipple positioned on a riser. A hydraulically actuated piston in the latch assembly may move from a second position to a first position, thereby moving a retainer member, which may be a plurality of spaced-apart dog members or a C-shaped member, to a latched position. The retainer member may be latched with an oilfield device, such as an RCD or a protective sleeve. The process may be reversed to unlatch the retainer member and to remove the oilfield device. A second piston may urge the first piston to move to the second position, thereby providing a backup unlatching mechanism. A latch assembly may itself be latchable to a housing section, using a similar piston and retainer member mechanism as used to latch the oilfield device to the latch assembly.

A method and system are provided for remotely determining whether the latch assemblies are latched or unlatched. In one embodiment, a comparator may compare a measured fluid value of the latch assembly hydraulic fluid with a predetermined fluid value to determine whether the latch assembly is latched or unlatched. In another embodiment, a comparator may compare a first measured fluid value of the latch assembly hydraulic fluid with a second measured fluid value of the hydraulic fluid to determine whether the latch assembly is latched or unlatched.

In another embodiment, an electrical switch may be positioned with a retainer member, and the switch output interpreted to determine whether the latch assembly is latched or unlatched. In another embodiment, a mechanical valve may be positioned with a piston, and a fluid value measured to determine whether the latch assembly is latched or unlatched. In another embodiment, a latch position indicator sensor, preferably an analog inductive proximity sensor, may be positioned with, but without contacting, a piston or a retainer member, and the sensor output interpreted to determine whether the latch assembly is latched or unlatched. The sensor may preferably detect the distance between the sensor and the targeted piston or retainer member. In one embodiment, the surface of the piston or retainer member targeted by the sensor may be inclined. In another embodiment, the surface of the piston or retainer member targeted by the sensor may contain more than one metal. The sensor may also detect movement of the targeted piston or retainer member. In another embodiment, more than one sensor may be positioned with a piston or a retainer member for redundancy. In another embodiment, sensors make physical contact with the targeted piston and/or retainer member.

BRIEF DESCRIPTION OF THE DRAWINGS

A better understanding of the present invention can be obtained when the following detailed description of various disclosed embodiments is considered in conjunction with the following drawings, in which:

FIGS. 15K-15O are enlarged cross-section views of the dual hydraulic latch assembly of FIGS. 6-8 taken along lines 15K-15K, 15L-15L, 15M-15M, 15N-15N, and 15O-15O of FIG. 16, illustrating passageways of a hydraulic fluid volume-sensing system for communicating whether the dual latch assembly is unlatched or latched;

FIG. 39B1*a* is a cross-section elevational detail view of the upper latch subassembly of FIG. 39B on the left side of the vertical break line except with the upper retainer member unlatched resulting in the upper indicator pin retracted further into the RCD;

FIG. 39B1*b* is a detail view of the upper latch subassembly of FIG. 39B on the left side of the vertical break line;

FIG. 39B2*a* is a cross-section elevational detail view of the lower latch subassembly of FIG. 39B on the left side of the vertical break line except with the lower retainer member unlatched, another embodiment of a lower indicator pin retracted further into the RCD, and another embodiment of a sensor;

FIG. 39B2*b* is the same view as FIG. 39B2*a* except with the lower retainer member latched resulting in the lower indicator pin protruding or extending further from the RCD;

FIG. 39B3*a* is a cross-section elevational detail view of the upper latch subassembly of FIG. 39B on the left side of the vertical break line except with the upper retainer member unlatched resulting in the upper indicator pin retracted further into the RCD, and other embodiments of sensors;

FIG. 39B3*b* is the same view as FIG. 39B3*a* except with the upper retainer member latched resulting in the upper indicator pin protruding or extending further from the RCD;

FIG. 39B4*a* is a cross-section elevational detail view of the upper latch subassembly of FIG. 39B on the left side of the vertical break line except with the upper retainer member unlatched, other embodiments of the upper indicator pin retracted further into the RCD, and other embodiments of a sensor;

FIG. 39B4*b* is the same view as FIG. 39B4*a* except with the upper retainer member latched resulting in the upper indicator pin protruding or extending further from the RCD;

DETAILED DESCRIPTION OF THE INVENTION

Although the following is sometimes described in terms of an offshore platform environment, all offshore and onshore embodiments are contemplated. Additionally, although the following is described in terms of oilfield drilling, the disclosed embodiments can be used in other operating environments and for drilling for non-petroleum fluids.

Figure 1:
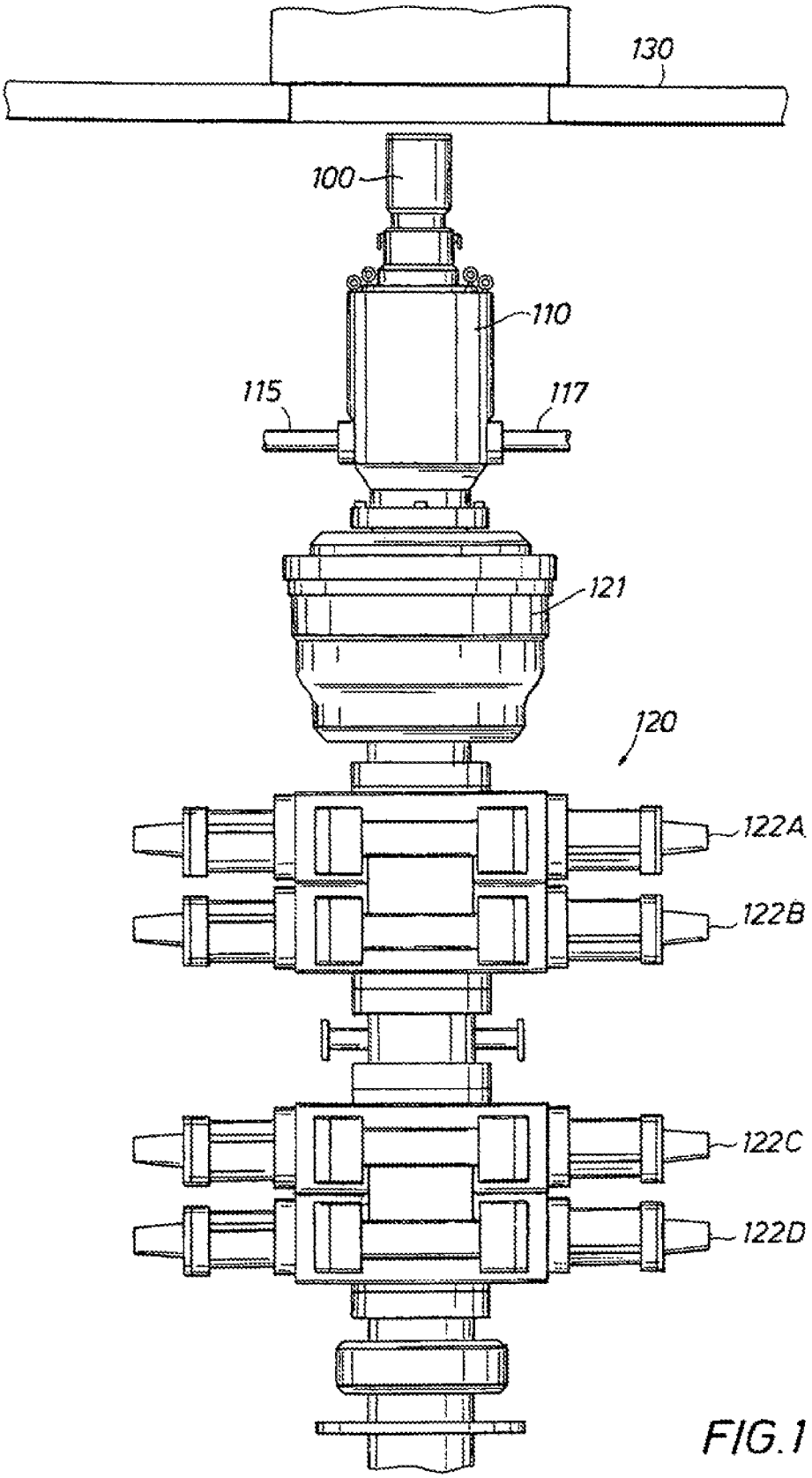
FIG. 1 is an elevational view of an RCD and a dual diverter housing positioned on a blowout preventer stack below a rotary table.

Turning to FIG. 1, a rotating control device 100 is shown latched into a riser or bell nipple 110 above a typical blowout preventer (BOP) stack, generally indicated at 120. As illustrated in FIG. 1, the exemplary BOP stack 120 contains an annular BOP 121 and four ram-type BOPs 122A-122D. Other BOP stack 120 configurations are contemplated and the configuration of these BOP stacks is determined by the work being performed. The rotating control device 100 is shown below the rotary table 130 in a moon pool of a fixed offshore drilling rig, such as a jackup or platform rig. The remainder of the drilling rig is not shown for clarity of the figure and is not significant to this application. Two diverter conduits 115 and 117 extend from the riser nipple 110. The diverter conduits 115 and 117 are typically rigid conduits; however, flexible conduits or lines are contemplated. With the rotating control device 100 latched with the riser nipple 110, the combination of the rotating control device 100 and riser nipple 110 functions as a rotatable marine diverter. In this configuration, the operator can rotate drill pipe (not shown) while the rotating marine diverter is closed or connected to a choke, for managed pressure or underbalanced drilling. The present invention could be used with the closed-loop circulating systems as disclosed in Pub. No. U.S. Pat. No. 7,044,237 B2 entitled "Drilling System and Method"; International Pub. No. WO 2002/050398 published Jun. 27, 2002 entitled "Closed Loop Fluid-Handling System for Well Drilling"; and International Pub. No. WO 2003/071091 published Aug. 28, 2003 entitled "Dynamic Annular Pressure Control Apparatus and Method." The disclosures of Pub. No. US 2003/0079912, International Pub. Nos. WO 2002/050398 and WO 2003/071091 are incorporated by reference herein in their entirety for all purposes.

Figure 2:
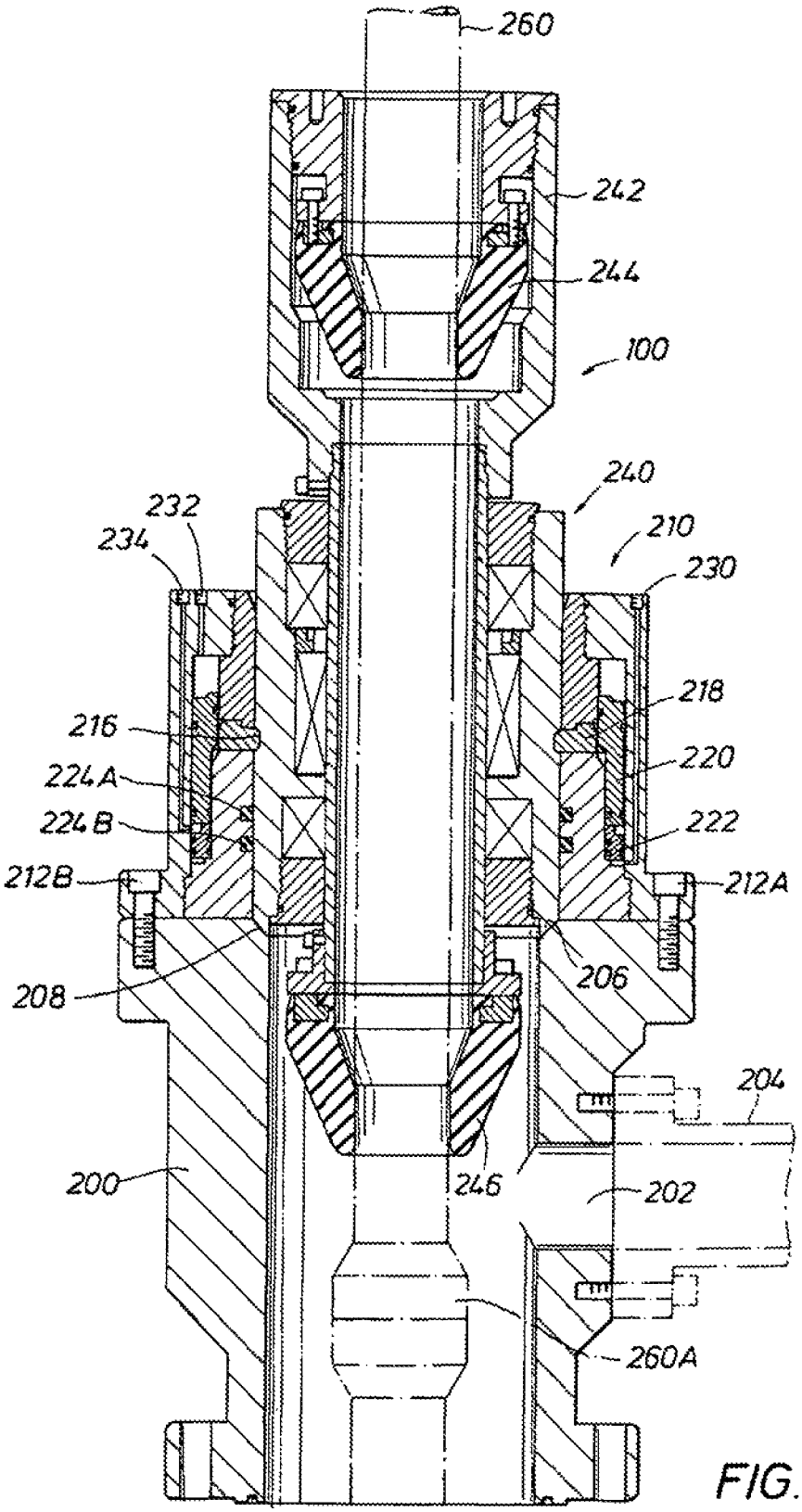
FIG. 2 is a cross-section view of an RCD and a single hydraulic latch assembly better illustrating the RCD shown in FIG. 1.

FIG. 2 is a cross-section view of an embodiment of a single diverter housing section, riser section, or other applicable wellbore tubular section (hereinafter a "housing section"), and a single hydraulic latch assembly to better illustrate the rotating control device 100 of FIG. 1. As shown in FIG. 2, a latch assembly separately indicated at 210 is bolted to a housing section 200 with bolts 212A and 212B. Although only two bolts 212A and 212B are shown in FIG. 2, any number of bolts and any desired arrangement of bolt positions can be used to provide the desired securement and sealing of the latch assembly 210 to the housing section 200. As shown in FIG. 2, the housing section 200 has a single outlet 202 for connection to a diverter conduit 204, shown in phantom view; however, other numbers of outlets and conduits can be used, as shown, for example, in the dual diverter embodiment of FIG. 1 with diverter conduits 115 and 117. Again, this conduit 204 can be connected to a choke. The size, shape, and configuration of the housing section 200 and latch assembly 210 are exemplary and illustrative only, and other sizes, shapes, and configurations can be used to allow connection of the latch assembly 210 to a riser. In addition, although the hydraulic latch assembly is shown connected to a nipple, the latch assembly can be connected to any conveniently configured section of a wellbore tubular or riser.

A landing formation 206 of the housing section 200 engages a shoulder 208 of the rotating control device 100, limiting downhole movement of the rotating control device 100 when positioning the rotating control device 100. The relative position of the rotating control device 100 and housing section 200 and latching assembly 210 are exemplary and illustrative only, and other relative positions can be used.

Figure 2A:
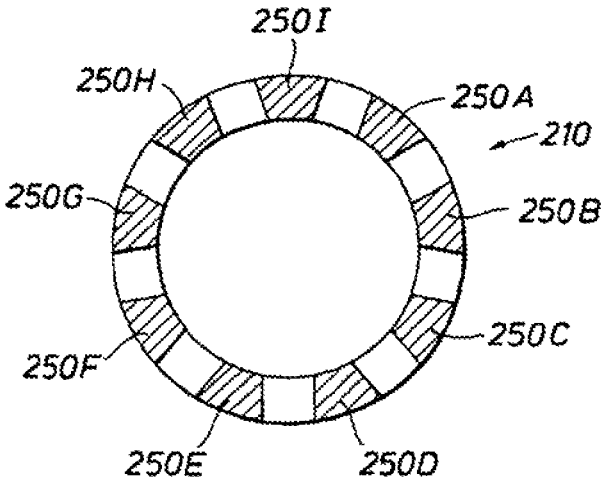
FIG. 2A is a cross-section view of a portion of the hydraulic latch assembly of FIG. 2 illustrating a plurality of dog members as a retainer member.

FIG. 2 shows the latch assembly 210 latched to the rotating control device 100. A retainer member 218 extends radially inwardly from the latch assembly 210, engaging a latching formation 216 in the rotating control device 100, latching the rotating control device 100 with the latch assembly 210 and therefore with the housing section 200 bolted with the latch assembly 210. In some embodiments, the retainer member 218 can be "C-shaped", such as retainer ring 275 in FIG. 2B, that can be compressed to a smaller diameter for engagement with the latching formation 216. However, other types and shapes of retainer rings are contemplated. In other embodiments, the retainer member 218 can be a plurality of dog, key, pin, or slip members, spaced apart and positioned around the latch assembly 210, as illustrated by dog members 250A, 250B, 250C, 250D, 250E, 250F, 250G, 250H, and 2501 in FIG. 2A. In embodiments where the retainer member 218 is a plurality of dog or key members, the dog or key members can optionally be spring-biased. The number, shape, and arrangement of dog members 250 illustrated in FIG. 2A is illustrative and exemplary only, and other numbers, arrangements, and shapes can be used. Although a single retainer member 218 is described herein, a plurality of retainer members 218 can be used. The retainer member 218 has a cross section sufficient to engage the latching formation 216 positively and sufficiently to limit axial movement of the rotating control device 100 and still engage with the latch assembly 210. An annular piston 220 is shown in a first position in FIG. 2, in which the piston 220 blocks the retainer member 218 in the radially inward position for latching with the rotating control device 100. Movement of the piston 220 from a second position to the first position compresses or moves the retainer member 218 radially inwardly to the engaged or latched position shown in FIG. 2. Although shown in FIG. 2 as an annular piston 220, the piston 220 can be implemented, for example, as a plurality of separate pistons disposed about the latch assembly 210.

Figure 6:
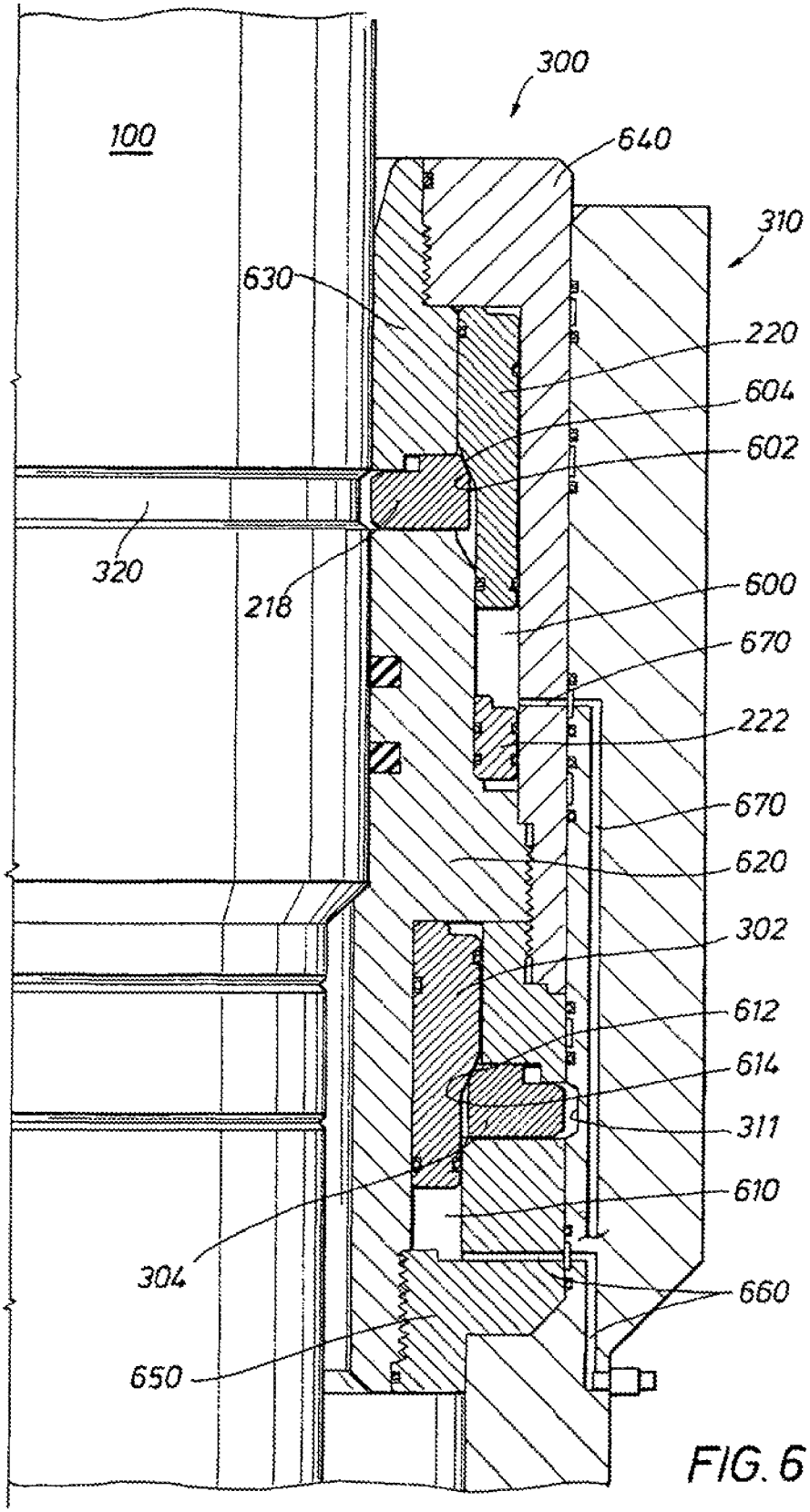
FIG. 6 is an enlarged cross-section detail view of one side of the dual hydraulic latch assembly of FIG. 3, with both the RCD and the housing section unlatched from the latch assembly.

As best shown in the dual hydraulic latch assembly embodiment of FIG. 6, when the piston 220 moves to a second position, the retainer member 218 can expand or move radially outwardly to disengage from and unlatch the rotating control device 100 from the latch assembly 210. The retainer member 218 and latching formation 216 (FIG. 2) or 320 (FIG. 6) can be formed such that a predetermined upward force on the rotating control device 100 will urge the retainer member radially outwardly to unlatch the rotating control device 100. A second or auxiliary piston 222 can be used to urge the first piston 220 into the second position to unlatch the rotating control device 100, providing a backup unlatching capability. The shape and configuration of pistons 220 and 222 are exemplary and illustrative only, and other shapes and configurations can be used.

Returning now to FIG. 2, hydraulic ports 232 and 234 and corresponding gun-drilled passageways allow hydraulic actuation of the piston 220. Increasing the relative pressure on port 232 causes the piston 220 to move to the first position, latching the rotating control device 100 to the latch assembly 210 with the retainer member 218. Increasing the relative pressure on port 234 causes the piston 220 to move to the second position, allowing the rotating control device 100 to unlatch by allowing the retainer member 218 to expand or move and disengage from the rotating control device 100. Connecting hydraulic lines (not shown in the figure for clarity) to ports 232 and 234 allows remote actuation of the piston 220.

The second or auxiliary annular piston 222 is also shown as hydraulically actuated using hydraulic port 230 and its corresponding gun-drilled passageway. Increasing the relative pressure on port 230 causes the piston 222 to push or urge the piston 220 into the second or unlatched position, should direct pressure via port 234 fail to move piston 220 for any reason.

The hydraulic ports 230, 232 and 234 and their corresponding passageways shown in FIG. 2 are exemplary and illustrative only, and other numbers and arrangements of hydraulic ports and passageways can be used. In addition, other techniques for remote actuation of pistons 220 and 222, other than hydraulic actuation, are contemplated for remote control of the latch assembly 210.

Thus, the rotating control device illustrated in FIG. 2 can be positioned, latched, unlatched, and removed from the housing section 200 and latch assembly 210 without sending personnel below the rotary table into the moon pool to manually connect and disconnect the rotating control device 100.

An assortment of seals is used between the various elements described herein, such as wiper seals and O-rings, known to those of ordinary skill in the art. For example, each piston 220 preferably has an inner and outer seal to allow fluid pressure to build up and force the piston in the direction of the force. Likewise, seals can be used to seal the joints and retain the fluid from leaking between various components. In general, these seals will not be further discussed herein.

For example, seals 224A and 224B seal the rotating control device 100 to the latch assembly 210. Although two seals 224A and 224B are shown in FIG. 2, any number and arrangement of seals can be used. In one embodiment, seals 224A and 224B are Parker Polypak® ¼-inch cross section seals from Parker Hannifin Corporation. Other seal types can be used to provide the desired sealing.

Figure 3:
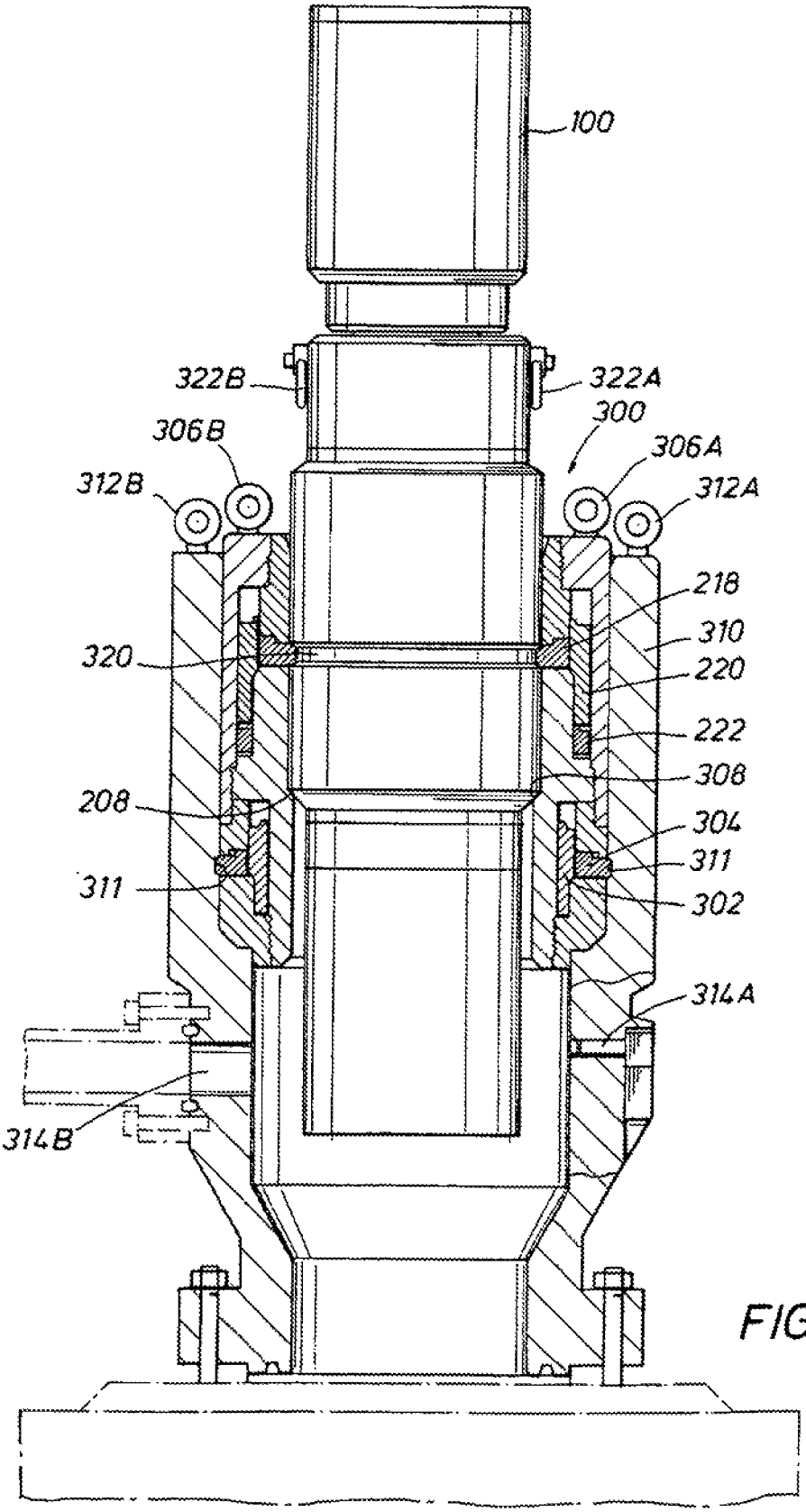
FIG. 3 is a cross-section view of an RCD, a single diverter housing, and a dual hydraulic latch assembly.

FIG. 3 illustrates a second embodiment of a latch assembly, generally indicated at 300, that is a dual hydraulic latch assembly. As with the single latch assembly 210 embodiment illustrated in FIG. 2, piston 220 compresses or moves retainer member 218 radially inwardly to latch the rotating control device 100 to the latch assembly 300. The retainer member 218 latches the rotating control device 100 in a latching formation, shown as an annular groove 320, in an outer housing of the rotating control device 100 in FIG. 3. The use and shape of annular groove 320 is exemplary and illustrative only and other latching formations and formation shapes can be used. The dual hydraulic latch assembly includes the pistons 220 and 222 and retainer member 218 of the single latch assembly embodiment of FIG. 2 as a first latch subassembly. The various embodiments of the dual hydraulic latch assembly discussed below as they relate to the first latch subassembly can be equally applied to the single hydraulic latch assembly of FIG. 2.

In addition to the first latch subassembly comprising the pistons 220 and 222 and the retainer member 218, the dual hydraulic latch assembly 300 embodiment illustrated in FIG. 3 provides a second latch subassembly comprising a third piston 302 and a second retainer member 304. In this embodiment, the latch assembly 300 is itself latchable to a housing section 310, shown as a riser nipple, allowing remote positioning and removal of the latch assembly 300. In such an embodiment, the housing section 310 and dual hydraulic latch assembly 300 are preferably matched with each other, with different configurations of the dual hydraulic latch assembly implemented to fit with different configurations of the housing section 310. A common embodiment of the rotating control device 100 can be used with multiple dual hydraulic latch assembly embodiments; alternately, different embodiments of the rotating control device 100 can be used with each embodiment of the dual hydraulic latch assembly 300 and housing section 310.

As with the first latch subassembly, the piston 302 moves to a first or latching position. However, the retainer member 304 instead expands radially outwardly, as compared to inwardly, from the latch assembly 300 into a latching formation 311 in the housing section 310. Shown in FIG. 3 as an annular groove 311, the latching formation 311 can be any suitable passive formation for engaging with the retainer member 304. As with pistons 220 and 222, the shape and configuration of piston 302 is exemplary and illustrative only and other shapes and configurations of piston 302 can be used. In some embodiments, the retainer member 304 can be "C-shaped", such as retainer ring 275 in FIG. 2B, that can be expanded to a larger diameter for engagement with the latching formation 311. However, other types and shapes of retainer rings are contemplated. In other embodiments, the retainer member 304 can be a plurality of dog, key, pin, or slip members, positioned around the latch assembly 300. In embodiments where the retainer member 304 is a plurality of dog or key members, the dog or key members can optionally be spring-biased. Although a single retainer member 304 is described herein, a plurality of retainer members 304 can be used. The retainer member 304 has a cross section sufficient to engage positively the latching formation 311 to limit axial movement of the latch assembly 300 and still engage with the latch assembly 300.

Shoulder 208 of the rotating control device 100 in this embodiment lands on a landing formation 308 of the latch assembly 300, limiting downward or downhole movement of the rotating control device 100 in the latch assembly 300. As stated above, the latch assembly 300 can be manufactured for use with a specific housing section, such as housing section 310, designed to mate with the latch assembly 300. In contrast, the latch assembly 210 of FIG. 2 can be manufactured to standard sizes and for use with various generic housing sections 200, which need no modification for use with the latch assembly 210.

Cables (not shown) can be connected to eyelets or rings 322A and 322B mounted on the rotating control device 100 to allow positioning of the rotating control device 100 before and after installation in a latch assembly. The use of cables and eyelets for positioning and removal of the rotating control device 100 is exemplary and illustrative, and other positioning apparatus and numbers and arrangements of eyelets or other attachment apparatus, such as discussed below, can be used.

Similarly, the latch assembly 300 can be positioned in the housing section 310 using cables (not shown) connected to eyelets 306A and 306B, mounted on an upper surface of the latch assembly 300. Although only two such eyelets 306A and 306B are shown in FIG. 3, other numbers and placements of eyelets can be used. Additionally, other techniques for mounting cables and other techniques for positioning the unlatched latch assembly 300, such as discussed below, can be used. As desired by the operator of a rig, the latch assembly 300 can be positioned or removed in the housing section 310 with or without the rotating control device 100. Thus, should the rotating control device 100 fail to unlatch from the latch assembly 300 when desired, for example, the latched rotating control device 100 and latch assembly 300 can be unlatched from the housing section 310 and removed as a unit for repair or replacement. In other embodiments, a shoulder of a running tool, tool joint 260A of a string 260 of pipe, or any other shoulder on a tubular that could engage lower stripper rubber 246 can be used for positioning the rotating control device 100 instead of the above-discussed eyelets and cables. An exemplary tool joint 260A of a string of pipe 260 is illustrated in phantom in FIG. 2.

Figure 4:
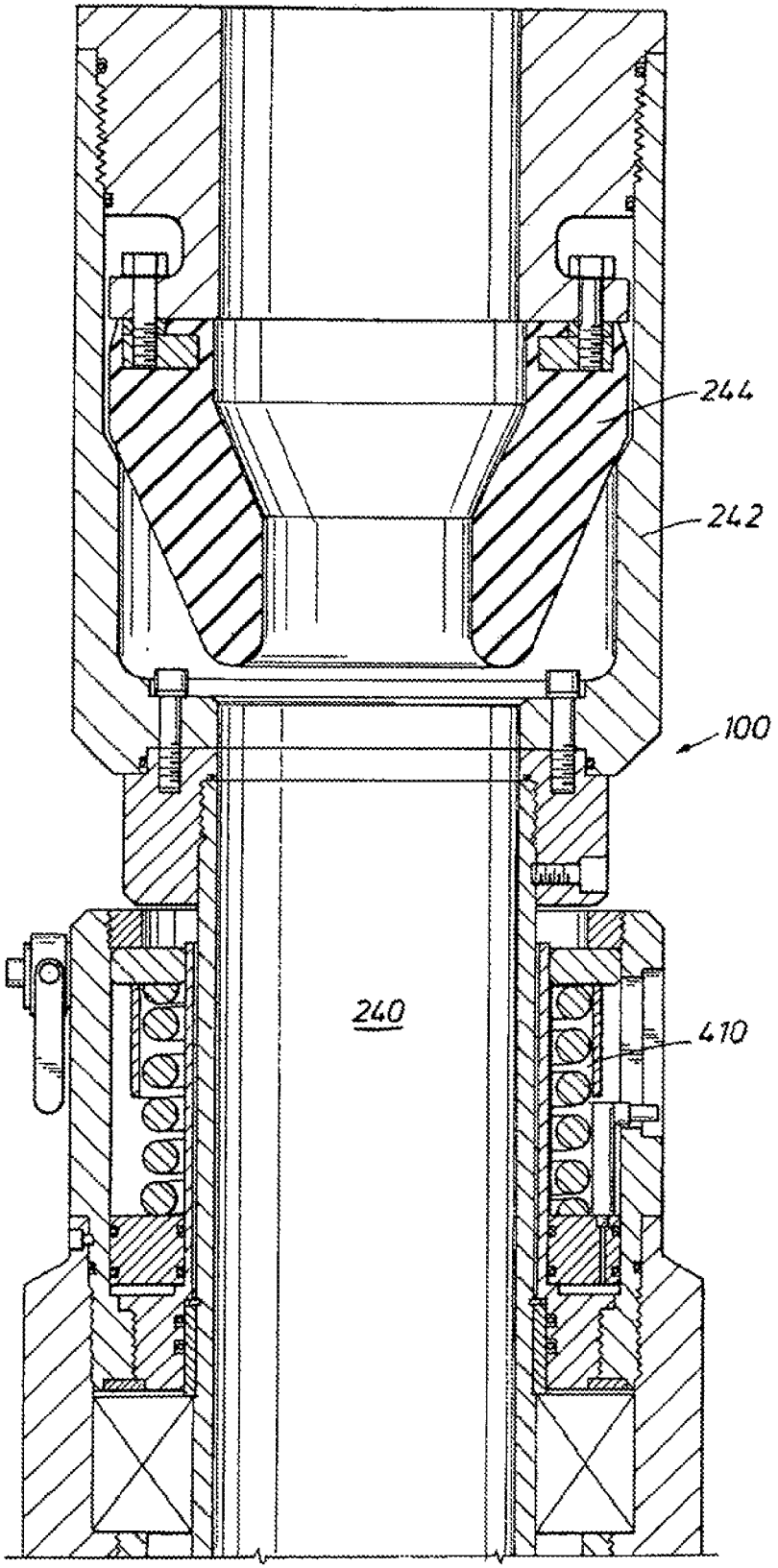
FIG. 4 is an enlarged cross-section detail view of an upper end of the RCDs of FIGS. 1, 2, and 3 with an accumulator.
Figure 5:
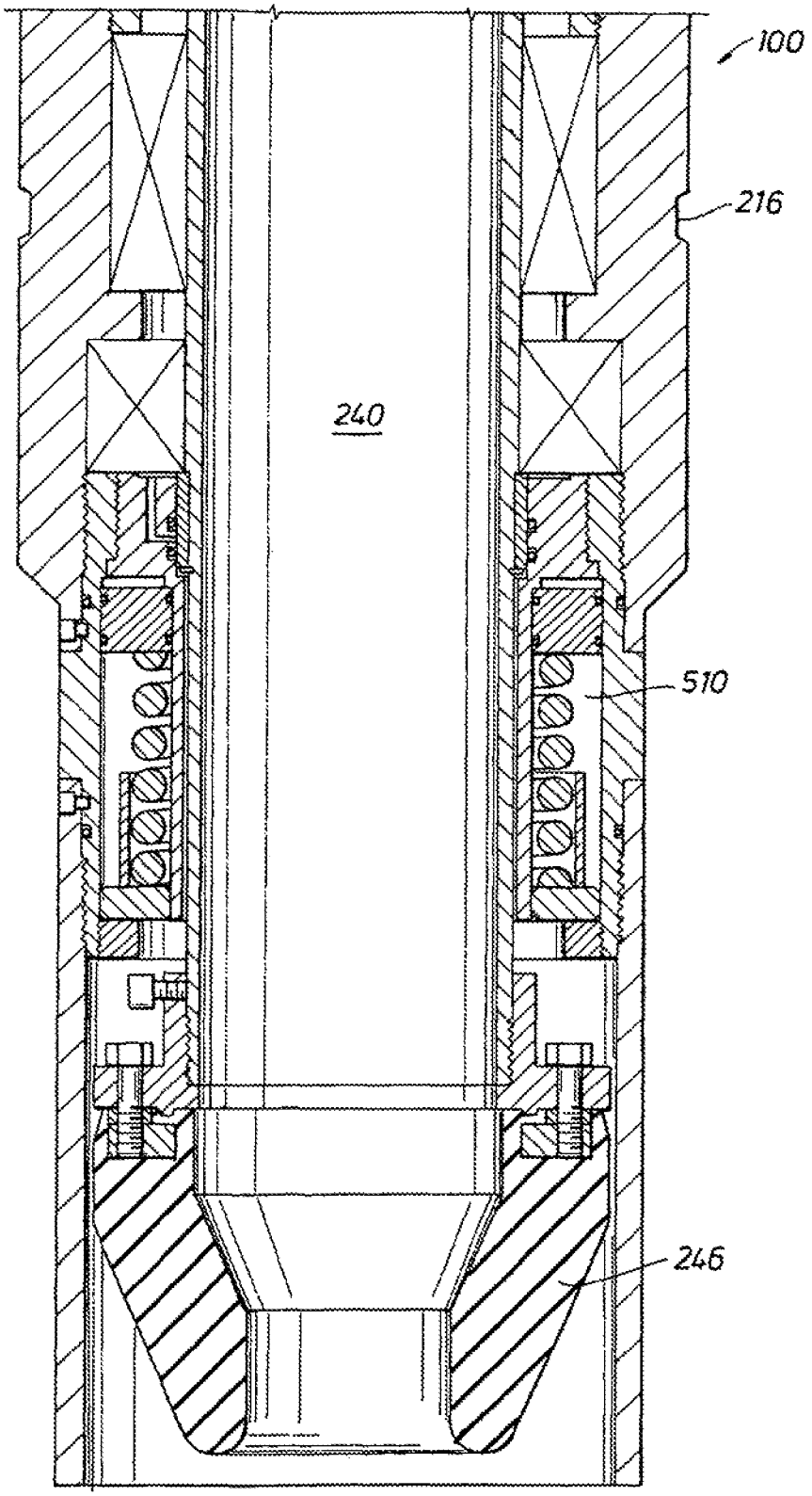
FIG. 5 is an enlarged cross-section detail view of a lower end of the RCDs of FIGS. 1, 2, and 3 with an accumulator.

As best shown in FIGS. 2, 4, and 5, the rotating control device 100 includes a bearing assembly 240. The bearing assembly 240 is similar to the Weatherford-Williams model 7875 rotating control device, now available from Weatherford International, Inc., of Houston, Tex. Alternatively, Weatherford-Williams models 7000, 7100, IP-1000, 7800, 8000/9000, and 9200 rotating control devices or the Weatherford RPM SYSTEM 3000™, now available from Weatherford International, Inc., could be used. Preferably, a rotating control device 240 with two spaced-apart seals, such as stripper rubbers, is used to provide redundant sealing. The major components of the bearing assembly 240 are described in U.S. Pat. No. 5,662,181, now owned by Weatherford/Lamb, Inc., which is incorporated herein by reference in its entirety for all purposes. Generally, the bearing assembly 240 includes a top rubber pot 242 that is sized to receive a top stripper rubber or inner member seal 244; however, the top rubber pot 242 and seal 244 can be omitted, if desired. Preferably, a bottom stripper rubber or inner member seal 246 is connected with the top seal 244 by the inner member of the bearing assembly 240. The outer member of the bearing assembly 240 is rotatably connected with the inner member. In addition, the seals 244 and 246 can be passive stripper rubber seals, as illustrated, or active seals as known by those of ordinary skill in the art.

In the embodiment of a single hydraulic latch assembly 210, such as illustrated in FIG. 2, the lower accumulator 510 as shown in FIG. 5 is required, because hoses and lines cannot be used to maintain hydraulic fluid pressure in the bearing assembly 100 lower portion. In addition, the accumulator 510 allows the bearings (not shown) to be self-lubricating. An additional accumulator 410, as shown in FIG. 4, can be provided in the upper portion of the bearing assembly 100 if desired.

Turning to FIG. 6, an enlarged cross-section view illustrates one side of the latch assembly 300. Both the first retainer member 218 and the second retainer member 304 are shown in their unlatched position, with pistons 220 and 302 in their respective second, or unlatched, position. Sections 640 and 650 form an outer housing for the latch assembly 300, while sections 620 and 630 form an inner housing, illustrated in FIG. 6 as threadedly connected to the outer housing 640 and 650. Other types of connections can be used to connect the inner housing and outer housing of the latch assembly 300. Furthermore, the number, shape, relative sizes, and structural interrelationships of the sections 620, 630, 640 and 650 are exemplary and illustrative only and other relative sizes, numbers, shapes, and configurations of sections, and arrangements of sections can be used to form inner and outer housings for the latch assembly 300. The inner housings 620 and 630 and the outer housings 640 and 650 form chambers 600 and 610, respectively. Pistons 220 and 222 are slidably positioned in chamber 600 and piston 302 is slidably positioned in chamber 610. The relative size and position of chambers 600 and 610 are exemplary and illustrative only. In particular, some embodiments of the latch assembly 300 can have the relative position of chambers 610 and 600 reversed, with the first latch subassembly of pistons 220, 222, and retainer member 218 being lower (relative to FIG. 6) than the second latch subassembly of piston 302 and retainer member 304.

As illustrated in FIG. 6, the piston 220 is axially aligned in an offset manner from the retainer member 218 by an amount sufficient to engage a tapered surface 604 on the outer periphery of the retainer member 218 with a corresponding tapered surface 602 on the inner periphery of the piston 220. The force exerted between the tapered surfaces 602 and 604 compresses the retainer member 218 radially inwardly to engage the groove 320. Similarly, the piston 302 is axially aligned in an offset manner from the retainer member 304 by an amount sufficient to engage a tapered surface 614 on the inner periphery of the retainer member 304 with a corresponding tapered surface 612 on the outer periphery of the piston 302. The force exerted between the tapered surfaces 612 and 614 expands the retainer member 304 radially outwardly to engage the groove 311.

Although no piston is shown for urging piston 302 similar to the second or auxiliary piston 222 used to disengage the rotating control device from the latch assembly 300, it is contemplated that an auxiliary piston (not shown) to urge piston 302 from the first, latched position to the second, unlatched position could be used, if desired.

Figure 7:
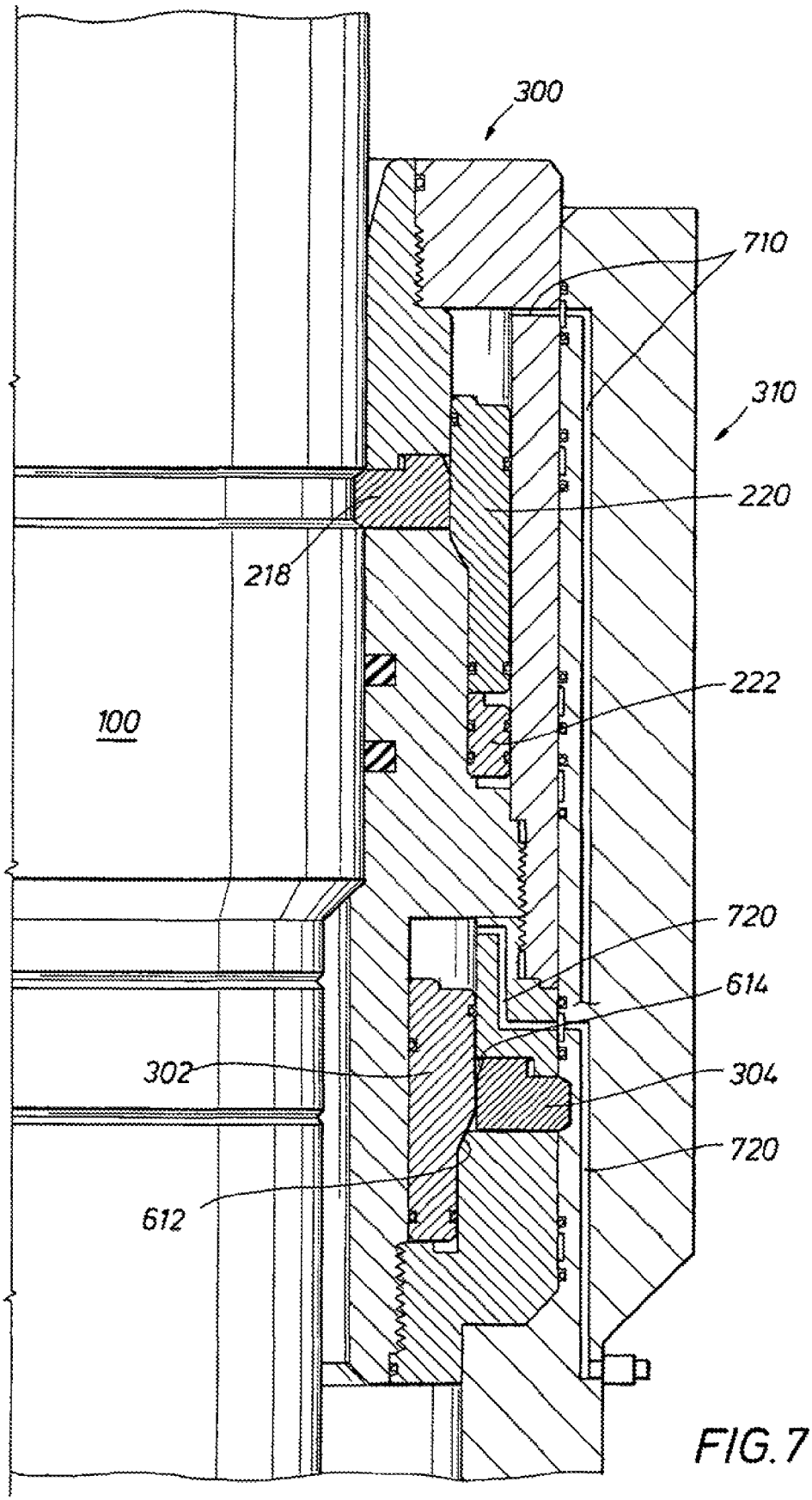
FIG. 7 is an enlarged cross-section detail view similar to FIG. 6 with the dual hydraulic latch assembly shown in the latched position with both the RCD and the housing section.
Figure 8:
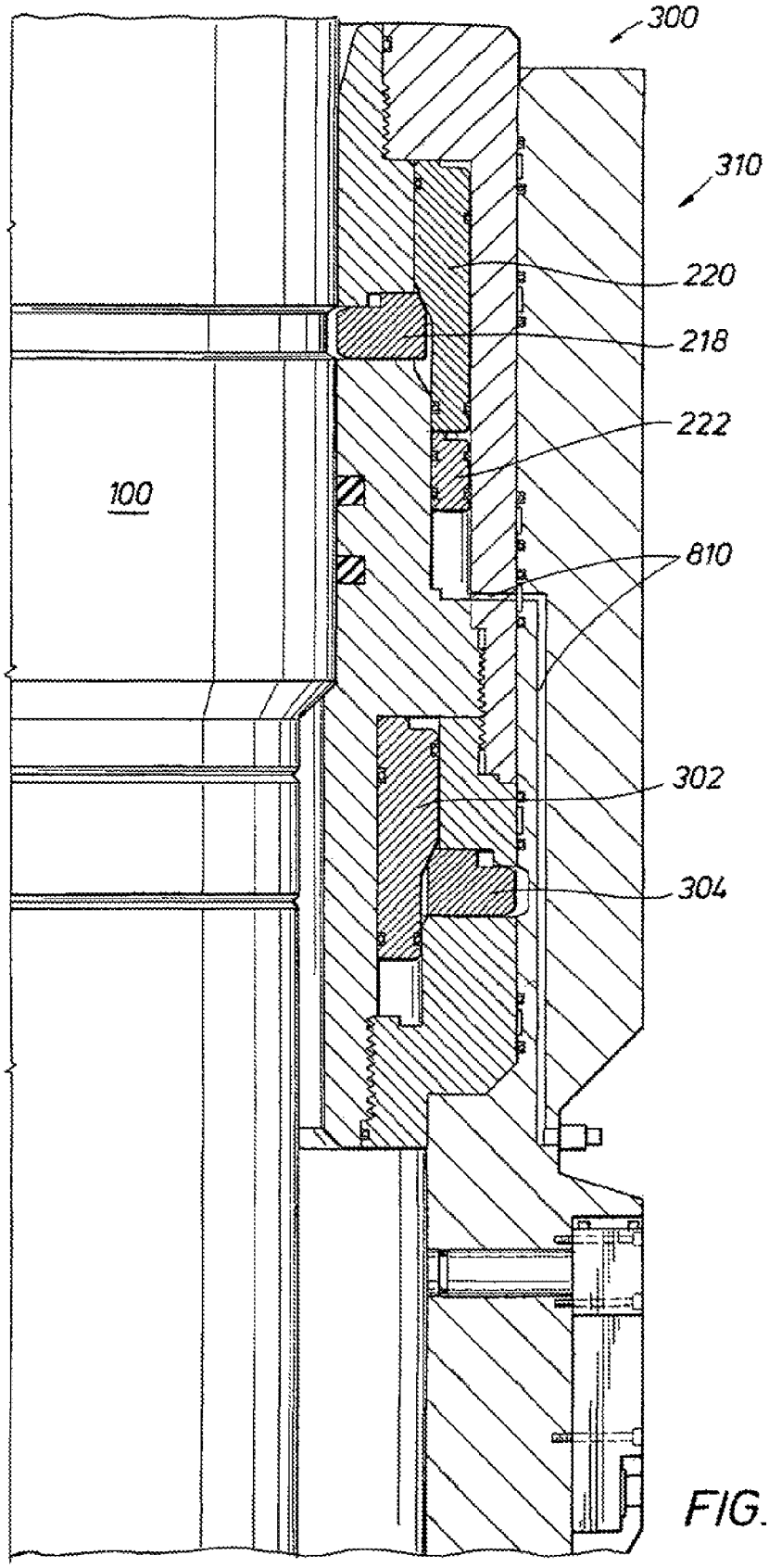
FIG. 8 is an enlarged cross-section detail view similar to FIG. 6 with the dual hydraulic latch assembly shown in the unlatched position from both the RCD and the housing section and an auxiliary piston in an unlatched position.

FIGS. 6 to 8 illustrate the latch assembly 300 in three different positions. In FIG. 6, both the retainer members 218 and 304 are in their retracted or unlatched position. Hydraulic fluid pressure in passageways 660 and 670 (the port for passageway 670 is not shown) move pistons 220 and 302 upward relative to the figure, allowing retainer member 218 to move radially outwardly and retainer member 304 to move radially inwardly to unlatch the rotating control device 100 from the latch assembly 300 and the latch assembly 300 from the housing section 310. While no direct manipulation is required in the illustrated embodiments of FIGS. 6 to 8 to move the retainer members 218 and 304 to their unlatched position, other embodiments are contemplated where a retainer member would move when a force is applied.

In FIGS. 6 to 8, the passageways 660, 670, 710, 720, and 810 that traverse the latch assembly 300 and the housing section 310 connect to ports on the side of the housing section 310. However, other positions for the connection ports can be used, such as on the top surface of the riser nipple as shown in FIG. 2, with corresponding redirection of the passageways 660, 670, 710, 720, and 810 without traversing the housing section 310. Therefore, the position of the hydraulic ports and corresponding passageways shown in FIGS. 6 to 8 are illustrative and exemplary only, and other hydraulic ports and passageways and location of ports and passageways can be used. In particular, although FIGS. 6 to 8 show the passageways 660, 670, 710, 720, and 810 traversing the latch assembly 300 and housing section 310, the passageways can be contained solely within the latch assembly 300.

FIG. 7 shows both retainer members 218 and 304 in their latched position. Hydraulic pressure in passageway 710 (port not shown) and 720 move pistons 220 and 302 to their latched position, urging retainer members 218 and 304 to their respective latched positions.

FIG. 8 shows use of the auxiliary or secondary piston 222 to urge or move the piston 220 to its second, unlatched position, allowing radially outward expansion of retainer member 218 to unlatch the rotating control device 100 from the latch assembly 300. Hydraulic passageway 810 provides fluid pressure to actuate the piston 222.

Furthermore, although FIGS. 6 to 8 illustrate the retainer member 218 and the retainer member 304 with both retainer members 218 and 304 being latched or both retainer members 218 and 304 being unlatched, operation of the latch assembly 300 can allow retainer member 218 to be in a latched position while retainer member 304 is in an unlatched position and vice versa. This variety of positioning is achieved since each of the hydraulic passageways 660, 670, 710, 720, and 810 can be selectively and separately pressurized.

Figure 9:
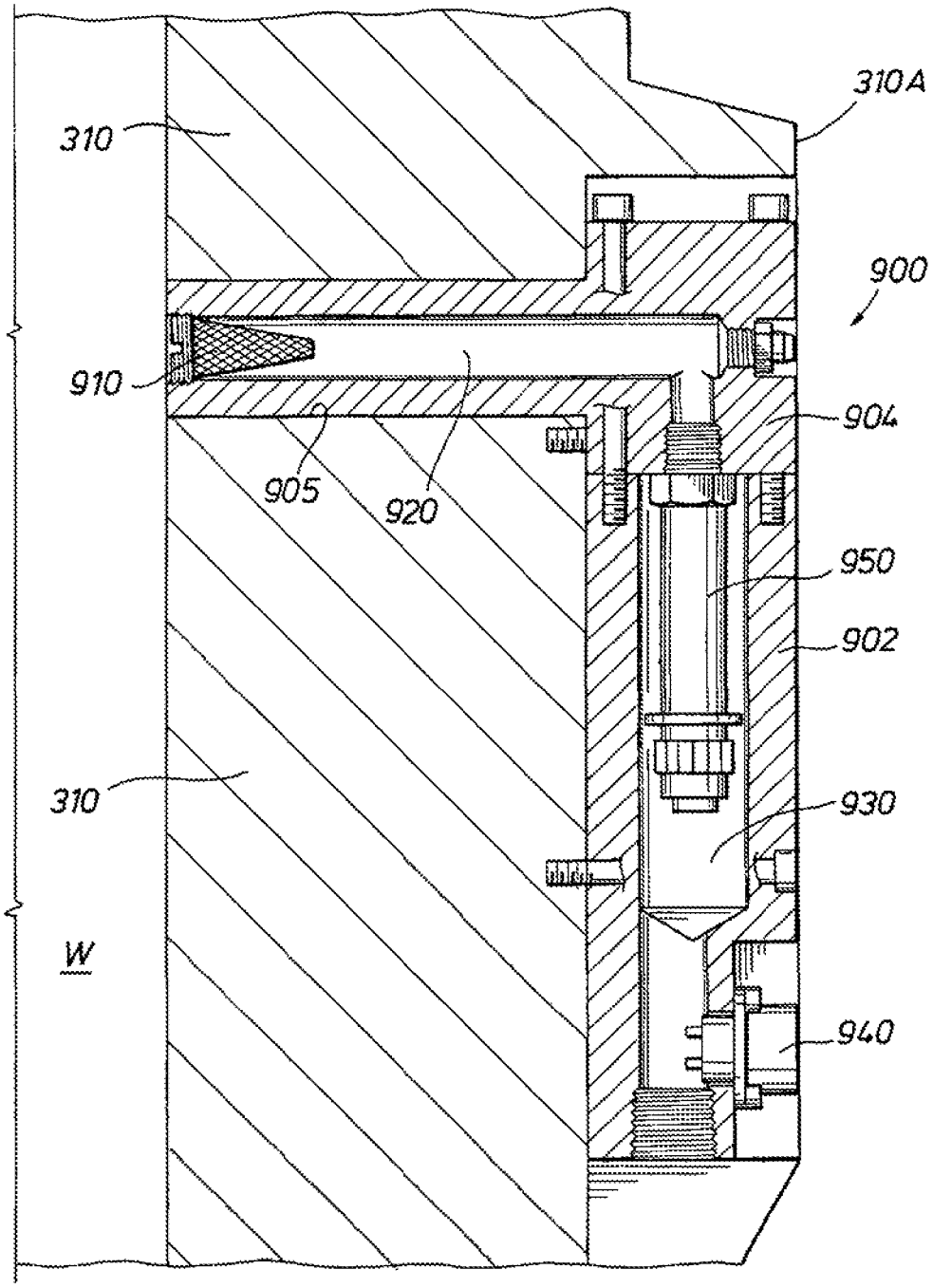
FIG. 9 is a enlarged cross-section detail view of a transducer protector assembly in a housing section.

Turning to FIG. 9, a pressure transducer protector assembly, generally indicated at 900, attached to a sidewall of the housing section 310 protects a pressure transducer 950. A passage 905 extends through the sidewall of the housing section 310 between a wellbore W or an inward surface of the housing section 310 to an external surface 310A of the housing section 310. A housing for the pressure transducer protector assembly 900 comprises sections 902 and 904 in the exemplary embodiment illustrated in FIG. 9. Section 904 extends through the passage 905 of the housing section 310 to the wellbore W, positioning a conventional diaphragm 910 at the wellbore end of section 904. A bore or chamber 920 formed interior to section 904 provides fluid communication from the diaphragm 910 to a pressure transducer 950 mounted in chamber 930 of section 902. Sections 902 and 904 are shown bolted to each other and to the housing section 310, to form the pressure transducer protector assembly 900. Other ways of connecting sections 902 and 904 to each other and to the housing section 310 or other housing section can be used. Additionally, the pressure transducer protector assembly 900 can be unitary, instead of comprising the two sections 902 and 904. Other shapes, arrangements, and configurations of sections 902 and 904 can be used.

Pressure transducer 950 is a conventional pressure transducer and can be of any suitable type or manufacture. In one embodiment, the pressure transducer 950 is a sealed gauge pressure transducer. Additionally, other instrumentation can be inserted into the passage 905 for monitoring predetermined characteristics of the wellbore W.

A plug 940 allows electrical connection to the transducer 950 for monitoring the pressure transducer 950. Electrical connections between the transducer 950 and plug 940 and between the plug 940 to an external monitor are not shown for clarity of the figure.

Figure 10B:
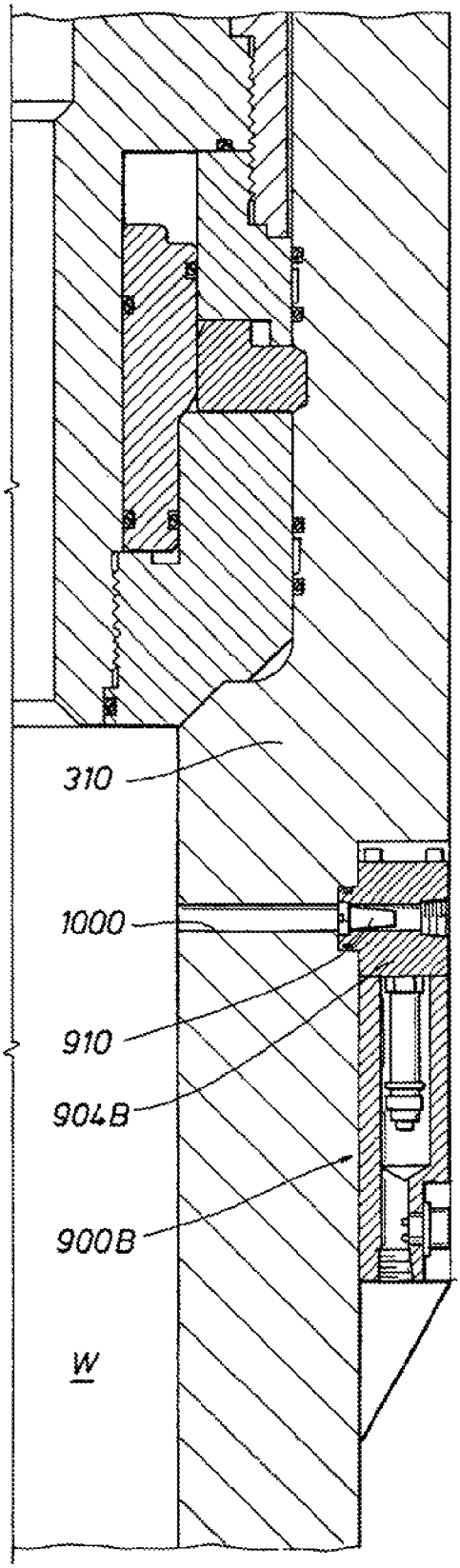
FIGS. 10A and 10B are enlarged cross-section views of two configurations of the transducer protector assembly in a housing section in relation to the dual hydraulic latch assembly of FIGS. 6-8.
Figure 10A:
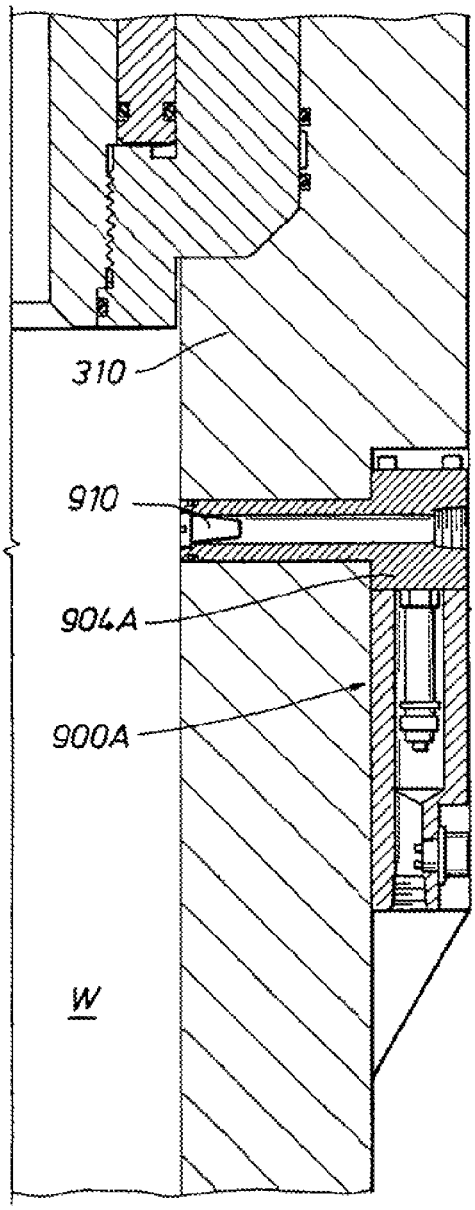

FIGS. 10A and 10B illustrate two alternate embodiments of the pressure transducer protector assembly 900 and illustrate an exemplary placement of the pressure transducer protector assembly 900 in the housing section 310. The placement of the pressure transducer protector assembly 900 in FIGS. 10A and 10B is exemplary and illustrative only, and the assembly 900 can be placed in any suitable location of the housing section 310. The assembly 900A of FIG. 10A differs from the assembly 900B of FIG. 10B only in the length of the section 904 and position of the diaphragm 910. In FIG. 10A, the section 904A extends all the way through the housing section 310, placing the diaphragm 910 at the interior or wellbore W surface of the housing section 310. The alternate embodiment of FIG. 10B instead limits the length of section 904B, placing the diaphragm 910 at the exterior end of a bore 1000 formed in the housing section 310. The alternate embodiments of FIGS. 10A and 10B are exemplary only and other section 904 lengths and diaphragm 910 placements can be used, including one in which diaphragm 910 is positioned interior to the housing section 310 at the end of a passage similar to passage 1000 extending part way through the housing section 310. The embodiment of FIG. 10A is preferable, to avoid potential problems with mud or other substances clogging the diaphragm 910. The wellbore pressure measured by pressure transducer 950 can be used to protect against unlatching the selected latching assembly 300 if the wellbore pressure is above a predetermined amount. One value contemplated for the predetermined wellbore pressure is a range of above 20-30 PSI. Although illustrated with the dual hydraulic latch assembly 300 in FIGS. 10A and 10B, the pressure transducer protector assembly 900 can be used with the single hydraulic latch assembly 210 of FIG. 2.

FIGS. 11A-17 illustrate various alternate embodiments for a latch position indicator system that can allow a system or rig operator to determine remotely whether the dual hydraulic latch assembly 300 is latched or unlatched to the housing section, such as housing section 310, and the rotating control device 100. Although FIGS. 11A-17 are configured for the dual hydraulic latch assembly 300, one skilled in the art would recognize that the relevant portions of the latch position indicator system can also be used with the single hydraulic latch assembly 210 of FIG. 2, using only those elements related to latching the latch assembly to the rotating control device 100.

In one embodiment, illustrated in FIGS. 11A-11H and FIG. 12, hydraulic lines (not shown) provide fluid to the latch assembly 300 for determining whether the latch assembly 300 is latched or unlatched from the rotating control device 100 and the housing section 310. Hydraulic lines also provide fluid to the latch assembly 300 to move the pistons 220, 222, and 302. In the illustrated embodiment, hydraulic fluid is provided from a fluid source (not shown) through a hydraulic line (not shown) to ports, best shown in FIG. 12. Passageways internal to the housing section 310 and latch assembly 300 communicate the fluid to the pistons 220, 222, and 302 for moving the pistons 220, 222, and 302 between their unlatched and latched positions. In addition, passageways internal to the housing section 310 and latch assembly 300 communicate the fluid to the pistons 220, 222, and 302 for the latch position indicator system. Channels are formed in a surface of the pistons 220 and 302. As illustrated in FIGS. 11A-11H, these channels in an operating orientation are substantially horizontal grooves that traverse a surface of the pistons 220 and 302. If piston 220 or 302 is in the latched position, the channel aligns with at least two of the passageways, allowing a return passageway for the hydraulic fluid. As described below in more detail with respect to FIG. 13, a hydraulic fluid pressure in the return line can be used to indicate whether the piston 220 or 302 is in the latched or unlatched position. If the piston 220 or 302 is in the latched position, a hydraulic fluid pressure will indicate that the channel is providing fluid communication between the input hydraulic line and the return hydraulic line. If the piston 220 or 302 is in the unlatched position, the channel is not aligned with the passageways, producing a lower pressure on the return line. As described below in more detail, the pressure measurement could also be on the input line, with a higher pressure indicating nonalignment of the channel and passageways, hence the piston 220 or 302 is in the unlatched position, and a lower pressure indicating alignment of the channel and passageways, hence the piston 220 or 302 is in the latched position. As described below in more detail, a remote latch position indicator system can use these pressure values to cause indicators to display whether the pistons 220 and 302 are latched or unlatched.

Typically, the passageways are holes formed by drilling the applicable element, sometimes known as "gun-drilled holes." More than one drilling can be used for passageways that are not a single straight passageway, but that make turns within one or more element. However, other techniques for forming the passageways can be used. The positions, orientations, and relative sizes of the passageways illustrated in FIGS. 11A-11H are exemplary and illustrative only and other position, orientations, and relative sizes can be used.

The channels of FIGS. 11A-11H are illustrated as grooves, but any shape or configuration of channel can be used as desired. The positions, shape, orientations, and relative sizes of the channels illustrated in FIGS. 11A-11H are exemplary and illustrative only and other position, orientations, and relative sizes can be used.

Figure 11A:
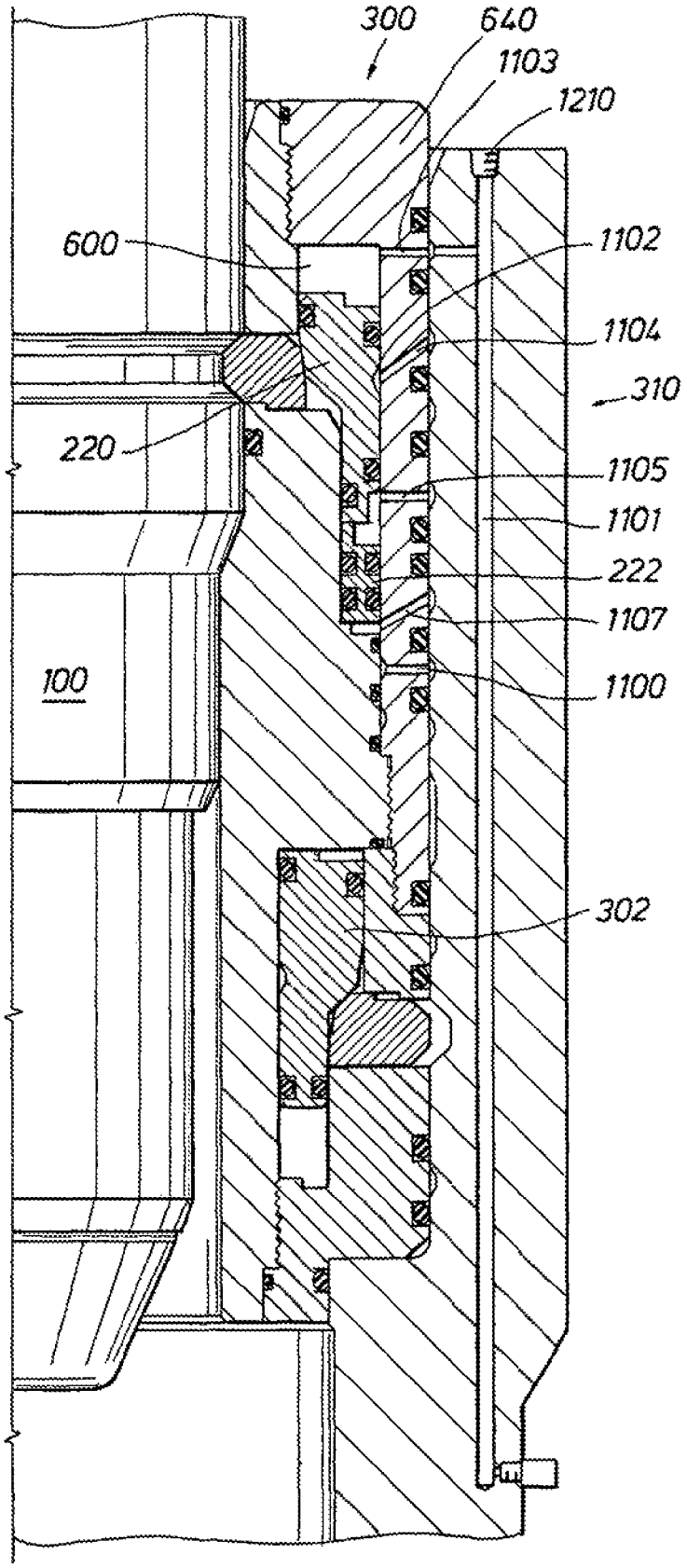
FIGS. 11A-11H are enlarged cross-section detail views of the dual hydraulic latch assembly of FIGS. 6-8 taken along lines 11A-11A, 11B-11B, 11C-11C, 11D-11D, 11E-11E, 11F-11F, 11G-11G, and 11H-11H of FIG. 12, illustrating passageways of a hydraulic fluid system for communicating whether the dual latch assembly is unlatched or latched.

Turning to FIG. 11A, which illustrates a slice of the latch assembly 300 and housing section 310 along line A-A, passageway 1101 formed in housing section 310 provides fluid communication from a hydraulic line (not shown) to the latch assembly 300 to provide hydraulic fluid to move piston 220 from the unlatched position to the latched position. A passageway 1103 formed in outer housing element 640 communications passageway 1101 and the chamber 600, allowing fluid to enter the chamber 600 and move piston 220 to the latched position. Passageway 1103 may actually be multiple passageways in multiple radial-slices of latch assembly 300, as illustrated in FIGS. 11A, 11D, 11E, 11F, and 11H, allowing fluid communication between passageway 1101 and chamber 600 in various rotational orientations of latch assembly 300 relative to housing section 310. in some embodiments, corresponding channels (not labeled) in the housing section 310 can be used to provide fluid communication between the multiple passageways 1103.

Also shown in FIG. 11A, passageway 1104 is formed in outer housing element 640, which communicates with a channel 1102 formed on a surface of piston 220 when piston 220 is in the latched position. Although, as shown in FIG. 11A, the passageway 1104 does not directly communicate with a hydraulic line input or return passageway in the housing section 310, a plurality of passageways 1104 in the various slices of FIGS. 11A-11H are in fluid communication with each other via the channel 1102 when the piston 220 is in the latched position.

Another plurality of passageways 1105 formed in outer housing element 640 provides fluid communication to chamber 600 between piston 220 and piston 222. Fluid pressure in chamber 600 through passageway 1105 urges piston 220 into the unlatched position, and moves piston 222 away from piston 220. Yet another plurality of passageways 1107 formed in outer housing element 640 provides fluid communication to chamber 600 such that fluid pressure urges piston 222 towards piston 220, and can, once piston 222 contacts piston 220, cause piston 220 to move into the unlatched position as an auxiliary or backup way of unlatching the latch assembly 300 from the rotating control device 100, should fluid pressure via passageway 1105 fail to move piston 220. Although as illustrated in FIG. 11A, pistons 220 and 222 are in contact with each other when piston 220 is in the latched position, pistons 220 and 222 can be separated by a gap between them when the piston 220 is in the latched position, depending on the size and shape of the pistons 220 and 222 and the chamber 600. In addition, a passageway 1100 is formed in outer housing element 640. This passageway forms a portion of passageway 1112 described below with respect to FIG. 11C.

Figure 11B:
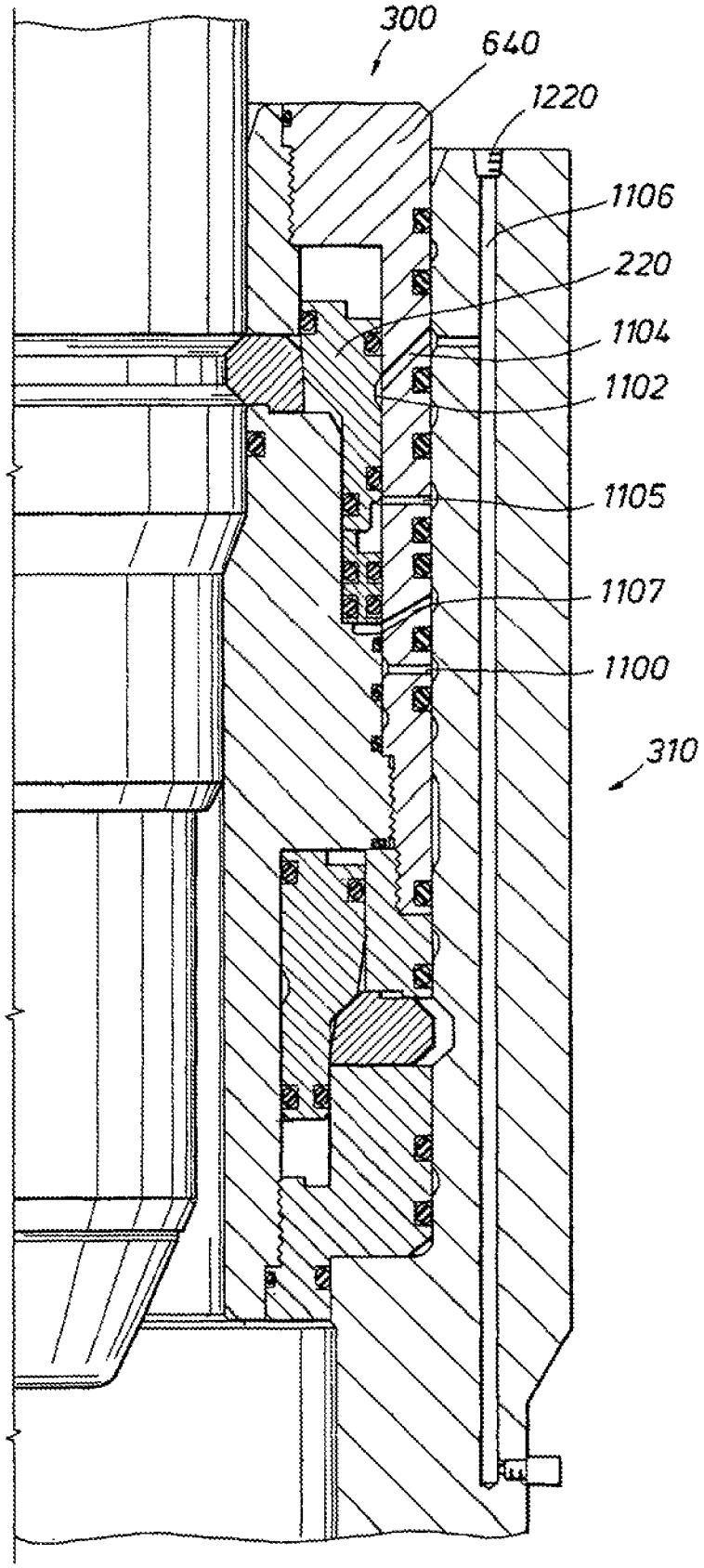
Figure 11C:
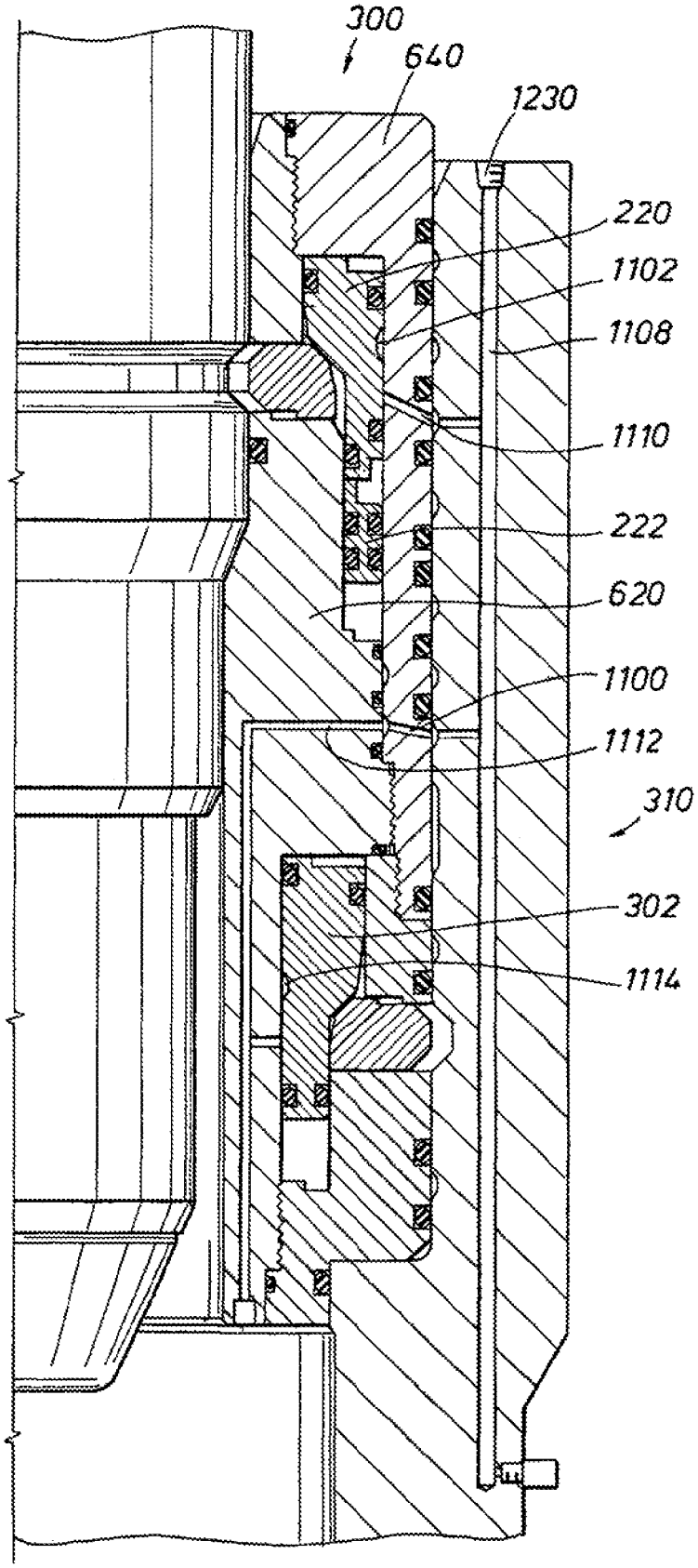
Figure 11D:
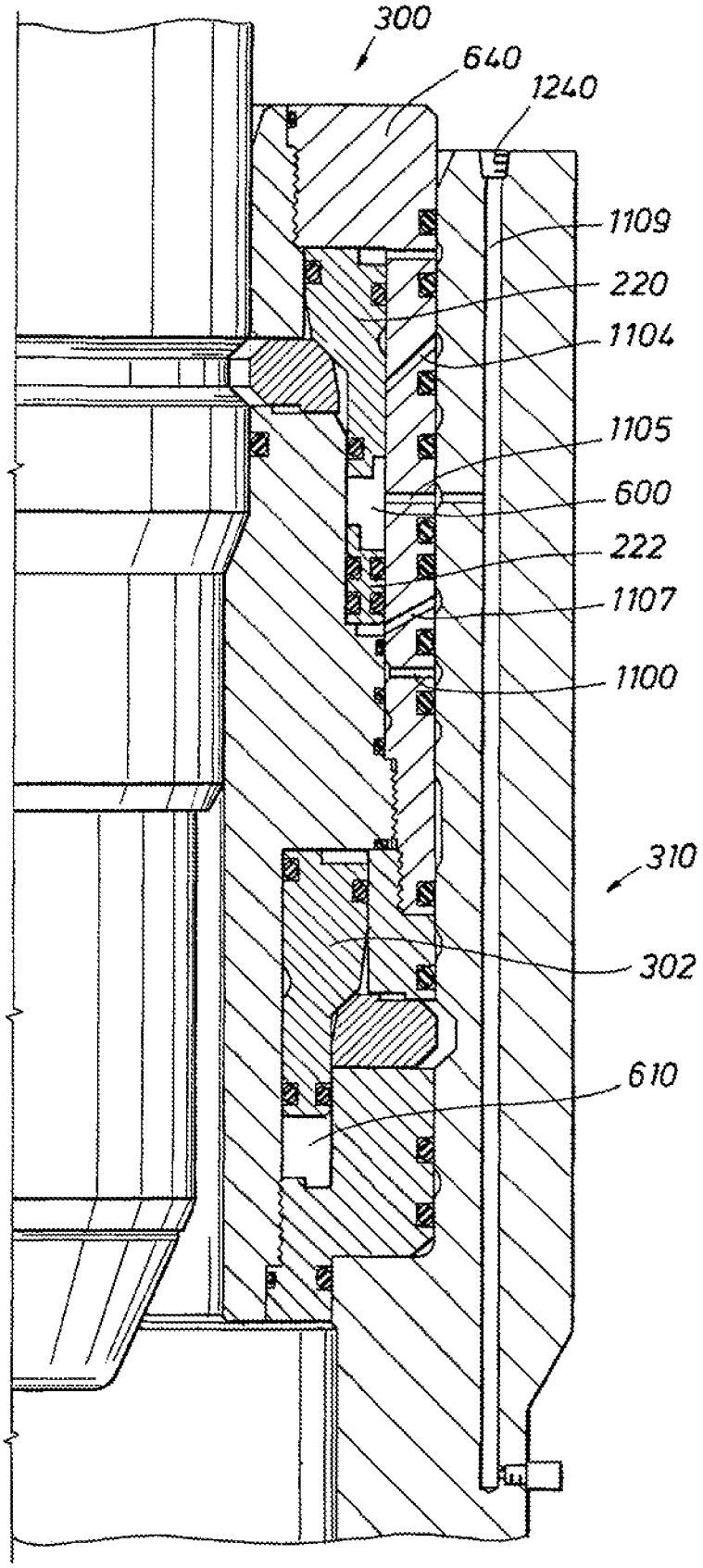

Turning now to FIG. 11B, piston 220 is shown in the latched position, as in FIG. 11A, causing the passageway 1104 to be in fluid communication with the channel 1102 in piston 220. As illustrated in FIG. 11B, passageway 1104 is further in fluid communication with passageway 1106 formed in housing section 310, which can be connected with a hydraulic line for supply or return of fluid to the latch assembly 300. If passageway 1106 is connected to a supply line, then hydraulic fluid input through passageway 1106 traverses passageway 1104 and channel 1102, then returns via passageways 1108 and 1110 to a return hydraulic line, as shown in FIG. 11C. If passageway 1106 is connected to a return line, then hydraulic fluid input through passageways 1108 and 1110 traverses the channel 1102 to return via passageways 1104 and 1106 to the return line. Because fluid communication between passageways 1106 and 1108 is interrupted when piston 220 moves to the unlatched position, as shown in FIG. 11C, pressure in the line (supply or return) connected to passageway 1106 can indicate the position of piston 220. For example, if passageway 1106 is connected to a supply hydraulic line, a measured pressure value in the supply line above a predetermined pressure value will indicate that the piston 220 is in the unlatched position. Alternately, if passageway 1106 is connected to a return hydraulic line, a measured pressure value in the return line below a predetermined pressure value will indicate that the piston 220 is in the unlatched position.

Figure 11E:
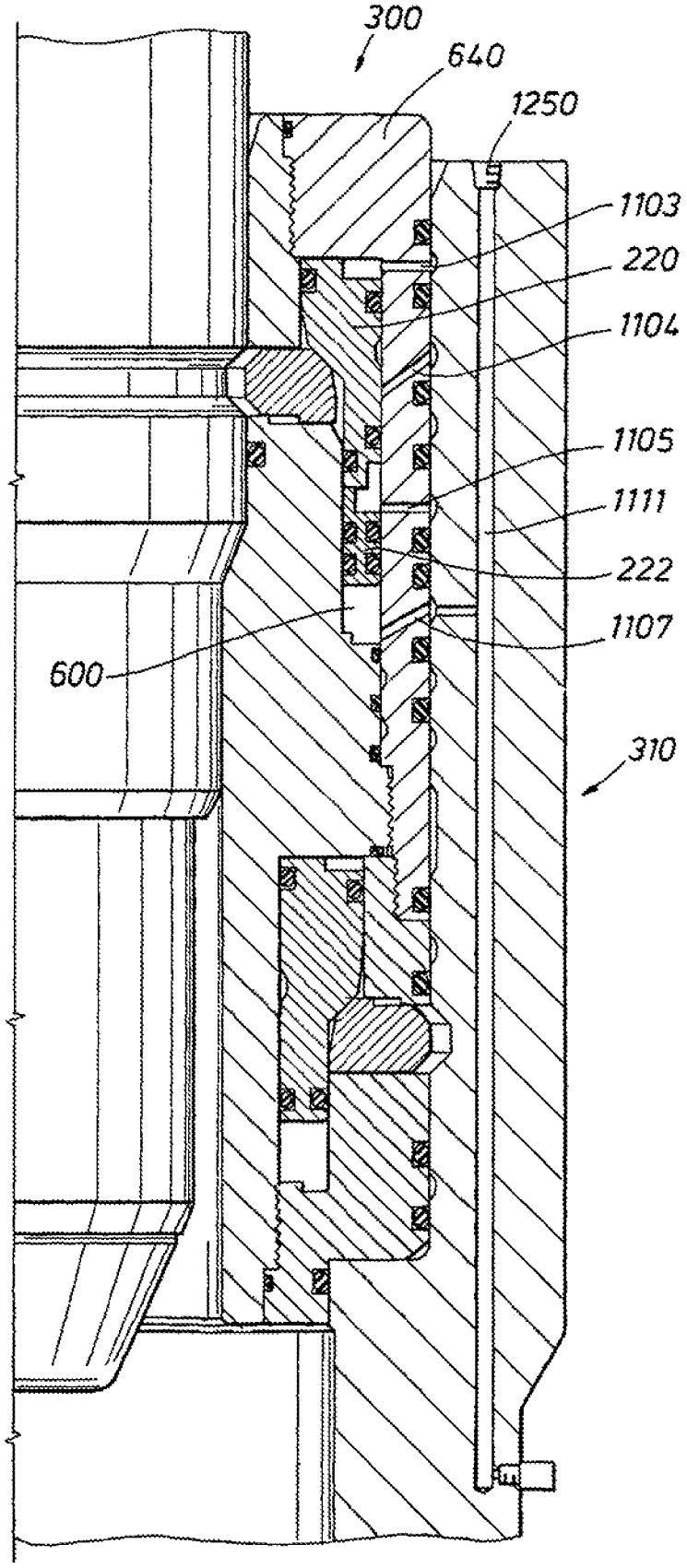
Figure 11F:
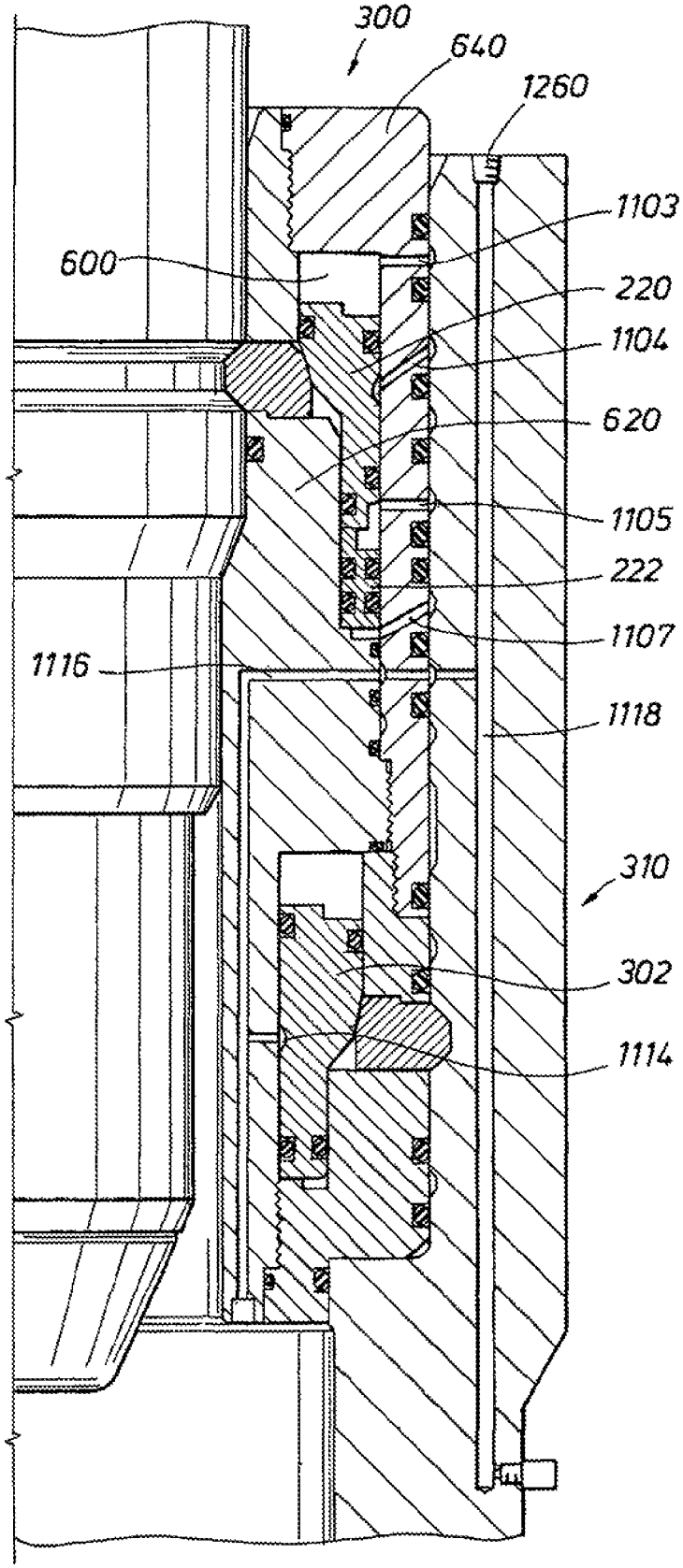

FIG. 11C illustrates a passageway 1108 in housing section 310 that is in fluid communication with passageway 1110 in outer housing element 640 of the latch assembly 300. As described above, when piston 220 is in the latched position, passageways 1108 and 1106 are in fluid communication with each other, via passageways 1104 and 1110, together with channel 1102 and are not in fluid communication when piston 220 is in the unlatched position. In addition, passageway 1108 is in fluid communication with passageway 1112. Turning to both FIG. 11C and FIG. 11F, when piston 302 is in the latched position, as shown in FIG. 11F, passageway 1112 is in fluid communication with passageways 1116 and 1118 via channel 1114 formed in piston 302. Thus, when piston 302 is in the latched position, hydraulic fluid supplied by a hydraulic supply line connected to one of passageways 1108 and 1118 flows through the housing section 310 and latch assembly 300 to a hydraulic return line connected to the other of passageways 1108 and 1118. As with the passageways for indicating the position of piston 220, such fluid communication between passageways 1108 and 1118 can indicate that piston 302 is in the latched position, and lack of fluid communication between passageways 1108 and 1118 can indicate that piston 302 is in the unlatched position. For example, if passageway 1108 is connected to a hydraulic supply line, then if the measured pressure value in the supply line exceeds a predetermined pressure value, piston 302 is in the unlatched position, and if the measured pressure value in the supply line is below a predetermined pressure value, piston 302 is in the unlatched position. Alternately, if passageway 1108 is connected to a hydraulic return line, if the measured pressure value in the return line is equal to or above a predetermined pressure value, then piston 302 is in the latched position, and if the pressure in the return line is equal to or less than a predetermined pressure value, then piston 302 is in the unlatched position.

Figure 11G:
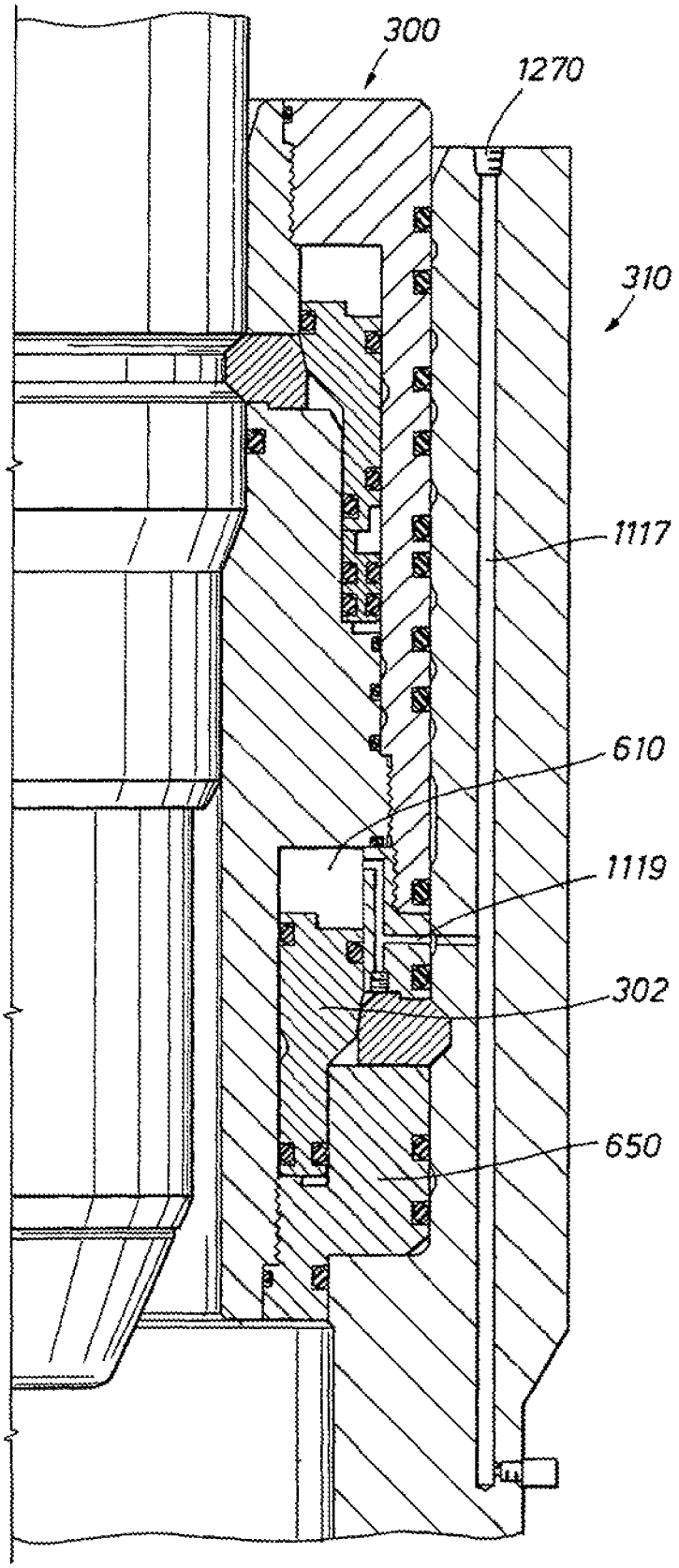

Turning now to FIG. 1 ID, passageway 1109 in the housing section 310 can provide hydraulic fluid through passageway 1105 in the latch assembly 300 to chamber 600, urging piston 220 from the latched position to the unlatched position, as well as to move piston 222 away from piston 220. Similarly, in FIG. 11E, passageway 1111 in the housing section 310 can provide hydraulic fluid through passageway 1107 in the latch assembly 300, urging piston 222, providing a backup technique for moving piston 220 from the latched position into the unlatched position, once piston 222 contacts piston 220. Likewise, as illustrated in FIG. 11G, hydraulic fluid in passageway 1117 in the housing section 310 traverses passageway 1119 to enter chamber 610, moving piston 302 from the unlatched position to the latched position, while hydraulic fluid in passageway 1121 in the housing section 310, illustrated in FIG. 11H, traverses passageway 1123 to enter chamber 610, moving piston 302 from the latched position to the unlatched position.

Although described above in each case as entering chamber 600 or 610 from the corresponding passageways, one skilled in the art will recognize that fluid can also exit from the chambers when the piston is moved, depending on the direction of the move. For example, viewing FIG. 11A and FIG. 11D, pumping fluid through passageways 1101 and 1103 into chamber 600 can cause fluid to exit chamber 600 via passageways 1105 and 1109, while pumping fluid through passageways 1109 and 1105 into chamber 600 can cause fluid to return from chamber 600 via passageways 1103 and 1101, as the piston 220 moves within chamber 600.

Figure 11H:
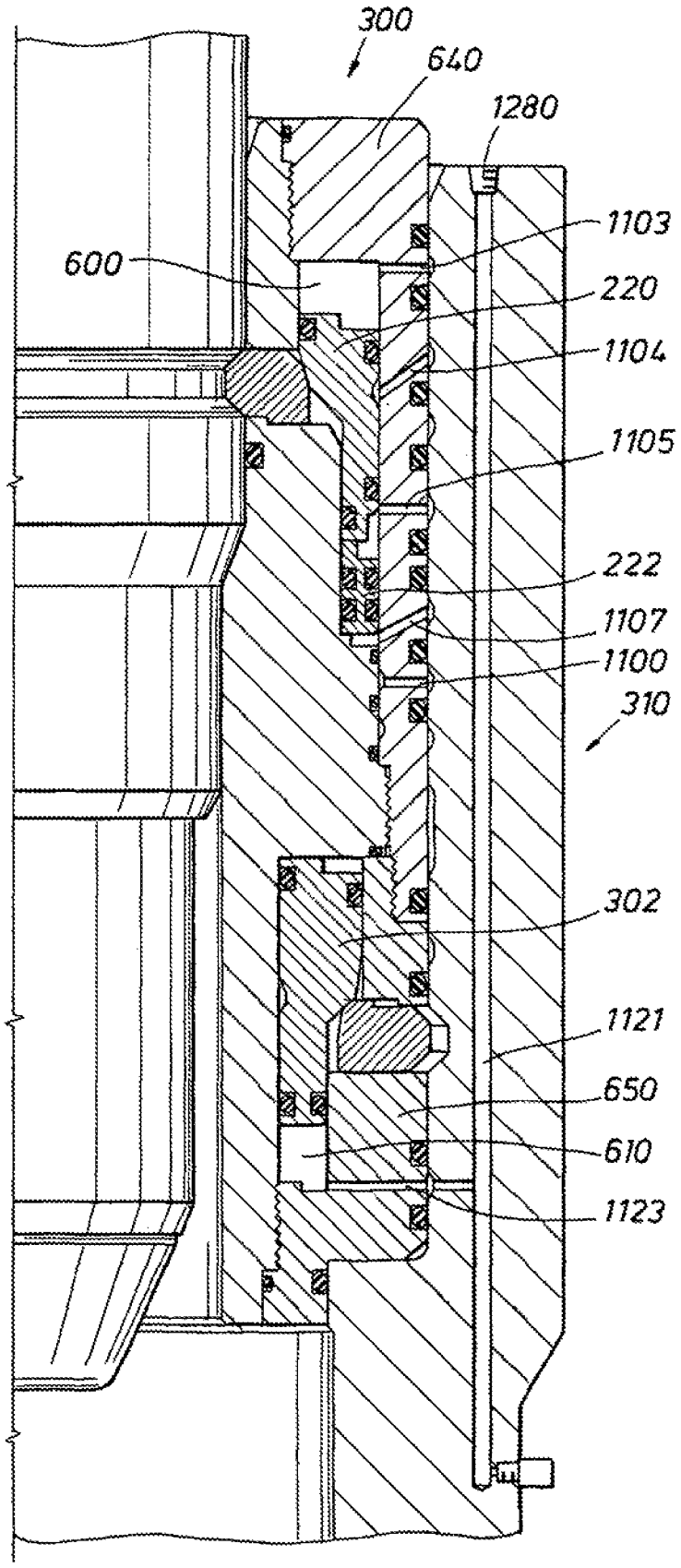
Figure 12:
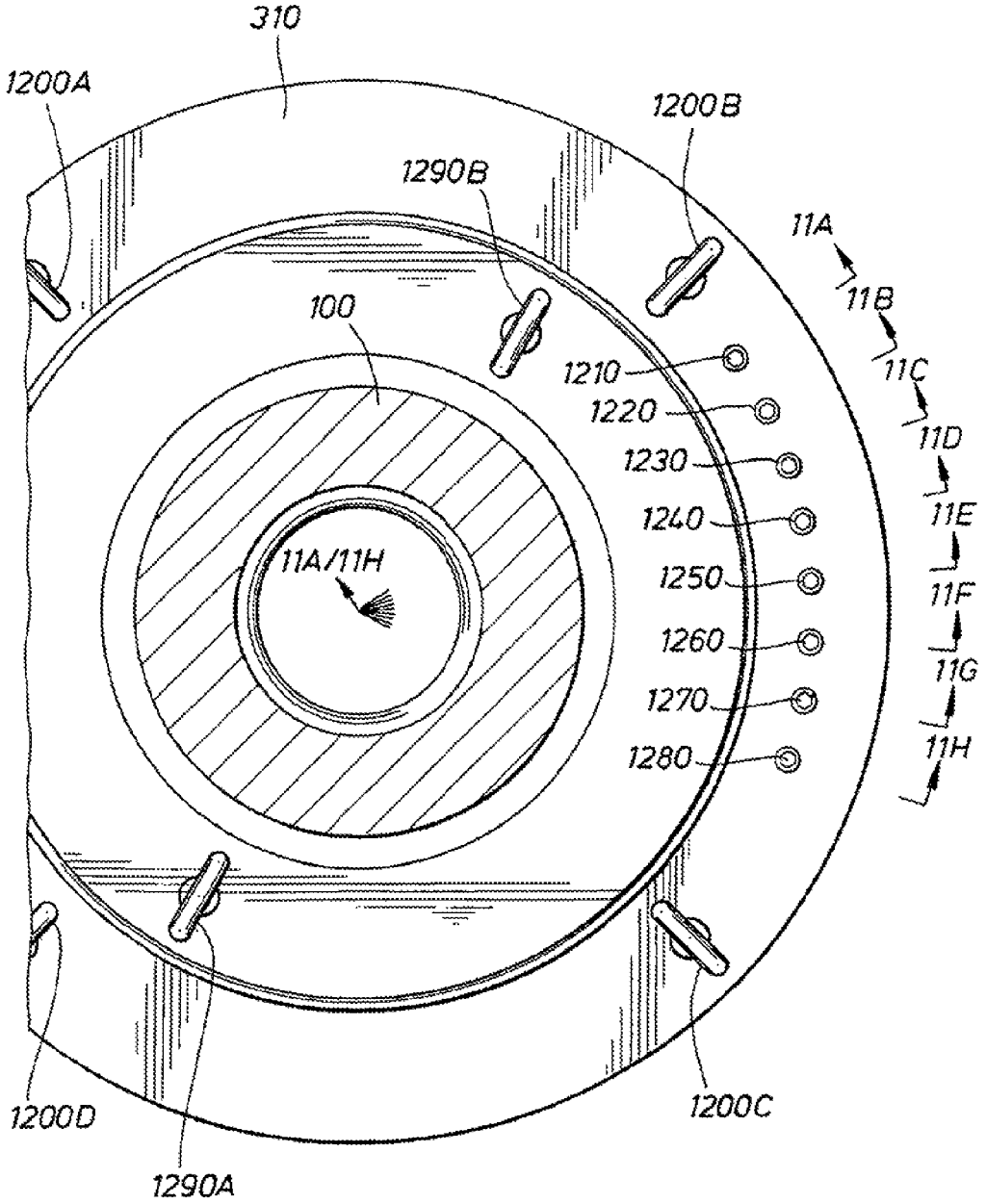
FIG. 12 is an end view of the dual hydraulic latch assembly of FIGS. 6-8 illustrating hydraulic connection ports corresponding to the cross-section views of FIGS. 11A-11H.

Turning now to FIG. 12, port 1210 is connected to passageway 1101, port 1220 is connected to passageway 1106, port 1230 is connected to passageway 1108, port 1240 is connected to passageway 1109, port 1250 is connected to passageway 1111, port 1260 is connected to passageway 1118, port 1270 is connected to passageway 1117, and port 1280 is connected to passageway 1121. The arrangement of ports and order of the slices illustrated in FIGS. 11A-11H is exemplary and illustrative only, and other orders and arrangements of ports can be used. In addition, the placement of ports 1210 to 1280 illustrated in end view in FIG. 12 is exemplary only, and other locations for the ports 1210 to 1280 can be used, such as discussed above on the side of the housing section 310, as desired.

In addition to the ports 1210 to 1280, FIG. 12 illustrates eyelets that can be used to connect cables or other equipment to the housing section 310 and latch assembly 300 for positioning the housing section 310 and latch assembly 300. Because the housing section 310 and latch assembly 300 can be latched and unlatched from each other and to the rotating control device 100 remotely using hydraulic line connected to ports 1210, 1240, 1250, 1270, and 1280, the housing section 310, the latch assembly 300 and the rotating control device 100 can be latched to or unlatched from each other and repositioned as desired without sending personnel below the rotary table 130. Likewise, because ports 1220, 1230, and 1260 can provide supply and return lines to a remote latch position indicator system, an operator of the rig does not need to send personnel below the rotary table 130 to determine the position of the latch assembly 300, but can do so remotely. It is also contemplated that the hydraulic latch position indicator system may be used with a secondary or back-up piston to determine its position, and therefore to indirectly determine the position of the retainer member. Further, it is contemplated that the hydraulic latch position indicator system may also be used with the retainer member to directly determine its position.

Figure 13:
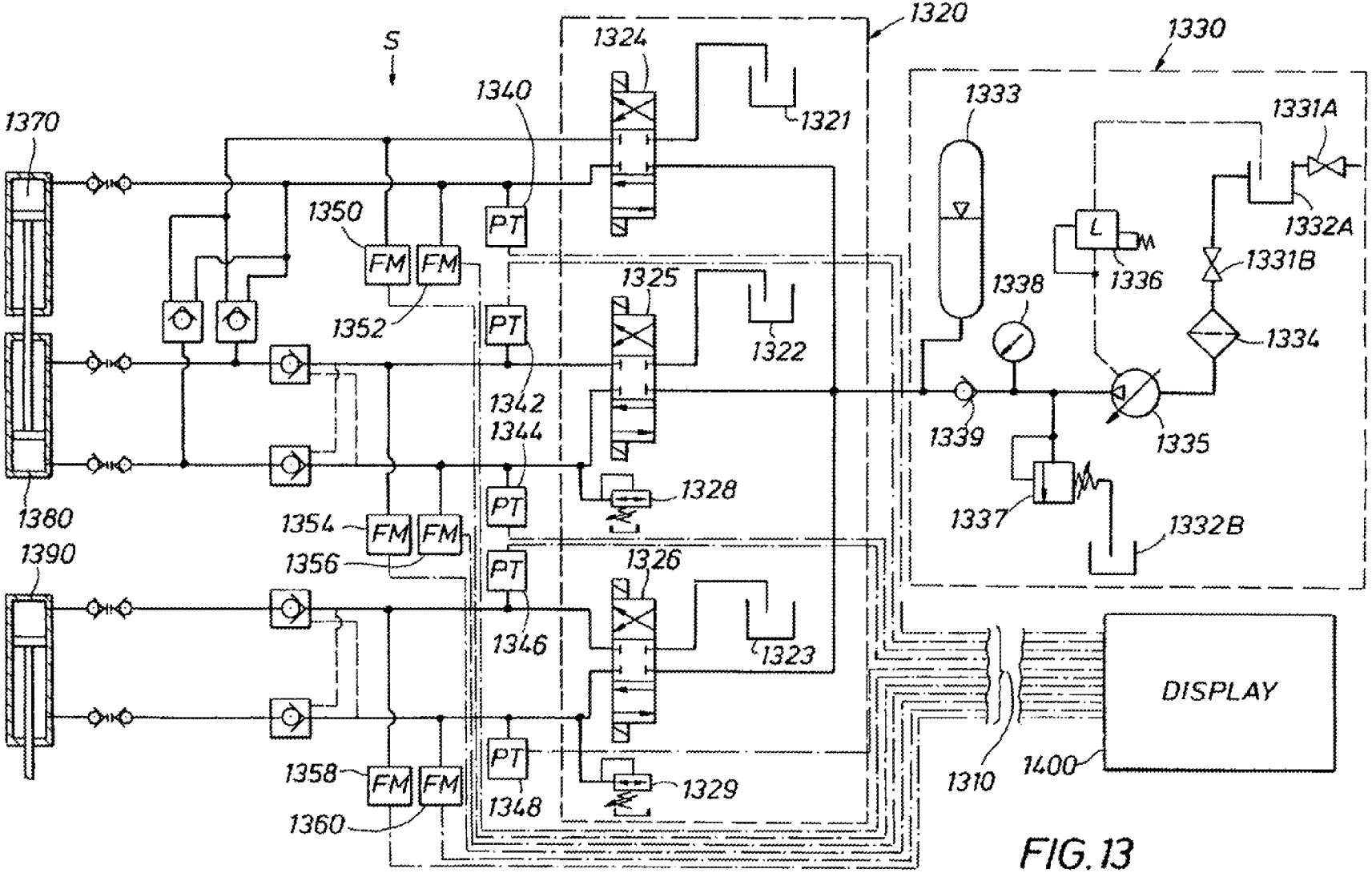
FIG. 13 is a schematic view of a latch position indicator system for the dual hydraulic latch assembly of FIGS. 6-8.

Turning now to FIG. 13, a schematic diagram for an alternate embodiment of a system S for controlling the latch assembly 300 of FIGS. 6 to 8, including a latch position indicator system for remotely indicating the position of the latch assembly 300. The elements of FIG. 13 represent functional characteristics of the system S rather than actual physical implementation, as is conventional with such schematics.

Figure 14:
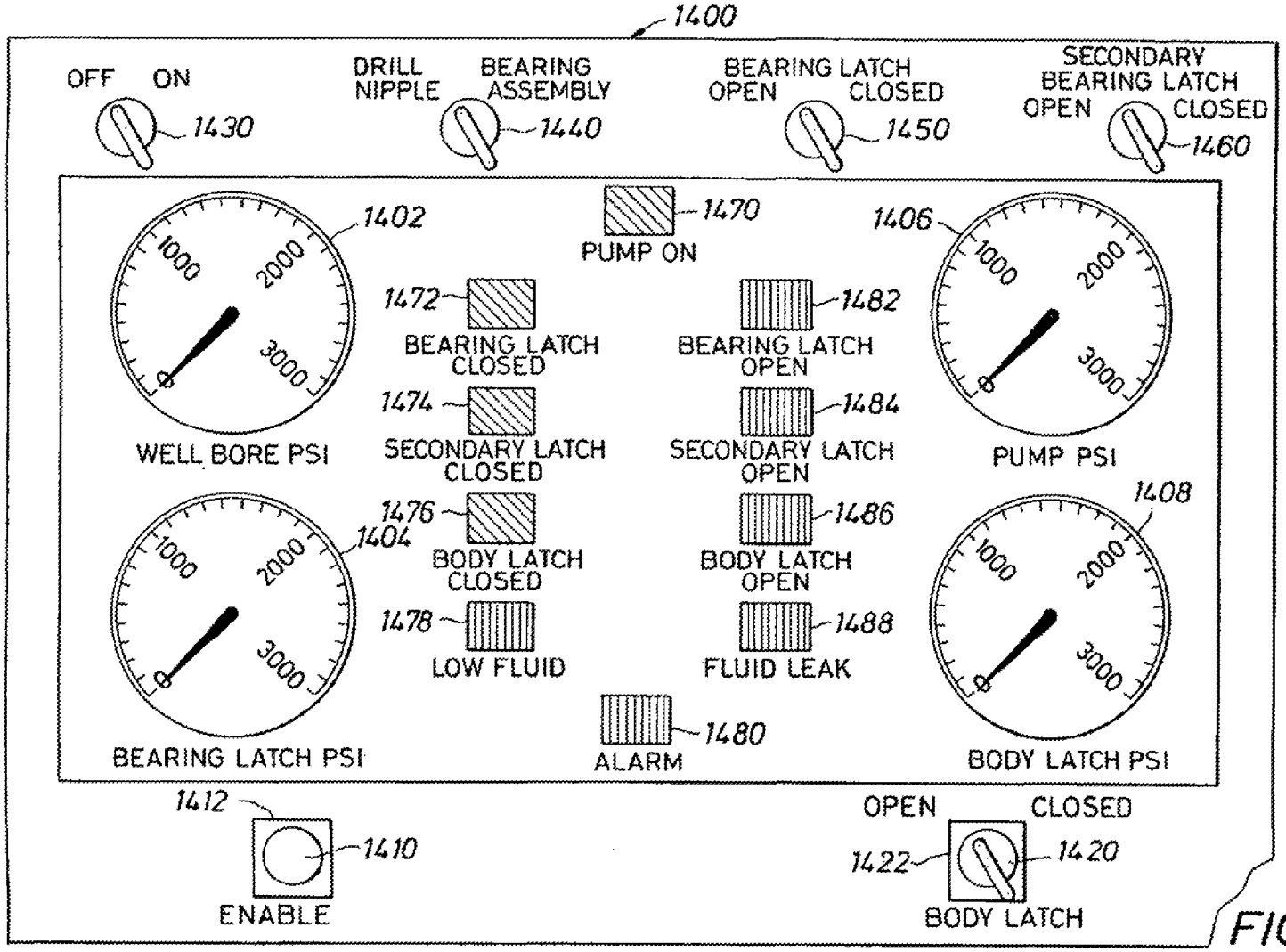
FIG. 14 is a front view of an indicator panel for use with the latch position indicator system of FIG. 13.

Block 1400 represents a remote control display for the latch position indicator subsystem of the system S, and is further described in one embodiment in FIG. 14. Control lines 1310 connect pressure transducers (PT) 1340, 1342, 1344, 1346, and 1348 and flow meters (FM) 1350, 1352, 1354, 1356, 1358, and 1360. For example, the flow meters FM may be totalizing flow meters, gear flow meters or a combination of these meters or other meters. One gear meter is an oval-gear meter having two rotating, oval-shaped gears with synchronized, close fitting teeth. When a fixed quantity of liquid passes through the meter for each revolution, shaft rotation can be monitored to obtain specific flow rates. It is also contemplated that the flow meters FM may be turbine flow meters. However, other types of flow meters FM are contemplated to fit the particular application of the system. Also, if desired flow conditioners, such as those disclosed in U.S. Pat. Nos. 5,529,093 and 5,495,872 could be used. U.S. Pat. Nos. 5,529,093 and 5,495,872 are incorporated herein by reference for all purposes. Typically, a programmable logic controller (PLC) or other similar measurement and control device, either at each pressure transducer PT and flow meter FM or remotely in the block 1400 reads an electrical output from the pressure transducer PT or flow meter FM and converts the output into a signal for use by the remote control display 1400, possibly by comparing a flow value or pressure value measured by the flow meter FM or pressure transducer PT to a predetermined flow value or pressure value, controlling the state of an indicator in the display 1400 according to a relative relationship between the measured value and the predetermined value. For example, if the measured flow value is less than a predetermined value, the display 1400 may indicate one state of the flow meter FM or corresponding device, and if the measured flow value is greater than a predetermined value, the display 1400 may indicate another state of the flow meter FM or corresponding device.

A fluid supply subsystem 1330 provides a controlled hydraulic fluid pressure to a fluid valve subsystem 1320. As illustrated in FIG. 13, the fluid supply subsystem 1330 includes shutoff valves 1331A and 1331B, reservoirs 1332A and 1332B, an accumulator 1333, a fluid filter 1334, a pump 1335, pressure relief valves 1336 and 1337, a gauge 1338, and a check valve 1339, connected as illustrated. However, the fluid supply subsystem 1330 illustrated in FIG. 13 can be any convenient fluid supply subsystem for supplying hydraulic fluid at a controlled pressure.

A fluid valve subsystem 1320 controls the provision of fluid to hydraulic fluid lines (unnumbered) that connect to the chambers 1370, 1380 and 1390. FIG. 13 illustrates the subsystem 1320 using three directional valves 1324, 1325 and 1326, each connected to one of reservoirs 1321, 1322 and 1323. Each of the valves 1324, 1325, and 1326 are illustrated as three-position, four-way electrically actuated hydraulic valves. Valves 1325 and 1326, respectively, can be connected to pressure relief valves 1328 and 1329. The elements of the fluid valve subsystem 1320 as illustrated in FIG. 13 are exemplary and illustrative only, and other components, and numbers, arrangements, and connections of components can be used as desired.

Pressure transducers PT or other pressure measuring devices 1340, 1342, 1344, 1346 and 1348 measure the fluid pressure in the hydraulic lines between the fluid valve subsystem 1320 and the chambers 1370, 1380 and 1390. Control lines 1310 connect the pressure measuring devices 1340, 1342, 1344, 1346 and 1348 to the remote control display 1400. In addition, flow meters FM 1350, 1352, 1354, 1356, 1358 and 1360 measure the flow of hydraulic fluid to the chambers 1370-1390, which can allow measuring the volume of fluid that is delivered to the chambers 1370, 1380 and 1390. Although the system S includes both pressure transducers PT and flow meters FM, either the pressure transducers PT or the flow meters FM can be omitted if desired. Although expressed herein in terms of pressure transducers PT and flow meters FM, other types of pressure and flow measuring devices can be used as desired.

Turning now to FIG. 14, an exemplary indicator panel is illustrated for remote control display 1400 for the system S of FIG. 13. In the following, the term "switch" will be used to indicate any type of control that can be activated or deactivated, without limitation to specific types of controls. Exemplary switches are toggle switches and push buttons, but other types of switches can be used. Pressure gauges 1402, 1404, 1406, and 1408 connected by control lines 1310 to the pressure transducers, such as the pressure transducers PT of FIG. 13, indicate the pressure in various parts of the system S. Indicators on the panel include wellbore pressure gauge 1402, bearing latch pressure gauge 1404, pump pressure gauge 1406, and body latch pressure gauge 1408. The rotating control device or bearing latch pressure 1404 indicates the pressure in the chamber 600 at the end of the chamber where fluid is introduced to move the piston 220 into the latched position. The housing section or body latch pressure gauge 1408 indicates the pressure in the chamber 610 at the end of the chamber where fluid is introduced to move the piston 302 into the latched position. A switch or other control 1420 can be provided to cause the system S to manipulate the fluid valve subsystem 1320 to move the piston 302 between the latched (closed) and unlatched (open) positions. For safety reasons, the body latch control 1420 is preferably protected with a switch cover 1422 or other apparatus for preventing accidental manipulation of the control 1420. For safety reasons, in some embodiments, an enable switch 1410 can be similarly protected by a switch cover 1412. The enable switch 1410 must be simultaneously or closely in time engaged with any other switch, except the Off/On control 1430 to enable the other switch. In one embodiment, engaging the enable switch allows activation of other switches within 10 seconds of engaging the enable switch. This technique helps prevent accidental unlatching or other dangerous actions that might otherwise be caused by accidental engagement of the other switch.

An Off/On control 1430 controls the operation of the pump 1335. A Drill Nipple/Bearing Assembly control 1440 controls a pressure value produced by the pump 1335. The pressure value can be reduced if a drilling nipple or other thin walled apparatus is installed. For example, when the control 1440 is in the "Drill Nipple" position, the pump 1335 can pressurize the fluid to 200 PSI, but when the control is in the "Bearing Assembly" position, the pump 1335 can pressurize the fluid to 1000 PSI. Additionally, an "Off" position can be provided to set the pump pressure to 0 PSI. Other fluid pressure values can be used. For example, in one embodiment, the "Bearing Assembly" position can cause pressurization depending on the position of the Bearing Latch switch 1450, such as 800 PSI if switch 1450 is closed and 2000 PSI if switch 1450 is open.

Control 1450 controls the position of the piston 220, latching the rotating control device 100 to the latch assembly 300 in the "closed" position by moving the piston 220 to the latched position. Likewise, the control 1460 controls the position of the auxiliary or secondary piston 222, causing the piston 222 to move to urge the piston 220 to the unlatched position when the bearing latch control 1460 is in the "open" position. Indicators 1470, 1472, 1474, 1476, 1478, 1480, 1482, 1484, 1486, and 1488 provide indicators of the state of the latch assembly and other useful indicators. As illustrated in FIG. 14, the indicators are single color lamps, which illuminate to indicate the specific condition. In one embodiment, indicators 1472, 1474, 1476, and 1478 are green lamps, while indicators 1470, 1480, 1482, 1484, 1486, and 1488 are red lamps; however, other colors can be used as desired. Other types of indicators can be used as desired, including multicolor indicators that combine the separate open/closed indicators illustrated in FIG. 14. Such illuminated indicators are known to the art. Indicator 1470 indicates whether the hydraulic pump 1335 of FIG. 13 is operating. Specifically, indicators 1472 and 1482 indicate whether the bearing latch is closed or open, respectively, corresponding to the piston 220 being in the latched or unlatched position, indicating the rotating control device 100 is latched to the latch assembly 300. Indicators 1474 and 1484 indicate whether the auxiliary or secondary latch is closed or open, respectively, corresponding to the piston 222 being in the first or second position. Indicators 1476 and 1486 indicate whether the body latch is closed or open, respectively, i.e., whether the latch assembly 300 is latched to the housing section 310, corresponding to whether the piston 302 is in the unlatched or latched positions. Additionally, hydraulic fluid indicators 1478 and 1488 indicate low fluid or fluid leak conditions, respectively.

An additional alarm indicator indicates various alarm conditions. Some exemplary alarm conditions include: low fluid, fluid leak, pump not working, pump being turned off while wellbore pressure is present and latch switch being moved to open when wellbore pressure is greater than a predetermined value, such as 25 PSI. In addition, a horn (not shown) can be provided for an additional audible alarm for safety purposes. The display 1400 allows remote control of the latch assembly 210 and 300, as well as remote indication of the state of the latch assembly 210 and 300, as well as other related elements.

Figure 18:
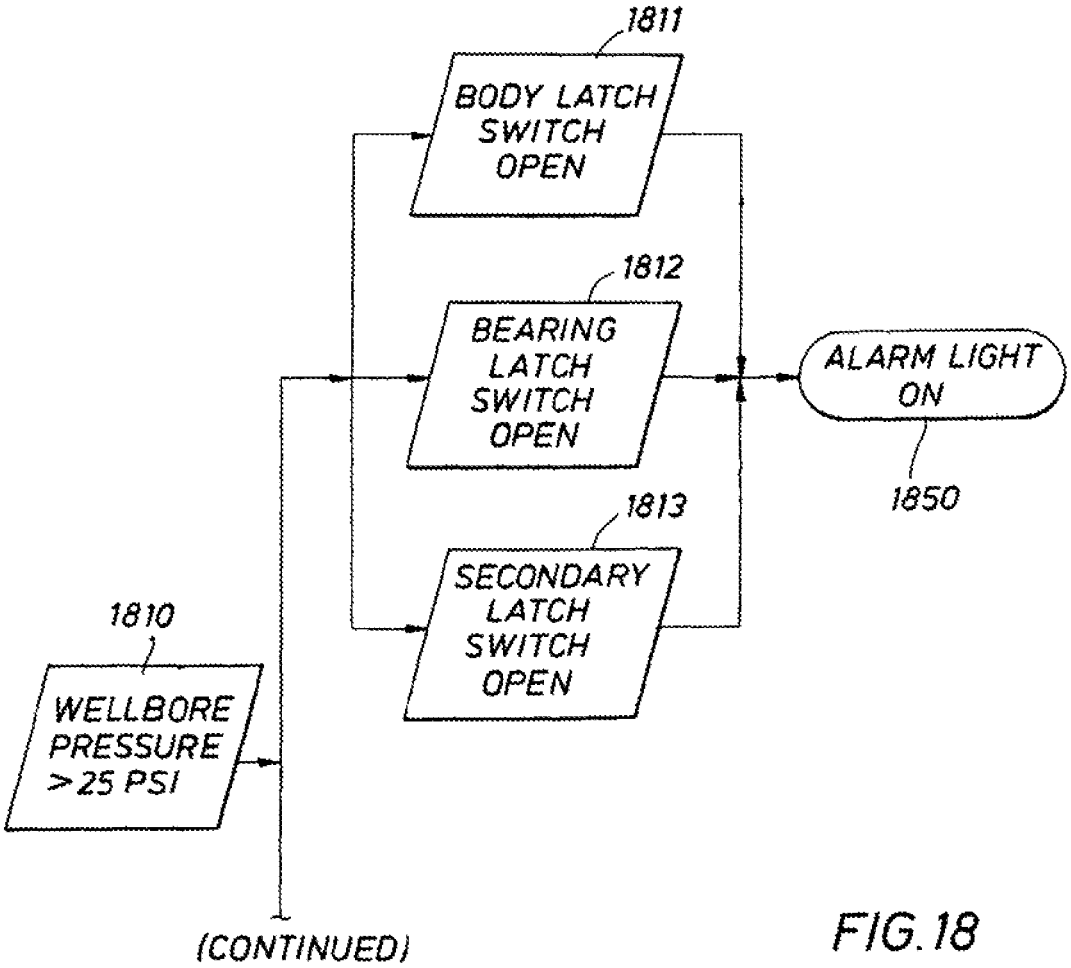
FIG. 18 is a diagram illustrating exemplary conditions for activating an alarm or a horn of the indicator panel of FIG. 14 for safety purposes.

FIG. 18 illustrates an exemplary set of conditions that can cause the alarm indicator 1480 and horn to be activated. As shown by blocks 1830 and 1840, if any of the flow meters FM of FIG. 13 indicate greater than a predetermined flow rate, illustrated in FIG. 18 as 3 GPM, then both the alarm light 1480 and the horn will be activated. As shown by blocks 1820, 1822, 1824, 1826, and 1840, if the wellbore pressure is in a predetermined relative relation to a predetermined pressure value, illustrated in FIG. 18 as greater than 100 PSI, and any of the bearing latch switch 1450, the body latch switch 1420, or the secondary latch switch 1460 are open, then both the alarm 1480 and the horn are activated. As shown by blocks 1810, 1814, 1815, 1816, and 1840, if the wellbore pressure is in a predetermined relative relationship to a predetermined pressure value, illustrated in FIG. 18 as greater than 25 PSI, and either the pump motor is not turned on by switch 1430, the fluid leak indicator 1488 is activated for a predetermined time, illustrated in FIG. 18 as greater than 1 minute, or the low fluid indicator 1478 is activated for a predetermined time, illustrated in FIG. 18 as greater than 1 minute, then both the alarm 1480 and horn are activated. Additionally, as indicated by blocks 1810, 1811, 1812, 1813, and 1850, if the wellbore pressure is in a predetermined relative relationship to a predetermined pressure value, illustrated in FIG. 18 as greater than 25 PSI, and either the body latch switch 1420 is open, the bearing latch switch 1450 is open, or the secondary latch switch 1460 is open, then the alarm indicator 1480 is activated, but the horn is not activated. The conditions that cause activation of the alarm 1480 and horn of FIG. 18 are illustrative and exemplary only, and other conditions and combinations of conditions can cause the alarm 1480 or horn to be activated.

Figure 15K:
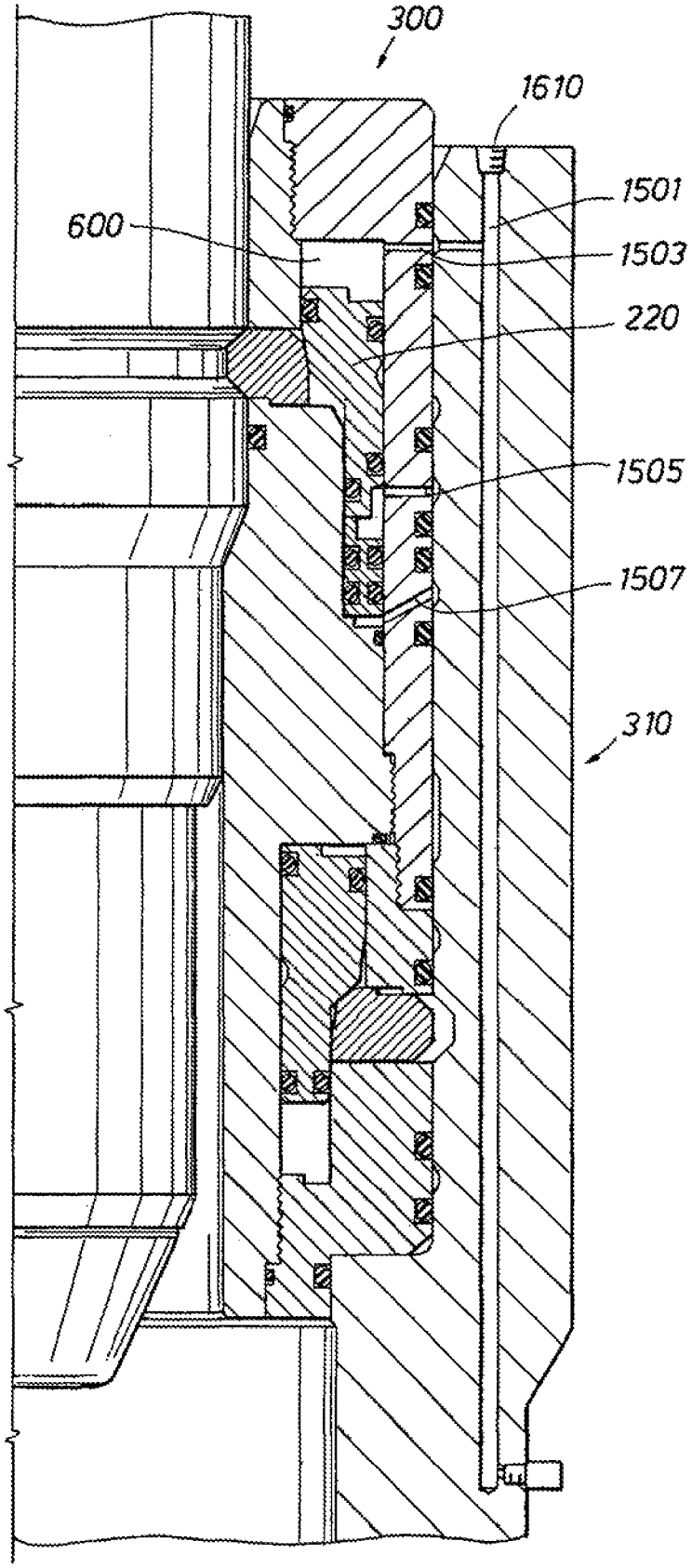
Figure 15L:
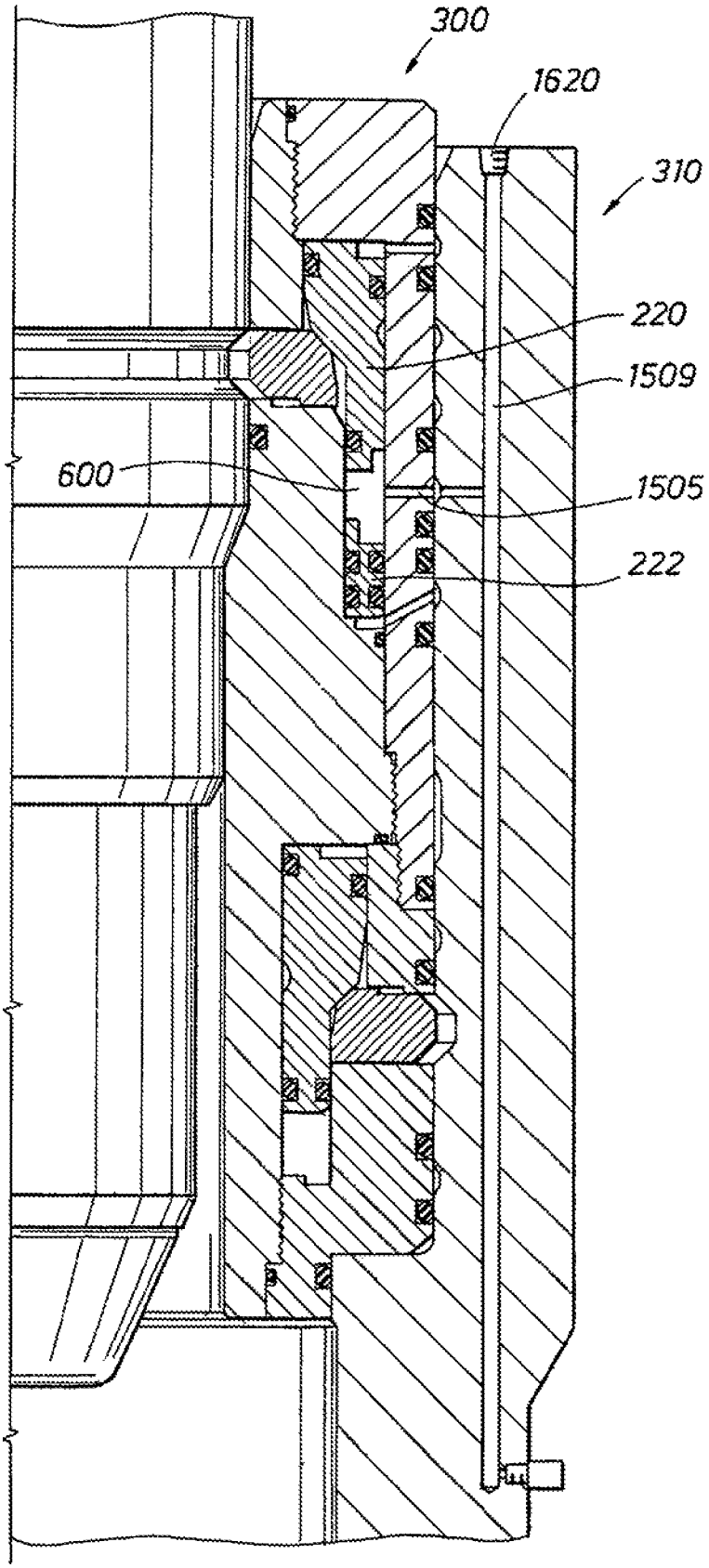
Figure 15M:
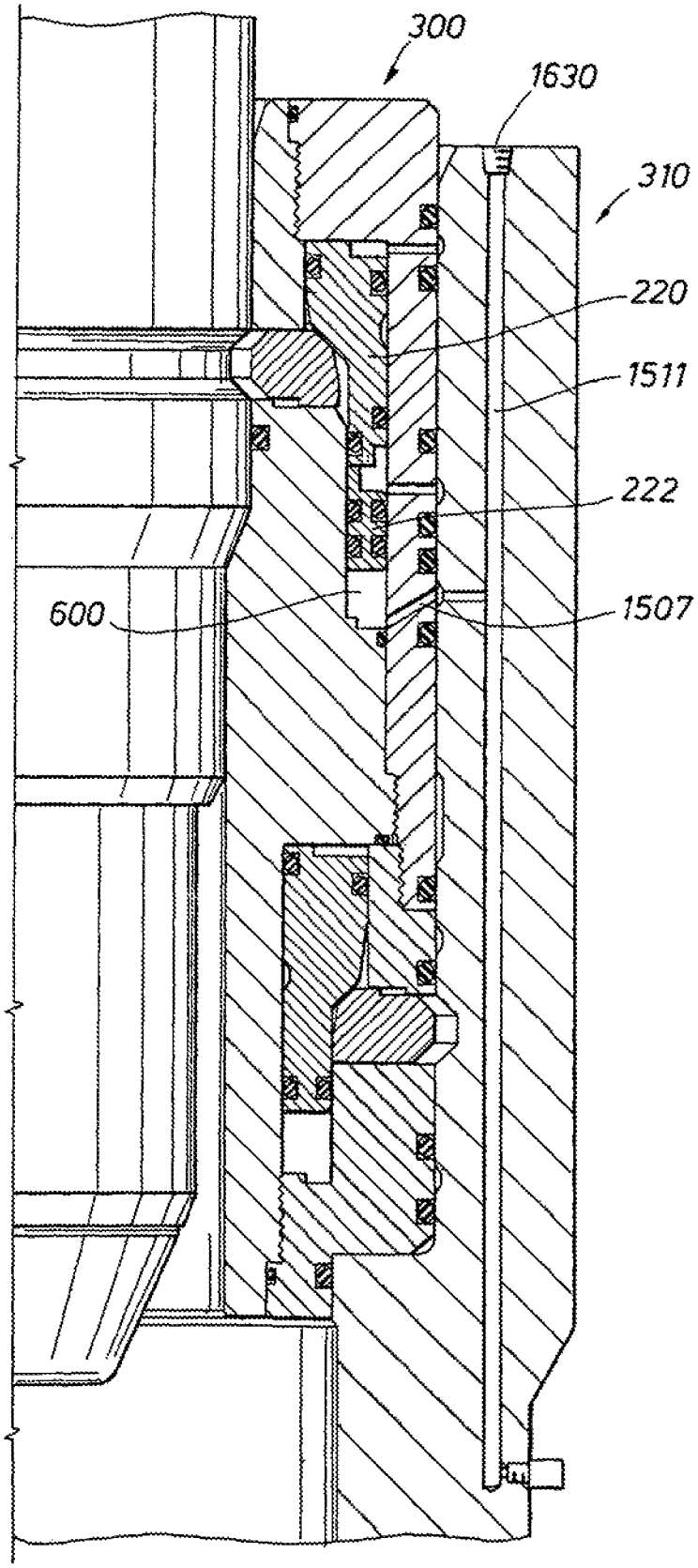
Figure 15N:
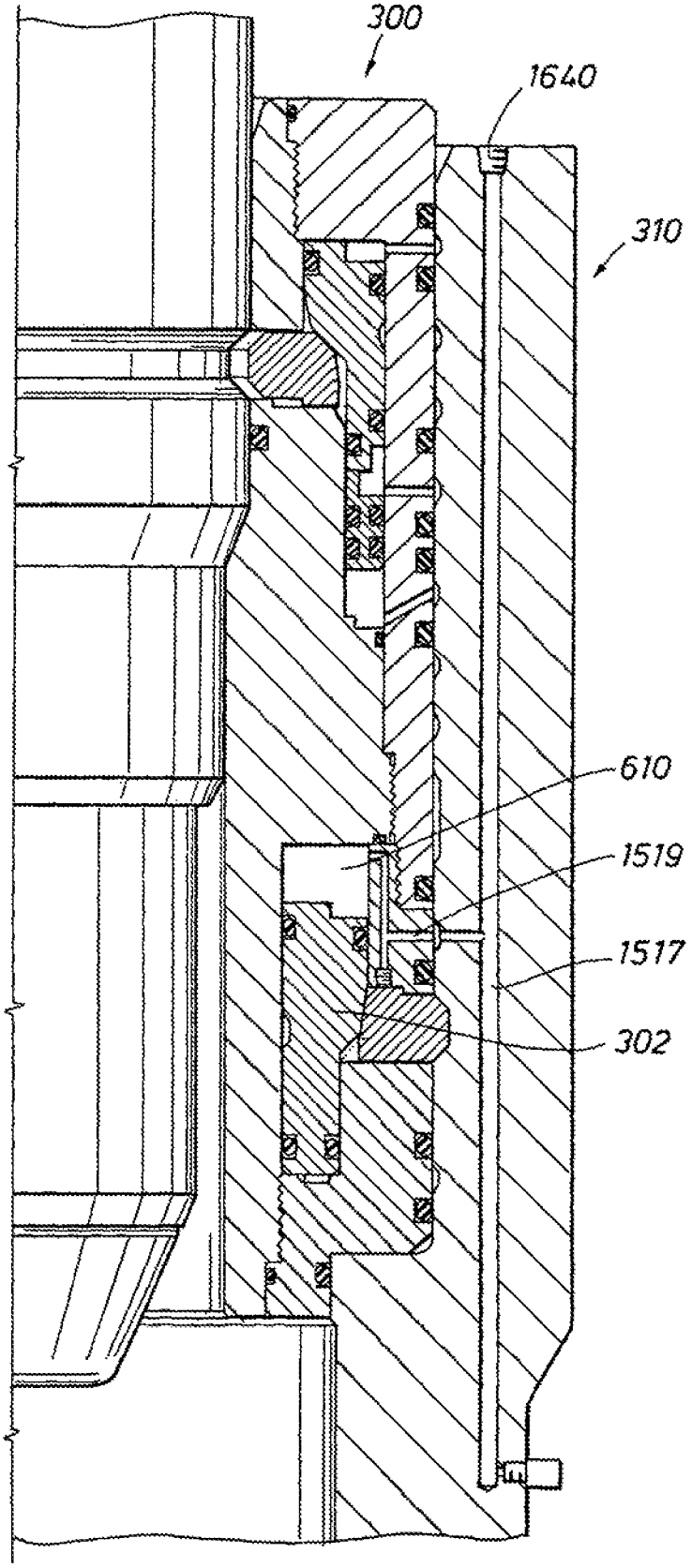
Figure 150:
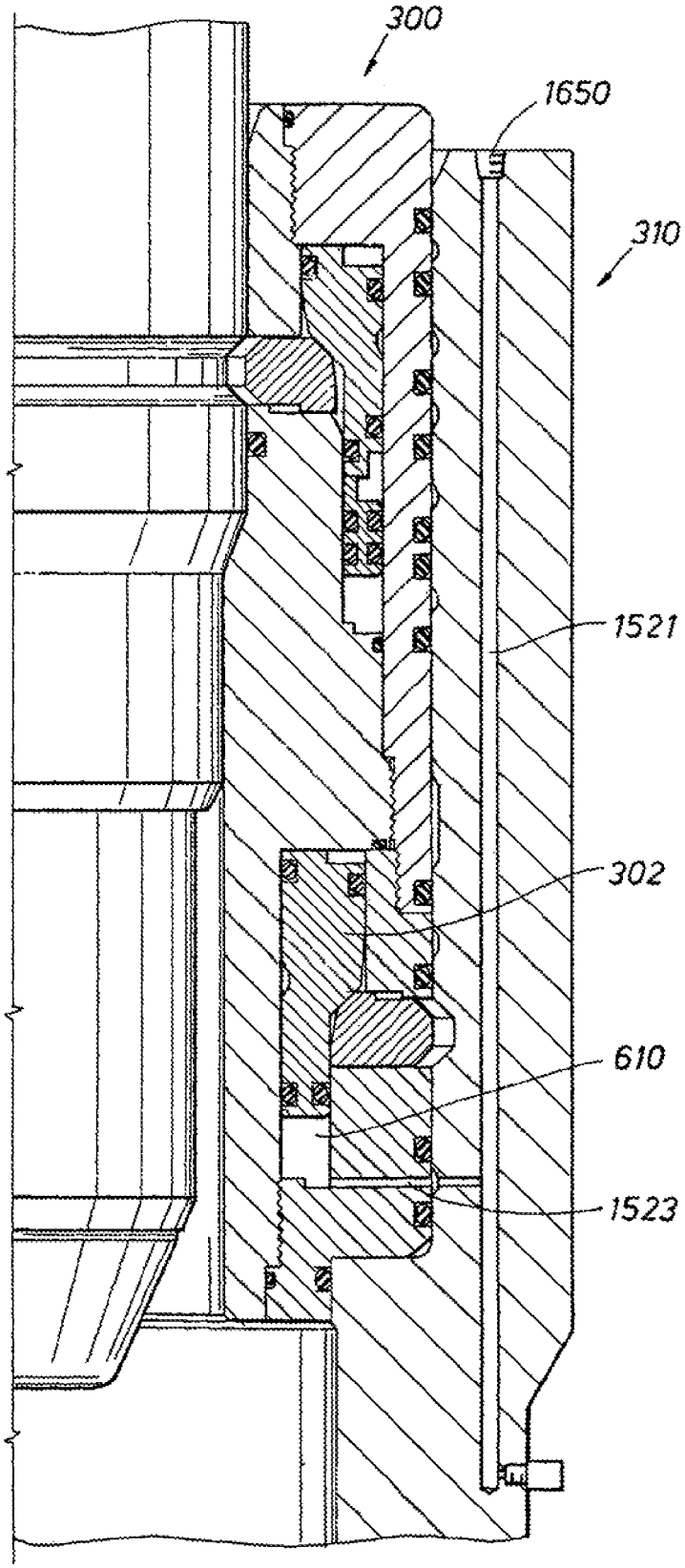
Figure 16:
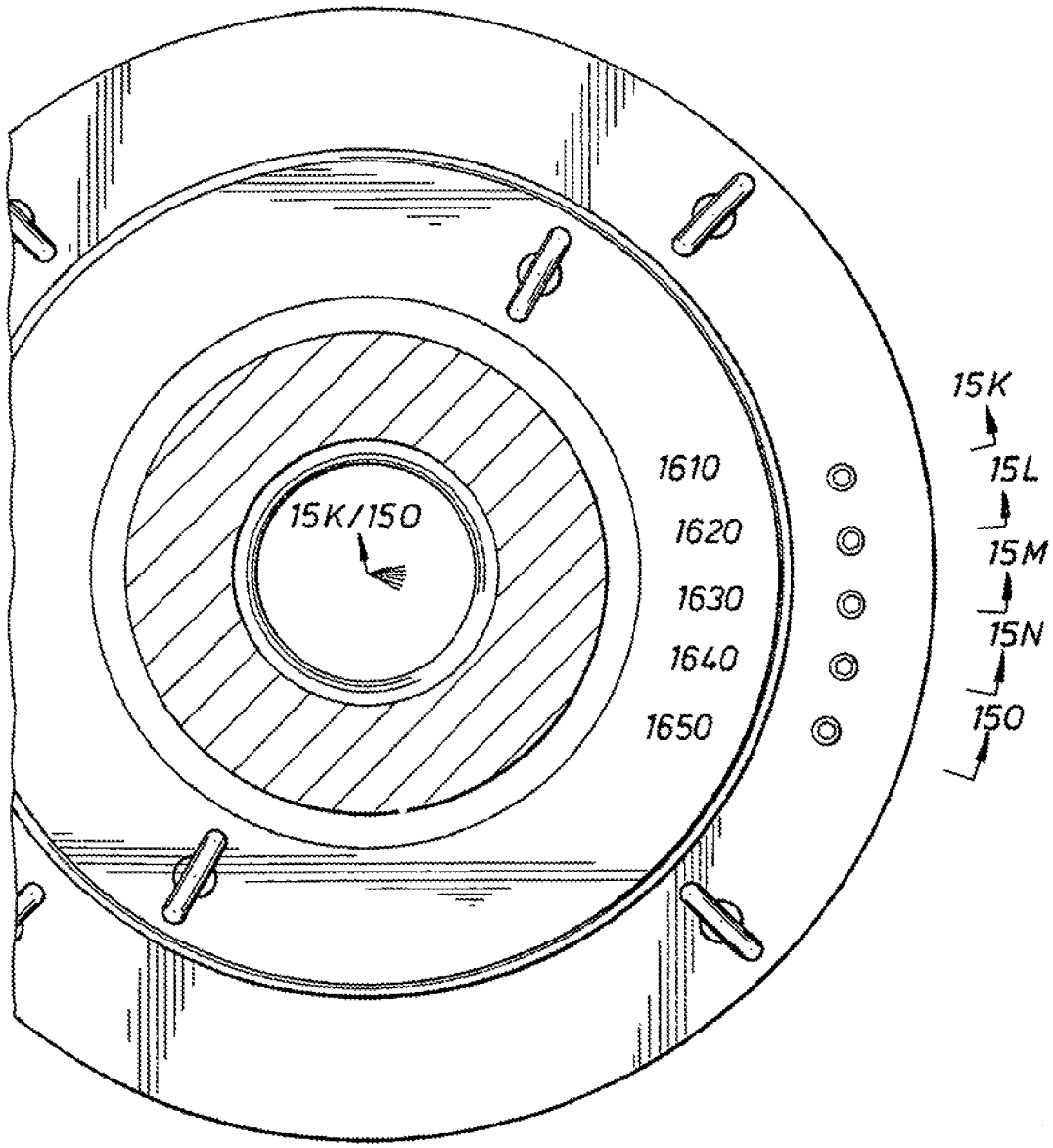
FIG. 16 is an end view of the dual hydraulic latch assembly of FIGS. 6-8 illustrating hydraulic connection ports corresponding to the cross-section views of FIGS. 15K-15O.

FIGS. 15K, 15L, 15M, 15N, 15O and 16 illustrate an embodiment in which measurement of the volume of fluid pumped into chambers 600 and 610 can be used to indicate the state of the latch assembly 300. Passageways 1501 and 1503 as shown in FIG. 15K, corresponding to passageways 1101 and 1103 as shown in FIG. 11A, allow hydraulic fluid to be pumped into chamber 600, causing piston 220 to move to the latched position. Passageways 1505 and 1509 as shown in FIG. 15L, corresponding to passageways 1105 and 1109, allow hydraulic fluid to be pumped into chamber 600, causing piston 220 to move to the unlatched position and piston 222 to move away from piston 220. Passageways 1507 and 1511 as shown in FIG. 15M, corresponding to passageways 1107 and 1111 as shown in FIG. 11E, allow hydraulic fluid to be pumped into chamber 600, causing piston 222 to urge piston 220 from the latched to the unlatched position. Passageways 1517 and 1519 as shown in FIG. 15N, corresponding to passageways 1117 and 1119 as shown in FIG. 11G, allow hydraulic fluid to be pumped into chamber 610, causing piston 302 to move to the latched position. Passageways 1521 and 1523 as shown in FIG. 15O, corresponding to passageways 1121 and 1123 as shown in FIG. 11H, allow hydraulic fluid to be pumped into chamber 610, causing piston 302 to move to the unlatched position. Ports 1610, 1620, 1630, 1640, and 1650 allow connection of hydraulic lines to passageways 1501, 1509, 1511, 1517 and 1521, respectively. By measuring the flow of fluid with flow meters FM, the amount or volume of fluid pumped through passageways 1501, 1509, 1511, 1517 and 1521 can be measured and compared to a predetermined volume. Based on the relative relationship between the measured volume value and the predetermined volume value, the system S of FIG. 13 can determine and indicate on display 1400 the position of the pistons 220, 222 and 302, hence whether the latch assembly 300 is latched to the rotating control device 100 and whether the latch assembly 300 is latched to the housing section, such as housing section 310, as described above.

In one embodiment, the predetermined volume value is a range of predetermined volume values. The predetermined volume value can be experimentally determined. An exemplary range of predetermined volume values is 0.9 to 1.6 gallons of hydraulic fluid, including 2 gallon to account for air that may be in either the chamber or the hydraulic line. Other ranges of predetermined volume values are contemplated.

Figure 17:
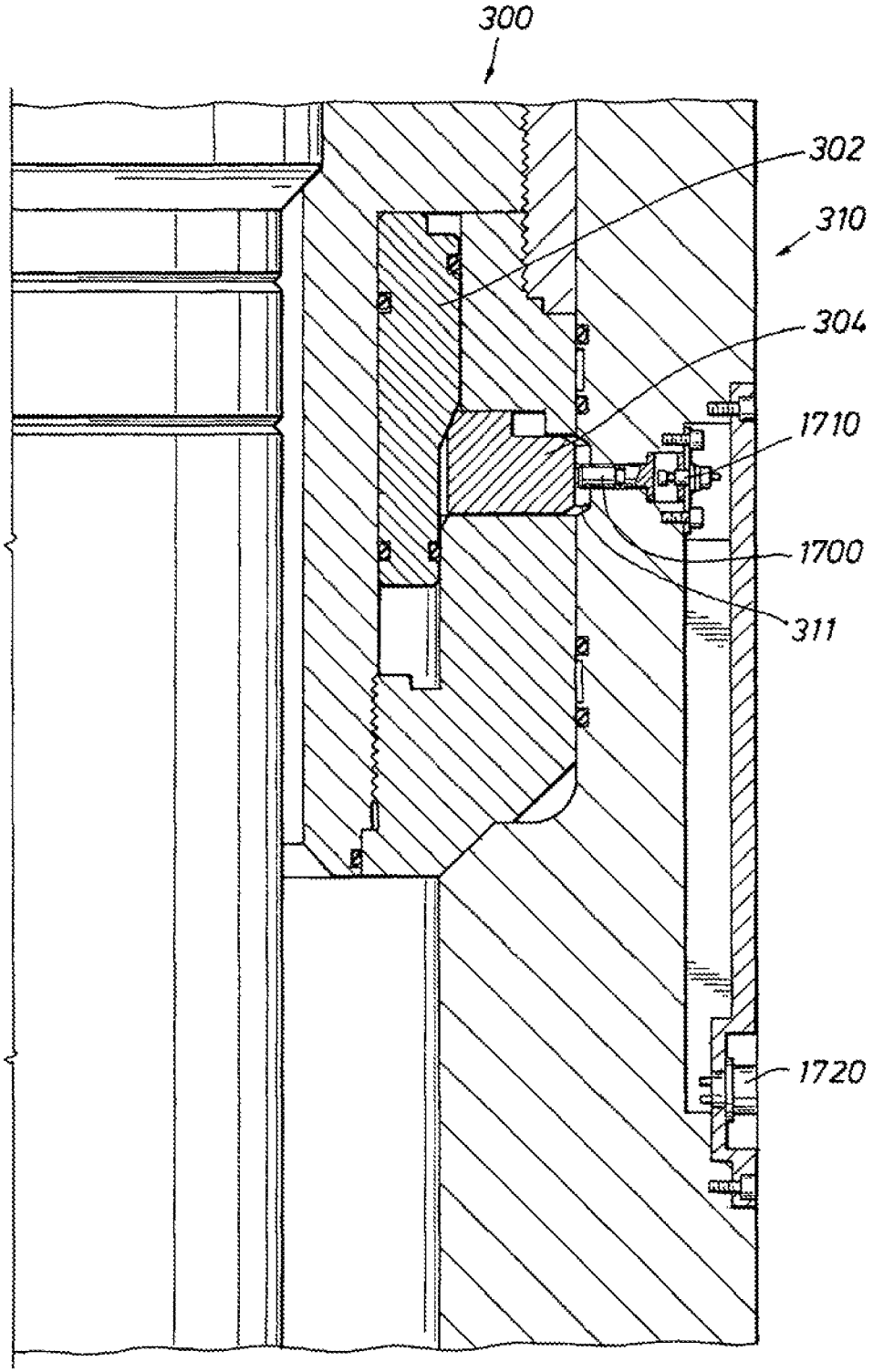
FIG. 17 is an enlarged cross-section detail view illustrating an electrical indicator system for transmitting whether the dual hydraulic latch assembly is unlatched or latched to the indicator panel of FIG. 14.
Figure 18:
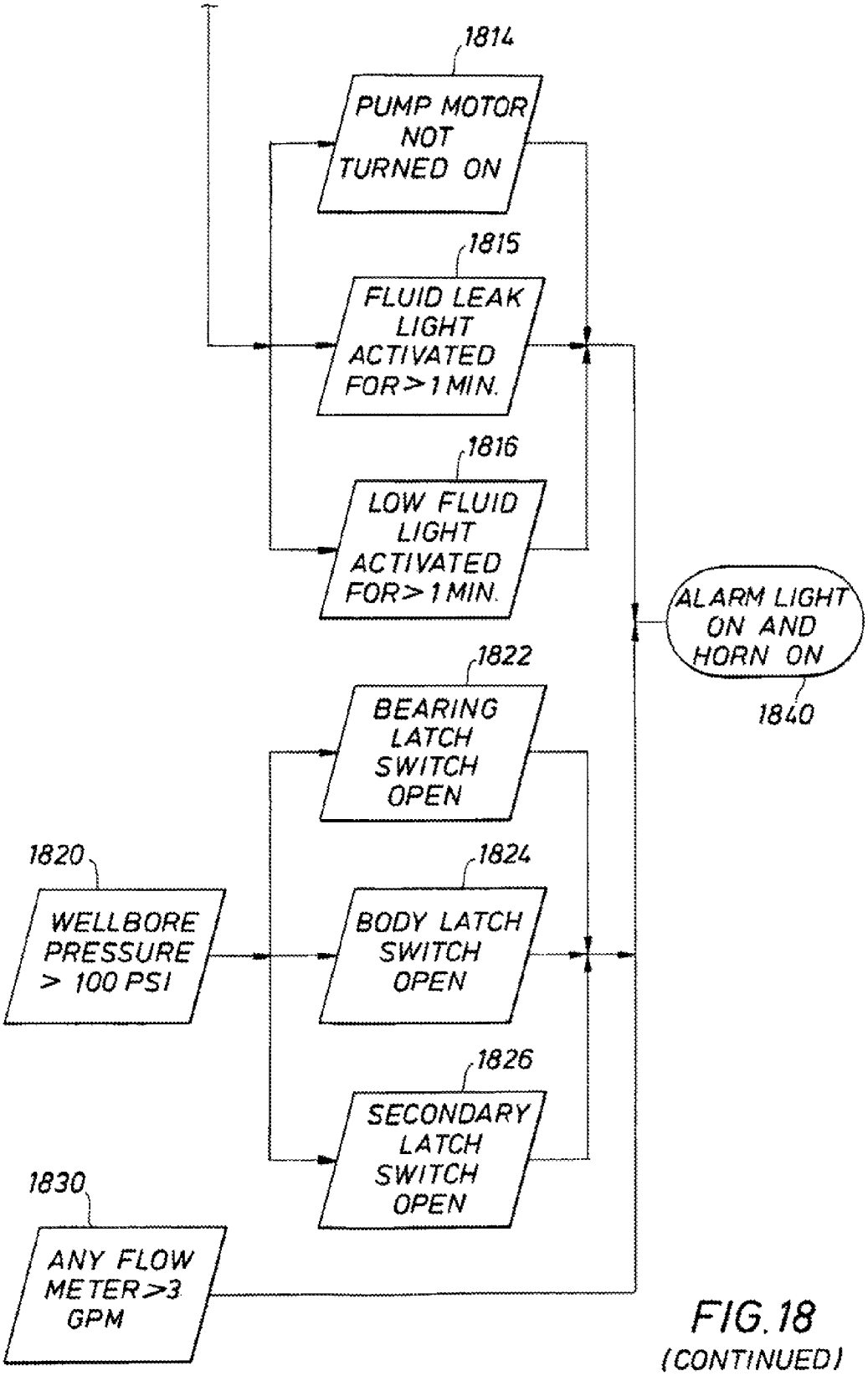

FIG. 17 illustrates an alternate embodiment that uses an electrical switch to indicate whether the latch assembly 300 is latched to the housing section 310. Movement of the retainer member 304 by the piston 302 can be sensed by a switch piston 1700 protruding in the latching formation 311. The switch piston 1700 is moved outwardly by the retainer member 304. Movement of the switch piston 1700 causes electrical switch 1710 to open or close, which can in turn cause an electrical signal via electrical connector 1720 to a remote indicator position system and to display 1400. Internal wiring is not shown in FIG. 17 for clarity of the drawing. Any convenient type of switch 1710 and electrical connector 1720 can be used. Preferably, switch piston 1700 is biased inwardly toward the latch assembly 300, either by switch 1710 or by a spring or similar apparatus, so that switch piston 1700 will move inwardly toward the latch assembly 300 when the retainer member 304 retracts upon unlatching the latch assembly 300 from the housing section 310.

As can now be understood, FIG. 17 illustrates "directly" determining whether the retainer member 304 is in the latched or unlatched position since the switch piston 1700 and electrical switch 1710 directly senses the retainer member 304. This is distinguished from the previously described method of using hydraulic fluid measurements to determine the location of the hydraulic piston, such as piston 302, and therefore "indirectly" determining whether the retainer member, such as retainer member 304, is in the latched position or unlatched position from the position of the hydraulic piston. Further, FIG. 17 illustrates a sensor that is a "contact type" sensor, in that the switch piston 1700 makes physical contact with the retainer member 304. As will be discussed below, the "contact type" sensor may simply determine if the retainer member is latched or unlatched, or it may determine the actual location of the retainer member 304, which may be somewhere between the latched and unlatched positions, or even past the normal latched position that would be expected for an inserted oilfield device or, in other words, an override position, which may be useful to determine if the oilfield device is latched in the proper location. As can now be understood, the output from electrical switch 1710 may be used to remotely and directly determine whether retainer member 304 is latched or unlatched.

Various changes in the details of the illustrated apparatus and construction and the method of operation may be made. In particular, variations in the orientation of the rotating control device 100, latch assemblies 210, 300, housing section 310, and other system components are possible. For example, the retainer members 218 and 304 can be biased radially inward or outward. The pistons 220, 222, and 302 can be a continuous annular member or a series of cylindrical pistons disposed about the latch assembly. Furthermore, while the embodiments described above have discussed rotating control devices, the apparatus and techniques disclosed herein can be used to advantage on other tools, including rotating blowout preventers.

All movements and positions, such as "above," "top," "below," "bottom," "side," "lower," and "upper" described herein are relative to positions of objects as viewed in the drawings such as the rotating control device. Further, terms such as "coupling," "engaging," "surrounding," and variations thereof are intended to encompass direct and indirect "coupling," "engaging," "surrounding," and so forth. For example, the retainer member 218 can engage directly with the rotating control device 100 or can be engaged with the rotating control device 100 indirectly through an intermediate member and still fall within the scope of the disclosure.

Figure 19:
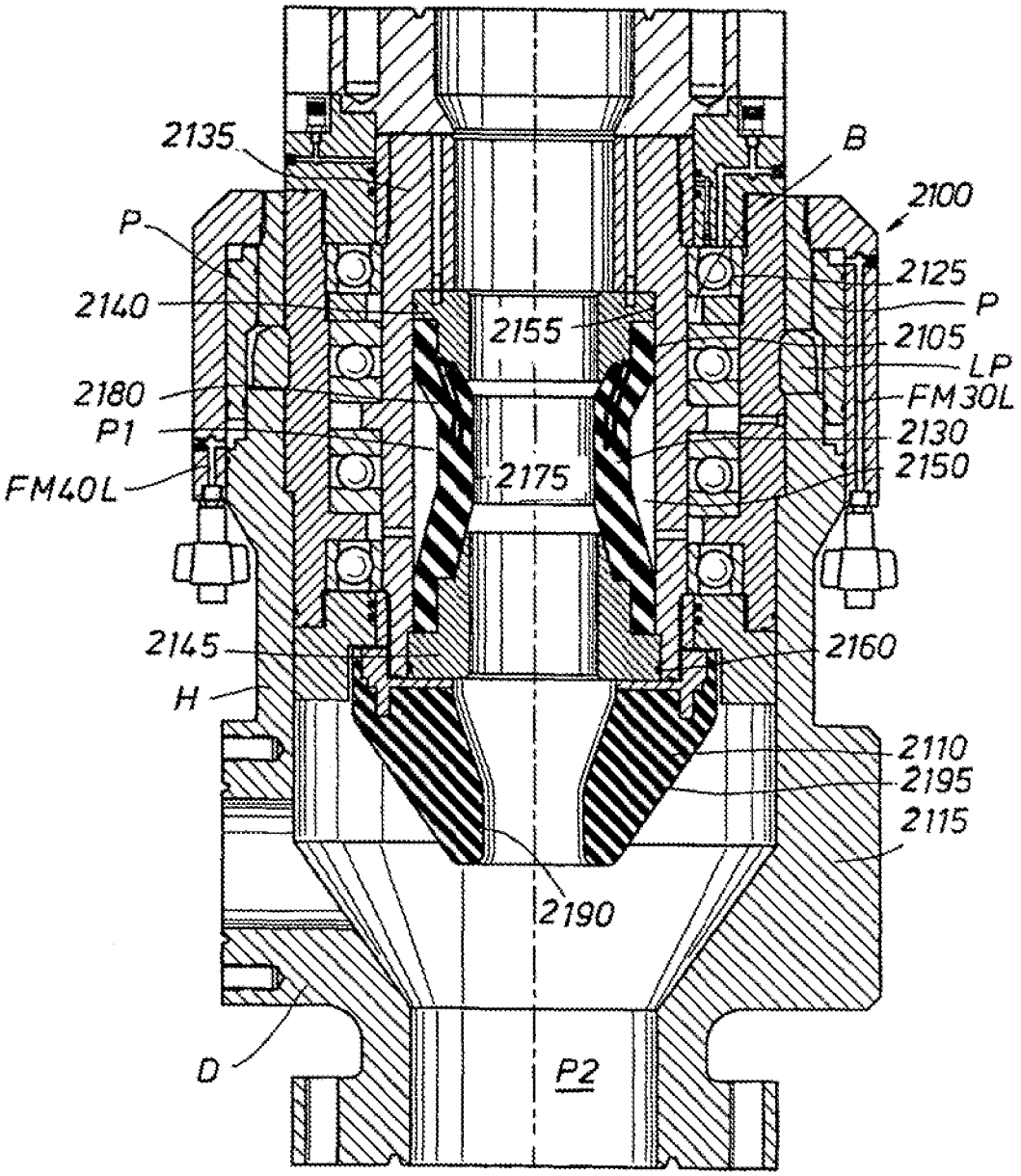
FIG. 19 is an elevational section view illustrating an RCD having an active seal assembly positioned above a passive seal assembly latched in a housing.

FIG. 19 is a cross-sectional view illustrating a rotating control device, generally indicated at 2100. The rotating control device 2100 preferably includes an active seal assembly 2105 and a passive seal assembly 2110. Each seal assembly 2105, 2110 includes components that rotate with respect to a housing 2115. The components that rotate in the rotating control device are mounted for rotation about a plurality of bearings 2125.

As depicted, the active seal assembly 2105 includes a bladder support housing 2135 mounted within the plurality of bearings 2125. The bladder support housing 2135 is used to mount bladder 2130. Under hydraulic pressure, bladder 2130 moves radially inward to seal around a tubular, such as a drilling pipe or tubular (not shown). In this manner, bladder 2130 can expand to seal off a borehole using the rotating control device 2100.

As illustrated in FIG. 19, upper and lower caps 2140, 2145 fit over the respective upper and lower end of the bladder 2130 to secure the bladder 2130 within the bladder support housing 2135. Typically, the upper and lower caps 2140, 2145 are secured in position by a setscrew (not shown). Upper and lower seals 2155, 2160 seal off chamber 2150 that is preferably defined radially outwardly of bladder 2130 and radially inwardly of bladder support housing 2135.

Generally, fluid is supplied to the chamber 2150 under a controlled pressure to energize the bladder 2130. Essentially, the hydraulic control maintains and monitors hydraulic pressure within pressure chamber 2150. Hydraulic pressure P1 is preferably maintained by the hydraulic control between 0 to 200 PSI above a wellbore pressure P2. The bladder 2130 is constructed from flexible material allowing bladder surface 2175 to press against the tubular at approximately the same pressure as the hydraulic pressure P1. Due to the flexibility of the bladder, it also may conveniently seal around irregular shaped tubular string, such as a hexagonal Kelly. In this respect, the hydraulic control maintains the differential pressure between the pressure chamber 2150 at pressure P1 and wellbore pressure P2. Additionally, the active seal assembly 2105 includes support fingers 2180 to support the bladder 2130 at the most stressful area of the seal between the fluid pressure P1 and the ambient pressure.

The hydraulic control may be used to de-energize the bladder 2130 and allow the active seal assembly 2105 to release the seal around the tubular. Generally, fluid in the chamber 2150 is drained into a hydraulic reservoir (not shown), thereby reducing the pressure P1. Subsequently, the bladder surface 2175 loses contact with the tubular as the bladder 2130 becomes de-energized and moves radially outward. In this manner, the seal around the tubular is released allowing the tubular to be removed from the rotating control device 2100.

In the embodiment shown in FIG. 19, the passive seal assembly 2110 is operatively attached to the bladder support housing 2135, thereby allowing the passive seal assembly 2110 to rotate with the active seal assembly 2105. Fluid is not required to operate the passive seal assembly 2110 but rather it utilizes pressure P2 to create a seal around the tubular. The passive seal assembly 2110 is constructed and arranged in an axially downward conical shape, thereby allowing the pressure P2 to act against a tapered surface 2195 to close the passive seal assembly 2110 around the tubular. Additionally, the passive seal assembly 2110 includes an inner diameter 2190 smaller than the outer diameter of the tubular to provide an interference fit between the tubular and the passive seal assembly 2110.

Figure 20:
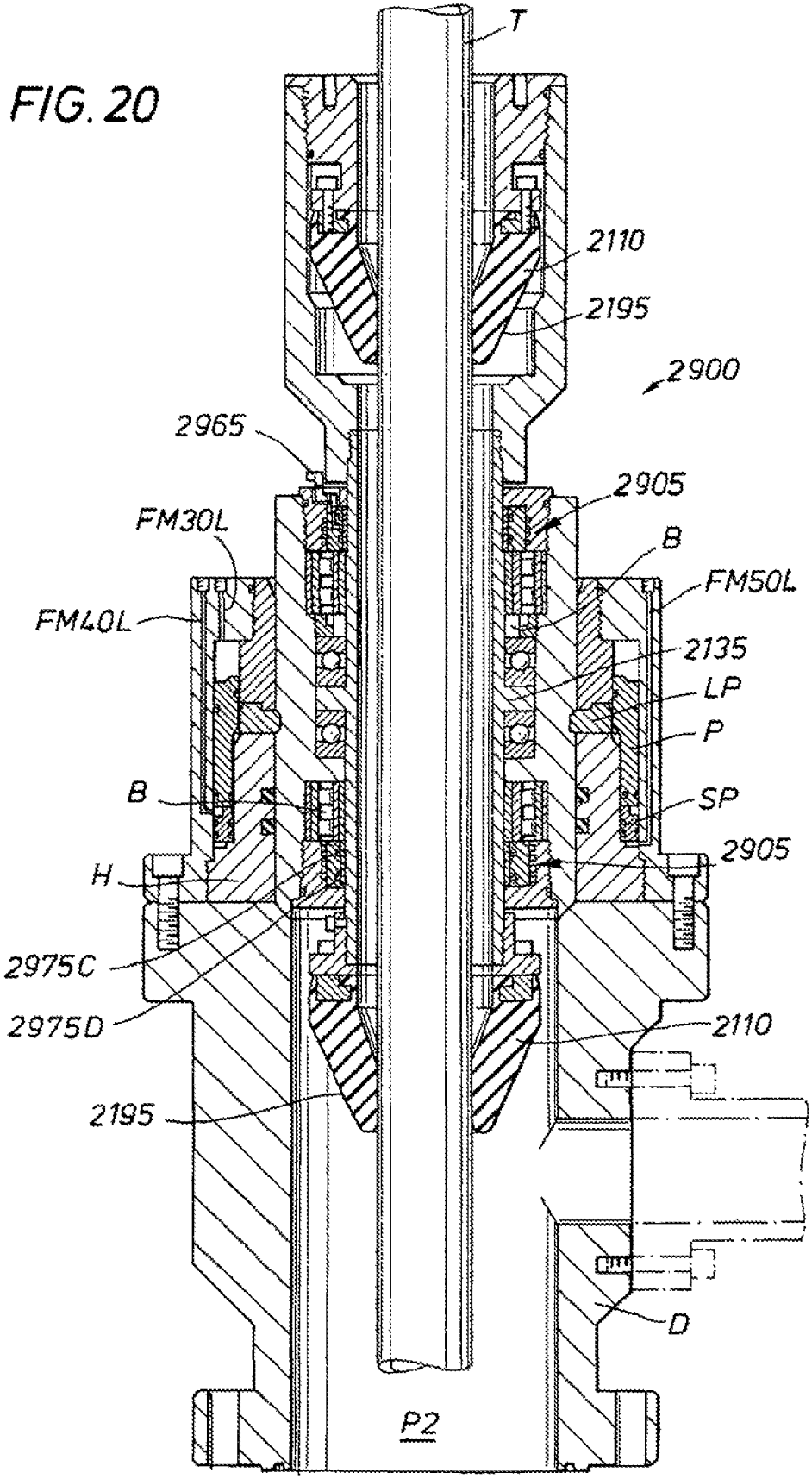
FIG. 20 is an elevational section view showing an RCD with two passive seal assemblies latched in a housing.

FIG. 20 illustrates another embodiment of a rotating control device, generally indicated at 2900. The rotating control device 2900 is generally constructed from similar components as the rotating control device 2100, as shown in FIG. 19. Therefore, for convenience, similar components that function in the same manner will be labeled with the same numbers as the rotating control device 2100. The primary difference between rotating control device 2900 and rotating control device 2100 is the use of two passive seal assemblies 2110, an alternative cooling system using one fluid to cool the radial seals and bearings in combination with a radial seal pressure protection system, and a secondary piston SP in addition to a primary piston P for urging the piston P to the unlatched position.

While FIG. 20 shows the rotating control device 2900 latched in a housing H above a diverter D, it is contemplated that the rotating control devices as shown in the figures could be positioned with any housing or riser as disclosed in U.S. Pat. Nos. 6,138,774; 6,263,982; 6,470,975; and 7,159,669, all of which are assigned to the assignee of the present invention and incorporated herein by reference for all purposes.

As shown in FIG. 20, both passive seal assemblies 2110 are operably attached to the inner member support housing 2135, thereby allowing the passive seal assemblies to rotate together. The passive seal assemblies are constructed and arranged in an axially-downward conical shape, thereby allowing the wellbore pressure P2 in the rotating control device 2900 to act against the tapered surfaces 2195 to close the passive seal assemblies around the tubular T. Additionally, the passive seal assemblies include inner diameters which are smaller than the outer diameter of the tubular T to allow an interference fit between the tubular and the passive seal assemblies.

Startup Operation

Figure 31:
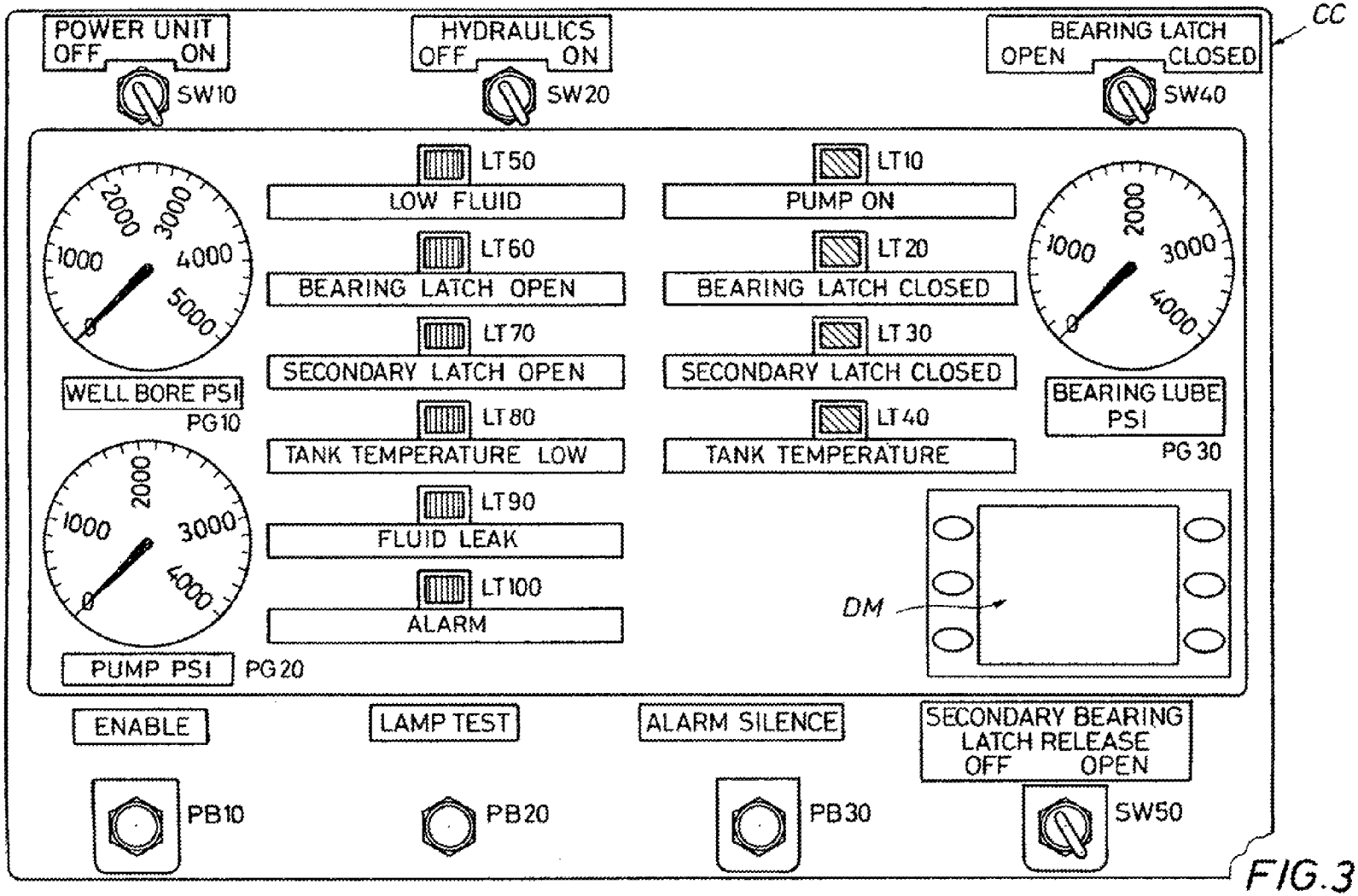
FIG. 31 is a plan view of a control console.

Turning now to FIGS. 21A to 31 along with below Tables 1 and 2, the startup operation of the hydraulic or fluid control of the rotating control device 2900 is described. Referring particularly to FIG. 31, to start the power unit, button PB10 on the control console, generally indicated at CC, is pressed and switch SW10 is moved to the ON position. As discussed in the flowcharts of FIGS. 22-23, the program of the programmable logic controller PLC including comparator CP checks to make sure that button PB10 and switch SW10 were operated less than 3 seconds of each other. If the elapsed time is equal to or over 3 seconds, the change in position of SW10 is not recognized. Continuing on the flowchart of FIG. 22, the two temperature switches TS10 and TS20, also shown in FIG. 21B, are then checked. These temperature switches indicate oil tank temperature. When the oil temperature is below a designated temperature, e.g. 80° F., the heater HT10 (FIG. 21B) is turned on and the power unit will not be allowed to start until the oil temperature reaches the designated temperature. When the oil temperature is above a designated temperature, e.g. 130° F., the heater is turned off and cooler motor M2 is turned on. As described in the flowchart of FIG. 23, the last start up sequence is to check to see if the cooler motor M2 needs to be turned on.

Figure 21A:
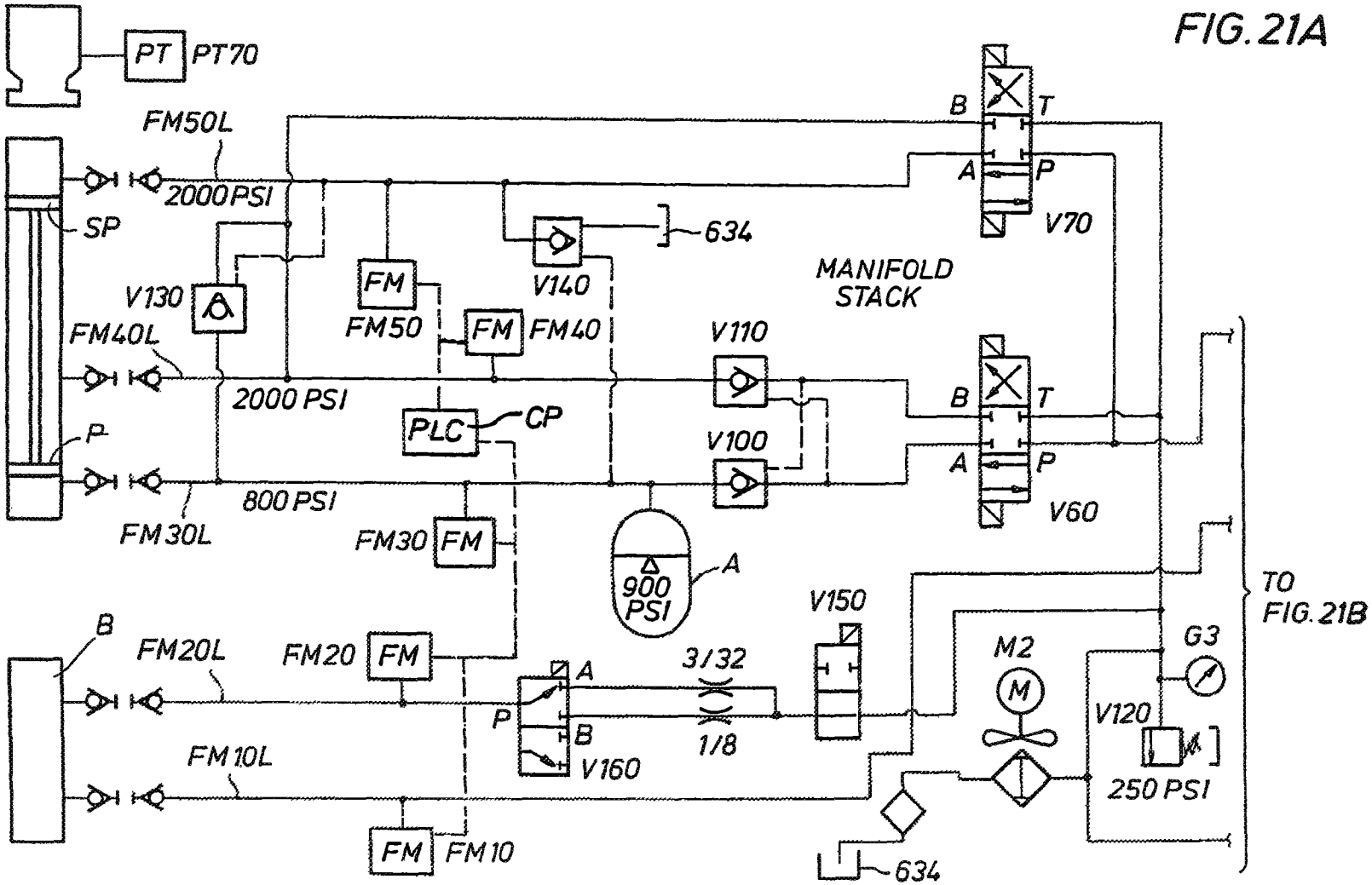
FIGS. 21A and 21B are schematics of a hydraulic system for an RCD.

Continuing on the flowchart of FIG. 22, the wellbore pressure P2 is checked to see if below 50 PSI. While the embodiments of the present invention, particularly FIGS. 21A to 30, propose specific values, parameters or ranges, it should be understood that other values, parameters and ranges could be used and should be used for the particular application. For example, the value for checking the wellbore pressure P2 was changed from "WB<50 PSI" in FIG. 22 to "WB<75 PSI" for a different application. As shown in below Table 2, associated alarms ALARM10, ALARM20, ALARM30 and ALARM40, light LT100 on control console CC, horn HN10 in FIG. 21B, and corresponding text messages on display monitor DM on console CC will be activated as appropriate. Wellbore pressure P2 is measured by pressure transducer PT70 (FIG. 21A). Further, reviewing FIGS. 21B to 23, when the power unit for the rotating control device, such as a Weatherford model 7800, is started, the three oil tank level switches LS10, LS20 and LS30 are checked. The level switches are positioned to indicate when the tank 634 is overfull (no room for heat expansion of the oil), when the tank is low (oil heater coil is close to being exposed), or when the tank is empty (oil heater coil is exposed). As long as the tank 634 is not overfull or empty, the power unit will pass this check by the PLC program.

Figure 21B:
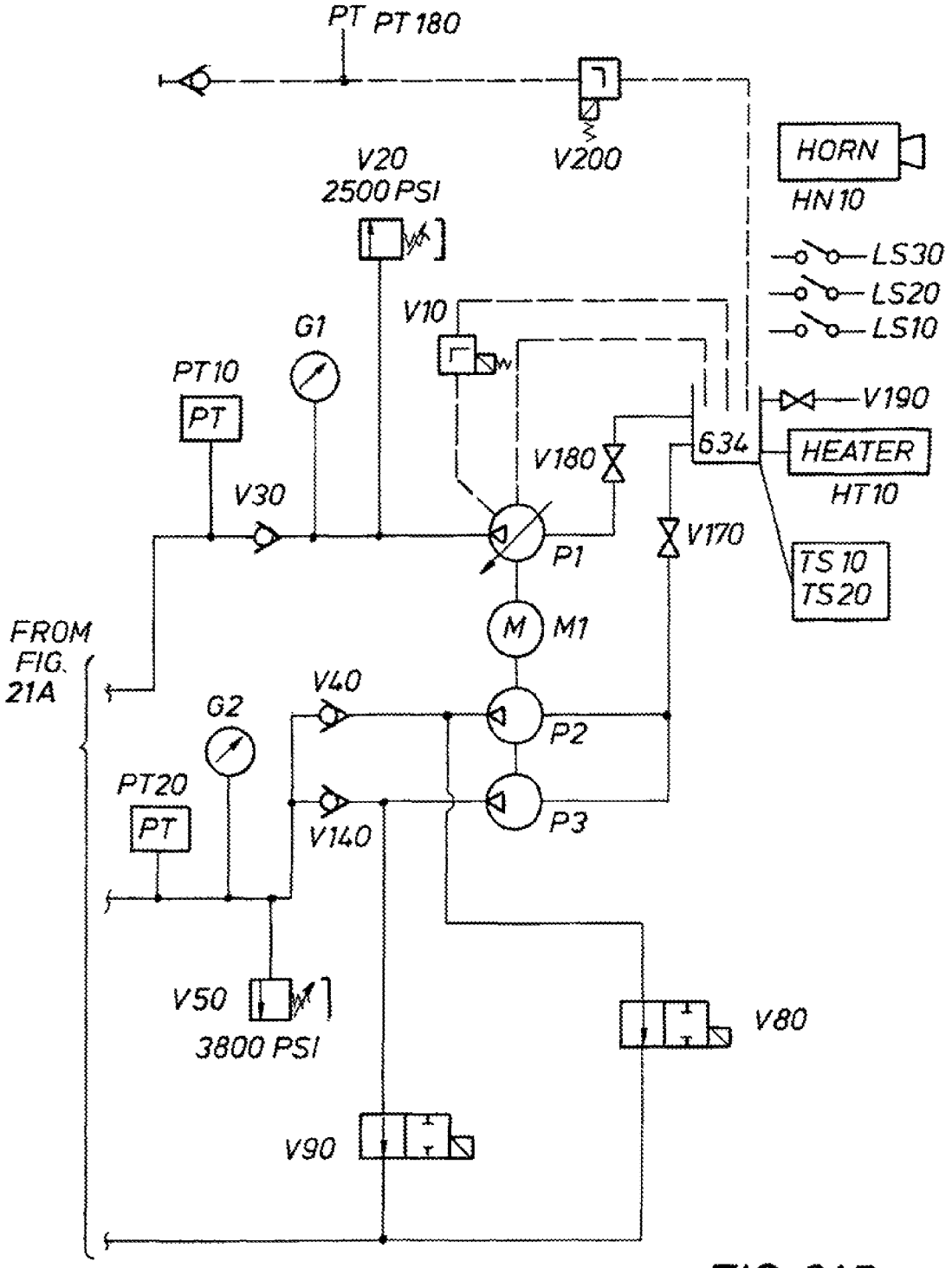
Figure 22:
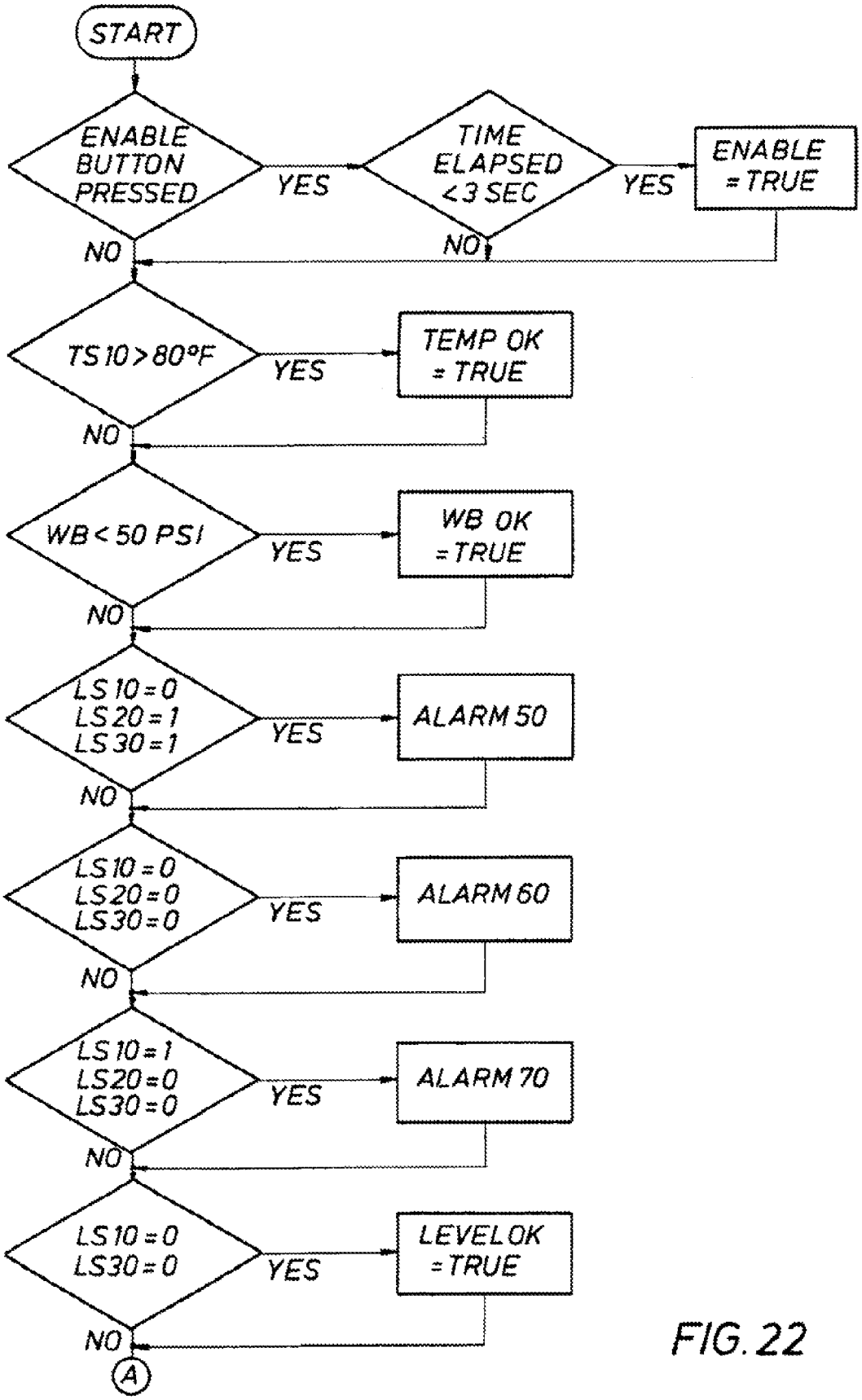
FIG. 22 is a flowchart for operation of the hydraulic system of FIGS. 21A and 21B.
Figure 23:
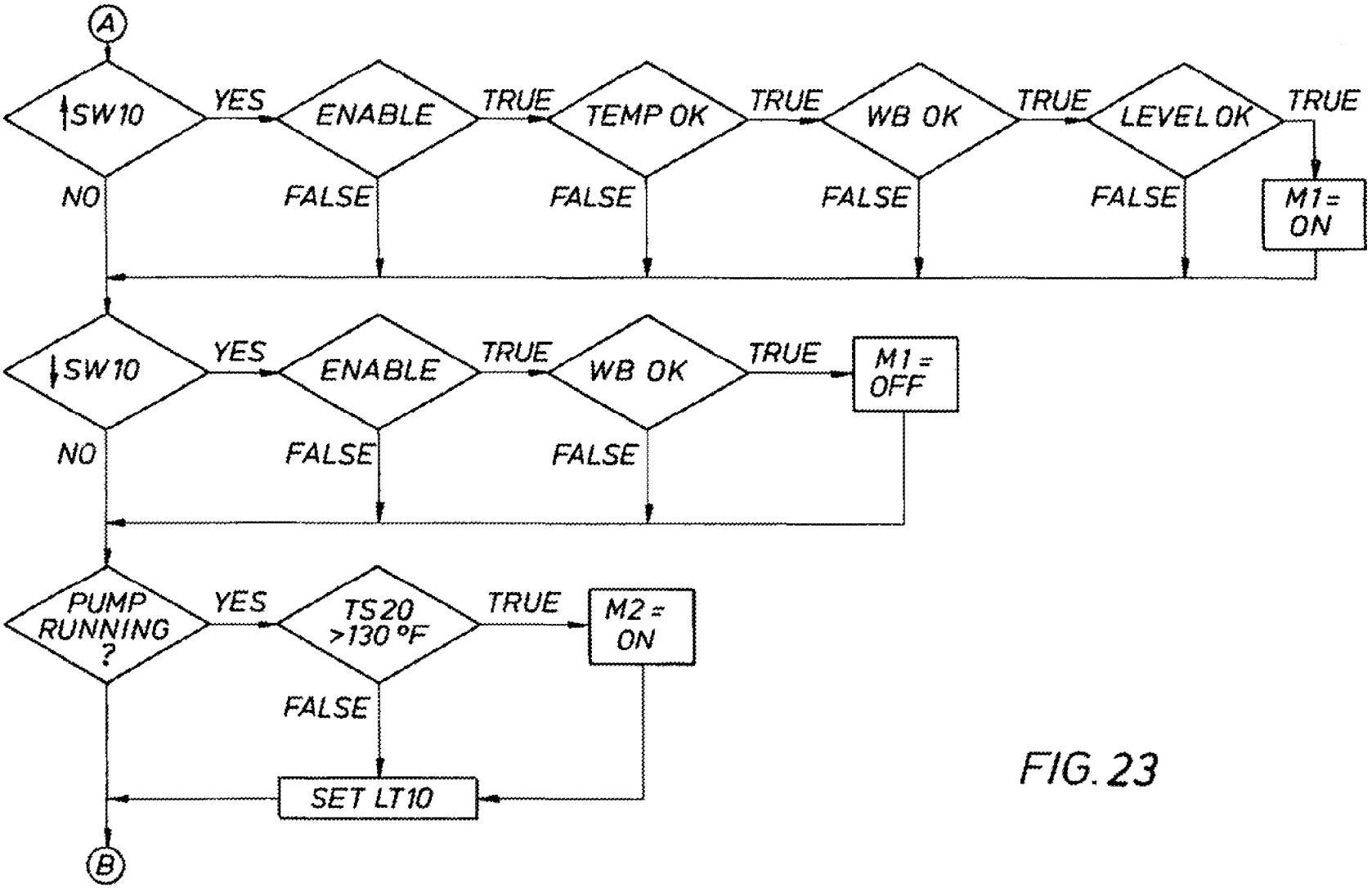
FIG. 23 is a continuation of the flowchart of FIG. 22.

Assuming that the power unit is within the above parameters, valves V80 and V90 are placed in their open positions, as shown in FIG. 21B. These valve openings unload gear pumps P2 and P3, respectively, so that when motor M1 starts, the oil is bypassed to tank 634. Valve V150 is also placed in its open position, as shown in FIG. 21A, so that any other fluid in the system can circulate back to tank 634. Returning to FIG. 21B, pump P1, which is powered by motor M1, will compensate to a predetermined value. The pressure recommended by the pump manufacturer for internal pump lubrication is approximately 300 PSI. The compensation of the pump P1 is controlled by valve V10 (FIG. 21B).

Continuing review of the flowchart of FIG. 22, fluid level readings outside of the allowed values will activate alarms ALARM50, ALARM60 or ALARM70 (see also below Table 2 for alarms) and their respective lights LT100, LT50 and LT60. Text messages corresponding to these alarms are displayed on display monitor DM.

When the PLC program has checked all of the above parameters the power unit will be allowed to start. Referring to the control console CC in FIG. 31, the light LT10 is then turned on to indicate the PUMP ON status of the power unit. Pressure gauge PG20 on console CC continues, to read the pump pressure provided by pressure transducer PT10, shown in FIG. 21B.

When shutdown of the unit desired, the PLC program checks to see if conditions are acceptable to turn the power unit off. For example, the wellbore pressure P2 should be below 50 PSI. Both the enable button PB10 must be pressed and the power switch SW10 must be turned to the OFF position within 3 seconds to turn the power unit off.

Latching Operation System Circuit

Closing the Latching System

Focusing now on FIGS. 20, 21A, 24A, 24B, 29 and 30, the retainer member LP of the latching system of housing H is closed or latched, as shown in FIG. 20, by valve V60 (FIG. 21A) changing to a flow position, so that the ports P-A, B-T are connected. The fluid pilot valve V110 (FIG. 21A) opens so that the fluid on that side of the primary piston P can go back to tank 634 via line FM40L through the B-T port. Valve V100 prevents reverse flow in case of a loss of pressure. Accumulator A (which allows room for heat expansion of the fluid in the latch assembly) is set at 900 psi, slightly above the latch pressure 800 psi, so that it will not charge. Fluid pilot valve V140 (FIG. 21A) opens so that fluid underneath the secondary piston SP goes back to tank 634 via line FM50L and valve V130 is forced closed by the resulting fluid pressure. Valve V70 is shown in FIG. 21A in its center position where all ports (APBT blocked) are blocked to block flow in any line. The pump P1, shown in FIG. 21B, compensates to a predetermined pressure of approximately 800 psi.

The retainer member LP, primary piston P and secondary piston SP of the latching system are mechanically illustrated in FIG. 20 (latching system is in its closed or latched position), schematically shown in FIG. 21A, and their operations are described in the flowcharts in FIGS. 24A, 24B, 29 and 30. Alternative latching systems are disclosed in FIGS. 2, 3, and 19.

With the above described startup operation achieved, the hydraulics switch SW20 on the control console CC is turned to the ON position. This allows the pump P1 to compensate to the required pressure later in the PLC program. The bearing latch switch SW40 on console CC is then turned to the CLOSED position. The program then follows the process outlined in the CLOSED leg of SW40 described in the flowcharts of FIGS. 24A and 24B. The pump P1 adjusts to provide 800 psi and the valve positions are then set as detailed above. As discussed below, the PLC program of the PLC comparator CP then compares the amount of fluid that flows through flow meters FM30, FM40 and FM50 to ensure that the required amount of fluid to close or latch the latching system goes through the flow meters. Lights LT20, LT30, LT60 and LT70 on console CC show the proper state of the latch. Pressure gauge PG20, as shown on the control console CC, continues to read the pressure from pressure transducer PT10 (FIG. 21B). All other comparisons described herein are also performed by the PLC comparator CP, which is in connection with the applicable flow meters.

Primary Latching System Opening

Figure 24A:
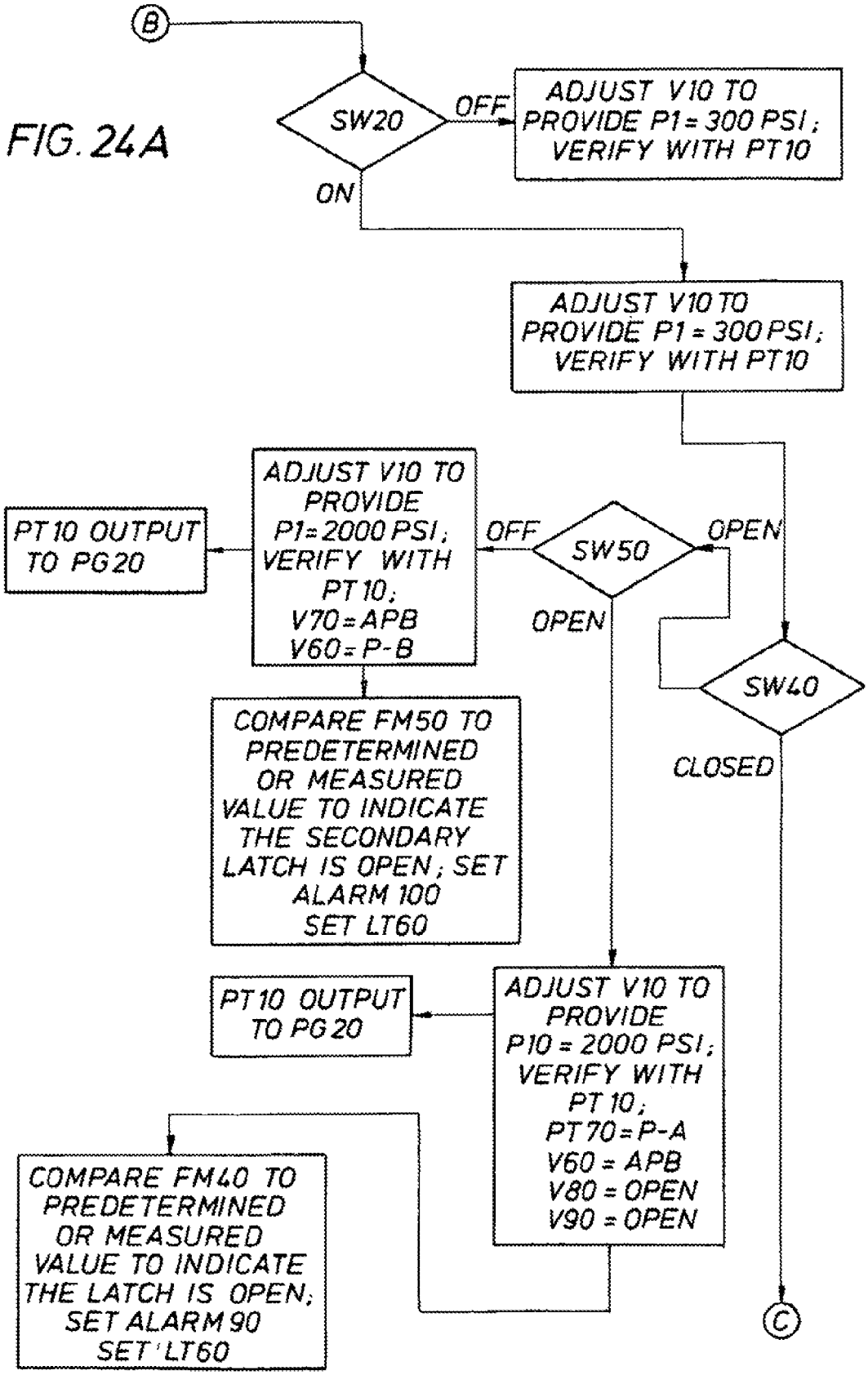
FIG. 24A is a continuation of the flowchart of FIG. 23.
Figure 24B:
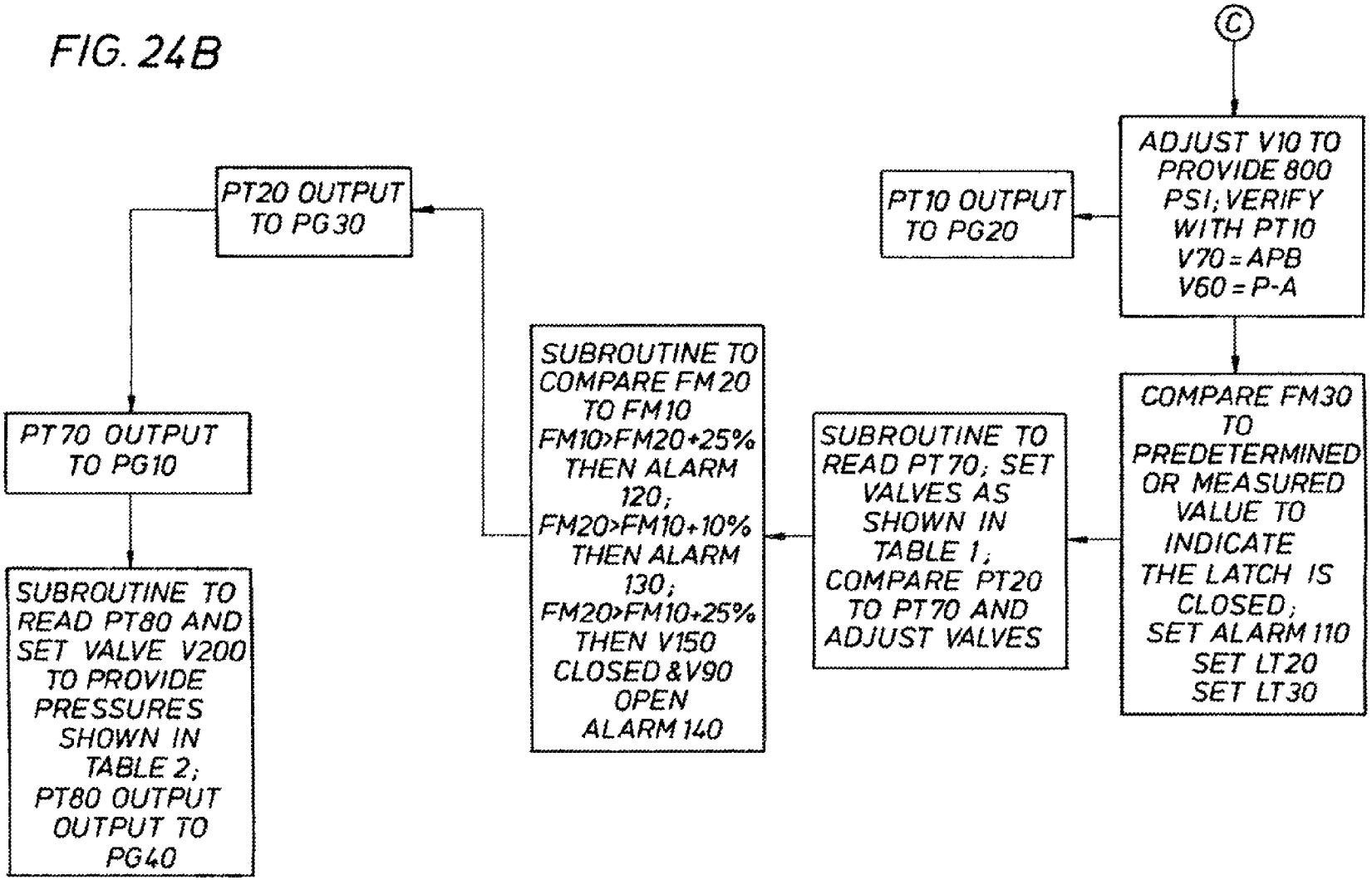
FIG. 24B is a continuation of the flowchart of FIG. 24A.
Figure 25:
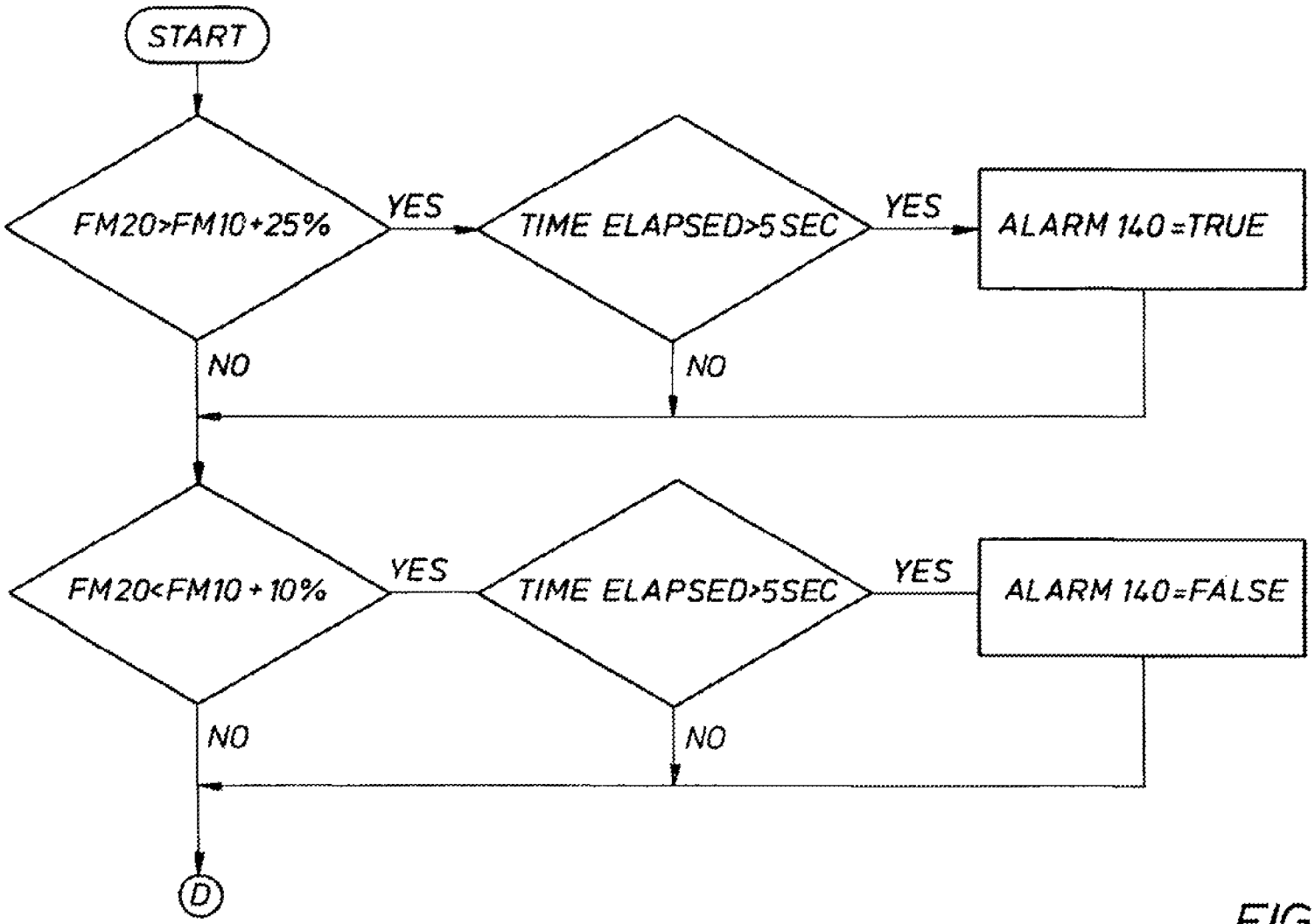
FIG. 25 is a flowchart of a subroutine for controlling the pressure in the bearing section of an RCD.
Figure 26:
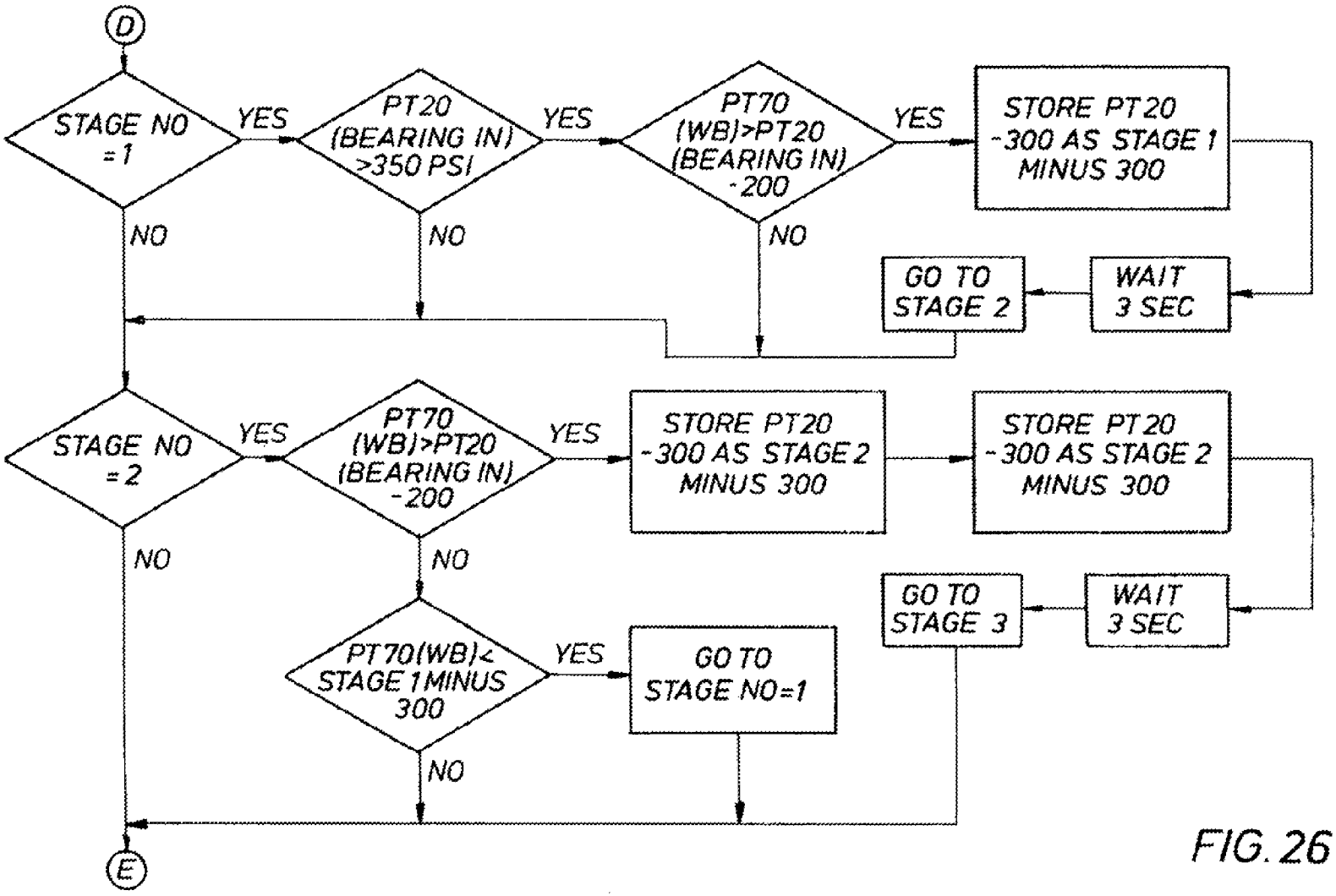
FIG. 26 is a continuation of the flowchart of FIG. 25.
Figure 27:
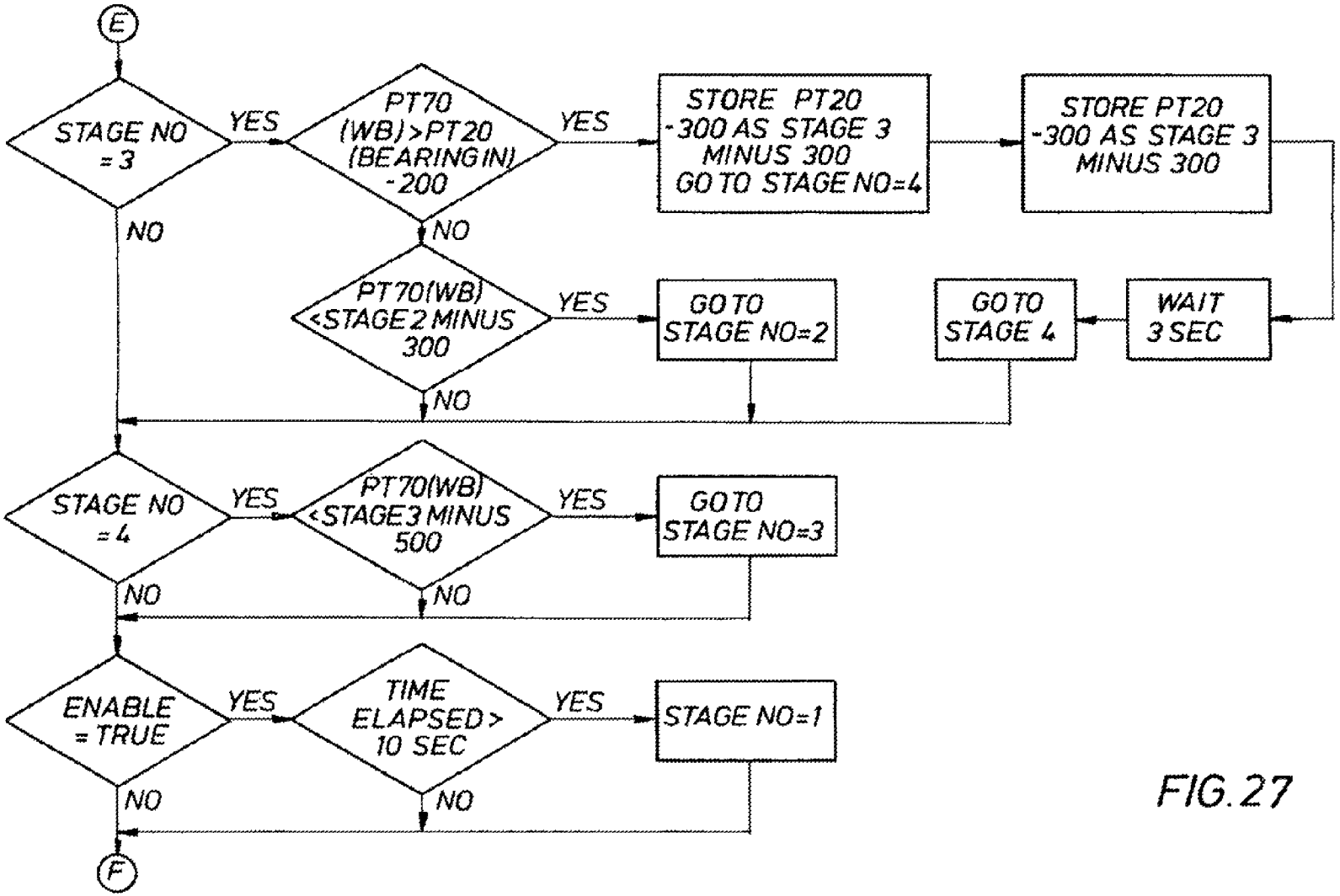
FIG. 27 is a continuation of the flowchart of FIG. 26.
Figure 28:
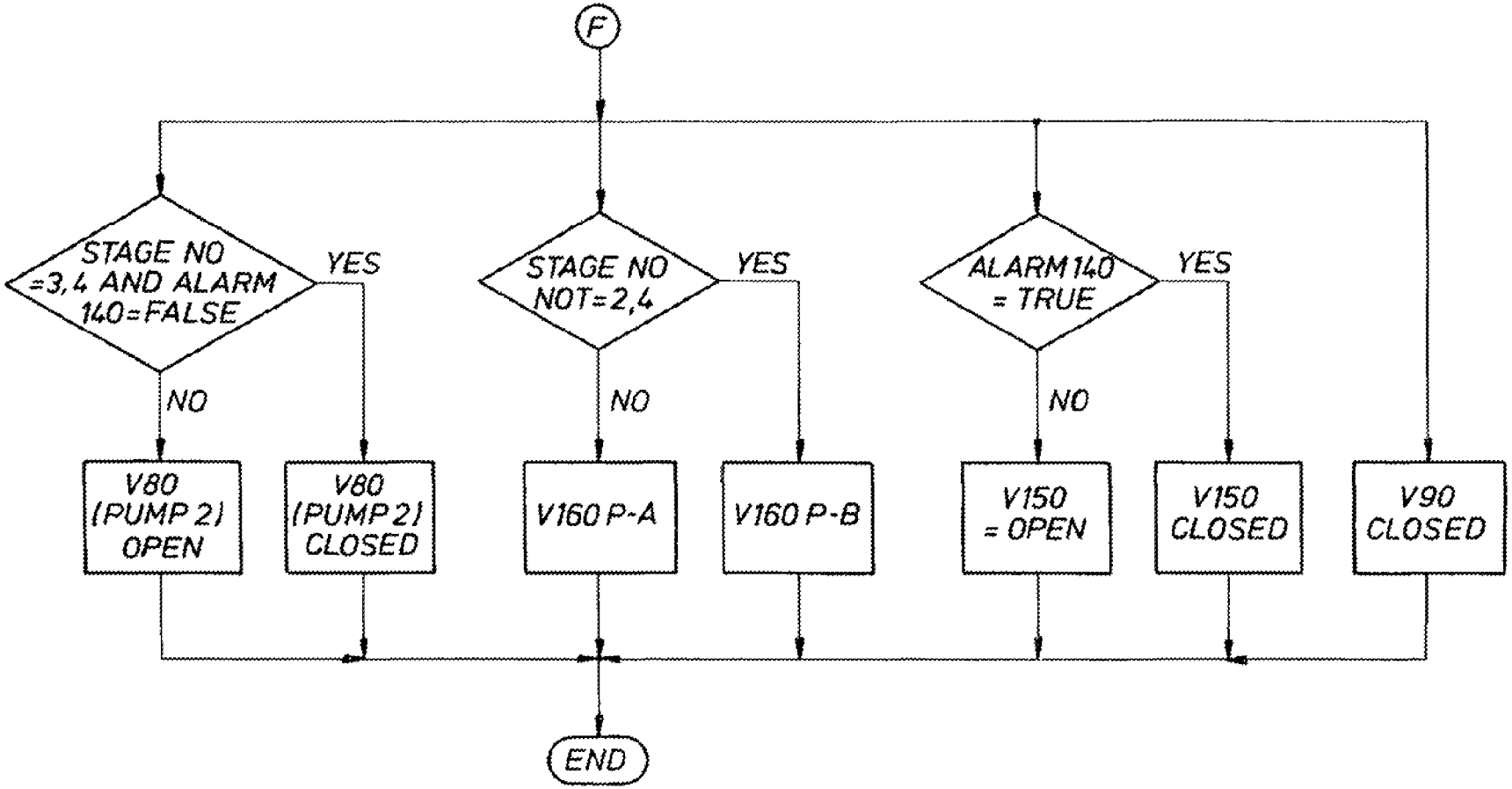
FIG. 28 is a continuation of the flowchart of FIG. 27.
Figure 29:
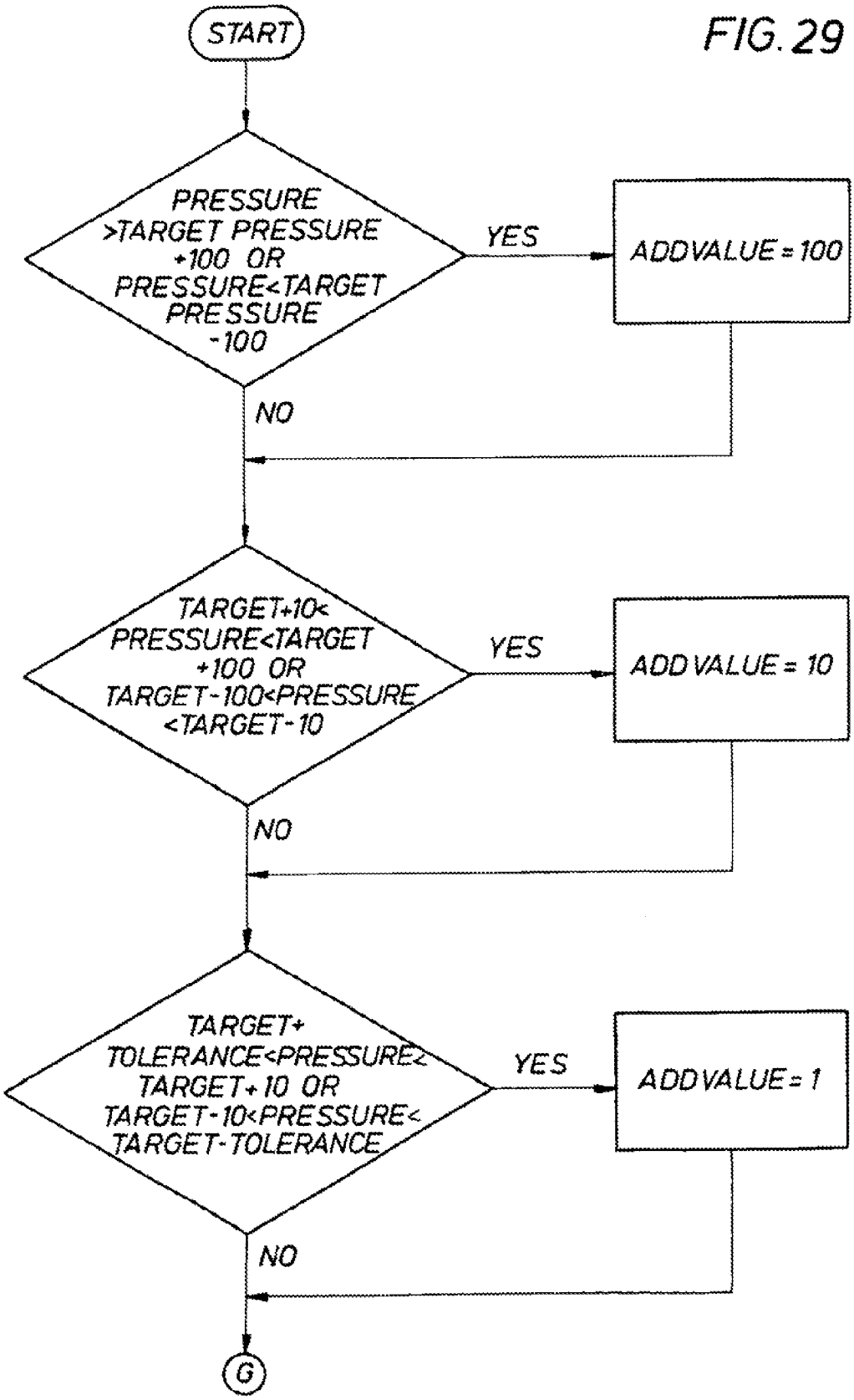
FIG. 29 is a flowchart of a subroutine for controlling the pressure of the latching system in a housing, such as shown in FIGS. 19 and 20.
Figure 30:
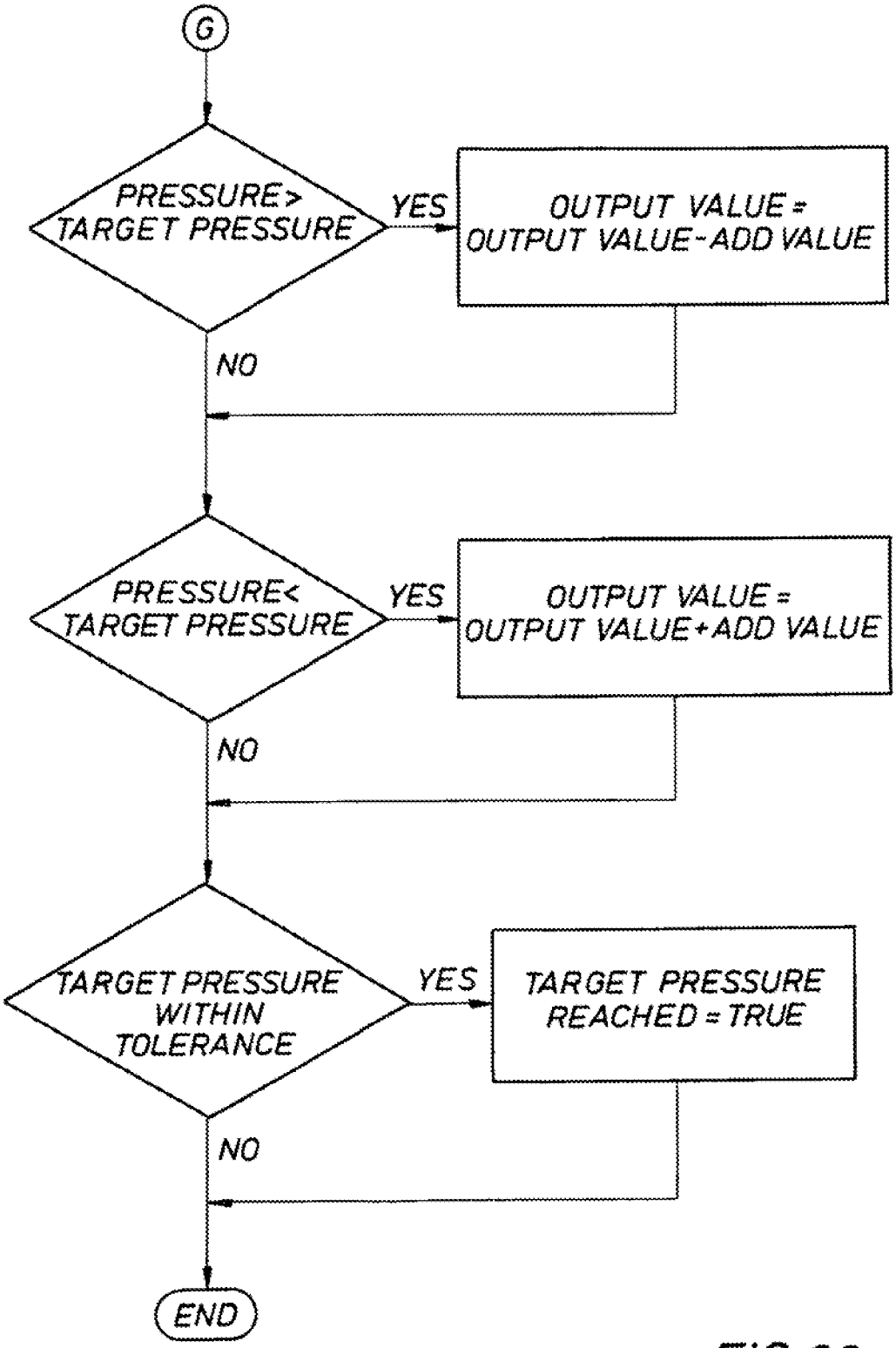
FIG. 30 is a continuation of the flowchart of FIG. 29.

Similar to the above latch closing process, the PLC program follows the OPEN leg of SW40 as discussed in the flowchart of FIG. 24A and then the OFF leg of SW0 of FIG. 24A to open or unlatch the latching system. Turning to FIG. 21A, prior to opening or unlatching the retainer member LP of the latching system, pressure transducer PT70 checks the wellbore pressure P2. If the PT70 reading is above a predetermined pressure (approximately 50 psi), the power unit will not allow the retainer member LP to open or unlatch. Three-way valve V70 (FIG. 21A) is again in the APBT blocked position. Valve V60 shifts to flow position P-B and A-T. The fluid flows through valve V110 into the chamber to urge the primary piston P to move to allow retainer member LP to unlatch. The pump P1, shown in FIG. 21B, compensates to a predetermined value (approximately 2000 psi). Fluid pilots open valve V100 to allow fluid of the primary piston P to flow through line FM30L and the A-T ports back to tank 634.

Secondary Latching System Opening

The PLC program following the OPEN leg of SW40 and the OPEN leg of SW50, described in the flowchart of FIG. 24A, moves the secondary piston SP. The secondary piston SP is used to open or unlatch the primary piston P and, therefore, the retainer member LP of the latching system. Prior to unlatching the latching system, pressure transducer PT70 again checks the wellbore pressure P2. If PT70 is reading above a predetermined pressure (approximately 50 psi), the power unit will not allow the latching system to open or unlatch. Valve V60 is in the APBT blocked position, as shown in FIG. 21A. Valve V70 then shifts to flow position P-A and B-T. Fluid flows to the chamber of the secondary latch piston SP via line FM50L. With valve V140 forced closed by the resulting pressure and valve V130 piloted open, fluid from both sides of the primary piston P is allowed to go back to tank 634 though the B-T ports of valve V70.

TABLE 1

| WELL PRESSURE | SEAL BLEED PRESSURE |
|---|---|
| 0-500 | 100 |
| 500-1200 | 300 |
| 1200-UP | 700 |

Alarms

During the running of the PLC program, certain sensors such as flow meters and pressure transducers are checked. If the values are out of tolerance, alarms are activated. The flowcharts of FIGS. 22, 23, 24A and 24B describe when the alarms are activated. Below Table 2 shows the lights, horn and causes associated with the activated alarms. The lights listed in Table 2 correspond to the lights shown on the control console CC of FIG. 31. As discussed below, a text message corresponding to the cause is sent to the display monitor DM on the control console CC.

Latch Leak Detection System

FM30/FM40 Comparison

Usually the PLC program will run a comparison where the secondary piston SP is "bottomed out" or in its latched position, such as shown in FIG. 20, or when only a primary piston P is used, such as shown in FIG. 19, the piston P is bottomed out. In this comparison, the flow meter FM30 coupled to the line FM30L measures either the flow volume value or flow rate value of fluid to the piston chamber to move the piston P to the latched position, as shown in FIG. 20, from the unlatched position, as shown in FIG. 19. Also, the flow meter FM40 coupled to the line FM40L measures the desired flow volume value or flow rate value from the piston chamber. Since the secondary piston SP is bottomed out, there should be no flow in line FM50L, as shown in FIG. 20. Since no secondary piston is shown in FIG. 19, there is no line FM50L or flow meter FM50.

In this comparison, if there are no significant leaks, the flow volume value or flow rate value measured by flow meter FM30 should be equal to the flow volume value or flow rate value, respectively, measured by flow meter FM40 within a predetermined tolerance. If a leak is detected because the comparison is outside the predetermined tolerance, the results of this FM30/FM40 comparison would be displayed on display monitor DM on control console CC, as shown in FIG. 31, preferably in a text message, such as "ALARM90—Fluid Leak". Furthermore, if the values from flow meter FM30 and flow meter FM40 are not within the predetermined tolerance, i.e. a leak is detected, the corresponding light LT100 would be displayed on the control console CC.

FM30/FM50 Comparison

In a less common comparison, the secondary piston SP would be in its "full up" position. That is, the secondary piston SP has urged the primary piston P, when viewing FIG. 20, as far up as it can move to its full unlatched position. In this comparison, the flow volume value or flow rate value, measured by flow meter FM30 coupled to line FM30L, to move piston P to its latched position, as shown in FIG. 20, is measured. If the secondary piston SP is sized so that it would block line FM40L, no fluid would be measured by flow meter FM40. But fluid beneath the secondary piston SP would be evacuated via line FM50L from the piston chamber of the latch assembly. Flow meter FM50 would then measure the flow volume value or flow rate value. The measured flow volume value or flow rate value from flow meter FM30 is then compared to the measured flow volume value or flow rate value from flow meter FM50.

If the compared FM30/FM50 values are within a predetermined tolerance, then no significant leaks are considered detected. If a leak is detected, the results of this FM30/FM50 comparison would be displayed on display monitor DM on control console CC, preferably in a text message, such as "ALARM100—Fluid Leak". Furthermore, if the values from flow meter FM30 and flow meter FM50 are not within a predetermined tolerance, the corresponding light LT100 would be displayed on the control console CC.

FM30/FM40+FM50 Comparison

Sometimes the primary piston P is in its full unlatched position and the secondary piston SP is somewhere between its bottomed out position and in contact with the fully unlatched piston P. In this comparison, the flow volume value or flow rate value measured by the flow meter FM30 to move piston P to its latched position is measured. If the secondary piston SP is sized so that it does not block line FM40L, fluid between secondary piston SP and piston P is evacuated by line FM40L. The flow meter FM40 then measures the flow volume value or flow rate value via line FM40L. This measured value from flow meter FM40 is compared to the measured value from flow meter FM30. Also, the flow value beneath secondary piston SP is evacuated via line FM50L and measured by flow meter FM50.

If the flow value from flow meter FM30 is not within a predetermined tolerance of the compared sum of the flow values from flow meter FM40 and flow meter FM50, then the corresponding light LT100 would be displayed on the control console CC. This detected leak is displayed on display monitor DM in a text message.

Measured Value/Predetermined Value

An alternative to the above leak detection methods of comparing measured values is to use a predetermined or previously calculated value. The PLC program then compares the measured flow value in and/or from the latching system to the predetermined flow value plus a predetermined tolerance.

It is noted that in addition to indicating the latch position, the flow meters FM30, FM40 and FM50 are also monitored so that if fluid flow continues after the piston P has moved to the closed or latched position for a predetermined time period, a possible hose or seal leak is flagged.

For example, alarms ALARM90, ALARM100 and ALARM110, as shown in below Table 2, could be activated as follows:

Alarm ALARM90—primary piston P is in the open or unlatched position. The flow meter FM40 measured flow value is compared to a predetermined value plus a tolerance to indicate the position of piston P. When the flow meter FM40 reaches the tolerance range of this predetermined value, the piston P is indicated in the open or unlatched position. If the flow meter FM40 either exceeds this tolerance range of the predetermined value or continues to read a flow value after a predetermined time period, such as an hour, the PLC program indicates the Alarm ALARM90 and its corresponding light and text message as discussed herein.

Alarm ALARM100—secondary piston SP is in the open or unlatched position. The flow meter FM50 measured flow value is compared to a predetermined value plus a tolerance to indicate the position of secondary piston SP. When the flow meter FM50 reaches the tolerance range of this predetermined value, the secondary piston SP is indicated in the open or unlatched position. If the flow meter FM50 either exceeds this tolerance range of the predetermined value or continues to read a flow value after a predetermined time period, such as an hour, the PLC program indicates the alarm ALARM1100 and its corresponding light and text message as discussed herein.

Alarm ALARM110—primary piston P is in the closed or latched position. The flow meter FM30 measured flow value is compared to a predetermined value plus a tolerance to indicate the position of primary piston P. When the flow meter FM30 reaches the tolerance range of this predetermined value, the primary piston P is indicated in the closed or latched position. If the flow meter FM30 either exceeds this tolerance range of the predetermined value or continues to read a flow value after a predetermined time period, such as an hour, the PLC program indicates the alarm ALARM110 and its corresponding light and text message as discussed herein.

TABLE 2

| ALARM # | LIGHT | HORN | CAUSE |
|---|---|---|---|
| ALARM10 | LT100 | WB > 100 | WELLBORE > 50, PT10 = 0; NO LATCH PUMP PRESSURE |
| ALARM20 | LT100 | WB > 100 | WELLBORE > 50, PT20 = 0; NO BEARING LUBE PRESSURE |
| ALARM30 | LT100 | Y | WELLBORE > 50, LT20 = OFF; LATCH NOT CLOSED |
| ALARM40 | LT100 | Y | WELLBORE > 50, LT30 = OFF; SECONDARY LATCH NOT CLOSED |
| ALARM50 | LT100 | | LS30 = ON; TANK OVERFULL |
| ALARM60 | LT50 | | LS20 = OFF; TANK LOW |
| ALARM70 | LT50 | Y | LS10 = OFF; TANK EMPTY |
| ALARM80 | LT100 | Y | WELLBORE > 100, PT10 = 0; NO LATCH PRESSURE |
| ALARM90 | LT100 | | FM40; FLUID LEAK; 10% TOLERANCE + FLUID MEASURE |
| ALARM100 | LT100 | | FM50; FLUID LEAK; 10% TOLERANCE + FLUID MEASURE |
| ALARM110 | LT100 | | FM30; FLUID LEAK; 10% TOLERANCE + FLUID MEASURE |
| ALARM120 | LT90 | | FM10 > FM20 + 25%: BEARING LEAK (LOSING OIL) |
| ALARM130 | LT90 | | FM20 > FM10 + 15%; BEARING LEAK (GAINING OIL) |
| ALARM140 | LT90 | Y | FM20 > FM10 + 30%; BEARING LEAK (GAINING OIL) |

Other Latch Position Indicator Embodiments

Additional methods are contemplated to indicate the position of the primary piston P and/or secondary piston SP in the latching system. One example would be to use an electrical sensor, such as a linear displacement transducer, to measure the distance the selected piston has moved. This type of sensor is a non-contact sensor as it does not make physical contact with the target, and will be discussed below in detail. The information from the sensor may be remotely used to indirectly determine whether the retainer member is latched or unlatched based upon the position of the piston.

Figure 32:
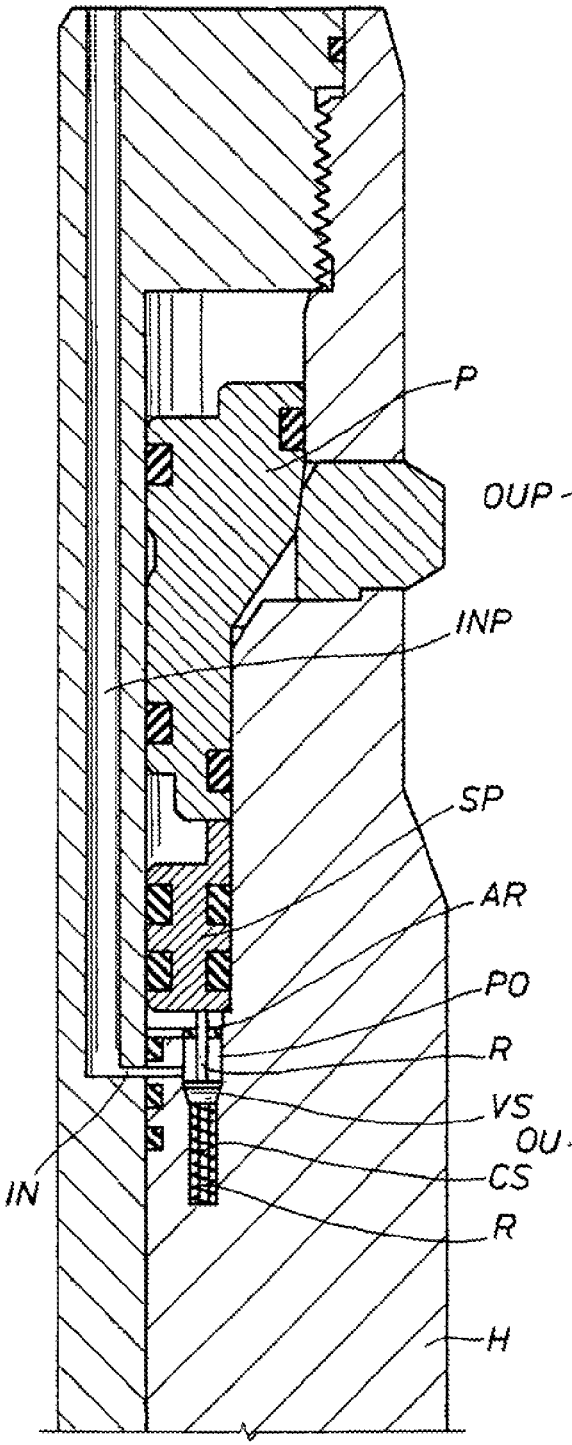
FIG. 32 is an enlarged elevational section view of a latch assembly in the latched position with a perpendicular port communicating above a piston indicator valve that is shown in a closed position.
Figure 33:
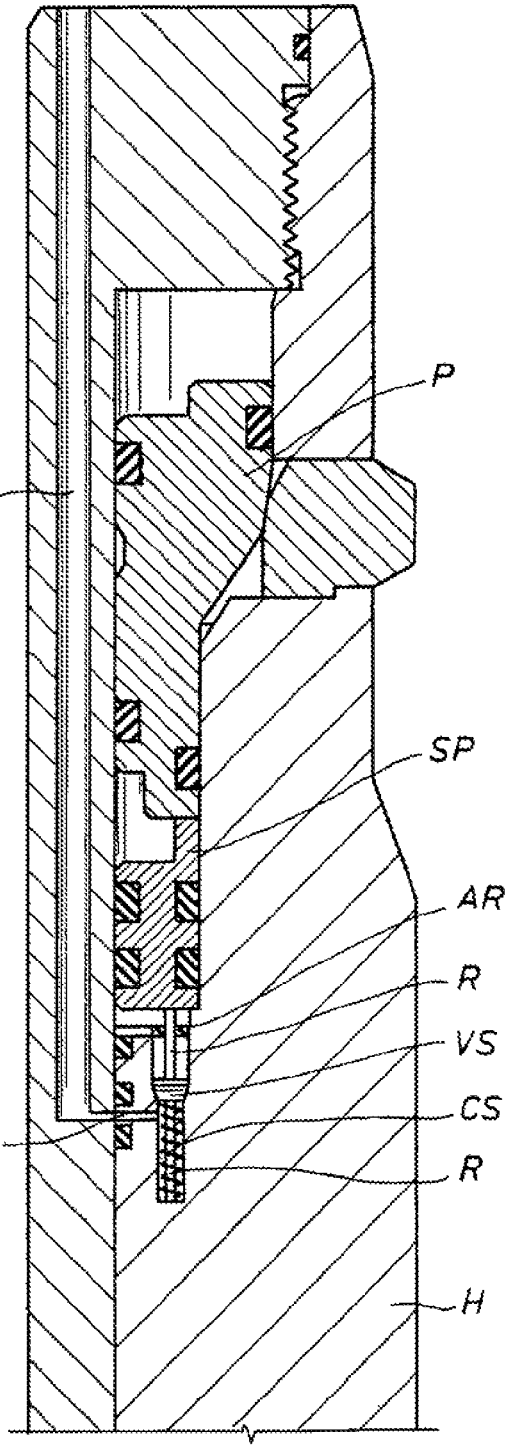
FIG. 33 is a view similar to FIG. 32 but taken at a different section cut to show another perpendicular port communicating below the closed piston indicator valve.

Another method could be drilling the housing of the latch assembly for a valve that would be opened or closed by either the primary piston P, as shown in the embodiment of FIG. 19, or the secondary piston SP, as shown in the embodiment of FIGS. 20, 32 and 33. In this method, a port PO would be drilled or formed in the bottom of the piston chamber of the latch assembly. Port PO is in fluid communication with an inlet port IN (FIG. 32) and an outlet port OU (FIG. 33) extending perpendicular (radially outward) from the piston chamber of the latch assembly. These perpendicular ports would communicate with respective passages INP and OUP that extend upward in the radially outward portion of the latch assembly housing. Housing passage OUP is connected by a hose to a pressure transducer and/or flow meter. A machined valve seat VS in the port to the piston chamber receives a corresponding valve seat, such as a needle valve seat. The needle valve seat would be fixedly connected to a rod R receiving a coil spring CS about its lower portion to urge the needle valve seat to the open or unlatched position if neither primary piston P (FIG. 19 embodiment) nor secondary piston SP (FIGS. 20, 32 and 33 embodiments) moves the needle valve seat to the closed or latched position. Rod R makes physical contact with secondary piston SP. An alignment retainer member AR is sealed as the member is threadably connected to the housing H. The upper portion of rod R is slidably sealed with retainer member AR.

If a flow value and/or pressure is detected in the respective flow meter and/or pressure transducer communicating with passage OUP, then the valve is indicated open. This open valve indicates the piston is in the open or unlatched position. If no flow value and/or pressure is detected in the respective flow meter and/or pressure transducer communicating with passage OUP, then the valve is indicated closed. This closed valve indicates the piston is in the closed or latched position. This information may then be remotely used to indirectly determine whether the retainer member is latched or unlatched depending upon the position of the piston. The above piston position would be shown on the console CC, as shown in FIG. 31, by lights LT20 or LT60 and LT30 or LT70 along with a corresponding text message on display monitor DM.

Figure 34:
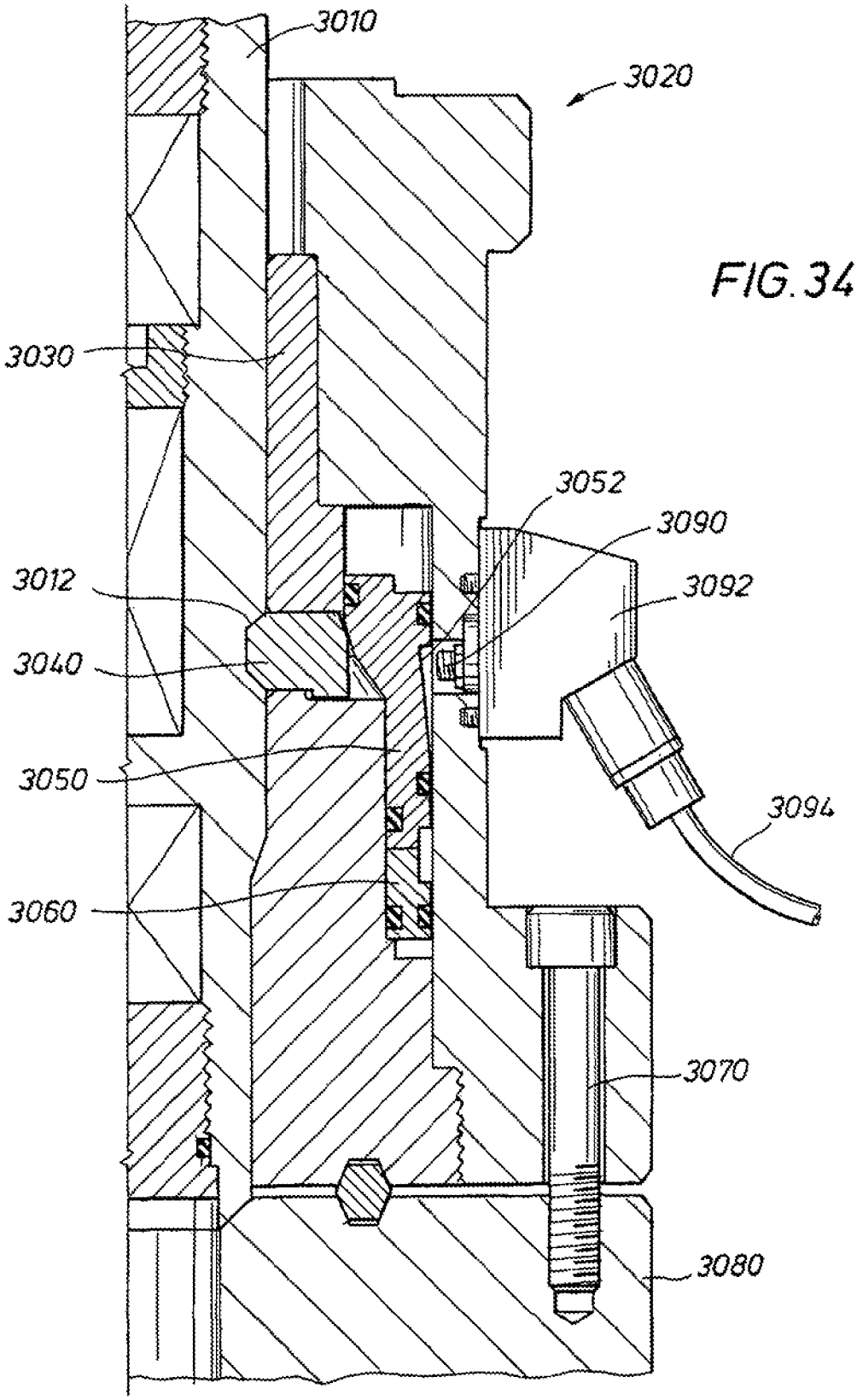
FIG. 34 is a cross-section elevational view of a single hydraulic latch assembly with the retainer member in the latched position with an RCD and a latch position indicator sensor positioned with the latch assembly.

Other embodiments of latch position indicator systems using latch position indicator sensors are shown in FIGS. 34-35, 35A, and 36-39A. Turning to FIG. 34, latch assembly 3020 within latch assembly housing 3030 is bolted with bolts 3070 to housing section 3080. Other attachment means are contemplated. Retainer member 3040 is in the latched position with RCD 3010. Retainer member 3040 is extended radially inwardly from the latch assembly 3020, engaging latching formation 3012 on the RCD 3010. An annular piston 3050 is in the first position, and blocks retainer member 3040 in the radially inward position for latching with RCD 3010. Movement of the piston 3050 from a second position to the first position compresses or moves retainer member 3040 to the engaged or latched position shown in FIG. 34. Although shown as an annular piston, the piston 3050 can be implemented as a plurality of separate pistons disposed about the latch assembly. First piston 3050 may be moved into the second position directly by hydraulic fluid. However, as a backup unlatching capability, a second or auxiliary piston 3060 may be used to urge the first piston 3050 into the second position to unlatch the RCD 3010. As can now be understood, latching assembly 3020 is a single hydraulic latch assembly similar to latching assembly 210 in FIG. 2.

Figure 40:
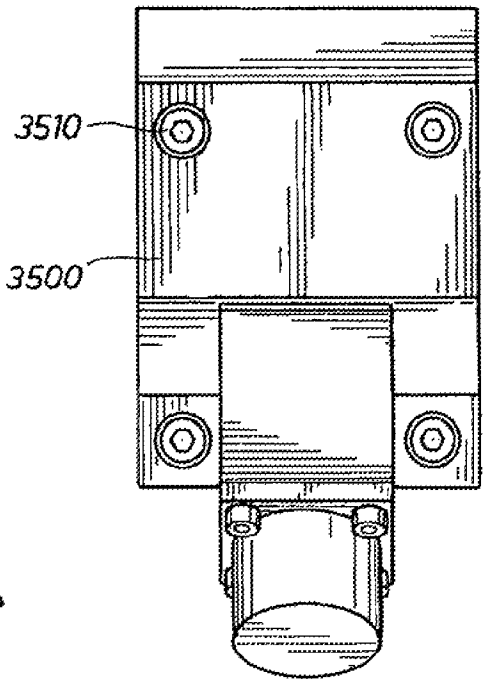
FIG. 40 is a view of the exposed exterior surface of a mounted latch position indicator sensor housing.
Figure 41:
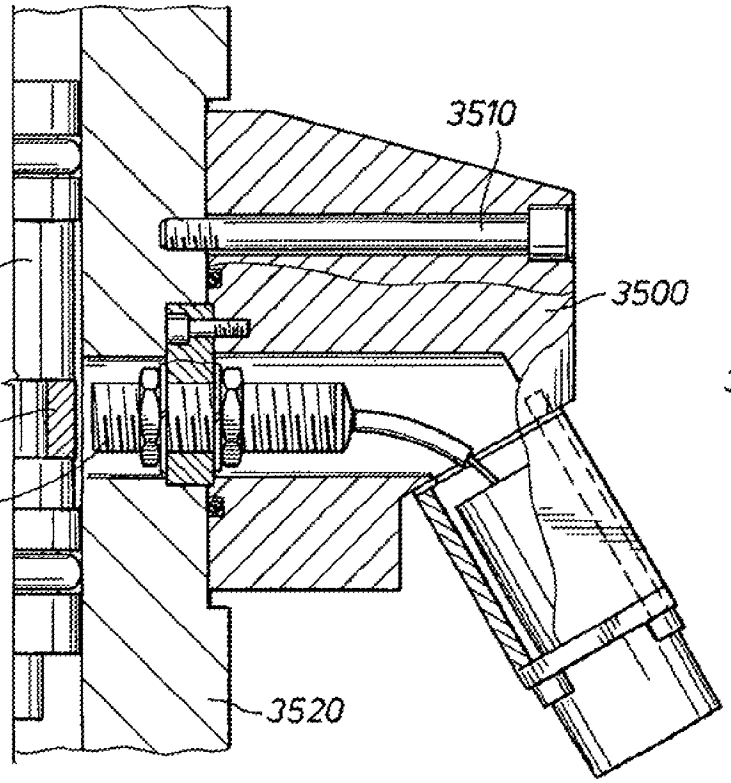
FIG. 41 is a cross-section view of a latch position indicator sensor positioned with a latch position indicator sensor housing shown in partial cutaway section view that is mounted with a housing section.
Figure 42:
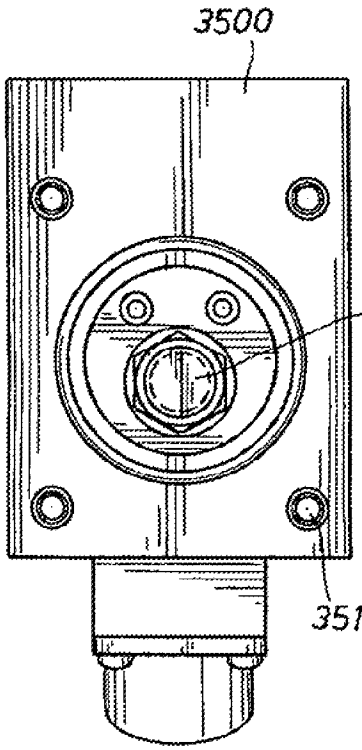
FIG. 42 is a view of the unexposed interior surface of a mounted latch position indicator sensor housing.

Returning to FIG. 34, piston 3050 has an inclined or ramped exterior surface 3052. Latch position indicator sensor housing 3092 is attached with latch assembly 3020. Latch position indicator sensor 3090 is mounted with housing 3092. Sensor 3090 can detect the distance from the sensor 3090 to the targeted inclined surface 3052, including while piston 3050 moves. Although the slope of the inclined surface 3052 is shown as negative, it should be understood that the slope of the inclined surface 3052 may be positive, which is true for all the inclined surfaces on the pistons on all the other embodiments shown below. Enlarged views of a housing and sensor similar to housing 3092 and sensor 3090 are shown in FIGS. 40-42. Returning to FIG. 34, sensor 3090 transmits an electrical signal through line 3094. The output signal from sensor 3090 may be interpreted to remotely determine the position and/or movement of piston 3050, and therefore indirectly the position and/or movement of retainer member 3040, as will be discussed in detail below. As can now be understood, sensor 3090 is mounted laterally in relation to piston 3050. As can also be understood, sensor 3090 is a non-contact type sensor in that it does not make physical contact with piston 3050. However, contact type sensors that do make contact with piston 3050 are contemplated. Contact and non-contact type sensors may be used interchangeably for all the embodiments of the invention. As can further be understood, the information from sensor 3090 may be used remotely to indirectly determine whether retainer member 3040 is latched or unlatched from the position of piston 3050.

Figure 43:
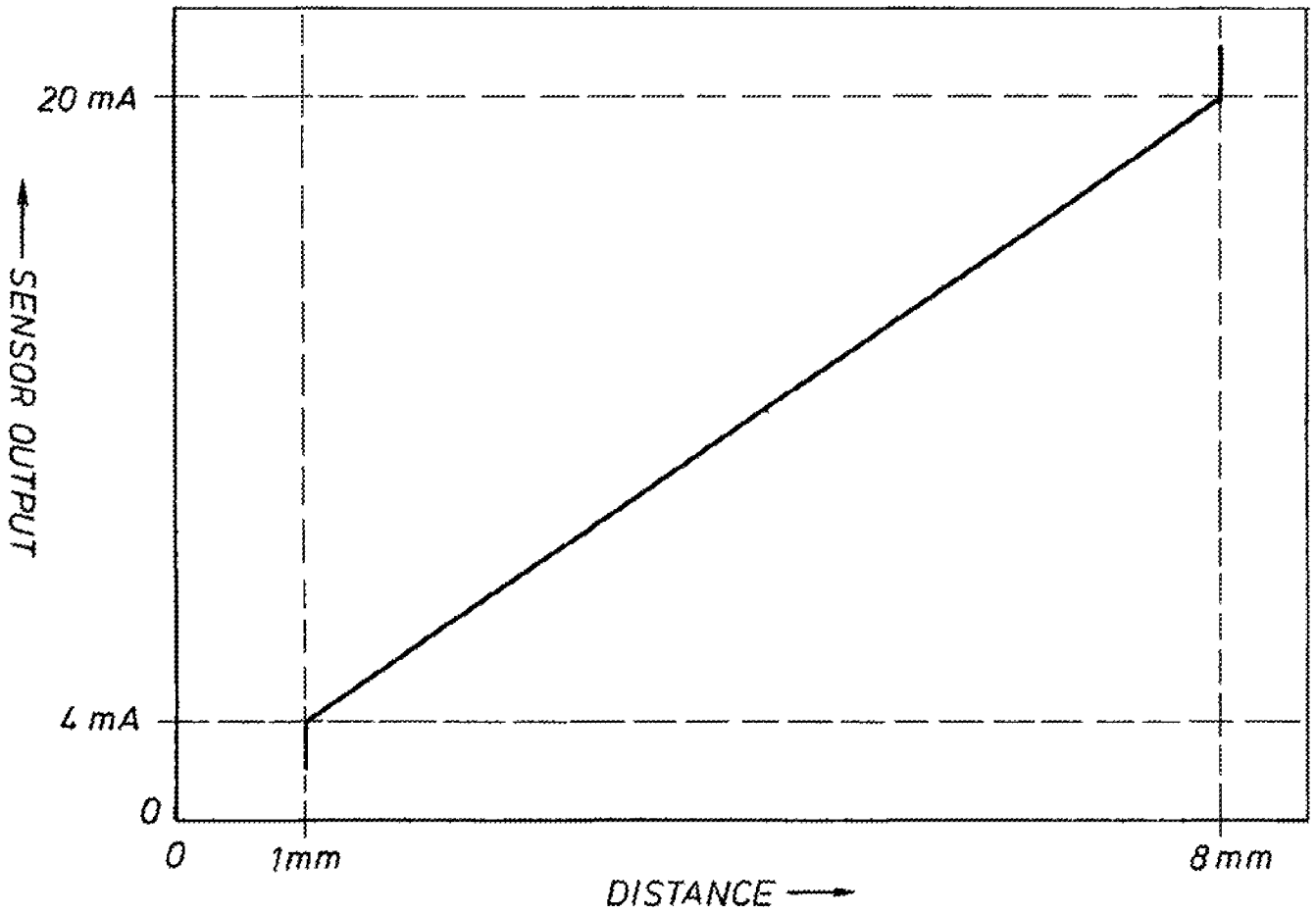
FIG. 43 is a graph of an exemplary linear correlation between the output signal of a latch position indicator sensor and the distance to its target.
Figure 44:
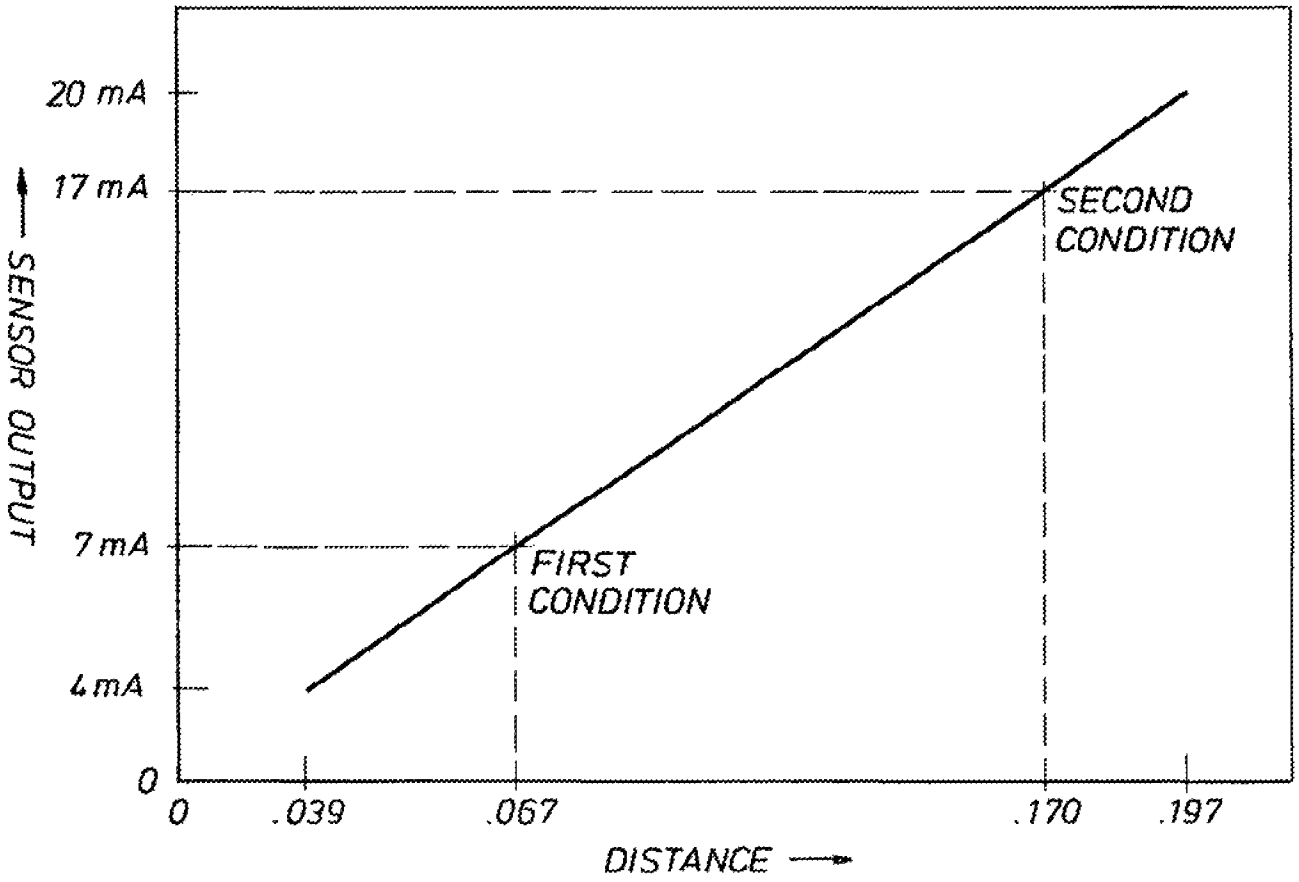
FIG. 44 is a graph similar to FIG. 43, except showing exemplary threshold limits for determining whether a latch assembly is closed (latched) or open (unlatched)
Figure 45:
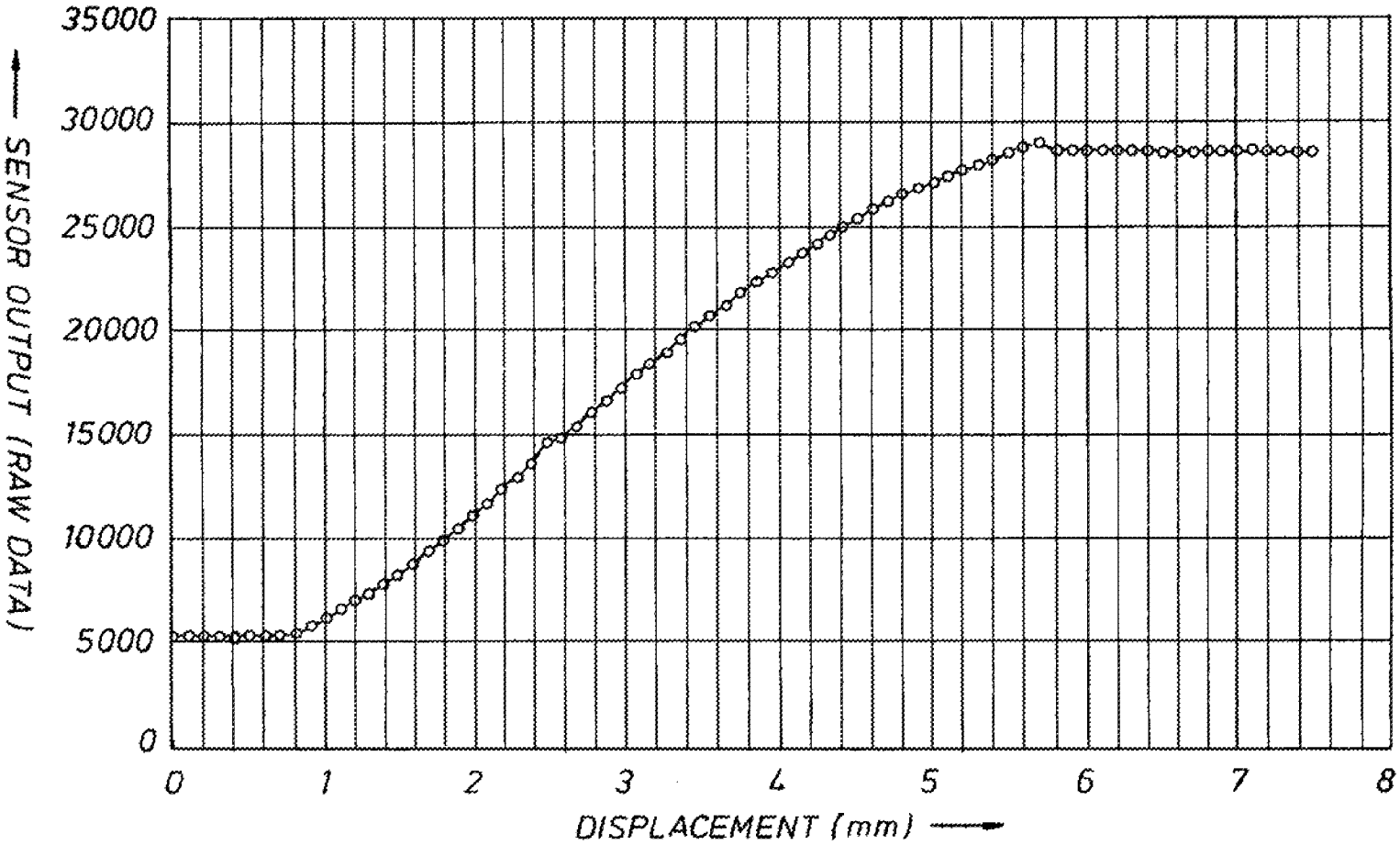
FIG. 45 is a graph of an exemplary substantially linear correlation between the output signal raw data of a latch position indicator sensor and the distance to its target.

Latch position indicator sensor 3090, as well as the latch position indicator sensors (3172, 3192, 3240, 3382, 3392, 3396, 3452, 3472, 3530, 4012, 4026, 4060, 4048, 4280, 4290, 4350) shown in FIGS. 35A, 36-39, 39A, 39B and 41, may preferably be an analog inductive proximity sensor used to measure travel of metal targets, such as sensor Part No. Bi 8-M18-Li/Ex i with Identification No. M1535528 available from Turck Inc. of Plymouth, Minn. Another similar analog inductive proximity sensor is model number BAW M18MI-ICC50B-S04G available from Balluff Inc. of Florence, Ky. Both the Turck and Balluff sensors are non-contact sensors. It is understood that an analog inductive sensor provides an electrical output signal that varies linearly in proportion to the position of a metal target within its working range, as shown in FIGS. 43-45. It is further understood that the inductive proximity sensor emits an alternating electro-magnetic sensing field based upon the eddy current sensing principle. When a metal target enters the sensing field, eddy currents are induced in the target, reducing the signal amplitude and triggering a change of state at the sensor output. The distance to the target may be determined from the sensor output. The motion of the target may also be determined from the sensor output.

Figure 38:
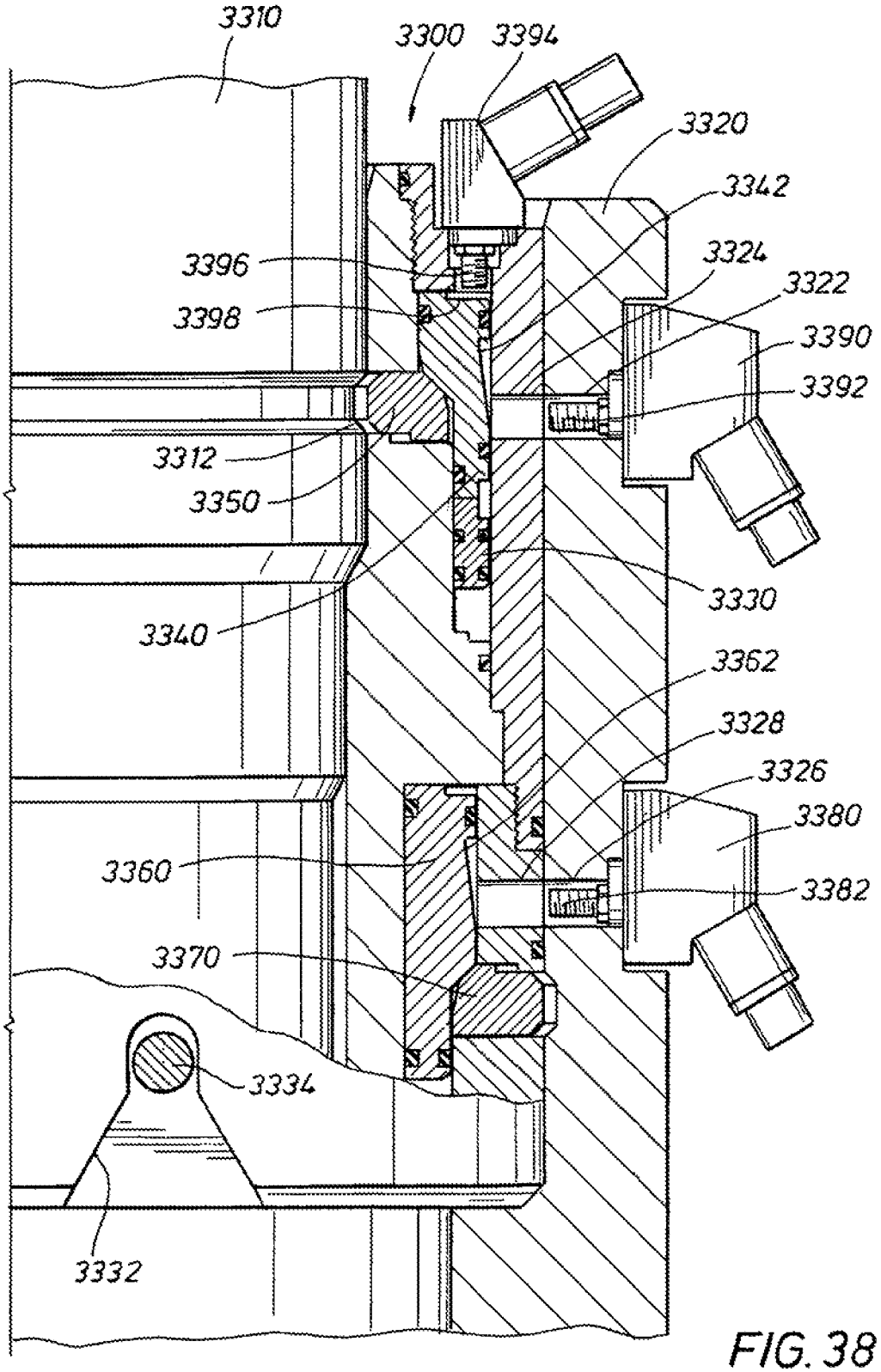
FIG. 38 is a partial cutaway cross-section elevational view of a dual hydraulic latch assembly with the retainer members in the first and second latch subassemblies in the unlatched positions and with two latch position indicator sensors positioned adjacent to the first subassembly and one latch position indicator sensor positioned adjacent to the second subassembly.

Other types of sensors, both contact type and non-contact type, for measuring distance and/or movement are contemplated for all embodiments of the invention, including, but not limited to, magnetic, electric, capacitive, eddy current, inductive, ultrasonic, photoelectric, photoelectric-diffuse, photoelectric-retro-reflective, photoelectric-thru-beam, optical, laser, mechanical, magneto-inductive, magneto-resistive, giant magneto-resistive (GMR), magno-restrictive, Hall-Effect, acoustic, ultrasonic, auditory, radio frequency identification, radioactive, nuclear, ferromagnetic, potentiometric, wire coil, limit switches, encoders, linear position transducers, linear displacement transducers, photoelectric distance sensors, magneto-inductive linear position sensors, and inductive distance sensors. It is contemplated that different types of sensors may be used with the same latch assembly, such as latch assembly 3100 in FIG. 36. It is contemplated that all sensors for all embodiments of the invention may be contact type sensors or non-contact type sensors. Although the preferred sensor shown in FIG. 34 is flush mounted, other similar sensors may be used that are not flush mounted. It is also contemplated that the transmission from any sensor shown in any embodiment may be wireless, such as shown in FIG. 38, so that line 3094 may not be necessary. The output from the sensors provide for remote determination of the position and/or movement of the piston or retainer member that is targeted.

Figure 35:
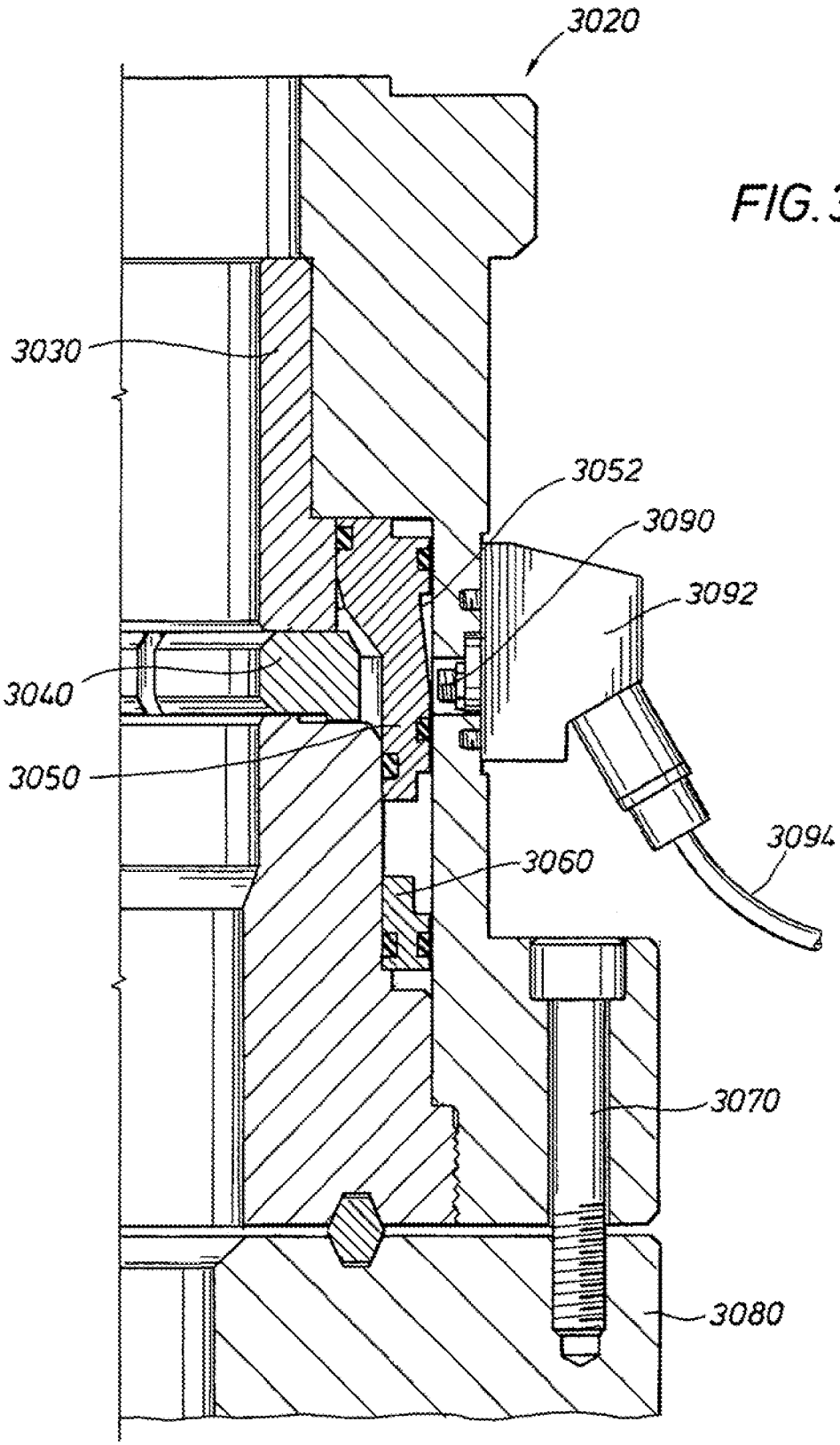
FIG. 35 is a similar view as FIG. 34 except with the retainer member in the unlatched position and the RCD removed.

It is also contemplated for all embodiments of the invention that a signal inducing device, such as a magnet, an active radio frequency identification device, a radioactive pill, or a nuclear transmitting device, may be mounted on piston 3050, similar to those shown in Pub. No. US 2008/0236819, that may be detected by a receiving device or a sensor mounted on latching assembly 3020 to determine the position of piston 3050. The '819 publication, assigned to the assignee of the present invention, is incorporated by reference for all purposes in its entirety. It is also contemplated that a signal inducing device may be mounted on a retainer member, such as retainer member 3040, as shown in FIGS. 34 and 35. A passive radio frequency identification device is also contemplated to be mounted on piston 3050 or retainer member 3040. It is also contemplated that a sensor may be mounted on piston 3050 or retainer member 3040, which may detect a signal inducing device on latching assembly 3020. It is also contemplated that signal inducing devices may be mounted on a combination of a retainer member, a piston and/or other latch assembly components, and a separate signal receiving device used to detect the position of the retainer member and/or piston.

Although an RCD 3010 is shown in FIG. 34, it is contemplated that other oilfield devices may be positioned with any embodiment of the invention shown in FIGS. 34-35, 35A, 36-39, 39A and 39B including, but not limited to, protective sleeves, bearing assemblies with no stripper rubbers, stripper rubbers, wireline devices, and any other devices positioned with a wellbore. Turning to FIG. 35, first piston 3050 is in the second position and retainer member 3040 is in the radially outward or unlatched position. The RCD 3010 shown in FIG. 34 has been removed. Although auxiliary piston 3060 may be used to urge first piston 3050 into the second position, it is not required, as shown in FIG. 35. Auxiliary piston 3060 provides a backup if first piston 3050 will not respond to hydraulic pressure alone.

Figure 35A:
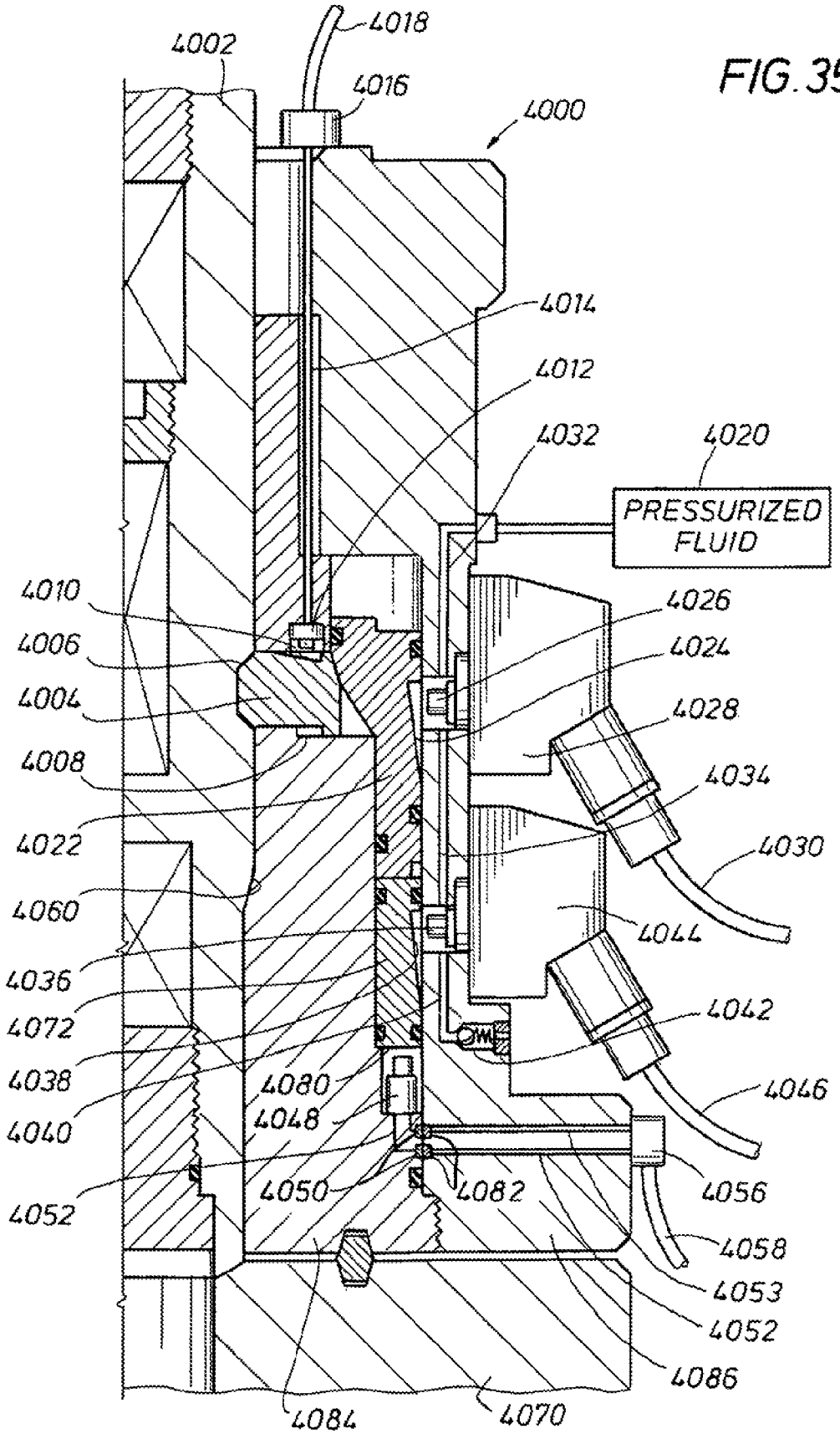
FIG. 35A is a cross-section elevational view of a single hydraulic latch assembly with the retainer member in the latched position with an RCD, a latch position indicator sensor positioned in the latch assembly with the retainer member, a latch position indicator sensor positioned with the primary piston, and two latch position indicator sensors positioned with the secondary piston.

Turning to FIG. 35A, latch assembly 4000 may be bolted to housing section 4070. Other attachment means are contemplated. Retainer member 4004 is in the latched position with RCD 4002. Retainer member 4004 is extended radially inwardly from the latch assembly 4000, engaging latching formation 4006 on the RCD 4002. Retainer member 4004 asserts a downward force on RCD 4002, and shoulder 4060 in latching assembly 4000 asserts an upward force on RCD 4002, thereby gripping or squeezing RCD 4002 when it is latched, to resist its outer housing and/or the bearing assembly from rotating with the rotation of the drill string. It is contemplated that a shoulder similar to shoulder 4060 may be used on all embodiments of the invention. An annular piston 4022 is in the first position, and blocks retainer member 4004 in the radially inward position for latching with RCD 4002. Movement of the piston 4022 from a second position to the first position compresses or moves retainer member 4004 to the engaged or latched position shown in FIG. 35A. Although shown as an annular piston, the piston 4022 can be implemented as a plurality of separate pistons disposed about the latch assembly. First piston 4022 may be moved into the second position directly by hydraulic fluid. However, as a backup unlatching capability, a second or auxiliary piston 4072 may be used to urge the first piston 4022 into the second position to unlatch the RCD 4002. As can now be understood, latching assembly 4000 is a single hydraulic latch assembly similar to latching assembly 210 in FIG. 2.

Returning to FIG. 35A, retainer member 4004 has an inclined surface 4010. Latch position indicator sensor 4012 is mounted in latch assembly 4000 so as to detect the distance from the sensor 4012 to the targeted inclined surface 4010, including while retainer member 4004 moves. Although the slope of the inclined surface 4010 is shown as negative, it should be understood that the slope of the inclined surface 4010 may be positive for the inclined surfaces on all the other embodiments. Sensor 4012 transmits an electrical signal through lines (4014, 4018). Fitting 4016 is sealingly mounted on latching assembly 4000. The output signal from sensor 4012 may be interpreted remotely to directly determine the position and/or movement of retainer member 4004. As can now be understood, sensor 4012 is mounted laterally in relation to retainer member 4004. As can also be understood, sensor 4012 is a non-contact type sensor in that it does not make physical contact with retainer member 4004. However, as will be discovered below, contact type sensors that do make contact with retainer member 4004 are contemplated. Contact and non-contact type sensors may be used interchangeably for all the embodiments of the invention. As can further be understood, the information from sensor 4012 may be used remotely to directly determine whether retainer member 4004 is latched or unlatched.

As with all embodiments of the invention, it is contemplated that different types of oilfield devices may be latched with the latch assemblies such as latch assembly 4000. Retainer member 4004 may need to move inwardly a greater distance for other latched equipment than it does for RCD 4002. Blocking shoulders slot 4008 allows retainer member 4004 to move a limited travel distance (even a distance considered to be an override position) or until engaged with different outer diameter inserted oilfield devices. It is contemplated that a blocking shoulder slot, such as blocking shoulder slot 4008, may be used with all embodiments of the invention. As will be discussed below, it is contemplated that the anticipated movement of retainer member 4004 for different latched oilfield devices may be programmed into the PLC.

First piston 4022 has an inclined or ramped exterior surface 4024. Latch position indicator sensor housing 4028 is attached with latch assembly 4000. Latch position indicator sensor 4026 is mounted with housing 4028. Sensor 4026 can detect the distance from the sensor 4026 to the targeted inclined surface 4024, including while piston 4022 moves. Enlarged views of a housing and sensor similar to housing 4028 and sensor 4026 are shown in FIGS. 40-42. Returning to FIG. 35A, sensor 4026 transmits an electrical signal through line 4030. The output signal from sensor 4026 may be interpreted to remotely determine the position and/or movement of piston 4022, and therefore indirectly the position and/or movement of retainer member 4004. As can now be understood, sensor 4026 is mounted laterally in relation to piston 4022. As can also be understood, sensor 4026 is a non-contact type sensor in that it does not make physical contact with piston 4022. However, contact type sensors that do make contact with piston 4022 are contemplated. As can further be understood, the information from sensor 4026 may be used remotely to indirectly determine whether retainer member 4004 is latched or unlatched from the position of piston 4022.

Although multiple sensors are shown in FIG. 35A, it is contemplated that fewer sensors may be used for less redundancy. It is also contemplated that more sensors may be used for greater redundancy. Second piston 4072 has an inclined or ramped exterior surface 4038. Latch position indicator sensor housing 4044 is attached with latch assembly 4000. Latch position indicator sensor 4036 is mounted with housing 4044. Sensor 4036 can detect the distance from the sensor 4036 to the targeted inclined surface 4038, including while second piston 4072 moves. Sensor 4036 transmits an electrical signal through line 4046. The output signal from sensor 4036 may be interpreted to remotely determine the position and/or movement of second piston 4072, and therefore indirectly the position and/or movement of retainer member 4004. Sensor 4036 is mounted laterally in relation to second piston 4072. Sensor 4036 is a non-contact type sensor in that it does not make physical contact with piston 4072. However, contact type sensors that do make contact with piston 4072 are contemplated. Contact and non-contact type sensors may be used interchangeably for all the embodiments of the invention. The information from sensor 4036 may be used remotely to indirectly determine whether retainer member 4004 is latched or unlatched from the position of piston 4072. It is contemplated that sensors similar to sensors (4036, 4048) may be positioned with a second piston similar to second piston 4072 in any embodiment of the invention.

Sensor 4048 is positioned axially in relation to second piston 4072. It is contemplated that sensor 4048 may be sealed from hydraulic pressure. Sensor 4048 can detect the distance from the sensor 4048 to the targeted second piston bottom surface 4080, including while second piston 4072 moves. Sensor 4048 transmits an electrical signal through lines (4052, 4058) connected with inner conductive rings 4050 mounted on the inner body 4084 of latch assembly 4000. Inner conductive rings 4050 are positioned with outer conductive rings 4082 on the outer body 4086 of latch assembly 4000. It is contemplated that conductive rings (4050, 4082) may be made of a metal that conducts electricity with minimal resistance, such as copper. The output signal from sensor 4048 travels through lines (4053, 4058) and may be interpreted to remotely determine the position and/or movement of second piston 4072, and therefore indirectly the position and/or movement of retainer member 4004, as will be discussed in detail below. Second fitting 4056 is sealingly mounted with latch assembly 4000. As can also be understood, sensor 4048 is a non-contact type sensor in that it does not make physical contact with second piston 4072. However, as will be discussed in detail below, contact type sensors that do make contact with second piston 4072 are contemplated. The information from sensor 4048 may be used remotely to indirectly determine whether retainer member 4004 is latched or unlatched from the position of second piston 4072.

Reservoir 4020 may contain pressurized fluid, such as a hydraulic fluid, such as water, with or without cleaning additives. However, other fluids (liquid or gas) are contemplated. The fluid may travel through lines (4032, 4034, 4040) to clean off debris around and on the sensors (4026, 4036) or targeted inclined surfaces (4024, 4038). One-way gate valve 4042 allows the fluid to travel out of latch assembly 4000. While not illustrated, it is contemplated that directed nozzles, such as a jet nozzle, could be positioned in lines 4032, 4034 to enhance the pressured cleaning of the sensors. Also, it is contemplated that pumps could be provided to provide pressurized fluid. For example, one pump could be provided in line 4032 and a second pump could be provided in line 4034. Where applicable, a gravity flow having a desirable head pressure could be used. Alternatively, it is also contemplated that the same hydraulic fluid used to move pistons (4022, 4072) may be used to clean debris around and on the sensors (4026, 4036) or targeted inclined surfaces (4024, 4038). It is contemplated that the fluid cleaning system shown in FIG. 35A and described above may be used with any embodiment of the invention, including to clean contact sensors, such as sensor 4180 and targeted surface 4182 shown in FIG. 39A.

Figure 36:
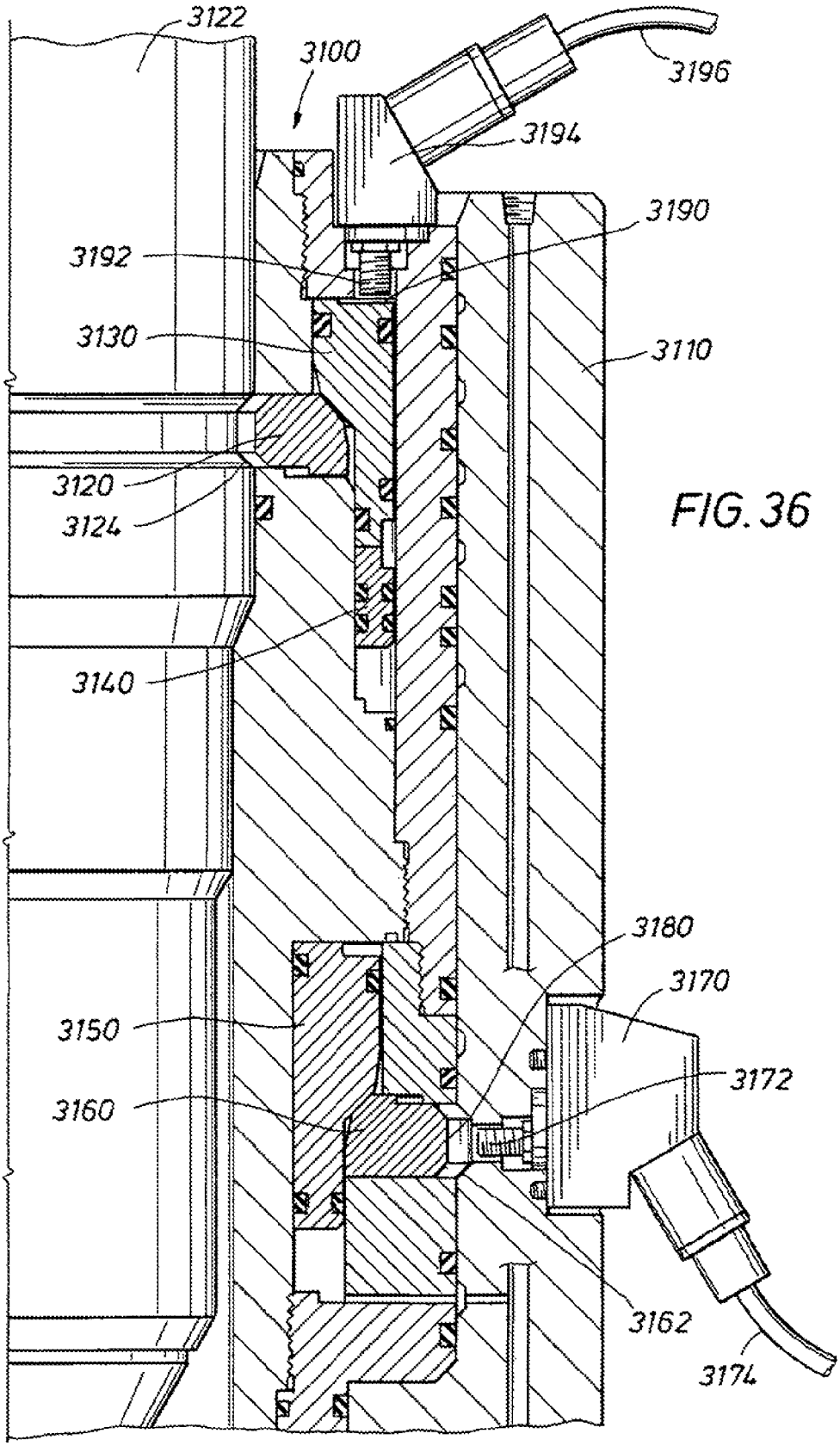
FIG. 36 is a cross-section elevational view of a dual hydraulic latch assembly with the retainer members in the first and second latch subassemblies in the unlatched positions and with latch position indicator sensors positioned adjacent to the subassemblies.

Turning to FIG. 36, it shows a dual hydraulic latch assembly 3100 similar to latch assembly 300 shown in FIG. 3. The first or upper latch subassembly comprises first piston 3130, second piston 3140, and first retainer member 3120. The second or lower latch subassembly comprises third piston 3150 and second retainer member 3160. It should be understood that the positions of the first and second subassemblies may be reversed. Latch assembly 3100 is latchable to a housing section 3110, shown as a riser nipple, allowing remote positioning and removal of the latch assembly 3100. Retainer member 3160 is in the radially inward or unlatched position with housing section 3110. When retainer member 3160 moves outwardly into the latched position it contacts latching formation 3162 in housing section 3110. Auxiliary piston 3140 in the first subassembly has urged first piston 3130 into the second position. Retainer member 3120 has moved radially outward to the unlatched position. When retainer member 3120 moves inwardly into the latched position it contacts latching formation 3124 on oilfield device 3122.

Latch position indicator sensor housing 3194 is positioned with latch assembly 3100 adjacent to the first latch subassembly of latch assembly 3100. Latch position indicator sensor 3192 is mounted with housing 3194. Sensor 3192 can detect the distance from the sensor 3192 to the targeted top surface 3190 of piston 3130, including while piston 3130 moves. Sensor 3192 and housing 3194 may be pressure sealed from the hydraulic fluid above piston 3130. Enlarged views of a housing and sensor similar to housing 3194 and sensor 3192 are shown in FIGS. 40-42. Returning to FIG. 36, sensor 3192 transmits electrical signals through line 3196. The output signal from sensor 3192 may be interpreted remotely to determine the position of piston 3130, and therefore indirectly the position of retainer member 3120, as will be discussed in detail below. As can now be understood, sensor 3192 is mounted axially in relation to piston 3130. Sensor 3192 is a non-contact sensor as it does not make physical contact with piston 3130. However, as will be discussed below in detail, a contact sensor is also contemplated for all embodiments of the invention.

Latch position indicator sensor housing 3170 is attached with housing section 3110 adjacent to the second latch subassembly of latch assembly 3100. Latch position indicator sensor 3172 is mounted with housing 3170. Sensor 3172 can detect the distance from the sensor 3172 to the targeted exterior surface 3180 of retainer member 3160, including while retainer member 3160 moves. Sensor 3172 transmits electrical signals through line 3174. The output signal from sensor 3172 may be interpreted remotely to directly determine the position of retainer member 3160, as will be discussed in detail below. Sensor 3172 is mounted axially in relation to retainer member 3160. Sensor 3172 is a non-contact type sensor.

As discussed above, it is contemplated that fluid used in different hydraulic configurations may be used to clean debris off sensor 3172 and the targeted exterior surface 3180 of retainer member 3160. It is contemplated that the same hydraulic fluid used to move the pistons (3130, 3160) in latch assembly 3100 may be used. Alternatively, it is also contemplated that the fluid may be stored in a separate reservoir. The fluid may move through one or more passageways in housing section 3110 or latch assembly 3100. It is contemplated that the same cleaning system and method may be used with all embodiments of the invention. Also, it contemplated that the cleaning system may be used with all of the sensors on an embodiment, such as sensor 3192 in FIG. 36.

Figure 37:
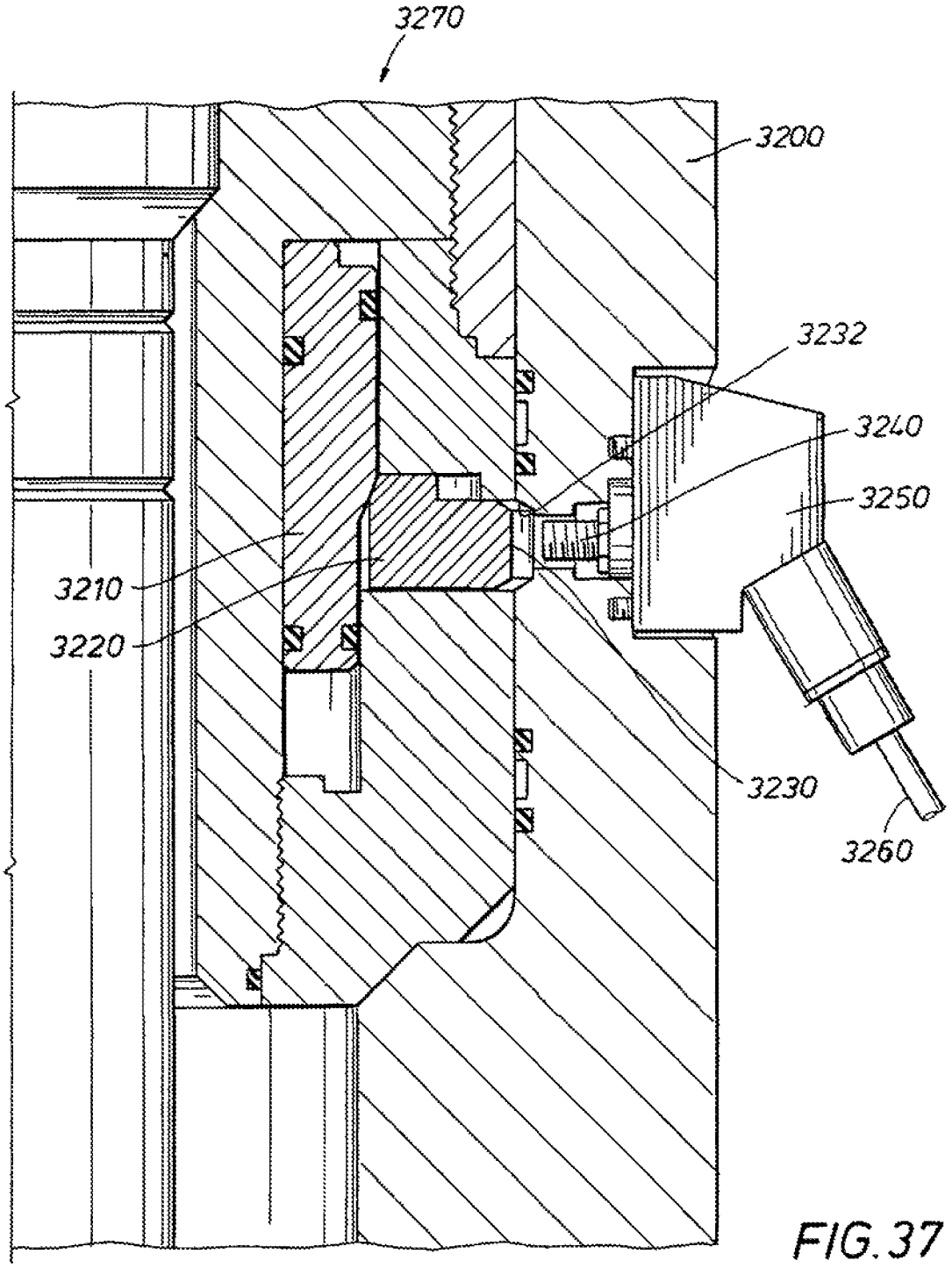
FIG. 37 is an enlarged cross-section elevational view of a second latch subassembly of a dual hydraulic latch assembly with the retainer member in the unlatched position and with a latch position indicator sensor positioned adjacent to the subassembly.

Turning to FIG. 37, a second latch subassembly 3270 is shown for a dual hydraulic latch assembly similar to the second latch subassemblies of latch assemblies (300, 3100) shown in FIGS. 3 and 36, respectively. The second latch subassembly 3270 comprises piston 3210 and retainer member 3220. Latch subassembly 3270 is latchable to a housing section 3200, allowing remote positioning and removal of the latch subassembly 3270. Retainer member 3220 is in the radially inward or unlatched position with housing section 3200. When retainer member 3220 moves outwardly into the latched position it contacts latching formation 3232 in housing section 3200.

Latch position indicator sensor housing 3250 is attached with housing section 3200 adjacent to the second latch subassembly 3270. Latch position indicator sensor 3240 is positioned with housing 3250. Sensor 3240 can detect the distance from the sensor 3240 to the exterior surface 3230 of retainer member 3220, including while retainer member 3220 moves. Sensor 3240 is a non-contact type sensor. Sensor 3240 transmits electrical signals through line 3260. The output signal from sensor 3240 may be interpreted remotely to directly determine the movement and/or position of retainer member 3220, as will be discussed in detail below.

FIG. 38 shows a dual hydraulic latch assembly 3300 similar to latch assembly 300 shown in FIG. 3 and latch assembly 3100 shown in FIG. 36. The first or upper latch subassembly comprises first piston 3340, second piston 3330, and first retainer member 3350. The second or lower latch subassembly comprises third piston 3360 and second retainer member 3370. Latch assembly 3300 is latchable to a housing section 3320, shown as a riser nipple, allowing remote positioning and removal of the latch assembly 3300. Retainer member 3370 is in the radially inward or unlatched position with housing section 3320.

When latching assembly 3300 is positioned with housing section 3320, alignment groove 3332 on the latch assembly 3300 aligns with alignment member 3334 on the surface of housing section 3320 to insure that openings (3322, 3326) in housing section 3320 align with corresponding openings (3324, 3328) in latch assembly 3300. The use and shape of member 3334 and groove 3332 are exemplary and illustrative only and other formations and shapes and other alignment means may be used. Auxiliary piston 3330 in the first subassembly has urged first piston 3340 into the second position. Retainer member 3350 has moved radially outwardly to the unlatched position. When retainer member 3350 moves inwardly into the latched position it contacts latching formation 3312 on oilfield device 3310.

Continuing with FIG. 38, two latch position indicator sensor housings (3390, 3394) are positioned adjacent to the first latch subassembly of latch assembly 3300. Latch position indicator sensor housing 3394 is also attached with latch assembly 3300. Latch position indicator sensor 3396 is positioned with housing 3394 and can detect the distance from the sensor 3396 to the top surface 3398 of piston 3340, including while piston 3340 moves. Sensor 3396 and housing 3394 may be pressure sealed from the hydraulic fluid above piston 3340. Sensor 3396 is shown as wireless, although, as disclosed above, the sensor may send electrical signals through a line. Sensor 3396 is mounted axially in relation to piston 3340. Sensor 3396 is a non-contact type sensor, whose output may be interpreted remotely to indirectly determine the position and/or movement of retainer member 3350, as will be discussed below.

Continuing with FIG. 38, latch position indicator sensor housing 3390 is positioned with housing section 3320. Latch position indicator sensor 3392 is positioned with housing 3390 to detect the distance from the sensor 3392 to the inclined surface 3342 of piston 3340 through aligned openings (3322, 3324), including while piston 3340 moves. Sensor 3392 is shown as wireless, although it may send electrical signals through a line. Sensor 3392 is mounted laterally in relation to piston 3340. Although two housings (3390, 3394) with respective sensors (3392, 3396) are shown in FIG. 38, it is contemplated that either housing with its respective sensor may be removed so that there may be only one housing and sensor positioned with the first latch subassembly. The two sensors (3392, 3396) provide redundancy, if desired. The same redundancy may be used on any embodiment of the invention, including on the second or lower latch subassemblies. It should be understood that sensor 3392 may not be the same type of sensor as sensor 3396, although it is contemplated that they may be the same type sensor. Sensor 3392 is a non-contact type sensor whose output may be used to indirectly and remotely determine the position and/or movement of retainer member 3350, from the position and/or movement of piston 3340, as will be discussed below.

Still continuing with FIG. 38, latch position indicator sensor housing 3380 is attached with housing section 3320 adjacent to the second or lower latch subassembly of latch assembly 3320. Latch position indicator sensor 3382 is mounted with housing 3380. Sensor 3382 can detect the distance from the sensor 3382 to the inclined surface 3362 of piston 3360 through aligned openings (3326, 3328), including while piston 3360 moves. Sensor 3382 is shown as wireless, although it may alternatively transmit electrical signals through a line. Sensor 3382 is a non-contact sensor. The output signal from sensor 3382 may be interpreted to remotely determine the position and/or movement of third piston 3360, and therefore indirectly the position and/or movement of retainer member 3370, as will be discussed in detail below. Sensor 3382 is mounted laterally in relation to piston 3360.

Figure 39:
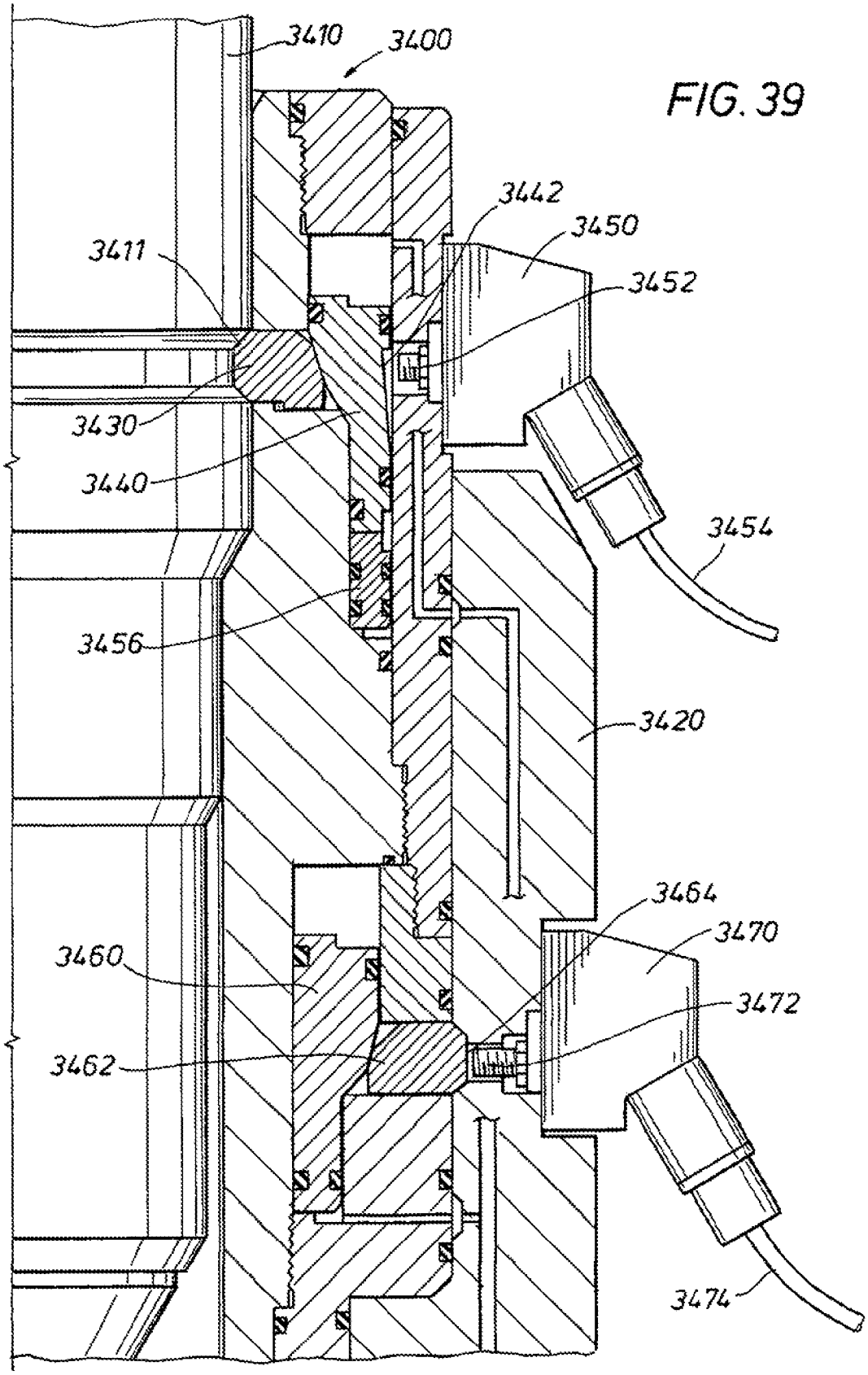
FIG. 39 is a cross-section elevational view of a dual hydraulic latch assembly with the retainer members in the first and second latch subassemblies in the latched positions and with latch position indicator sensors positioned adjacent to the subassemblies.

Turning now to FIG. 39, a dual hydraulic latch assembly 3400 is shown similar to latch assembly 300 shown in FIG. 3, latch assembly 3100 shown in FIG. 36, and latch assembly 3300 shown in FIG. 38. The first or upper latch subassembly comprises first piston 3440, second piston 3456, and first retainer member 3430. The second or lower latch subassembly comprises third piston 3460 and second retainer member 3462. Latch assembly 3400 is latchable to a housing section 3420, shown as a riser nipple, allowing remote positioning and removal of the latch assembly 3400. Retainer member 3462 is in the radially outward or latched position with housing section 3420. Retainer member 3430 is in the radially inward or latched position and is in contact with latching formation 3411 on oilfield device 3410.

Continuing with FIG. 39, latch position indicator sensor housing 3450 is attached with latch assembly 3400 adjacent to the first latch subassembly of latch assembly 3400. Latch position indicator sensor 3452 is mounted with sensor housing 3450. Sensor 3452 can detect the distance from the sensor 3452 to the inclined surface 3442 of piston 3440, including while piston 3440 moves. Sensor 3452 may be wireless or, as shown in FIG. 39, it may send electrical signals through line 3454. Sensor 3452 is positioned laterally in relation to piston 3440. Sensor 3452 is a non-contact sensor, but as with all embodiments, it is contemplated that contact and non-contact sensors may be used interchangeably. As will be discussed below, the output from sensor 3452 may be interpreted to remotely determine the position and/or movement of piston 3440, and therefore indirectly position and/or movement of retainer member 3430.

Latch position indicator sensor housing 3470 is positioned with housing section 3320 adjacent to the second or lower latch subassembly of latch assembly 3400. Latch position indicator sensor 3472 is mounted with sensor housing 3470 and it can detect the distance from the sensor 3472 to the exterior surface 3464 of retainer member 3462, including while member 3462 moves. Sensor 3472 may be wireless or, as shown in FIG. 39, it may send electrical signals through line 3474. The information from sensor 3472 may be used to remotely and directly determine the movement and/or position of retainer member 3462, as will be discussed in detail below. Sensor 3472 is positioned axially in relation to retainer member 3462. Sensor 3472 is a non-contact sensor, but as with all embodiments, it is contemplated that contact and non-contact sensors may be used interchangeably.

Figure 39A:
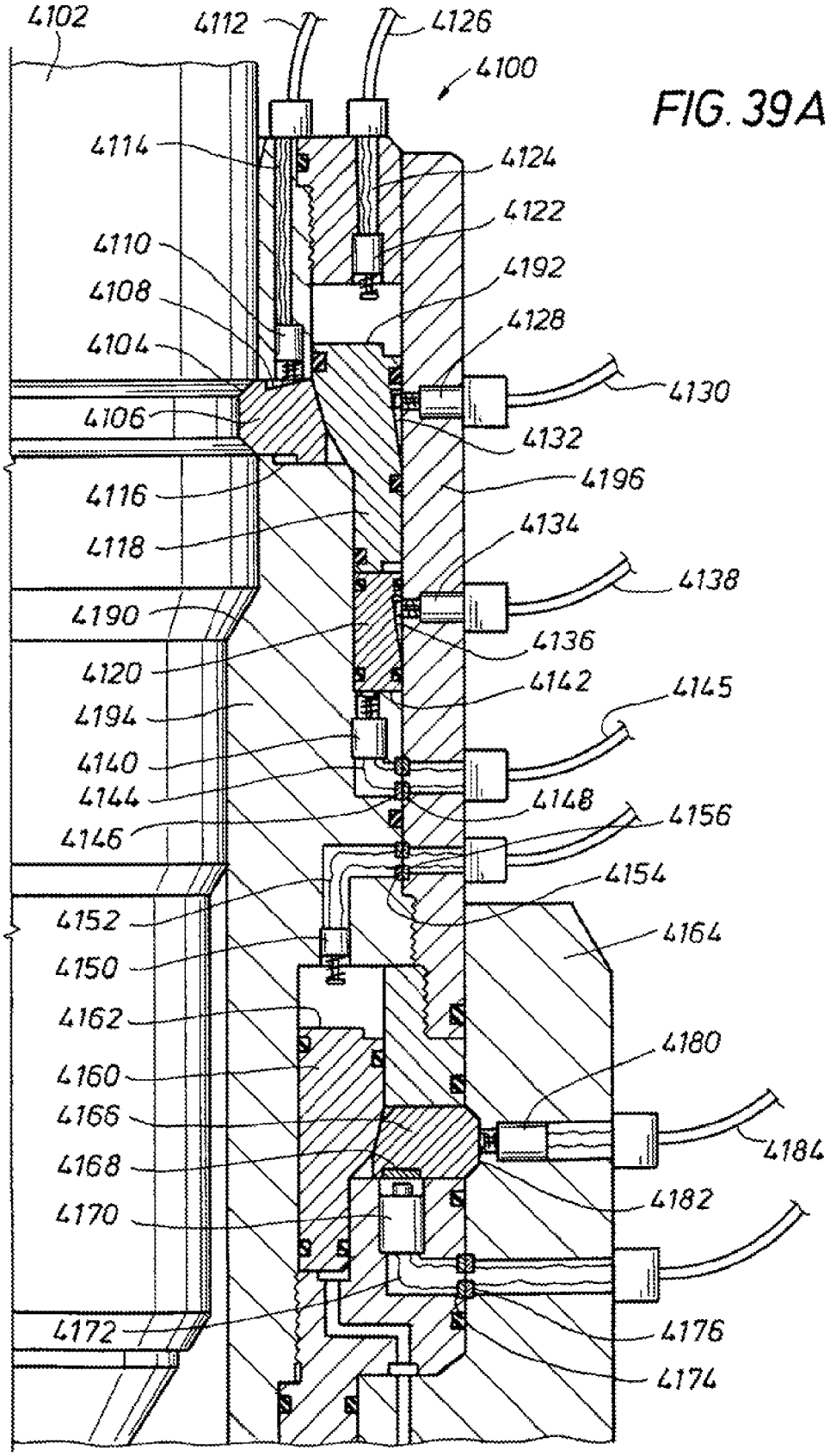
FIG. 39A is a cross-section elevational view of a dual hydraulic latch assembly with the retainer members in the first and second latch subassemblies in the latched positions and with latch position indicator sensors positioned adjacent to the subassemblies.

Turning now to FIG. 39A, a dual hydraulic latch assembly 4100 is shown similar to latch assembly 300 shown in FIG. 3, latch assembly 3100 shown in FIG. 36, latch assembly 3300 shown in FIG. 38, and latch assembly 3400 shown in FIG. 39. The first or upper latch subassembly comprises first piston 4118, second piston 4120, and first retainer member 4106. The second or lower latch subassembly comprises third piston 4160 and second retainer member 4166. Latch assembly 4100 is latchable to a housing section 4164, shown as a riser nipple, allowing remote positioning and removal of the latch assembly 4100. Second retainer member 4166 is in the radially outward or latched position with housing section 4164. First retainer member 4106 is in the radially inward or latched position and is in contact with latching formation 4104 on oilfield device 4102. Blocking shoulders slot 4116, as discussed above, allows for first retainer member 4106 to move a limited travel distance or until engaged with an inserted oilfield device. Also, as discussed above, shoulder 4190 allows for oilfield device 4102 to be gripped or squeezed between inner body shoulder 4190 and retainer member 4106, thereby resisting rotation.

Latch position indicator sensor 4110 is sealingly positioned in latch assembly 4100 adjacent to the first retainer member 4106. Sensor 4110 can detect the distance from the sensor 4110 to the inclined surface 4108 of retainer member 4106, including while retainer member 4106 moves. Sensor 4110 may be wireless or, as shown in FIG. 39A, it may send electrical signals through lines, generally indicated as 4114, and line 4112. Sensor 4110 is positioned laterally in relation to retainer member 4106. Sensor 4110 is a contact type sensor in that it makes physical contact with the target inclined surface 4108. As will be discussed below, the output from sensor 4110 may be interpreted to remotely directly determine the position and/or movement of retainer member 4106.

Latch position indicator sensor 4128 is attached with latch assembly 4100 adjacent to the first latch subassembly of latch assembly 4100. Sensor 4128 can detect the distance from the sensor 4128 to the inclined surface 4132 of piston 4118, including while piston 4118 moves. Sensor 4118 may be wireless or, as shown in FIG. 39, it may send electrical signals through line 4130. Sensor 4128 is sealingly positioned laterally in relation to piston 4118. Sensor 4128 is a contact type sensor in that it makes physical contact with the target inclined surface 4132. The output from sensor 4128 may be interpreted to remotely determine the position and/or movement of piston 4118, and therefore indirectly position and/or movement of retainer member 4106. It should be understood that the plurality of sensors shown in FIG. 39A are for redundancy, and it is contemplated that fewer or more sensors may be used.

Latch position indicator sensor 4122 is sealingly positioned axially in relation to first piston 4118. Sensor 4122 is a contact type sensor in that it makes physical contact with the target first piston top surface 4192 when first piston 4118 is in the unlatched position. Sensor 4122 does not make contact with piston 4118 when piston 4118 is in the latched position, as shown in FIG. 39A. Sensor 4122 may send electrical signals through lines, generally indicated as 4124, and line 4126. The output from sensor 4122 may be interpreted to remotely determine the position of piston 4118, and therefore indirectly position and/or movement of retainer member 4106.

Second piston 4120 has an inclined or ramped exterior surface 4136. Latch position indicator sensor 4134 is positioned so as to detect the distance from the sensor 4134 to the targeted inclined surface 4136, including while second piston 4120 moves. Sensor 4134 transmits an electrical signal through line 4138. The output signal from sensor 4134 may be interpreted to remotely determine the position and/or movement of second piston 4120, and therefore indirectly the position and/or movement of retainer member 4106. Sensor 4134 is sealingly mounted laterally in relation to second piston 4120. Sensor 4134 is a contact type sensor in that it makes physical contact with inclined surface 4136. Contact and non-contact type sensors may be used interchangeably for all the embodiments of the invention. As can further be understood, the information from sensor 4134 may be used remotely to indirectly determine whether retainer member 4106 is latched or unlatched from the position of second piston 4120.

Sensor 4140 is sealingly positioned axially in relation to second piston 4120. That is, it is contemplated that sensor 4140 may be sealed from, among other elements, hydraulic pressure and debris. Sensor 4140 can detect the distance from the sensor 4140 to the targeted second piston bottom surface 4142, including, for a limited distance, while second piston 4120 moves. Sensor 4140 transmits an electrical signal through lines, generally indicated as 4144, connected with inner conductive rings, similar to ring 4146, mounted on the inner body 4194 of latch assembly 4100. Inner conductive rings are positioned with outer conductive rings, similar to ring 4148, on the outer body 4196 of latch assembly 4100. It is contemplated that conductive rings (4146, 4148) may be made of a metal that conducts electricity with minimal resistance, such as copper. The output signal from sensor 4140 travels through lines, generally indicated as 4144, and line 4145 and may be interpreted to remotely determine the position and/or movement of second piston 4120, and therefore indirectly the position and/or movement of retainer member 4106. As can also be understood, sensor 4140 is a contact type sensor in that it makes physical contact with second piston 4120 for a limited travel distance or for its full travel distance.

Latch position indicator sensor 4180 is sealingly positioned adjacent to the second or lower latch subassembly of latch assembly 4100. Latch position indicator sensor 4180 is positioned with housing section 4164 so that it can detect the distance from the sensor 4180 to the exterior surface 4182 of retainer member 4166, including while member 4166 moves for a limited travel distance or for its full travel distance. Sensor 4180 may be wireless or, as shown in FIG. 39A, it may send electrical signals through line 4184. The information from sensor 4180 may be used to remotely and directly determine the movement and/or position of retainer member 4166, as will be discussed in detail below. Sensor 4180 is positioned axially in relation to retainer member 4166. Sensor 4180 is a contact type sensor, but as with all embodiments, it is contemplated that contact and non-contact sensors may be used interchangeably.

For redundancy, sensor 4170 is positioned laterally in relation to retainer member 4166. It is contemplated that retainer member 4166 may be made substantially from one metal, such as steel, and that insert 4168 may be made substantially from another metal, such as copper or aluminum. Other metals and combination of metals and arrangements are contemplated. Distinguished from the other sensors in FIG. 39A, sensor 4170 is a non-contact sensor that can determine the position and/or movement of retainer member 4166 from the movement of the ring 4168. When the distance from the latch position indicator sensor 4170 to the metal target is kept constant, the output from sensor 4170 will change when the target metal changes due to the difference in magnetic properties of the target. Therefore, the movement and/or position of retainer member 4166 may be obtained from sensor 4170. It is contemplated that sensor 4170 may be an analog inductive sensor, although other types are contemplated. Sensor 4170 sends electrical signals through lines, generally indicated as 4172, and conductive rings, such as rings (4174, 4176) as has been described above. As can now be understood, sensors (4180, 4170) may directly determine whether retainer member 4166 is latched or unlatched.

Continuing with FIG. 39A, sensor 4150 is sealingly positioned axially in relation to third piston 4160. Sensor 4150 is a contact sensor that makes contact with top surface 4162 of third piston 4160 when third piston 4160 is in the unlatched position. Sensor 4150 sends electrical signals through lines, generally indicated as 4152, and conductive rings, such as rings (4154, 4156) as has been described above. The information from sensor 4150 can be used remotely to indirectly determine whether retainer member 4166 is latched or unlatched.

Figure 39B:
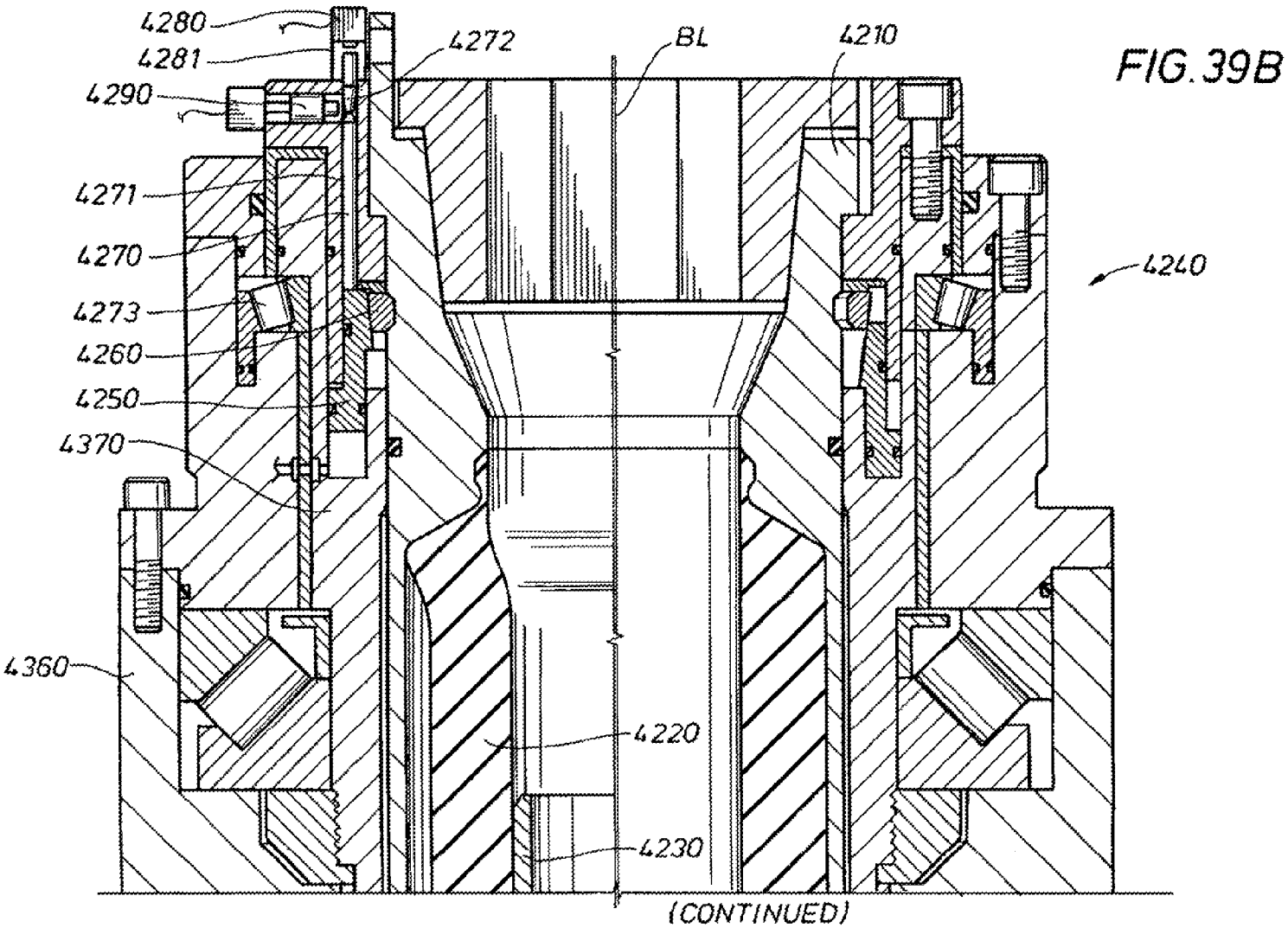
FIG. 39B is a cross-section elevational split view of an RCD with an active seal shown in engaged mode with an inserted drill string on the left side of the vertical break line, and the active seal shown in unengaged mode on the right side of the break line, and upper and lower latch subassemblies shown in latched mode on the left side of the break line, and in unlatched mode on the right side of the break line, and two sensors positioned with each upper and lower latch indicator pins protruding or extending from the RCD.
Figure 39B:
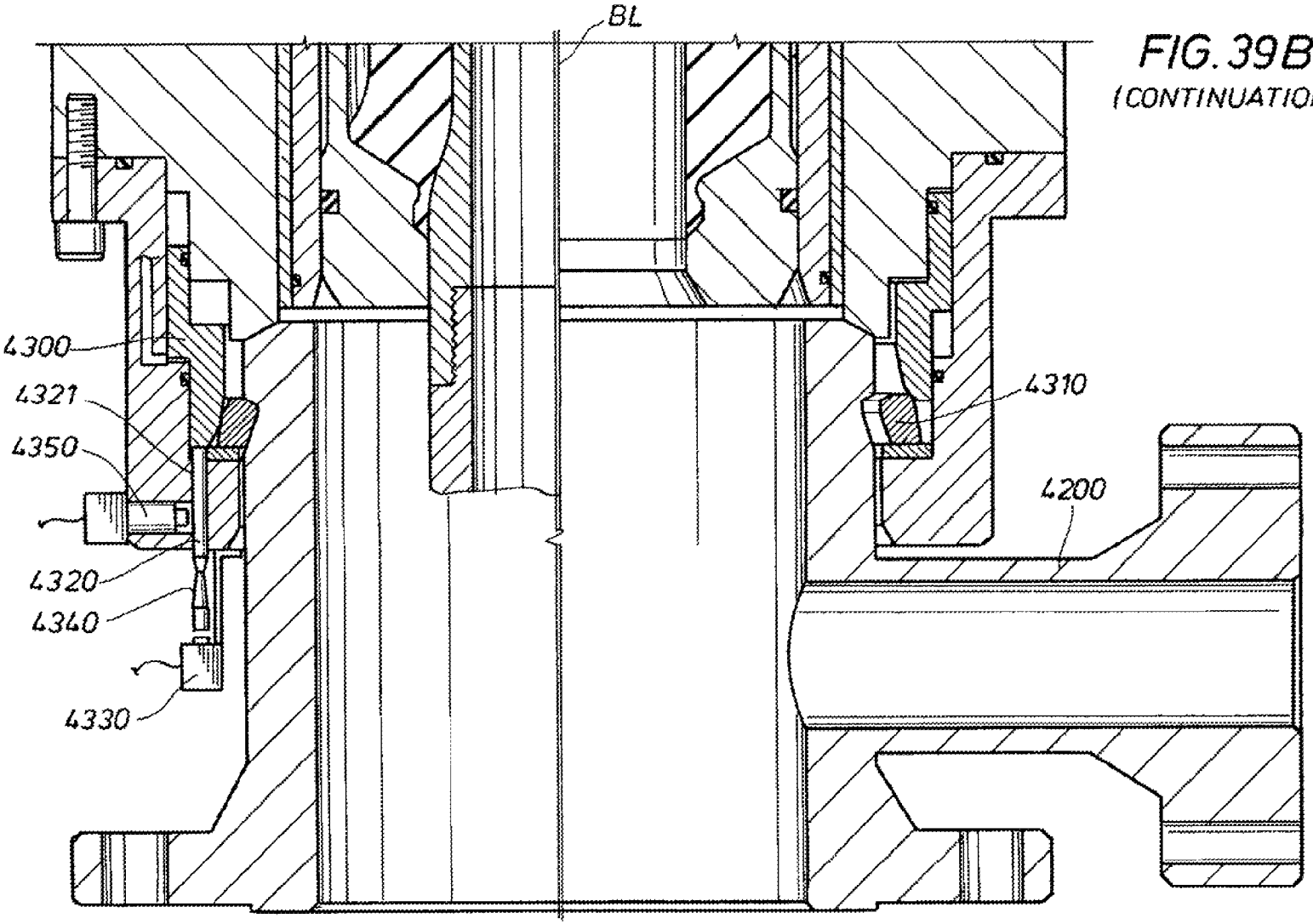

Turning to FIG. 39B, and viewing the left "latched" side of the vertical break line BL, RCD 4240 is shown latched to diverter housing 4200 with lower latch retainer member 4310. When lower hydraulic annular piston 4300 moves lower retainer member 4310 to its inward latched position, lower piston 4300 is latched. Active seal 4220 is engaged with drill string 4230. Packer 4210 supports seal 4220, and upper retainer member 4260 is latched with packer 4210. When upper hydraulic annular piston 4250 moves upper retainer member 4260 to it inward latched position, upper piston 4250 is latched. Bearings 4273 are positioned between annular outer bearing housing 4360 and annular inner bearing housing 4370.

Turning to the right "unlatched" side of the vertical break line BL, upper and lower retainer members (4260, 4310) are unlatched, and active seal 4220 is deflated or unengaged with drill string 4230. Upper and lower pistons (4250, 4300) are in their unlatched positions. As can now be understood, in the latched position shown on the left side of the break line BL, RCD 4240 is in operational mode, and active seal 4220 and inner bearing housing 4370 may rotate with drill string 4230. As shown on the right side when RCD 4240 is not in operational mode, packer 4210 may be removed for repair or replacement of seal 4220 while the bearing assembly with inner and outer bearing housings (4370, 4360) with bearings 4273 are left in place. Further, the RCD 4240 may be completely removed from diverter housing 4200 when lower retainer member 4310 is unlatched. As can now be understood, the positions of upper and lower pistons (4250, 4300) may be used to determine the positions of their respective retainer members (4260, 4310).

Upper piston indicator pin 4270 is attached with the top surface of upper piston 4250 and travels in channel 4271. It is contemplated that pin 4270 may either be releasably attached with piston 4250 or fabricated integral with it. When upper piston 4250 is in the latched position as shown on the left side of the break line BL, upper retainer member 4260 is in its inward latched position. Sensor 4280 is positioned axially in relation to upper pin 4270. Sensor 4280 is a non-contact type sensor, such as described above and below, that does not make physical contact with the top of pin 4270 when piston 4250 is in its latched position. Sensor 4280 also does not make contact with pin 4270 when upper piston 4250 is in its unlatched position, as the piston 4250 is shown on the right side of the break line BL. Sensor 4280 may be positioned in a transparent sealed housing 4281, so that the position of pin 4270 may also be monitored visually. However, it is also contemplated that there could be no housing 4281. The information from sensor 4280 may be remotely used to indirectly determine the position of retainer member 4260.

For redundancy, sensor 4290 is positioned laterally in relation to upper pin 4270. Pin 4270 has an inclined reduced diameter opposed conical surface 4272. Sensor 4290 may measure the distance from sensor 4290 to the target inclined surface 4272. Sensor 4290 is a non-contact line-of-sight sensor that is preferably an analog inductive sensor. The information from sensor 4290 may be remotely used to indirectly determine the position of retainer member 4260.

Lower piston indicator pin 4320 engages the bottom surface of lower piston 4300 and travels in channel 4321. It is contemplated that pin 4320 may be releasably attached or integral with piston 4300. When lower piston 4300 is in the latched position as shown on the left side of the vertical break line BL, lower retainer member 4310 is in its inward latched position. Sensor 4330 is positioned axially in relation to lower pin 4320. Sensor 4330 is a non-contact type sensor that does not make contact with pin 4320. Sensor 4330 may be positioned in a transparent housing so that the position of pin 4320 may also be monitored visually. The information from sensor 4330 may be remotely used to indirectly determine the position of lower retainer member 4310. For redundancy, sensor 4350 is positioned laterally in relation to lower pin 4320. Pin 4320 has an inclined reduced diameter opposed conical surface 4340. Sensor 4350 may measure the distance from sensor 4350 to the target inclined surface 4340. Sensor 4350 is a non-contact sensor that is preferably an analog inductive sensor. The information from sensor 4350 may be remotely used to indirectly determine the position of lower retainer member 4310.

FIGS. 39B1*a* shows the lower end of upper indicator pin 4270 of FIG. 39 threadedly and releasably attached with threads 4361 with upper piston 4250. Upper piston 4250 is in the unlatched position allowing the upper retainer member 4260 to move to the radially outward or unlatched position. Upper pin 4270 is retracted into RCD 4240 in this unlatched position. Even with upper pin 4270 in its retracted position, the upper end 4291 of pin 4270 is still shown visible but could be flush with the upper surface of channel 4271. It is contemplated that all or part of pin 4270 may be a color that is easily visible, such as red. As can now be understood, even without fluid measurement, the embodiment of FIGS. 39B1*a* and 39B1*b* allows for triple redundancy. It is contemplated that fewer or more sensors may also be used, and that different types of sensors may be used. FIG. 3981*b* is similar to FIG. 39B1*a* except upper piston 4250 is in the latched position, and upper retainer member 4260 is in the radially inward or latched position, resulting in the upper pin 4270 protruding further from the RCD 4240.

Figure 2B:
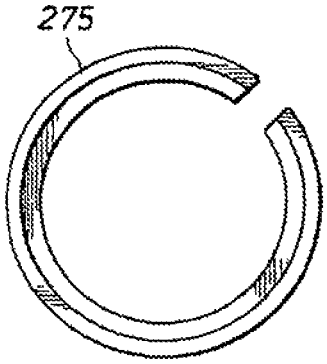
FIG. 2B is a plan view of a "C-shaped" retainer member.

Turning to FIG. 39B2*a*, lower piston 4300 is in the unlatched position, allowing the lower retainer member 4310 to move to the radially outward or unlatched position. The upper end of lower indicator pin 4400 is threadedly and releasably attached with threads 4301 to lower piston 4300. Other attachment means are contemplated. The sensor is a contact potentiometer type circuit, generally indicated as 4410A, shown in a transparent housing or cover 4410. It is contemplated that electric current may be run through circuit sensor 4410A that includes wire coiled end 4420 of lower pin 4400. FIG. 39B2*b* shows lower piston 4300 is in the latched position resulting in lower retainer member 4310 moving to the radially inward or latched position so that lower pin 4400 further protrudes or extends from RCD 4240. This information could be transmitted wireless or be hardwired to a remote location. As can now be understood, the electrical current information from circuit sensor 4410A may be remotely used to indirectly determine the position of lower retainer member 4310 from the position of lower piston 4300.

Turning to FIG. 3983*a*, transparent housing 4504 encloses the upper end 4291 of upper indicator pin 4270 allowing for visual monitoring by sensors or human eye. Multiple non-contact type sensors (4500, 4502) are mounted on the RCD 4240. It is contemplated that sensors (4500, 4502) may be optical type sensors, such as electric eye or laser. Other types of sensors are contemplated. It is further contemplated that the transparent housing or other cover could be sized to sealably enclose the desired multiple sensors, such as sensors 4500, 4502. When indicator pin 4270 is retracted as shown in FIG. 39B3*a*, lower sensor 4502 and upper sensor 4500 will generate different output signals than when pin 4270 protrudes as shown in FIG. 39B3*b*. Sensors (4500, 4502) may also be used to determine when piston 4250 is in an intermediate position between the first position and the second position. It is contemplated for all embodiments of the invention that any of the sensors shown in any of the Figures and embodiments may also detect movement as well as position. Having the two sensors (4500, 4502) also allows for redundancy if one of the two sensors (4500, 4502) fails. Sensor 4290 targets inclined reduced diameter opposed conical surface 4247 on pin 4270. As can now be understood, even without fluid measurement, FIGS. 39B3*b* provide for quadruple redundancy when human visual monitoring is included. Greater or lesser redundancy is contemplated. As can now be understood, sensors (4290, 4500, 4502) allow for remote indirect determination of the position of upper retainer member 4260 from the position of upper piston 4250.

Turning to FIG. 39B4*a*, upper indicator pin 4520 is retracted into the RCD 4240 as upper piston 4250 is in the unlatched position allowing the upper retainer member 4260 to move to the unlatched position. While end 4524 of upper pin 4520 is shown visible extending from its channel, it could be flush with or retracted within its channel top. Contact type sensor 4522 is mounted with bracket 4526 on RCD 4240. It is contemplated that a transparent housing may also be used to enclose sensor 4522 and pin end 4524. As shown in FIG. 39B4*b*, sensor 4522 makes contact with end 4524 of upper pin 4520 when upper piston 4250 is in the latched position. When upper piston 4250 is in the unlatched position, sensor 4522 does not make contact with pin 4520. Sensor 4522 may be an electrical, magnetic, or mechanical type sensor using a coil spring, although other types of sensors are contemplated. It is contemplated that a sensor that makes continuous contact with upper pin 4520 through the full travel of pin 4520 may also be used. The information from sensor 4522 may be used to remotely indirectly determine the position of upper retainer member 4260 from the position of upper piston 4250.

FIGS. 40-42 show different views of an exemplary latch position indicator sensor housing 3500 that is similar to the latch position indicator sensor housings (3092, 3170, 3194, 3250, 3380, 3390, 3394, 3450, 3470, 4028, 4044) shown in FIGS. 34-35, 35A, 36-39. As shown in FIG. 41, exemplary latch position indicator sensor housing 3500 may be mounted to a housing member 3520, which may be a latch assembly, such as latch assemblies (3020, 3100, 3270, 3300, 3400, 4000, 4100) shown in FIGS. 34, 35, 35A, 36, 37, 38, 39, and 39A or a housing section, such as housing sections (3110, 3200, 3320, 3420) shown in FIGS. 36, 37, 38 and 39. Although latch position indicator sensor housing 3500 is shown in FIGS. 40, 41 and 42 mounted with bolts 3510, other means of attachment are contemplated.

FIG. 41 shows an alternative embodiment piston 3602 without an inclining surface that may be used with any embodiment of the invention. It is contemplated that piston 3602 may be primarily one metal, such as steel, and that ring insert 3600 may be a different metal, such as copper or aluminum. Other metals for piston 3602 and ring insert 3600 are contemplated. When the distance from the latch position indicator sensor 3530 to the metal target is kept constant, the output from sensor 3530 will change when the target metal changes due to the difference in magnetic properties of the target. Therefore, the movement and/or position of piston 3602 may be obtained from sensor 3530. Latch position indicator sensor 3530 shown mounted with housing 3500 is similar to the sensors (3090, 3172, 3192, 3240, 3382, 3392, 3396, 3452, 3472, 4012, 4026, 4036, 4048, 4060, 4170) shown in FIGS. 34-35, 35A, 36-39 and 39A. Sensor 3530 of FIG. 41 is preferably an analog inductive sensor. It is understood that such a sensor may detect differences in permeability of the target material. For example, aluminum is non-magnetic and has a relatively low permeability, whereas mild steels are magnetic and typically have a relatively high permeability. Other types of sensors are also contemplated, which have been previously identified.

FIGS. 43-45 show the representative substantially linear correlation between the magnitude of the signal output from the latch position indicator sensor, preferably an analog inductive sensor, and the distance to the targeted surface, such as inclined surfaces (3052, 3342, 3362, 3442) on the respective pistons (3050, 3340, 3360, 3440) in FIGS. 34, 35, 38, and 39. As the target piston translates vertically, the distance to the target changes, thereby changing the sensor output signal. The analog sensor (3090, 3382, 3392, 3452) may be interrogated by a programmable logic controller (PLC), microprocessor, or CPU to determine the location of the respective piston (3050, 3360, 3340, 3440) within its travel range. Threshold values may be set, as shown in FIG. 44 as "First Condition" and "Second Condition," that may be required to be met to establish that the target, such as piston (3050, 3360, 3340, 3440), have moved to a first (latched) or second (unlatched) position.

Using the embodiments in FIGS. 34-35 as an example, FIG. 44 shows that if an output signal of 17 milli-Amperes (the "Second Condition") or higher is detected, then the distance from sensor 3090 to the target 3052 is 0.170 or higher, which correlates to the retainer member 3040 being closed (latched), as shown in FIG. 34. Therefore, the "Second Condition" is "Latch Closed." If an output signal of 7 milli-Amperes (the "First Condition") or lower is detected, then the distance from sensor 3090 to the target 3052 is 0.067 or lower, which correlates to the retainer member 3040 being open (unlatched), as shown in FIG. 35. Therefore, the "First Condition" is "Latch Open." As can now be understood, the information obtained from the movement of the piston 3050 may be used to indirectly determine the position of the retainer member 3040. The threshold values shown in FIG. 44 are exemplary, and other values are contemplated.

It is contemplated that rather than threshold values, a bandwidth of values may be used to determine the "First Condition" or the "Second Condition." As an example, in FIG. 44 a bandwidth for the "Second Condition" may be a sensor output of 13 milli-Amps to 17 milli-Amps, so that if the sensor output is in that range, then the Second Condition is considered to be met. Such ranges may take into account tolerances. The range may also vary depending upon the oilfield device that is inserted into the latch assembly. For example, the retainer member may be expected to move a larger distance to latch a protective sleeve than to latch a bearing assembly. It is contemplated that it may be remotely input into the PIC that a particular oilfield device, such as an RCD, is being inserted, and that the corresponding bandwidth will then be applied.

FIG. 44 may be used with any embodiment of the invention, although the values contained therein are exemplary only. Using the embodiment in FIG. 37 as an example, FIG. 44 shows that if an output signal of 17 milli-Amperes (the "Second Condition") or higher is detected, then the distance from sensor 3240 to the target 3230 is 0.170 or higher, which correlates to the retainer member 3230 being open (unlatched), as it is shown in FIG. 37. Therefore, the "First Condition" is "Latch Open." If an output signal of 7 milli-Amperes (the "First Condition") or lower is detected, then the distance from sensor 3240 to the target 3230 is 0.067 or lower, which correlates to the retainer member 3230 being closed (latched). Therefore, the "Second Condition" is "Latch Closed." As can now be understood, the information obtained from the sensor 3240 may be used to directly determine the position of the retainer member 3220. Again, the threshold values shown in FIG. 44 are exemplary, and other values are contemplated. Similar correlations may be used for the movement of the back-up piston, such as pistons (4072, 4120) in respective FIGS. 35A and 39A.

The PLC may also monitor the change of rate and/or output of the sensor (3090, 3382, 3392, 3452) signal output. The change of rate and/or output will establish whether the piston (3050, 3360, 3340, 3440) is moving. For example, if the piston (3050, 3360, 3340, 3440) is not moving, then the change of rate and/or output should be zero. It is contemplated that monitoring the change of rate and/or output of the sensor may be useful for diagnostics. For redundancy, any combination or permutations of the following three conditions may be required to be satisfied to establish if the latch has opened or closed: (1) the threshold value (or the bandwidth) must be met, (2) the piston must not be moving, and/or (3) the hydraulic system must have regained pressure. Also, as can now be understood, several different conditions may be monitored, yet there may be some inconsistency between them. For example, if the threshold value has been met and the piston is not moving, yet the hydraulic system has not regained pressure, it may indicate that the retainer member is latched, but that there is a leak in the hydraulic system. It is contemplated that the PLC may be programmed to make a determination of the latch position based upon different permutations or combinations of monitored values or conditions, and to indicate a problem such as leakage in the hydraulic system based upon the values or conditions. It is further contemplated for all embodiments that the information from the sensors may be transmitted to a remote offsite location, such as by satellite transmission. It is also contemplated that the sensor outputs may be transmitted remotely to a PLC at the well site. The information from the PLC may also be recorded, such as for diagnostics, on hard copy or electronically. This information may include, but is not limited to, pressures, temperatures, flows, volumes, and distances. For example, it may be helpful to determine whether the distance a retainer member has moved to latch an RCD has progressively changed over time, particularly in recent usages, which may signal a problem. It is further contemplated that this electronically recorded information could be manipulated to provide desired information of the operation of the well and sent hardwired or via satellite to remote locations such as a centralized worldwide location for a service provider and/or its customers/operators.

Method of Operation

For the single hydraulic latch assembly (210, 3020, 4000) and the first subassembly of the dual hydraulic latch assembly (300, 3100, 3300, 3400, 4100), the latch position indicator sensor may be calibrated during installation of the oilfield device into the latch assembly. The oilfield device may be inserted with the latch assembly open (unlatched). The latch position indicator sensor may be adjusted for the preferred sensor when the LED illuminates or a specific current output level is achieved, such as 7 milli-Amperes as shown in FIG. 44, or preferably 6.5 milli-Amperes. It is contemplated that no further calibration may be required. Threshold values may be set that must be met to indicate whether the latch assembly is latched or unlatched. For example, for the embodiments shown in FIGS. 34-35, if the sensor output is 17 milli-Amperes, then the "Second Condition" in FIG. 44 is that the latch assembly is closed. The analog sensor may be interrogated by a PLC to determine the location of the target within its travel range. The PLC may also monitor the change of rate and/or output of the sensor to determine if the target is moving. As discussed above, three conditions may be required for redundancy to determine whether the latch assembly is latched or unlatched. The threshold values may vary depending upon the oilfield device that is to be inserted. A cleaning system such as shown in FIG. 35A may be used to insure that debris does not interfere with the sensor performance.

As can now be understood, a latch position indicator system that uses a latch position indicator sensor to detect the position of the target piston or retainer member can be used in combination with, or mutually exclusive from, a system that measures one or more hydraulic fluid values and provides an indirect indication of the status of the latch. For example, if the piston that is being investigated is damaged or stuck, the indirect fluid measurement system may give an incorrect assessment of the latch position, such as a false positive. However, assuming that the piston is the target of the sensor, the latch position indicator system should accurately determine that the piston has not moved. Moreover, fluid metrics can be adversely affected by temperature, and specifically cold temperatures, leading to incorrect results. If desired, only one sensor is needed for the direct measurement system to determine if the oilfield device is latched, which eliminates wires and simplifies the PLC interface. While assembly, installation, and calibration may be made easier with a sensor, application will usually dictate the appropriate latch position indicator system to be used.

The latch position indicator measurement system using a sensor also allows for the measurement of motion, which provides for redundancy and increased safety. The latch position indicator system minimizes the affects of mechanical tolerance errors on detection of piston position. The latch position indicator system can insure that the piston or retainer member travels a minimum amount, and/or can detect that the piston or retainer member movement did not exceed a maximum amount. The latch position indicator system may be used to detect that certain oilfield devices were moved, or parts were replaced, such as replacement of bearings, installation of a test plug, or installation of wear bushings. This may be helpful for diagnostics. The retainer member may move a different amount to latch or unlatch an RCD than it moves to latch or unlatch another oilfield device having a different size or configuration. Blocking shoulders slots such as blocking shoulders slots (4008, 4116) shown is respective FIGS. 35A and 39A allow the retainer member to move a limited distance or until engaged with the oilfield device. The distance that the retainer member moves may also be monitored to insure that it is latching with the appropriate receiving location on the oilfield device, such as latching formations (4006, 4104) in respective FIGS. 35A and 39A. For example, if retainer member 4004 shown in FIG. 35A were to move a greater distance than anticipated to mate with latching formation 4006 or override with the blocking shoulders not yet engaged, then it may indicate that the RCD 4002 is not properly seated in the latch assembly 4000, and that retainer member 4004 has not latched in the correct location on the RCD 4002. For example, if the RCD 4002 has not been properly seated, such as when the lower reduced diameter portion of RCD 4002 is adjacent to retainer member 4004, then the retainer member 4004 will move to an override position.

It should be understood that the latch position indicator system using a sensor is contemplated for use either individually or in combination with an indirect measurement system such as a hydraulic measurement system. While the latch position indicator system with the latch position indicator sensor may be the primary system for detecting position, a system that measures one or more hydraulic fluid values and provides an indirect indication of the status of the latch may be used for a redundant system. Further, the latch position indicator system with the sensor may be used to calibrate the hydraulic measurement system to insure greater accuracy and confidence in the system. The backup hydraulic measurement system may then be more accurately relied upon should the latch position indicator system with the sensor malfunction. It is contemplated that the two systems in combination may also assist in leak detection of the hydraulic system of the latch assembly. For example, if the latch position indicator system with the sensor indicates that the retainer member has moved to the latched position, but the hydraulic measurement system shows that a greater amount of fluid flow than normal was required to move the retainer member, then there may be a leak in the hydraulic system. Redundant sensors may be used to insure greater accuracy of the sensors, and signal when one of the sensors may begin to malfunction.

The foregoing disclosure and description of the invention are illustrative and explanatory thereof, and various changes in the details of the illustrated apparatus and construction and the method of operation may be made without departing from the spirit of the invention.

We claim:

1. An apparatus, comprising:

a housing;

an oilfield device configured to be received with the housing;

a latch assembly positioned with the housing, comprising:

a retainer member configured to be movable between an unlatched position and a latched position; and a non-contact latch position indicator sensor positioned with the latch assembly and configured to transmit a signal of the position of the retainer member.

2. The apparatus of claim 1, wherein the latch position indicator sensor comprises:

a first sensor means for indicating the position of the retainer member.

3. The apparatus of claim 2, further comprising:

a second sensor means for indicating the position of the retainer member.

4. The apparatus of claim 2, wherein the first sensor means directly measures the position of the retainer member.

5. The apparatus of claim 1, further comprising:

a first fluid means for indicating the position of the retainer member.

6. The apparatus of claim 1, wherein the oilfield device is a rotatable control device having an inner member configured to be rotatable relative to an outer member, one of the members having a seal.

7. The apparatus of claim 1, wherein the latch position indicator sensor directly measures the position of the retainer member.

8. The apparatus of claim 7, wherein the oilfield device is a rotatable control device having an inner member configured to be rotatable relative to an outer member, one of the members having a seal.

9. The apparatus of claim 1, wherein the latch position indicator sensor indirectly measures the position of the retainer member.

10. The apparatus of claim 1, wherein the latch assembly is configured to be remotely actuatable to latch the oilfield device with the housing, and wherein the latch position indicator sensor is configured to transmit a signal indicating that the retainer member is in the latched position.

11. A system for determining whether an oilfield device is latched with a housing, comprising:

a latch assembly positioned with the housing and configured to be latchable with the oilfield device, comprising:

a retainer member configured to be movable between an unlatched position and a latched position; and a piston configured to move the retainer member to the latched position and the piston configured to allow the retainer member to move to the unlatched position; and a latch position indicator sensor positioned with the latch assembly and configured to transmit a signal of the position of the retainer member.

12. The system of claim 11, wherein the piston having an inclined surface, and the latch position indicator sensor is configured to determine the movement of the piston by measuring the distance from the sensor to the piston inclined surface.

13. The system of claim 11, wherein the latch position indicator sensor is an inductive sensor.

14. The system of claim 11, wherein the latch position indicator sensor is configured to determine the position of the retainer member by measuring the distance from the sensor to the retainer member.

15. The system of claim 14, wherein the latch position indicator sensor is an inductive sensor.

16. An apparatus, comprising:

a latch assembly housing;

an oilfield device configured to be received with the latch assembly housing;

a latch assembly positioned within the latch assembly housing, comprising:

a retainer member configured to be movable between an unlatched position and a latched position; and a non-contact latch position indicator sensor positioned with the latch assembly and configured to transmit a signal of the position of the retainer member.

17. The apparatus of claim 16, wherein the sensor directly measures the position of the retainer member.

18. The apparatus of claim 16, wherein the sensor is attached with the latch assembly housing.

19. The apparatus of claim 16, further comprising a line, wherein the signal is transmitted through said line to a remote location.

20. The system of claim 16, wherein the retainer member having an inclined surface, and the latch position indicator sensor is configured to determine the position of the retainer member by measuring the distance from the sensor to the retainer member.

21. A system for determining whether an oilfield device is latched with a latch assembly housing, comprising:

a latch assembly disposed within the latch assembly housing and configured to be latchable with the oilfield device, comprising:

a retainer member configured to be movable between an unlatched position and a latched position; and a piston configured to move the retainer member to the latched position and the piston configured to allow the retainer member to move to the unlatched position; and a latch position indicator sensor positioned with the latch assembly and configured to transmit a signal of the position of the retainer member.

22. The system of claim 21, wherein the piston having an inclined surface, and the latch position indicator sensor is configured to determine the movement of the piston by measuring the distance from the sensor to the piston inclined surface.

23. The system of claim 21, wherein the latch position indicator sensor is an inductive sensor.

24. An apparatus, comprising:

a housing;

an oilfield device configured to be received with the housing;

a latch assembly disposed within the housing, comprising:

a retainer member configured to be movable between an unlatched position and a latched position; and a first non-contact latch position indicator sensor means for indicating the position of the retainer member and configured to transmit a signal of the position of the retainer member.

25. The apparatus of claim 24, further comprising:

a second sensor means for indicating the position of the retainer member.

26. The apparatus of claim 25, wherein the second sensor means indirectly measures the position of the retainer member.

27. The apparatus of claim 24, wherein the first sensor means directly measures the position of the retainer member.

28. A system for determining whether an oilfield device is latched with a housing, comprising:

a latch assembly disposed within the housing and configured to be latchable with the oilfield device, comprising:

a retainer member configured to be movable between an unlatched position and a latched position; and a piston configured to move the retainer member to the latched position and the piston configured to allow the retainer member to move to the unlatched position; and a latch position indicator sensor means for indicating the position of the retainer member and configured to transmit a signal of the position of the retainer member.

29. The system of claim 28, wherein the latch assembly having an inclined surface, and the latch position indicator sensor means is configured to determine the movement of the retainer member by measuring the distance from the sensor to the latch assembly inclined surface.

30. A system for determining whether an oilfield device is latched with a latch assembly housing, comprising:

a latch assembly disposed within the latch assembly housing and configured to be latchable with the oilfield device, comprising:

a retainer member configured to be movable between an unlatched position and a latched position; and a piston configured to move the retainer member to the latched position and the piston configured to allow the retainer member to move to the unlatched position; and a non-contact latch position indicator sensor positioned with the latch assembly.

* * * * *